US007314693B2

(12) United States Patent
Ikegami et al.

(10) Patent No.: US 7,314,693 B2
(45) Date of Patent: Jan. 1, 2008

(54) ELECTROPHOTOGRAPHIC PHOTOCONDUCTOR, ELECTROPHOTOGRAPHIC PROCESS, ELECTROPHOTOGRAPHIC APPARATUS, AND PROCESS CARTRIDGE

(75) Inventors: Takaaki Ikegami, Shizuoka (JP); Shinji Nohsho, Shizuoka (JP); Eiji Kurimoto, Shizuoka (JP); Hidetoshi Kami, Shizuoka (JP); Akihiro Sugino, Shizuoka (JP); Yasuyuki Yamashita, Shizuoka (JP); Hideo Nakamori, Shizuoka (JP); Takeshi Takada, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 317 days.

(21) Appl. No.: 10/938,585

(22) Filed: Sep. 13, 2004

(65) Prior Publication Data

US 2005/0118518 A1 Jun. 2, 2005

(30) Foreign Application Priority Data

| | | |
|---|---|---|
| Sep. 11, 2003 | (JP) | 2003-319362 |
| Sep. 12, 2003 | (JP) | 2003-321814 |
| Sep. 19, 2003 | (JP) | 2003-328177 |
| Dec. 18, 2003 | (JP) | 2003-421103 |
| Jul. 20, 2004 | (JP) | 2004-211846 |

(51) Int. Cl.
*G03G 5/047* (2006.01)

(52) U.S. Cl. ..... 430/58.75; 430/58.85; 430/66; 399/159

(58) Field of Classification Search ..... 430/58.75, 430/66, 970, 58.85; 399/159
See application file for complete search history.

(56) References Cited

U.S. PATENT DOCUMENTS

| | | | |
|---|---|---|---|
| 4,957,839 | A | 9/1990 | Rokutanzono et al. |
| 5,008,172 | A | 4/1991 | Rokutanzono et al. |
| 5,147,751 | A | 9/1992 | Kojima et al. |
| 5,342,718 | A | 8/1994 | Nousho et al. |
| 5,578,405 | A | 11/1996 | Ikegami et al. |
| 5,702,855 | A | 12/1997 | Ikegami et al. |
| 5,871,876 | A | 2/1999 | Ikuno et al. |
| 5,991,573 | A | 11/1999 | Nohsho et al. |
| 6,030,733 | A | 2/2000 | Kami et al. |
| 6,030,736 | A | 2/2000 | Ikegami et al. |
| 6,151,468 | A | 11/2000 | Kami et al. |
| 6,326,112 | B1 | 12/2001 | Tamura et al. |
| 6,432,596 | B2 | 8/2002 | Ikuno et al. |
| 6,573,016 | B2 | 6/2003 | Kami et al. |
| 6,618,565 | B2 | 9/2003 | Tamiya et al. |
| 6,641,964 | B2 | 11/2003 | Ikuno et al. |
| 6,653,033 | B1 | 11/2003 | Kami et al. |
| 6,741,821 | B2 | 5/2004 | Sugino et al. |
| 2003/0134209 | A1* | 7/2003 | Itami ..... 430/58.2 |
| 2003/0194627 | A1* | 10/2003 | Ikegami et al. ..... 430/58.65 |

FOREIGN PATENT DOCUMENTS

| | | |
|---|---|---|
| EP | 1 291 723 | 3/2003 |
| JP | 62-272282 | 11/1987 |
| JP | 2-55364 | 2/1990 |
| JP | 2-189550 | 7/1990 |
| JP | 6-332219 | 12/1994 |
| JP | 2003-66641 | 3/2003 |

OTHER PUBLICATIONS

U.S. Appl. No. 11/500,352, filed Aug. 8, 2006, Toshine, et al.
U.S. Appl. No. 11/505,860, filed Aug. 18, 2006, Orito, et al.
U.S. Appl. No. 11/519,098, filed Sep. 12, 2006, Toda, et al.
U.S. Appl. No. 11/487,573, filed Jul. 17, 2006, Nakamori.
U.S. Appl. No. 11/403,012, filed Apr. 13, 2006, Toda.
U.S. Appl. No. 11/366,469, filed Mar. 3, 2006, Sugino, et al.
U.S. Appl. No. 11/317,302, filed Dec. 27, 2005, Takada, et al.
U.S. Appl. No. 11/224,984, filed Sep. 14, 2005, Nousho, et al.
U.S. Appl. No. 10/900,204, filed Jul. 28, 2004, Kami, et al.
U.S. Appl. No. 10/893,302, filed Jul. 19, 2004, Sugino, et al.
U.S. Appl. No. 10/784,872, filed Feb. 24, 2004, Shimada, et al.
U.S. Appl. No. 10/804,084, filed Mar. 19, 2004, Takada, et al.
U.S. Appl. No. 10/803,256, filed Mar. 19, 2004, Kami.
U.S. Appl. No. 10/787,299, filed Feb. 27, 2004, Nagame, et al.
U.S. Appl. No. 10/792,607, filed Mar. 4, 2004, Ikegami, et al.
U.S. Appl. No. 10/647,346, filed Aug. 26, 2003, Suzuki, et al.
U.S. Appl. No. 10/674,358, filed Oct. 1, 2003, Sugiyama, et al.
U.S. Appl. No. 10/706,113, filed Nov. 13, 2003, Tanaka, et al.
U.S. Appl. No. 10/667,410, filed Sep. 23, 2003, Ikegami, et al.

(Continued)

*Primary Examiner*—John L Goodrow
(74) *Attorney, Agent, or Firm*—Oblon, Spivak, McClelland, Maier & Neustadt, P.C.

(57) ABSTRACT

The present invention relates to an electrophotographic photoconductor comprising a photoconductive layer, a protective layer, and a conductive support, wherein the protective layer is disposed as the outermost layer of the photoconductive layer, and 20% by volume to 60% by volume of fine particles of fluorine-contained resin and at least one compound selected from amine aromatic compounds and hydroxy aromatic compounds are incorporated into the protective layer.

According to the present invention, high durability may be achieved, image degradation such as lags may be controlled from the increase of residual potential and decrease of charging, and high quality images may be formed stably even after the prolonged and repeated usage.

The present invention also relates to an electrophotographic process, an electrophotographic apparatus and a process cartridge for the electrophotographic apparatus which utilize the electrophotographic photoconductor respectively.

22 Claims, 4 Drawing Sheets

OTHER PUBLICATIONS

U.S. Appl. No. 10/703,447, filed Nov. 10, 2003, Yoshiyuki, et al.
U.S. Appl. No. 10/660,620, filed Sep. 12, 2003, Murakami, et al.
U.S. Appl. No. 10/652,505, filed Sep. 2, 2003, Murakami, et al.
U.S. Appl. No. 10/665,825, filed Sep. 22, 2003, Yoshizawa, et al.
U.S. Appl. No. 10/628,532, filed Jul. 29, 2003, Kurimoto, et al.
U.S. Appl. No. 10/384,701, filed Mar. 11, 2003, Nohsho, et al.
U.S. Appl. No. 10/315,935, filed Dec. 11, 2002, Kurimoto, et al.
U.S. Appl. No. 10/384,662, filed Mar. 11, 2003, Kawasaki et al.
U.S. Appl. No. 10/235,961, filed Sep. 6, 2002, Tamoto, et al.
U.S. Appl. No. 10/282,039, filed Oct. 29, 2002, Ogiyama et al.
U.S. Appl. No. 10/180,316, filed Jun. 27, 2002, Suzuki, et al.
U.S. Appl. No. 10/151,109, filed May 21, 2002, Kabata, et al.
U.S. Appl. No. 10/135,548, filed May 1, 2002, Tamoto, et al.
U.S. Appl. No. 10/614,828, filed Jul. 9, 2003, Tamiya, et al.
U.S. Appl. No. 10/193,219, filed Jul. 12, 2002, Takahashi, et al.
U.S. Appl. No. 10/103,791, filed Mar. 25, 2002, Suzuki, et al.
U.S. Appl. No. 10/090,745, filed Mar. 6, 2002, Suzuki, et al.
U.S. Appl. No. 10/104,078, filed Mar. 25, 2002, Ikegami, et al.
U.S. Appl. No. 10/625,570, filed Jul. 24, 2003, Tamoto, et al.
U.S. Appl. No. 10/625,408, filed Jul. 23, 2003, Tamoto, et al.
U.S. Appl. No. 09/985,347, filed Nov. 2, 2001, Tamoto et al.
U.S. Appl. No. 10/638,637, filed Aug. 12, 2003, Ikuno, et al.
U.S. Appl. No. 08/862,260, filed May 23, 1997, Kishida, et al.
U.S. Appl. No. 07/459,348, filed Dec. 29, 1989, Unknown.
U.S. Appl. No. 07/198,865, filed May 26, 1988, Nagame, et al.

* cited by examiner

ELECTROPHOTOGRAPHIC PHOTOCONDUCTOR, ELECTROPHOTOGRAPHIC PROCESS, ELECTROPHOTOGRAPHIC APPARATUS, AND PROCESS CARTRIDGE

BACKGROUND OF THE INVENTION

1. Field of the Invention

The present invention relates to an electrophotographic photoconductor with high durability and high image quality. The present invention also relates to an electrophotographic process, an electrophotographic apparatus and a process cartridge for the electrophotographic apparatus which utilize the electrophotographic photoconductor respectively.

2. Description of the Related Art

In recent years, information processing systems have achieved remarkable advance along with the progress of the related apparatuses employing electrophotography. In particular, laser printers and digital copiers have significantly enhanced the printing quality and reliability in which the image recordings of them are conducted based on lights through transferring information into digital signals. In addition, the information processing systems have been applied progressively to laser printers and digital copiers capable of full-color printing in combination with the advanced high-speed technology. Therefore, the compatibility of high image quality and high durability has been demanded for photoconductor performance in particular.

The photoconductors utilized for the electrophotographic laser printers and digital copiers are generally base on organic photosensitive material from the viewpoint of lower cost, higher productivity, and less environmental pollution. Examples of the organic electrophotographic photoconductor include the type of photoconductive resin such as polyvinyl carbazol (PVK), the type of charge-transferring complex such as PVK-TNF (2,4,7-trinitrofluorenone), the type of pigment dispersion such as phthalocyanine binder, and the type of discrete function that combines charge-generating material with charge-transporting substance.

The mechanism of latent electrostatic-image formation in the discrete function type of photoconductor is as follows: the photoconductor is charged and irradiated with light, the light passes through a charge-transporting layer, and is absorbed by a charge-generating substance in the charge-generating layer to generate a charge; the charge thus generated is implanted into the charge-transporting layer at the interface of the charge-generating layer and charge-transporting layer, moves through the charge-transporting layer due to the electric field, and forms the latent electrostatic image by neutralizing the surface charge on the photoconductor.

However, when such organic photoconductors are utilized repeatedly, film scrapings tend to occur; when the film scrapings of the photoconducting layer come to significant, the charging potential of the photoconductor is likely to decrease, the photosensitivity tends to be deteriorated, the background smear comes to apparent due to such flaws on the photoconductor surface, and lower image density and inferior image quality tend to be seriously promoted; as such, the lower wear resistance of the photoconductor has been a serious problem in the art. Furthermore, higher durability of the photoconductor has been demanded more importantly, along with higher speed of electrophotographic apparatuses or smaller size of photoconductors, in recent years.

On the other hand, smaller and spherical toners are recently interested in the market associated with the requirement of higher image quality. However, the smaller and spherical toners have cause such a problem as lower cleaning ability due to the inherently higher mobility, inducing image degradation in terms of the toner filming or fusion, which is a serious problem to be solved.

In order to solve such problems, Japanese Patent Application Laid-Open (JP-A) No. 05-45920 and No. 2000-19918 disclose the addition of fine particles of fluorine-contained resin into the surface layer of photoconductor as a lubricant so as to promote separation at the surface. These proposals are effective by virtue of the decreased friction coefficient initially; however, the cleaning system and the toner should be controlled severely, and the reliability of surface separation is not sufficient under the repeated usage against the degradation or fluctuation of the related parts associated with the prolonged life of the photoconductor.

Further, JP-A No. 8-160648 discloses that the inclusion of polytetrafluoroethylene powder into the surface layer of photoconductor and incorporation of specific charge-transporting substances having a specific structural formula may lead to a photoconductor having high durability against surface abrasion due to wear and tear and may provide an electrophotographic photoconductor having high durability without image blurs, along with superior cleaning ability and without the toner adhesion on the photoconductor surface layer. However, since a large amount of fine particles of the fluorine-contained resin is employed, the compounds exemplified in the application cannot be expected to obtain sufficient effects. Furthermore, the redox potentials are likely to be lower and variable spontaneously, to form electric traps, and to cause the increase of residual potential.

SUMMARY OF THE INVENTION

The object of the present invention is to provide photoconductors, in which high durability may be achieved, image degradation such as lags may be controlled from the increase of residual potential and decrease of charging, and high quality images may be formed stably even after the prolonged and repeated usage. Furthermore, the object of the present invention is to provide an electrophotographic process, electrophotographic apparatus, and process cartridge for electrophotography, in which the replacements of the photoconductors may be remarkably reduced by virtue of the employment of the inventive photoconductors, the miniaturization of the apparatus may be achieved, and high quality images may be formed stably even after the prolonged and repeated usage.

The object is attained by the electrophotographic photoconductor according to the present invention which comprises a photoconductive layer, a protective layer, and a conductive support, wherein the protective layer is disposed as the outermost layer of the photoconductive layer, and 20% by volume to 60% by volume of fine particles of fluorine-contained resin and at least one compound selected from amine aromatic compounds and hydroxy aromatic compounds are incorporated into the protective layer.

Preferably the amine aromatic compounds are the compounds expressed by the general formulas (1) to (22), and (25) to (28):

General Formula (1)

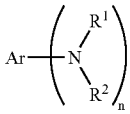

in the general formula (1), $R^1$ and $R^2$ are each an alkyl group having 1 to 4 carbon atoms, may be unsubstituted or substituted by an aromatic hydrocarbon group, and may be identical or different; or $R^1$ and $R^2$ may combine each other to form a heterocyclic ring group containing a nitrogen atom; n is an integer of 1 to 4; Ar is a substituted or unsubstituted aromatic ring group;

General Formula (2)

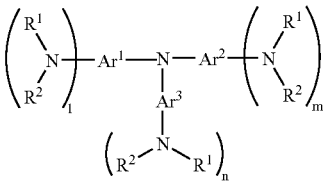

in the general formula (2), $R^1$ and $R^2$ are each an alkyl group having 1 to 4 carbon atoms, may be unsubstituted or substituted by an aromatic hydrocarbon group, and may be identical or different; or $R^1$ and $R^2$ may combine each other to form a heterocyclic ring group containing a nitrogen atom; l, m, n are each an integer of 0 to 3, wherein all of l, m, n being not 0 together with; $Ar^1$, $Ar^2$, and $Ar^3$ are each a substituted or unsubstituted aromatic ring group and may be identical or different; the respective $Ar^1$ and $Ar^2$, $Ar^2$ and $Ar^3$, $Ar^3$ and $Ar^1$ may combine each other to form a heterocyclic ring group containing a nitrogen atom;

General Fomula (3)

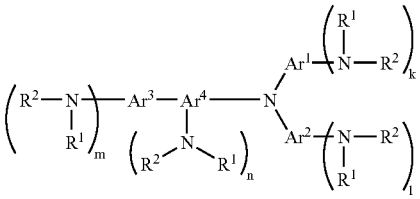

in the general formula (3), $R^1$ and $R^2$ are each an alkyl group having 1 to 4 carbon atoms, may be unsubstituted or substituted by an aromatic hydrocarbon group, and may be identical or different; or $R^1$ and $R^2$ may combine each other to form a heterocyclic ring group containing a nitrogen atom; k, l, m, n are each an integer of 0 to 3, wherein all of k, l, m, n being not 0 together with; $Ar^1$, $Ar^2$, $Ar^3$ and $Ar^4$ are each a substituted or unsubstituted aromatic ring group and may be identical or different; the respective $Ar^1$ and $Ar^2$, $Ar^1$ and $Ar^4$, $Ar^3$ and $Ar^4$ may combine each other to form a ring;

General Formula (4)

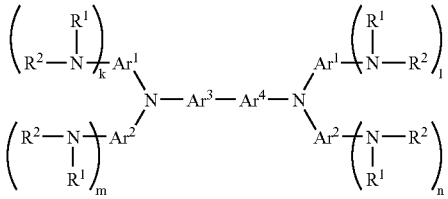

in the general formula (4), $R^1$ and $R^2$ are each an alkyl group having 1 to 4 carbon atoms, may be unsubstituted or substituted by an aromatic hydrocarbon group, and may be identical or different; or $R^1$ and $R^2$ may combine each other to form a heterocyclic ring group containing a nitrogen atom; k, l, m, n are each an integer of 0 to 3, wherein all of k, l, m, n being not 0 together with; $Ar^1$, $Ar^2$, $Ar^3$ and $Ar^4$ are each a substituted or unsubstituted aromatic ring group and may be identical or different; the respective $Ar^1$ and $Ar^2$, $Ar^1$ and $Ar^3$, $Ar^3$ and $Ar^4$ may combine each other to form a ring;

General Formula (5)

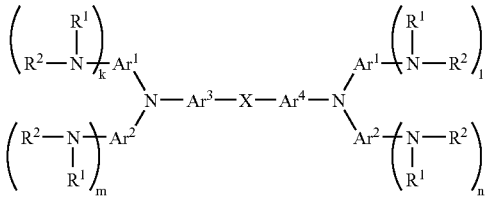

in the general formula (5), $R^1$ and $R^2$ are each an alkyl group having 1 to 4 carbon atoms, may be unsubstituted or substituted by an aromatic hydrocarbon group, and may be identical or different; or $R^1$ and $R^2$ may combine each other to form a heterocyclic ring group containing a nitrogen atom; k, l, m, n are each an integer of 0 to 3, wherein all of k, l, m, n being not 0 together with; $Ar^1$, $Ar^2$, $Ar^3$ and $Ar^4$ are each a substituted or unsubstituted aromatic ring group and may be identical or different; the respective $Ar^1$ and $Ar^2$, $Ar^1$ and $Ar^3$, $Ar^1$ and $Ar^4$ may combine each other to form a ring; X is one of divalent group or atom of methylene group, cyclohexylidene group, oxygen and sulfur;

General Formula (6)

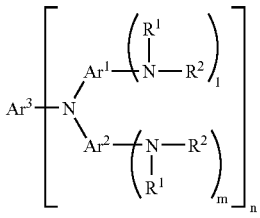

in the general formula (6), $R^1$ and $R^2$ are each an alkyl group having 1 to 4 carbon atoms, may be unsubstituted or substituted by an aromatic hydrocarbon group, and may be identical or different; or $R^1$ and $R^2$ may combine each other to form a heterocyclic ring group containing a nitrogen atom; l and m are each an integer of 0 to 3, wherein both of l and m being not 0 together with; $Ar^1$, $Ar^2$, and $Ar^3$ are each a substituted or unsubstituted aromatic ring group and may be identical or different; the respective $Ar^1$ and $Ar^2$, $Ar^1$ and $Ar^3$ may combine each other to form a ring; n is an integer of 1 to 4;

General Formula (7)

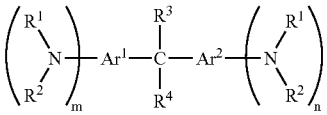

in the general formula (7), $R^1$ and $R^2$ are each an alkyl group having 1 to 4 carbon atoms, may be unsubstituted or substituted by an aromatic hydrocarbon group, and may be identical or different; or $R^1$ and $R^2$ may combine each other to form a heterocyclic ring group containing a nitrogen atom; m and n are each an integer of 0 to 3, wherein both of m and n being not 0 together with; $R^3$ and $R^4$ are each a hydrogen atom, substituted or unsubstituted alkyl group having 1 to 11 carbon atoms, substituted or unsubstituted aromatic ring group or heterocyclic ring group, and may be identical or different; $Ar^1$ and $Ar^2$ are each a substituted or unsubstituted aromatic ring group and may be identical or different; at least one of $Ar^1$, $Ar^2$, $R^3$ and $R^4$ is an aromatic ring group or heterocyclic ring group;

General Formula (8)

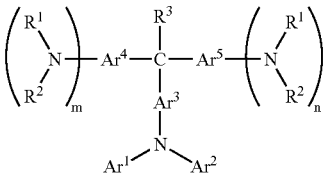

in the general formula (8), $R^1$ and $R^2$ are each an alkyl group having 1 to 4 carbon atoms, may be unsubstituted or substituted by an aromatic hydrocarbon group, and may be identical or different; or $R^1$ and $R^2$ may combine each other to form a heterocyclic ring group containing a nitrogen atom; m and n are each an integer of 0 to 3, wherein both of m and n being not 0 together with; $R^3$ is a hydrogen atom, substituted or unsubstituted alkyl group having 1 to 11 carbon atoms, or substituted or unsubstituted aromatic ring group; $Ar^1$, $Ar^2$, $Ar^3$, $Ar^4$ and $Ar^5$ are each a substituted or unsubstituted aromatic ring group and may be identical or different; the respective $Ar^1$ and $Ar^2$, $Ar^1$ and $Ar^3$ may combine each other to form a heterocyclic ring containing a nitrogen atom;

General Formula (9)

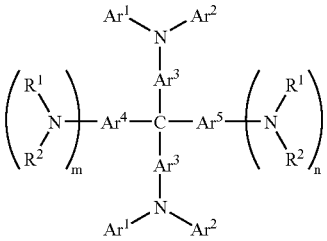

in the general formula (9), $R^1$ and $R^2$ are each an alkyl group having 1 to 4 carbon atoms, may be unsubstituted or substituted by an aromatic hydrocarbon group, and may be identical or different; or $R^1$ and $R^2$ may combine each other to form a heterocyclic ring group containing a nitrogen atom; m and n are each an integer of 0 to 3, wherein both of m and n being not 0 together with; $Ar^1$, $Ar^2$, $Ar^3$, $Ar^4$ and $Ar^5$ are each a substituted or unsubstituted aromatic ring group and may be identical or different; the respective $Ar^1$ and $Ar^2$, $Ar^1$ and $Ar^3$ may combine each other to form a heterocyclic ring containing a nitrogen atom;

General Formula (10)

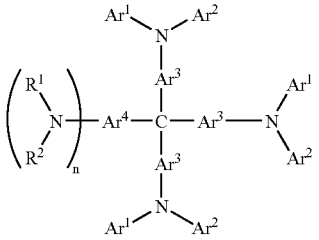

in the general formula (10), $R^1$ and $R^2$ are each an alkyl group having 1 to 4 carbon atoms, may be unsubstituted or substituted by an aromatic hydrocarbon group, and may be identical or different; or $R^1$ and $R^2$ may combine each other to form a heterocyclic ring group containing a nitrogen atom; n is an integer of 1 to 3; $Ar^1$, $Ar^2$, $Ar^3$ and $Ar^4$ are each a substituted or unsubstituted aromatic ring group and may be identical or different; the respective $Ar^1$ and $Ar^2$, $Ar^1$ and $Ar^3$ may combine each other to form a heterocyclic ring containing a nitrogen atom;

General Formula (11)

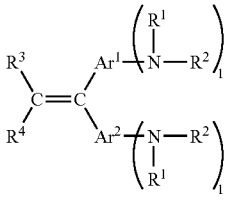

in the general formula (11), $R^1$ and $R^2$ are each an alkyl group having 1 to 4 carbon atoms, may be unsubstituted or substituted by an aromatic hydrocarbon group, and may be identical or different; or $R^1$ and $R^2$ may combine each other to form a heterocyclic ring group containing a nitrogen atom; l is an integer of 1 to 3; $Ar^1$ and $Ar^2$ are each a substituted or unsubstituted aromatic ring group and may be identical or different; $R^3$ and $R^4$ are each a hydrogen atom, unsubstituted or substituted alkyl group having 1 to 4 carbon atoms, unsubstituted or substituted aromatic ring group, or the group expressed by the following general formula (23), General Formula (23)

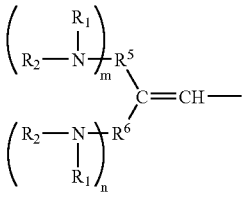

in the general formula (23), $R^1$ and $R^2$ are each an alkyl group having 1 to 4 carbon atoms, may be unsubstituted or substituted by an aromatic hydrocarbon group, and may be identical or different; or $R^1$ and $R^2$ may combine each other to form a heterocyclic ring group containing a nitrogen atom; m and n are each an integer of 0 to 3; $R^5$ and $R^6$ are each a hydrogen atom, unsubstituted or substituted alkyl or alkylene group having 1 to 4 carbon atoms, or unsubstituted or substituted aromatic ring group, and may be identical or different; the respective $R^3$ and $R^4$, $R^5$ and $R^6$, $Ar^1$ and $Ar^2$ may combine each other to form a ring;

General Formula (12)

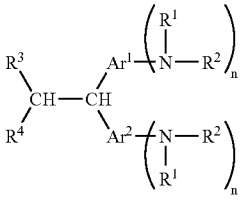

in the general formula (12), $R^1$ and $R^2$ are each an alkyl group having 1 to 4 carbon atoms, may be unsubstituted or substituted by an aromatic hydrocarbon group, and may be identical or different; or $R^1$ and $R^2$ may combine each other to form a heterocyclic ring group containing a nitrogen atom; n is an integer of 1 to 3; $Ar^1$ and $Ar^2$ are each a substituted or unsubstituted aromatic ring group and may be identical or different; $R^3$ and $R^4$ are each a hydrogen atom, unsubstituted or substituted alkyl group having 1 to 4 carbon atoms, unsubstituted or substituted aromatic ring group, or the group expressed by the following general formula (24), and may be identical or different, wherein $R^3$ and $R^4$ are not each a hydrogen atom together with; the respective $R^3$, $R^4$, $Ar^1$, and $Ar^2$ may combine each other to form a ring;

General Formula (24)

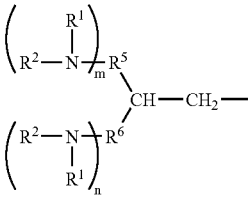

in the general formula (24), $R^1$ and $R^2$ are each an alkyl group having 1 to 4 carbon atoms, may be unsubstituted or substituted by an aromatic hydrocarbon group, and may be identical or different; or $R^1$ and $R^2$ may combine each other to form a heterocyclic ring group containing a nitrogen atom; m and n are each an integer of 0 to 3; $R^5$ and $R^6$ are each a hydrogen atom, substituted or unsubstituted alkyl or alkylene group having 1 to 4 carbon atoms, or substituted or unsubstituted aromatic ring group, and may be identical or different, the respective $R^5$ and $R^6$ may combine each other to form a rin;

General Formula (13)

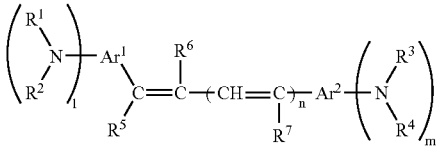

in the general formula (13), $R^1$ and $R^2$ are each an alkyl group having 1 to 4 carbon atoms, may be unsubstituted or substituted by an aromatic hydrocarbon group, and may be identical or different; or $R^1$ and $R^2$ may combine each other to form a heterocyclic ring group containing a nitrogen atom; $R^3$ and $R^4$ are each a substituted or unsubstituted alkyl group having 1 to 4 carbon atoms or a substituted or unsubstituted aromatic ring group, and may be identical or different; $R^5$, $R^6$ and $R^7$ are each a hydrogen atom, substituted or unsubstituted alkyl group having 1 to 4 carbon atoms, or substituted or unsubstituted aromatic ring group, and may be identical or different; the respective $R^3$ and $R^4$, $Ar^2$ and $R^4$ may combine each other to form a ring containing a nitrogen atom; $Ar^1$ and $R^5$ may combine each other to form a ring; l is an integer of 1 to 3, m is an integer of 0 to 3, n is an integer of 0 or 1;

General Formula (14)

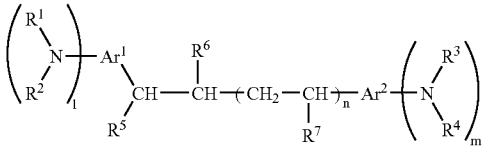

in the general formula (14), $R^1$ and $R^2$ are each an alkyl group having 1 to 4 carbon atoms, may be unsubstituted or substituted by an aromatic hydrocarbon group, and may be identical or different; or $R^1$ and $R^2$ may combine each other to form a heterocyclic ring group containing a nitrogen atom; $R^3$ and $R^4$ are each a substituted or unsubstituted alkyl group having 1 to 4 carbon atoms or a substituted or unsubstituted aromatic ring group, and may be identical or different; $R^5$, $R^6$ and $R^7$ are each a hydrogen atom, substituted or unsubstituted alkyl group having 1 to 4 carbon atoms, or substituted or unsubstituted aromatic ring group; $Ar^1$ and $Ar^2$ are each a substituted or unsubstituted aromatic ring group, and may be identical or different; the respective $R^3$ and $R^4$, $Ar^2$ and $R^4$ may combine each other to form a ring containing a nitrogen atom; $Ar^1$ and $R^5$ may combine each other to form a ring; l is an integer of 1 to 3, m is an integer of 0 to 3, n is an integer of 0 or 1;

General Formula (15)

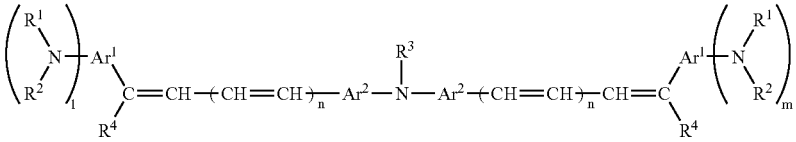

in the general formula (15), $R^1$ and $R^2$ are each an alkyl group having 1 to 4 carbon atoms, may be unsubstituted or substituted by an aromatic hydrocarbon group, and may be identical or different; or $R^1$ and $R^2$ may combine each other to form a heterocyclic ring group containing a nitrogen atom; l and m are each an integer of 0 to 3, wherein both of l and m being not 0 together with; $R^3$ is a substituted or unsubstituted alkyl group having 1 to 4 carbon atoms or a substituted or unsubstituted aromatic ring group; $R^4$ is a hydrogen atom, a substituted or unsubstituted alkyl group having 1 to 4 carbon atoms, or a substituted or unsubstituted aromatic ring group; $Ar^1$ and $Ar^2$ are each a substituted or unsubstituted aromatic ring group; the respective $Ar^1$ and $R^4$, $Ar^2$ and $R^3$, $Ar^2$ and $Ar^2$ may combine each other to form a ring; n is an integer of 0 or 1;

General Formula (16)

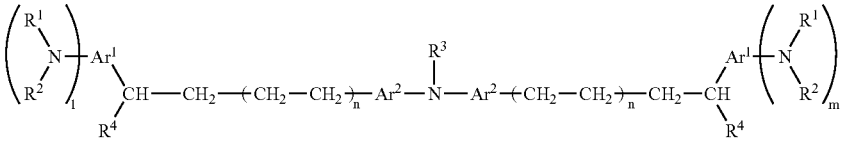

in the general formula (16), $R^1$ and $R^2$ are each an alkyl group having 1 to 4 carbon atoms, may be unsubstituted or substituted by an aromatic hydrocarbon group, and may be identical or different; or $R^1$ and $R^2$ may combine each other to form a heterocyclic ring group containing a nitrogen atom; l and m are each an integer of 0 to 3, wherein both of l and m being not 0 together with; $R^3$ is a substituted or unsubstituted alkyl group having 1 to 4 carbon atoms or a substituted or unsubstituted aromatic ring group; $R^4$ is a hydrogen atom, a substituted or unsubstituted alkyl group having 1 to 4 carbon atoms, or a substituted or unsubstituted aromatic ring group; $Ar^1$ and $Ar^2$ are each a substituted or unsubstituted aromatic ring group; the respective $Ar^1$ and $R^4$, $Ar^2$ and $R^3$, $Ar^2$ and $Ar^2$ may combine each other to form a ring; n is an integer of 0 or 1;

General Formula (17)

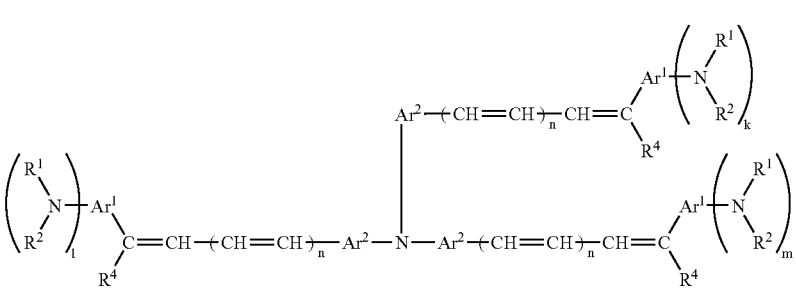

in the general formula (17), $R^1$ and $R^2$ are each an alkyl group having 1 to 4 carbon atoms, may be unsubstituted or substituted by an aromatic hydrocarbon group, and may be identical or different; or $R^1$ and $R^2$ may combine each other to form a heterocyclic ring group containing a nitrogen atom; k, l, m are each an integer of 0 to 3, wherein all of k, l, m being not 0 together with; $R^4$ is a hydrogen atom, a substituted or unsubstituted alkyl group having 1 to 4 carbon atoms, or a substituted or unsubstituted aromatic ring group; $Ar^1$ and $Ar^2$ are each a substituted or unsubstituted aromatic ring group; the respective $Ar^1$ and $R^4$, $Ar^2$ and $Ar^2$ may combine each other to form a ring; n is an integer of 0 or 1;

in the general formula (19), $R^1$ and $R^2$ are each an alkyl group having 1 to 4 carbon atoms, may be unsubstituted or substituted by an aromatic hydrocarbon group, and may be identical or different; or $R^1$ and $R^2$ may combine each other to form a heterocyclic ring group containing a nitrogen atom; $R^3$ and $R^4$ are each a substituted or unsubstituted alkyl group having 1 to 4 carbon atoms or a substituted or unsubstituted aromatic ring group, and may be identical or General Formula (18)

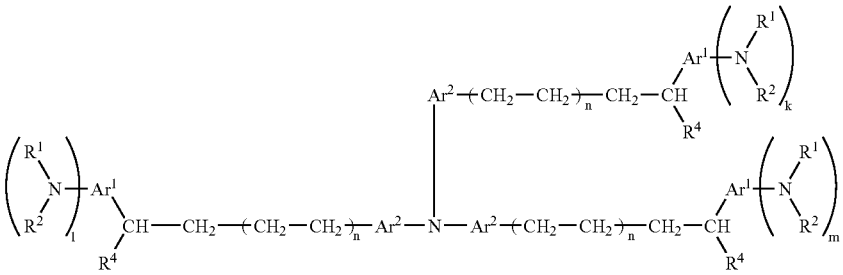

in the general formula (18), $R^1$ and $R^2$ are each an alkyl group having 1 to 4 carbon atoms, may be unsubstituted or substituted by an aromatic hydrocarbon group, and may be identical or different; or $R^1$ and $R^2$ may combine each other to form a heterocyclic ring group containing a nitrogen atom; k, l, m are each an integer of 0 to 3, wherein all of k, l, m being not 0 together with; $R^4$ is a hydrogen atom, a substituted or unsubstituted alkyl group having 1 to 4 carbon atoms, or a substituted or unsubstituted aromatic ring group; $Ar^1$ and $Ar^2$ are each a substituted or unsubstituted aromatic ring group; the respective $Ar^1$ and $R^4$, $Ar^2$ and $Ar^2$ may combine each other to form a ring; n is an integer of 0 or 1;

different; $R^5$ is a hydrogen atom, a substituted or unsubstituted alkyl group having 1 to 4 carbon atoms, or a substituted or unsubstituted aromatic ring group; $Ar^1$ and $Ar^2$ are each a substituted or unsubstituted aromatic ring group; the respective $R^3$ and $R^4$, $Ar^1$ and $R^4$ may combine each other to form a heterocyclic ring group containing a nitrogen atom; k, l, m are each an integer of 0 to 3, n is an integer of 1 or 2; when all of k, l, m are 0 together with, $R^3$ and $R^4$ are each an alkyl group having 1 to 4 carbon atoms, and may be identical or different, and $R^3$ and $R^4$ may combine each other to form a heterocyclic ring containing a nitrogen atom;

General Formula (19)

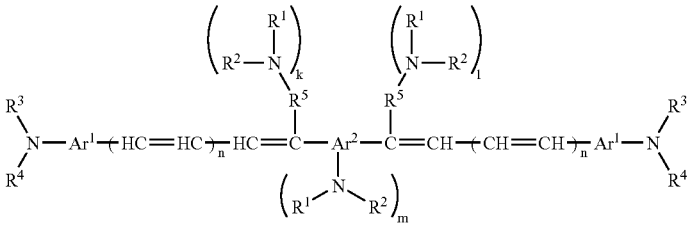

General Formula (20)

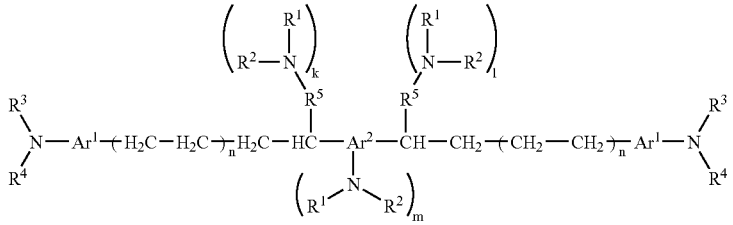

in the general formula (20), $R^1$ and $R^2$ are each an alkyl group having 1 to 4 carbon atoms, may be unsubstituted or substituted by an aromatic hydrocarbon group, and may be identical or different; or $R^1$ and $R^2$ may combine each other to form a heterocyclic ring group containing a nitrogen atom; $R^3$ and $R^4$ are each a substituted or unsubstituted alkyl group having 1 to 4 carbon atoms or a substituted or unsubstituted aromatic ring group, and may be identical or different; $R^5$ is a hydrogen atom, a substituted or unsubstituted alkyl group having 1 to 4 carbon atoms, or a substituted or unsubstituted aromatic ring group; $Ar^1$ and $Ar^2$ are each a substituted or unsubstituted aromatic ring group; the respective $R^3$ and $R^4$, $Ar^1$ and $R^4$ may combine each other to form a heterocyclic ring group containing a nitrogen atom; m is an integer of 0 to 4, n is an integer of 1 or 2; when m is 0, $R^3$ and $R^4$ are each an alkyl group having 1 to 4 carbon atoms, and may be identical or different, and $R^3$ and $R^4$ may combine each other to form a heterocyclic ring containing a nitrogen atom;

General Formula (21)

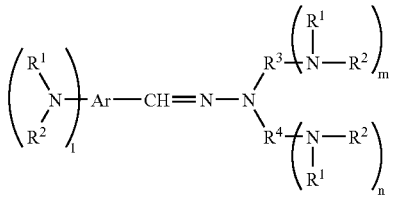

in the general formula (21), $R^1$ and $R^2$ are each an alkyl group having 1 to 4 carbon atoms, may be unsubstituted or substituted by an aromatic hydrocarbon group, and may be identical or different; or $R^1$ and $R^2$ may combine each other to form a heterocyclic ring group containing a nitrogen atom; Ar is a substituted or unsubstituted aromatic ring group; $R^3$ and $R^4$ are each a hydrogen atom, a substituted or unsubstituted alkyl or alkylene group having 1 to 4 carbon atoms, or a substituted or unsubstituted aromatic ring group; l, m, n are each an integer of 0 to 3, wherein all of l, m, n are not 0 together with;

General Formula (22)

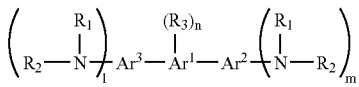

in the general formula (22), $R^1$ and $R^2$ are each an alkyl group having 1 to 4 carbon atoms, may be unsubstituted or substituted by an aromatic hydrocarbon group, and may be identical or different; or $R^1$ and $R^2$ may combine each other to form a heterocyclic ring group containing a nitrogen atom; $Ar^1$ is a substituted or unsubstituted aromatic ring group or heterocyclic ring group; $Ar^2$ and $Ar^3$ are each a substituted or unsubstituted aromatic ring group; $R^3$ is a hydrogen atom, a substituted or unsubstituted alkyl having 1 to 4 carbon atoms, or a substituted or unsubstituted aromatic ring group; l, m are each an integer of 0 to 3, wherein both of l and m are not 0 together with; n is an integer of 1 to 3;

General Formula (25)

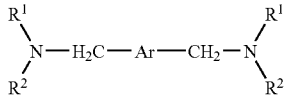

in the general formula (25), $R^1$ and $R^2$ are each a substituted or unsubstituted alkyl group, or a substituted or unsubstituted aromatic hydrocarbon group, may be identical or different, wherein at least one of is $R^1$ and $R^2$ is a substituted or unsubstituted aromatic hydrocarbon group; $R^1$ and $R^2$ may combine each other to form a substituted or unsubstituted heterocyclic ring group containing a nitrogen atom; Ar is substituted or unsubstituted aromatic hydrocarbon group;

General Formula (26)

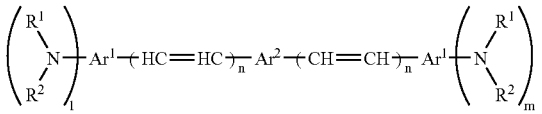

in the general formula (26), $R^1$ and $R^2$ are each an alkyl group having 1 to 4 carbon atoms, may be substituted by an aromatic hydrocarbon group, and may be identical or different; $R^1$ and $R^2$ may combine each other to form a heterocyclic ring group containing a nitrogen atom; $Ar^1$ and $Ar^2$ are each a substituted or unsubstituted aromatic ring group; l and m are each an integer of 0 to 3, wherein both of l and m are not 0 together with; n is an integer of 1 or 2;

General Formula (27)

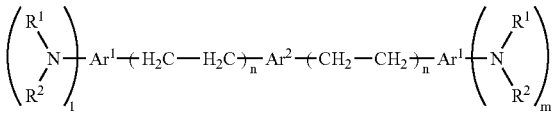

in the general formula (27), $R^1$ and $R^2$ are each an alkyl group having 1 to 4 carbon atoms, may be substituted by an aromatic hydrocarbon group, and may be identical or different; $R^1$ and $R^2$ may combine each other to form a substituted or unsubstituted heterocyclic ring group containing a nitrogen atom; $Ar^1$ and $Ar^2$ are each a substituted or unsubstituted aromatic ring group; l and m are each an integer of 0 to 3, wherein both of l and m are not 0 together with; n is an integer of 1 or 2;

General Formula (28)

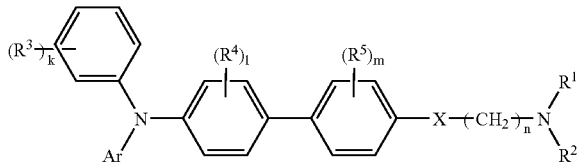

in the general formula (28), $R^1$ and $R^2$ are each a substituted or unsubstituted alkyl group, or a substituted or unsubstituted aromatic hydrocarbon group, may be identical or different; or $R^1$ and $R^2$ may combine each other to form a substituted or unsubstituted heterocyclic ring group containing a nitrogen atom; $R^3$, $R^4$, and $R^5$ are each a substituted or unsubstituted alkyl group, alkoxy group, or halogen atom; Ar is substituted or unsubstituted aromatic hydrocarbon group, or aromatic heterocyclic ring group; X is an oxygen atom, sulfur atom, or bond thereof; n is an integer of 2 to 4, k, l, m are each an integer of 0 to 3.

Also, the hydroxy aromatic compounds are preferably the compounds expressed by the general formulas (101) to (112):

General Formula (101)

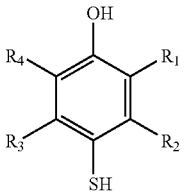

in the general formula (101), $R^1$, $R^2$, $R^3$ and $R^4$ are each a hydrogen atom, halogen atom, hydroxy group, substituted or unsubstituted alkyl group, substituted or unsubstituted alkenyl group, substituted or unsubstituted aryl group, substituted or unsubstituted cycloalkyl group, substituted or unsubstituted alkoxy group, substituted or unsubstituted aryloxy group, substituted or unsubstituted alkylthio group, substituted or unsubstituted arylthio group, substituted amino group, imino group, heterocyclic group, sulfoxide group, sulfonyl group, acyl group, or azo group;

General Formula (102)

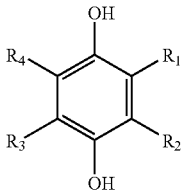

in the general formula (102), $R^1$, $R^2$, $R^3$ and $R^4$ are each a hydrogen atom, halogen atom, substituted or unsubstituted alkyl group, substituted or unsubstituted alkenyl group, substituted or unsubstituted cycloalkyl group, substituted or unsubstituted alkoxy group, substituted or unsubstituted aryloxy group, alkylthio group, arylthio group, alkylamino group, arylamino group, acyl group, alkylacylamino group, arylacylamino group, alkylcarbamoyl group, arylcarbamoyl group, alkylsulfonamido group, arylsulfonamido group, alkylsulfamoyl group, arylsulfamoyl group, alkylsulfonyl group, arylsulfonyl group, alkyloxycarbonyl group, aryloxycarbonyl group, alkylacyloxy group, arylacyloxy group, silyl group, or heterocyclic group, wherein at least one of $R^1$, $R^2$, $R^3$ and $R^4$ is a group having 4 or more carbon atoms in total;

General Formula (103)

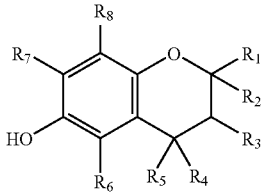

in the general formula (103), $R^1$, $R^2$, $R^3$, $R^4$, $R^5$, $R^6$, $R^7$ and $R^8$ are each a hydrogen atom, hydroxy group, halogen atom, substituted or unsubstituted alkyl group, substituted or unsubstituted alkenyl group, substituted or unsubstituted aryl group, substituted or unsubstituted cycloalkyl group, substituted or unsubstituted alkoxy group, substituted or unsubstituted aryloxy group, substituted or unsubstituted amino group, substituted or unsubstituted imino group, substituted or unsubstituted heterocyclic ring group, substituted or unsubstituted alkylthio group, substituted or unsubstituted arylthio group, substituted or unsubstituted acyl group, substituted or unsubstituted sulfonyl group, substituted or unsubstituted phosphonyl group, or substituted or unsubstituted carbamoyl group;

General Formula (104)

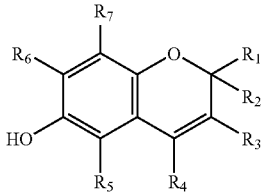

in the general formula (104), $R^1$, $R^2$, $R^3$, $R^4$, $R^5$, $R^6$ and $R^7$ are each a hydrogen atom, hydroxy group, halogen atom, substituted or unsubstituted alkyl group, substituted or unsubstituted alkenyl group, substituted or unsubstituted aryl group, substituted or unsubstituted cycloalkyl group, substituted or unsubstituted alkoxy group, substituted or unsubstituted aryloxy group, substituted or unsubstituted amino group, substituted or unsubstituted imino group, substituted or unsubstituted heterocyclic ring group, substituted or unsubstituted alkylthio group, substituted or unsubstituted arylthio group, substituted or unsubstituted acyl group, substituted or unsubstituted sulfonyl group, substituted or unsubstituted phosphonyl group, or substituted or unsubstituted carbamoyl group;

General Formula (105)

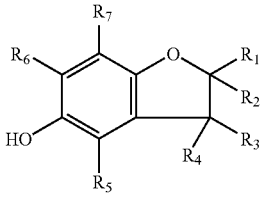

in the general formula (105), $R^1$, $R^2$, $R^3$, $R^4$, $R^5$, $R^6$, and $R^7$ are each a hydrogen atom, hydroxy group, halogen atom, substituted or unsubstituted alkyl group, substituted or unsubstituted alkenyl group, substituted or unsubstituted aryl group, substituted or unsubstituted cycloalkyl group, substituted or unsubstituted alkoxy group, substituted or unsubstituted aryloxy group, substituted or unsubstituted amino group, substituted or unsubstituted imino group, substituted or unsubstituted heterocyclic ring group, substituted or unsubstituted alkylthio group, substituted or unsubstituted arylthio group, substituted or unsubstituted acyl group, substituted or unsubstituted sulfonyl group, substituted or unsubstituted phosphonyl group, or substituted or unsubstituted carbamoyl group;

General Formula (106)

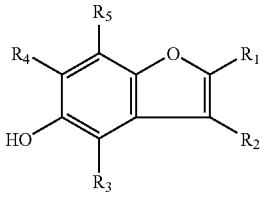

in the general formula (106), $R^1$, $R^2$, $R^3$, $R^4$ and $R^5$ are each a hydrogen atom, hydroxy group, halogen atom, substituted or unsubstituted alkyl group, substituted or unsubstituted alkenyl group, substituted or unsubstituted aryl group, substituted or unsubstituted cycloalkyl group, substituted or unsubstituted alkoxy group, substituted or unsubstituted aryloxy group, substituted or unsubstituted amino group, substituted or unsubstituted imino group, substituted or unsubstituted heterocyclic ring group, substituted or unsubstituted alkylthio group, substituted or unsubstituted arylthio group, substituted or unsubstituted acyl group, substituted or unsubstituted sulfonyl group, substituted or unsubstituted phosphonyl group, or substituted or unsubstituted carbamoyl group;

General Formula (107)

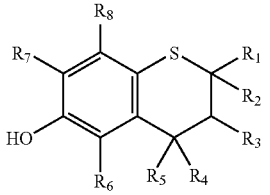

in the general formula (107), $R^1$, $R^2$, $R^3$, $R^4$, $R^5$, $R^6$, $R^7$ and $R^8$ are each a hydrogen atom, hydroxy group, halogen atom, substituted or unsubstituted alkyl group, substituted or unsubstituted alkenyl group, substituted or unsubstituted aryl group, substituted or unsubstituted cycloalkyl group, substituted or unsubstituted alkoxy group, substituted or unsubstituted aryloxy group, substituted amino group, imino group, heterocyclic ring group, substituted or unsubstituted alkylthio group or arylthio group, acyl group, sulfonyl group, phosphonyl group, or carbamoyl group;

General Formula (108)

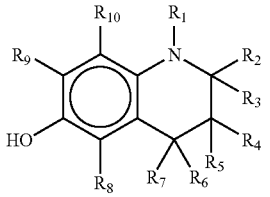

General Formula (109)

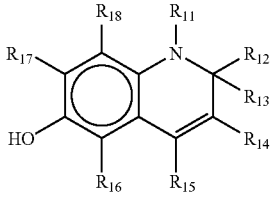

in the general formulas (108) and (109), $R^1$, $R^2$, $R^3$, $R^4$, $R^5$, $R^6$, $R^7$, $R^8$ $R^9$ and $R^{10}$, and $R^{11}$, $R^{12}$, $R^{13}$, $R^{14}$, $R^{15}$, $R^{16}$, $R^{17}$ and $R^{18}$ are each a hydrogen atom, halogen atom, hydroxy group, substituted or unsubstituted alkyl group, substituted or unsubstituted alkenyl group, substituted or unsubstituted aryl group, substituted or unsubstituted cycloalkyl group, substituted or unsubstituted alkoxy group, substituted or unsubstituted aryloxy group, substituted amino group, imino group, heterocyclic ring group, substituted or unsubstituted alkylthio group or arylthio group, sulfoxide group, sulfonyl group, acyl group, or azo group;

General Formula (110)

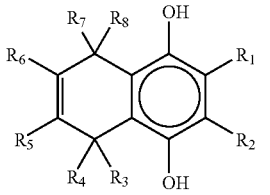

-continued

General Formula (111)

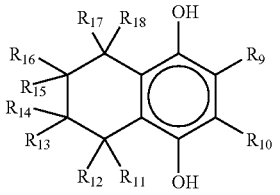

in the general formulas (110) and (111), $R^1$, $R^2$, $R^3$, $R^4$, $R^5$, $R^6$, $R^7$ and $R^8$, and $R^9$, $R^{10}$, $R^{11}$, $R^{12}$, $R^{13}$, $R^{14}$, $R^{15}$, $R^{16}$, $R^{17}$ and $R^{18}$ are each a hydrogen atom, halogen atom, hydroxy group, substituted or unsubstituted alkyl group, substituted or unsubstituted alkenyl group, substituted or unsubstituted aryl group, substituted or unsubstituted cycloalkyl group, substituted or unsubstituted alkoxy group, substituted or unsubstituted aryloxy group, substituted amino group, imino group, heterocyclic ring group, substituted or unsubstituted alkylthio group or arylthio group, sulfoxide group, sulfonyl group, acyl group, or azo group;

General Formula (112)

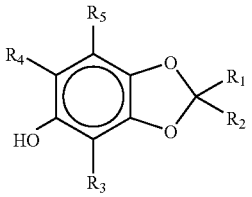

in the general formula (112), $R^1$, $R^2$, $R^3$, $R^4$ and $R^5$ are each a hydrogen atom, halogen atom, hydroxy group, substituted or unsubstituted alkyl group, substituted or unsubstituted alkenyl group, substituted or unsubstituted aryl group, substituted or unsubstituted cycloalkyl group, substituted or unsubstituted alkoxy group, substituted or unsubstituted aryloxy group, substituted amino group, imino group, heterocyclic ring group, substituted or unsubstituted alkylthio group or arylthio group, sulfoxide group, sulfonyl group, acyl group, or azo group.

DESCRIPTION OF THE PREFERRED EMBODIMENTS

Figure 1:
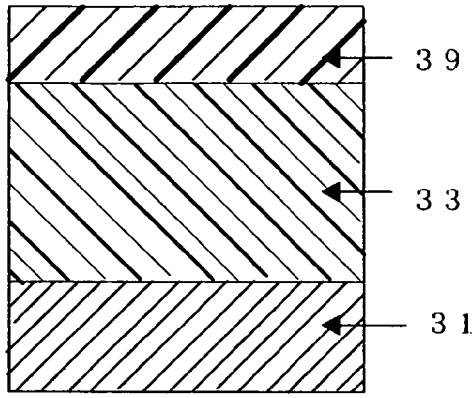
FIG. 1 schematically shows an exemplary layer construction of the photoconductor according to the present invention.

The present invention will be explained in detail hereinafter.

It is known that the incorporation of fine particles of fluorine-contained resin into the outermost surface layer of the photoconductor is effective in order to achieve higher durability and lower skin-friction coefficient of electrophotographic photoconductors. However, 20% or more by volume of fine particles of fluorine-contained resin is required in order to maintain the higher durability and lower skin-friction coefficient. When a large amount of fine particles of fluorine-contained resin is incorporated to form a layer, the fine particles hardly disperse in the configuration of individually divided particles; a considerable amount of particles exist as secondary agglomerated particles or secondary particles in the resultant layer. Should the size of the secondary particles come to considerable, secondary particles induce the roughened surface, resulting in poor cleaning ability and inferior toner images. Further, since laser radiation is scattered on the agglomerated particles, extraordinary images are derived due to the disturbed exposed latent images or insufficient contrast of potential.

On the other hand, when the fine particles of fluorine-contained resin disperse into the configuration of individually divided particles, these undesirable matters disappear; however, the exposed surface of the fine particles on the layer is relatively small, therefore, the contacting area between the toner and the fine particles is relatively small, resulting in lower effect on lowering the skin-friction coefficient of the photoconductors.

We now have found, after vigorous investigations and numerous experiments, that the fine particles of fluorine-contained resin should exist suitably in local areas in a range as well as cover suitably the photoconductor surface in light of the cleaning ability for toner. Namely, the condition is most preferable that the fine particles of fluorine-contained resin having 0.3 to 4 μm of secondary particle diameter cover the area of the photoconductor in the range of 10 to 60%, that is, the covering ratio of the fine particles of fluorine-contained resin is 10 to 60% over the photoconductor surface.

However, the photoconductor containing the secondary particles of fluorine-contained resin in the higher amount may cause such a problem as memory effect or lag due to decreased charging ability depending on the employed condition, is likely to absorb acidic gases such as NOx, may decrease the electric resistance at the outermost surface, and may cause such a problem as image deletion.

In still further investigations, we have found that the inclusion of a specific compound selected from the compounds expressed by the general formulas (1) to (22), (25) to (28), and (101) to (112) may solve the problems such as the above described memory effect and the absorption of acidic gases. Although not wishing to limit the present invention to any one theory, the reason is considered that the configuration containing the secondary particles of fluorine-contained resin in the higher amount may efficiently suppress the formation of radical substances that tends to accumulate inside a non-uniformity particulate structure. Further, it is considered that the amino group or hydroxy group in the compounds may efficiently suppress the formation of radical substances under the existence of the acidic gases, or the charge-transporting performance of these compounds may inhibit the charge trapping by the fluorine-contained resin at the site of inside the secondary agglomeration.

The compounds expressed by the general formulas (1) to (22) will be explained at first.

Examples of the alkyl group in the general formulas are methyl, ethyl, propyl, butyl, hexyl and undecyl. Examples of cyclic aromatic groups are monovalent-hexavalent aromatic hydrocarbon groups having an aromatic hydrocarbon ring, such as benzene, naphthalene, anthracene and pyrene, and monovalent-hexavalent heterocyclic groups having a heterocyclic aromatic ring such as pyridine, quinoline, thiophene, furan, oxazole, oxadiazole and carbazole. Examples of substituents thereof are the alkyl groups given in the aforesaid examples, alkoxy groups such as is methoxy, ethoxy, propoxy and butoxy, halogen atoms such as fluorine, chlorine, bromine and iodine, and aromatic rings. Examples of heterocyclic groups wherein $R^1$ and $R^2$ are bonded together comprising a nitrogen atom, are pyrrolidinyl, piperidinyl and pyrolinyl. Other examples of heterocyclic groups all comprising a nitrogen atom are aromatic heterocyclic groups such as N-methyl carbazole, N-ethyl carbazole, N-phenyl carbazole, indole, and quinoline.

Preferred examples of the general formulas (1) to (22) are given below. The present invention is not limited to these compounds.

| No. | Exemplified Compounds |
|---|---|
| A-1-1 | 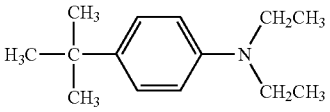 |
| A-1-2 | 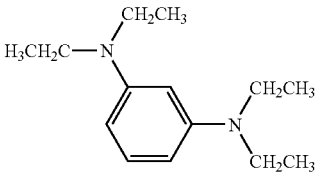 |
| A-1-3 | 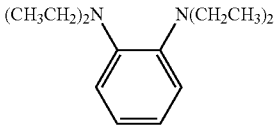 |
| A-1-4 | 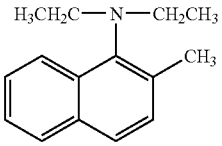 |
| A-1-5 | 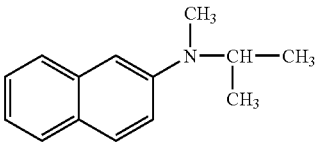 |
| A-1-6 | 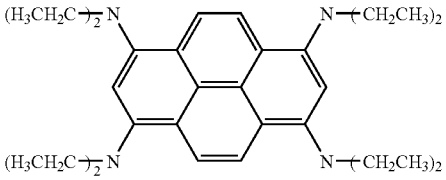 |
| A-1-7 | 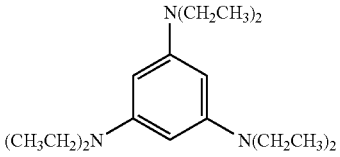 |

-continued
| No. | Exemplified Compounds |
|---|---|
| A-1-8 | 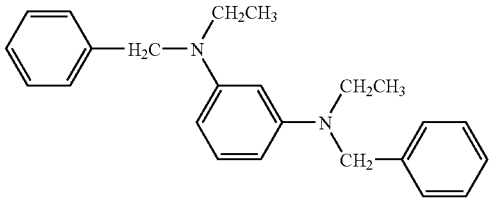 |
| A-1-9 | 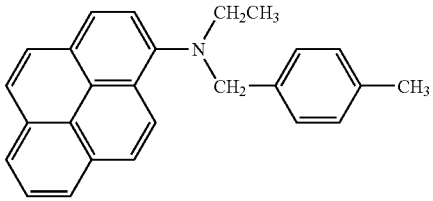 |
| A-2-1 | 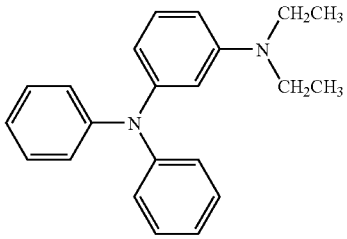 |
| A-2-2 | 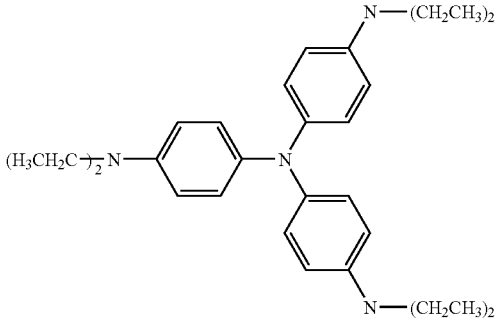 |
| A-2-3 | 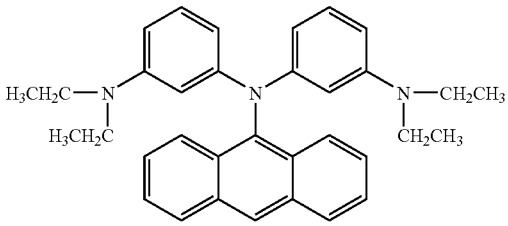 |
| A-2-4 | 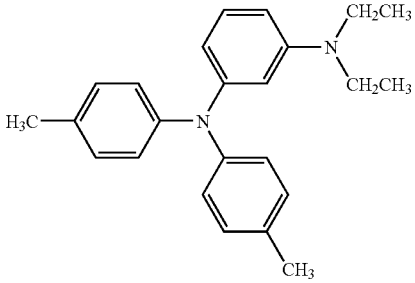 |

-continued
| No. | Exemplified Compounds |
|---|---|
| A-2-5 | 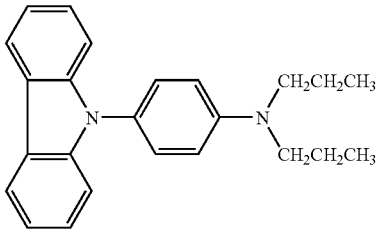 |
| A-2-6 | 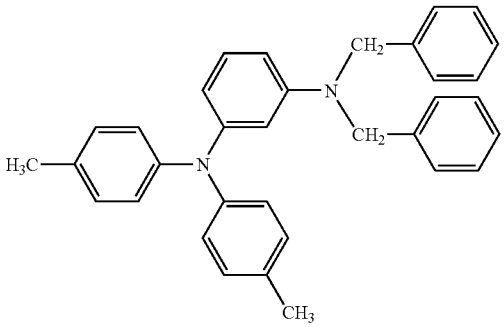 |
| A-2-7 | 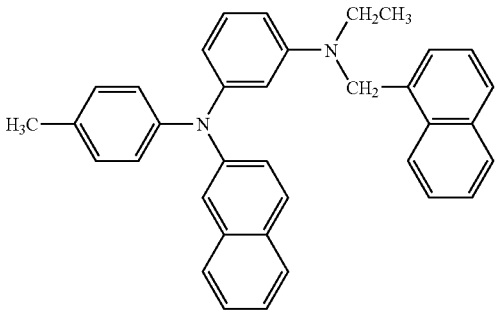 |
| A-3-1 | 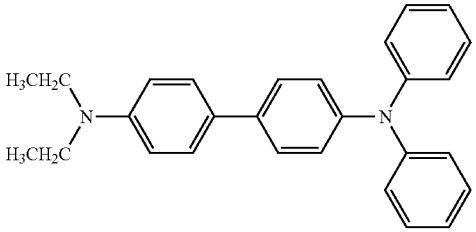 |
| A-3-2 | 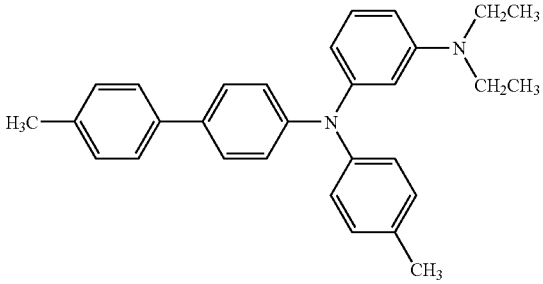 |

-continued
| No. | Exemplified Compounds |
|---|---|
| A-3-3 | 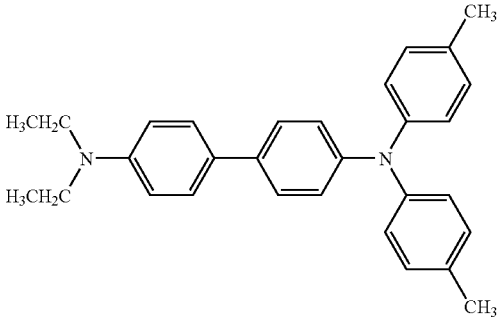 |
| A-3-4 | 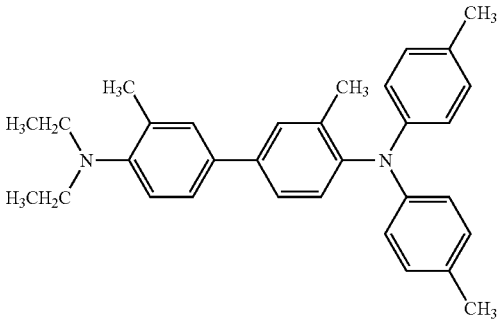 |
| A-3-5 | 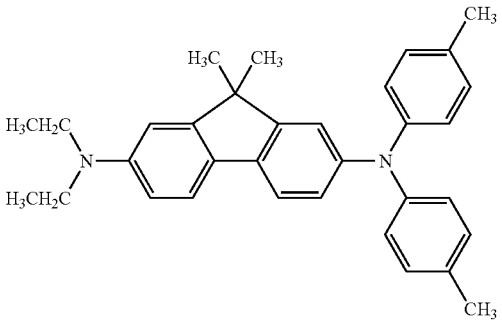 |
| A-3-6 | 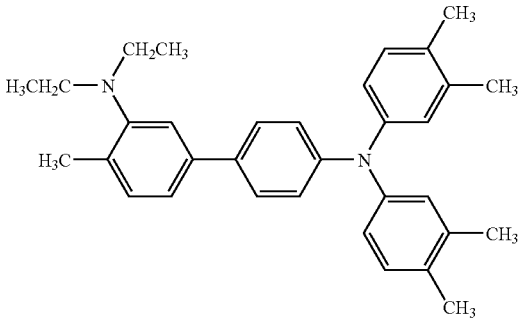 |

-continued
| No. | Exemplified Compounds |
|---|---|
| A-3-7 | 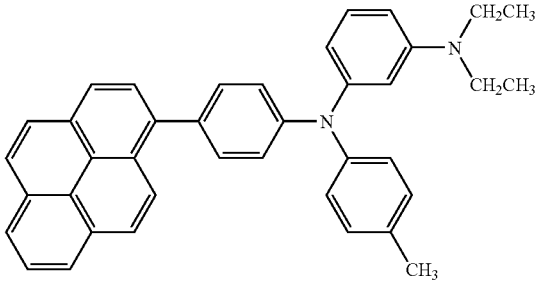 |
| A-3-8 | 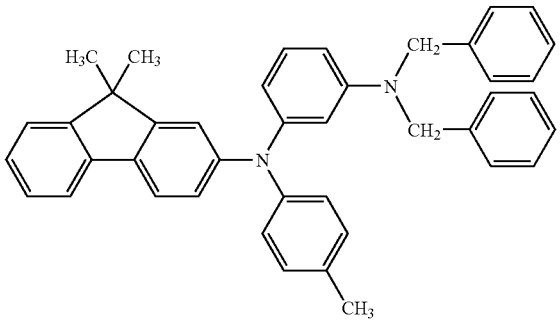 |
| A-3-9 | 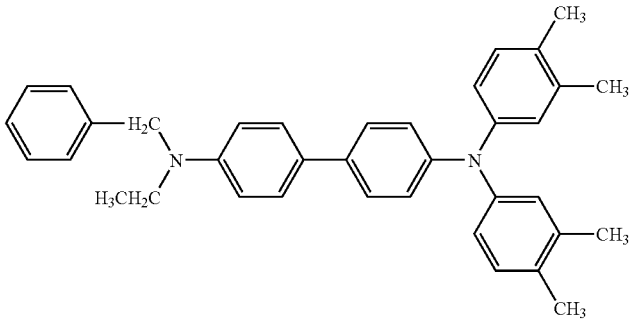 |
| A-4-1 | 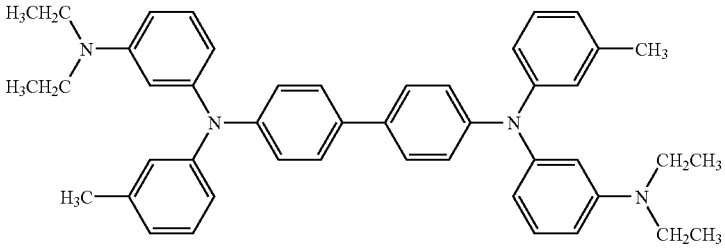 |
| A-4-2 | 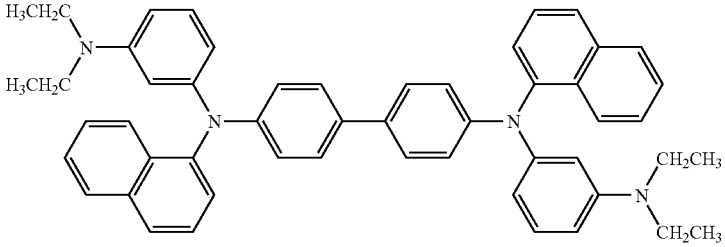 |

-continued
| No. | Exemplified Compounds |
|---|---|
| A-4-3 | 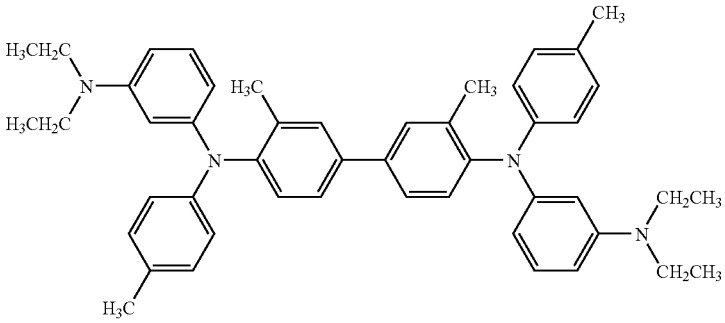 |
| A-4-4 | 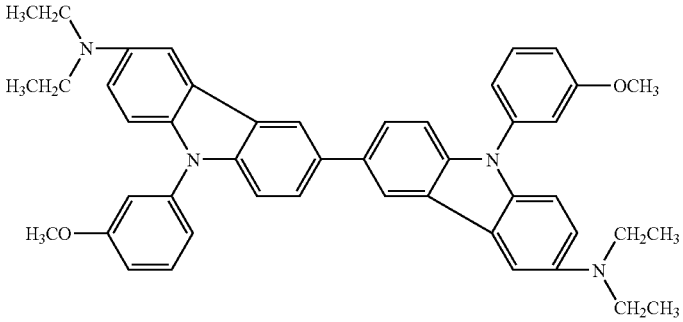 |
| A-4-5 | 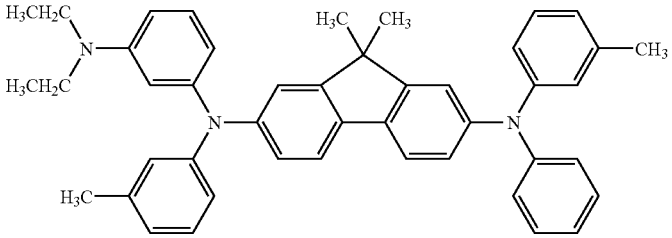 |
| A-4-6 | 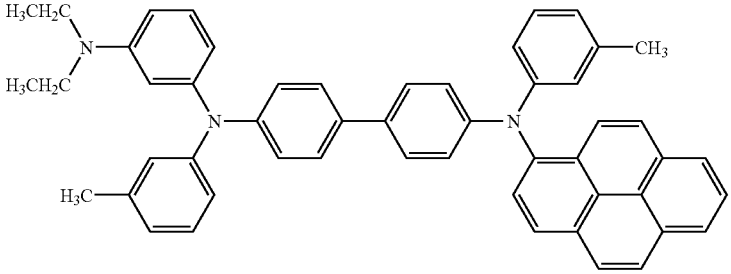 |
| A-4-7 | 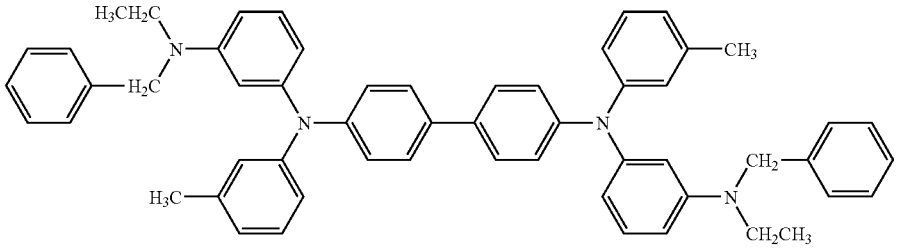 |

-continued
| No. | Exemplified Compounds |
|---|---|
| A-4-8 | 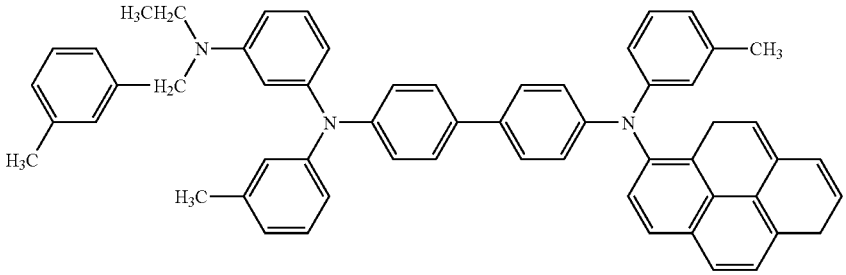 |
| A-5-1 | 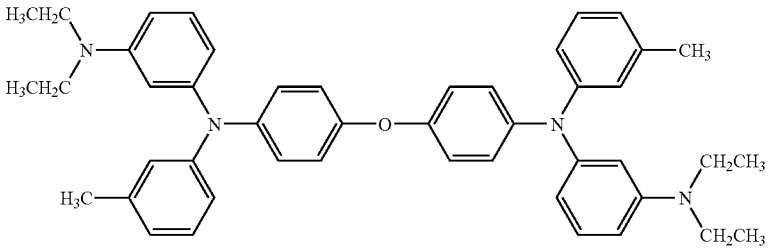 |
| A-5-2 | 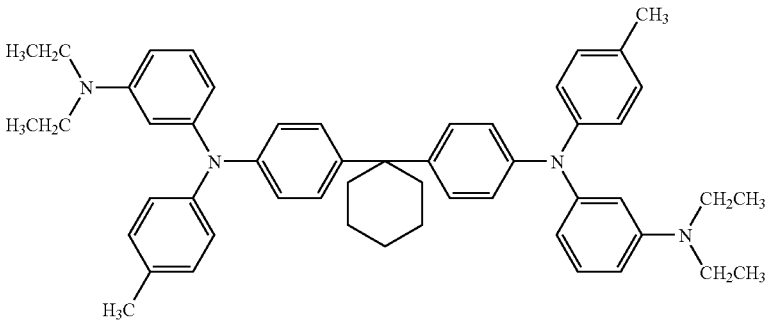 |
| A-5-3 | 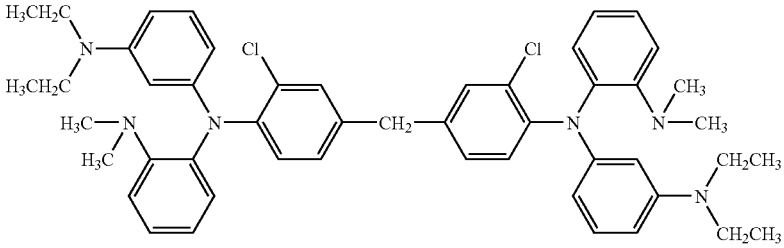 |
| A-5-4 | 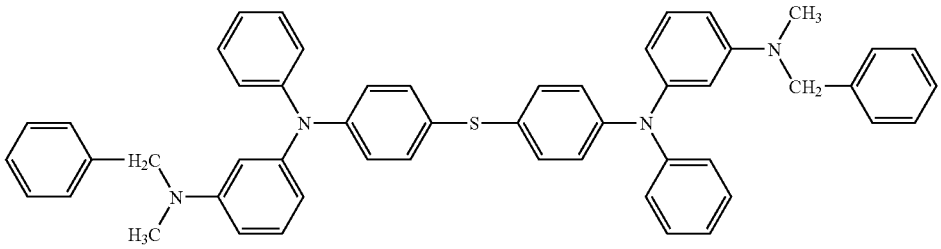 |

-continued
| No. | Exemplified Compounds |
|---|---|
| A-6-1 | 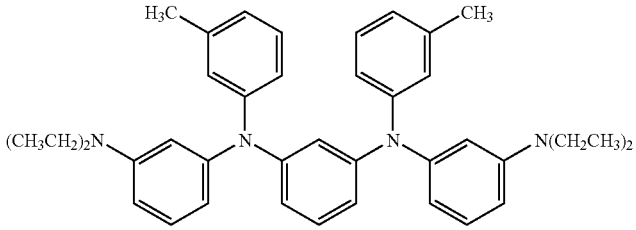 |
| A-6-2 | 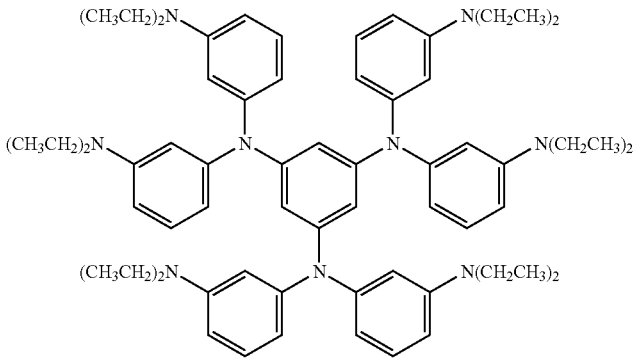 |
| A-6-3 | 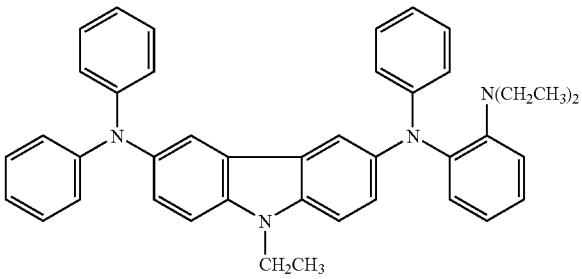 |
| A-6-4 | 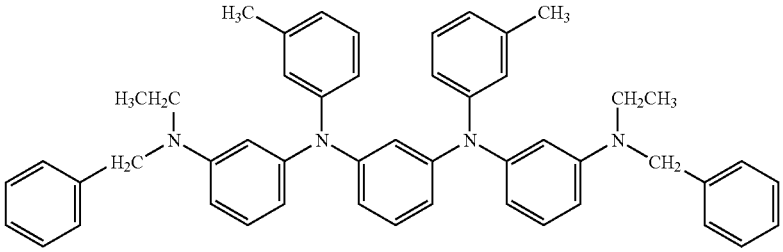 |
| A-7-1 | 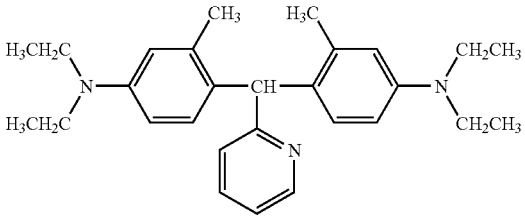 |

-continued
| No. | Exemplified Compounds |
|---|---|
| A-7-2 | 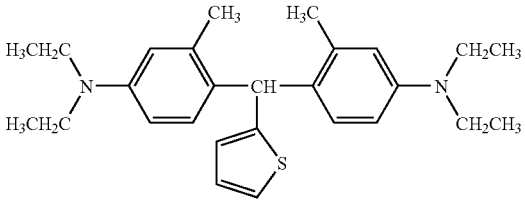 |
| A-7-3 | 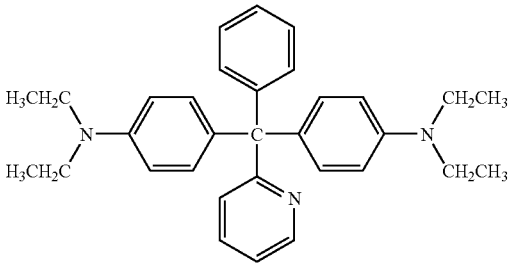 |
| A-7-4 | 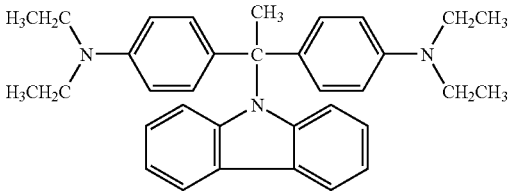 |
| A-7-5 | 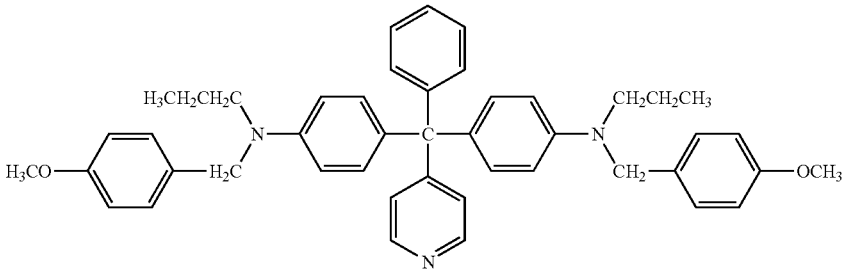 |
| A-8-1 | 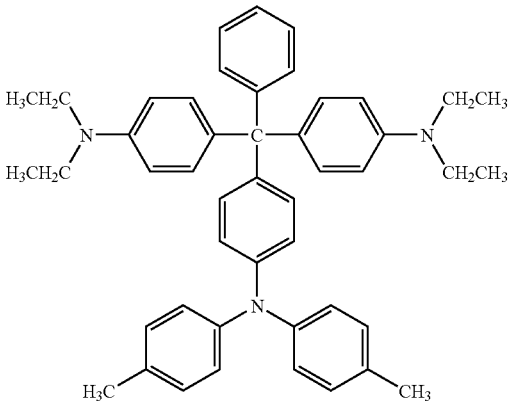 |

-continued
| No. | Exemplified Compounds |
|---|---|
| A-8-2 | 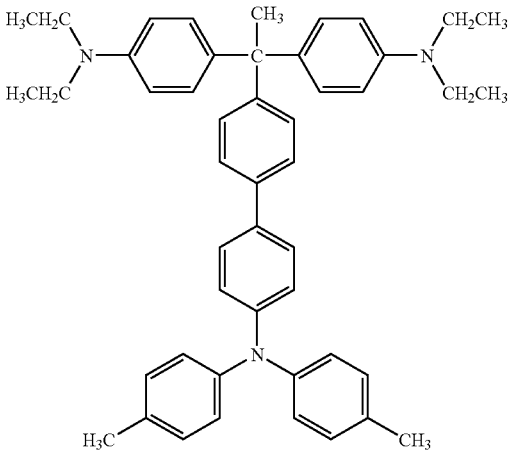 |
| A-8-3 | 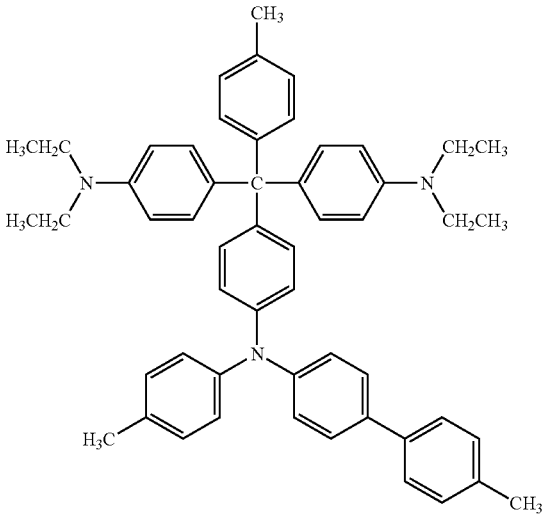 |
| A-8-4 | 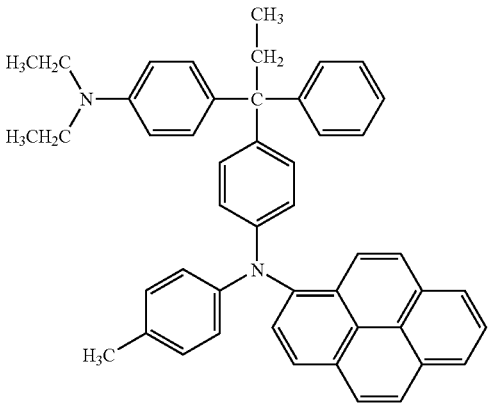 |

-continued
| No. | Exemplified Compounds |
|---|---|
| A-8-5 | 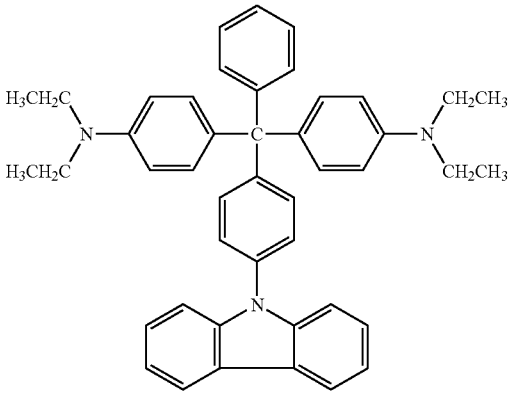 |
| A-8-6 | 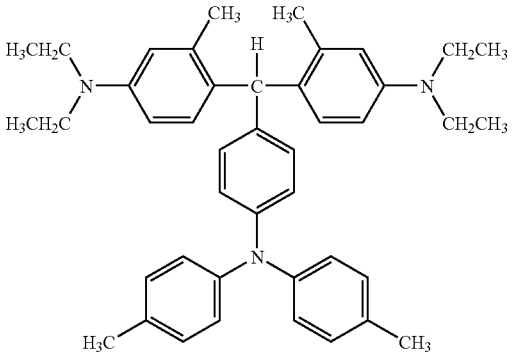 |
| A-8-7 | 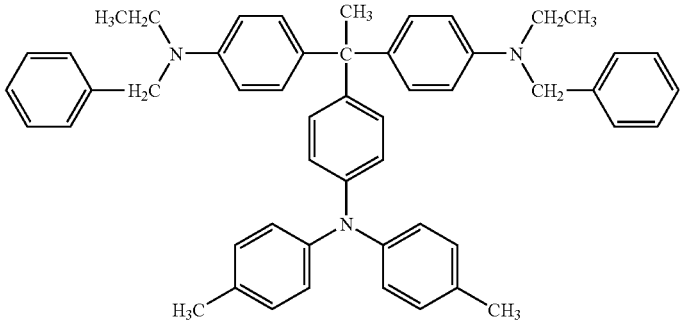 |
| A-9-1 | 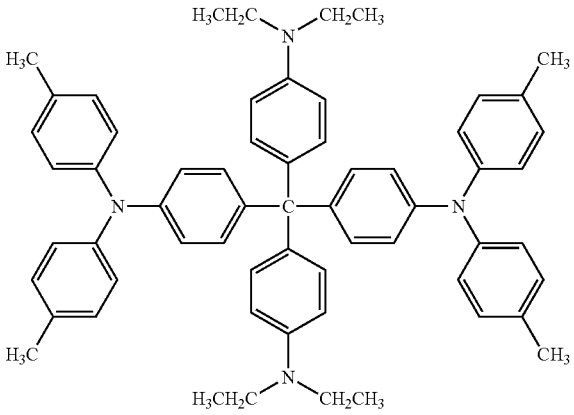 |

-continued
| No. | Exemplified Compounds |
|---|---|
| A-9-2 | 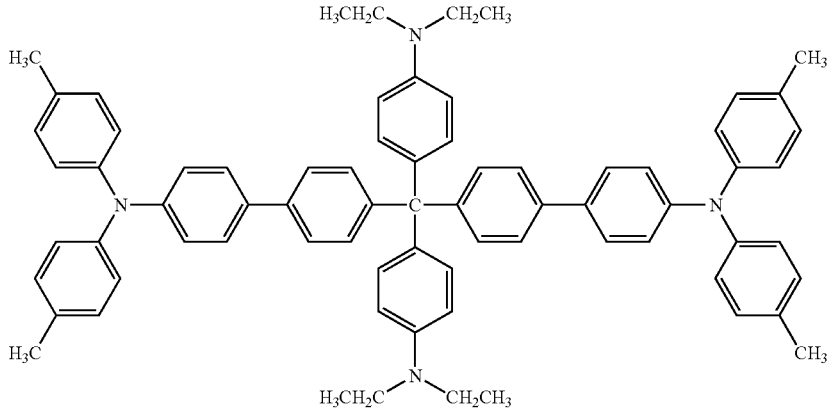 |
| A-9-3 | 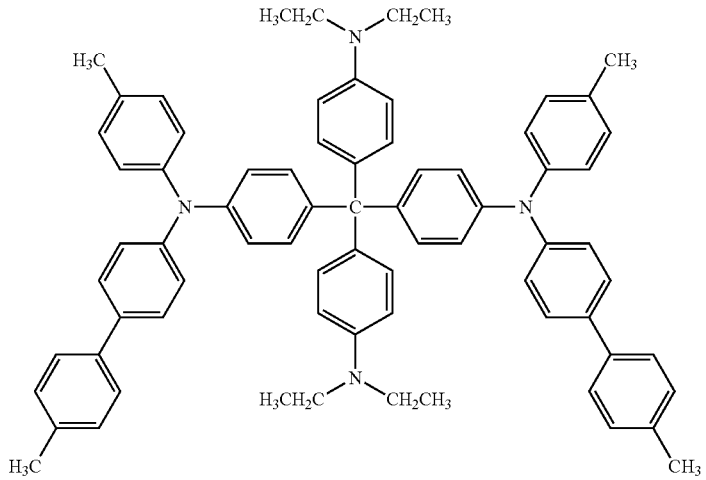 |
| A-9-4 | 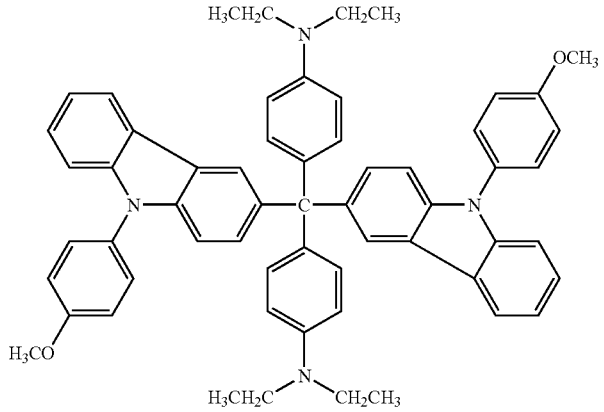 |

-continued
| No. | Exemplified Compounds |
|---|---|
| A-9-5 | 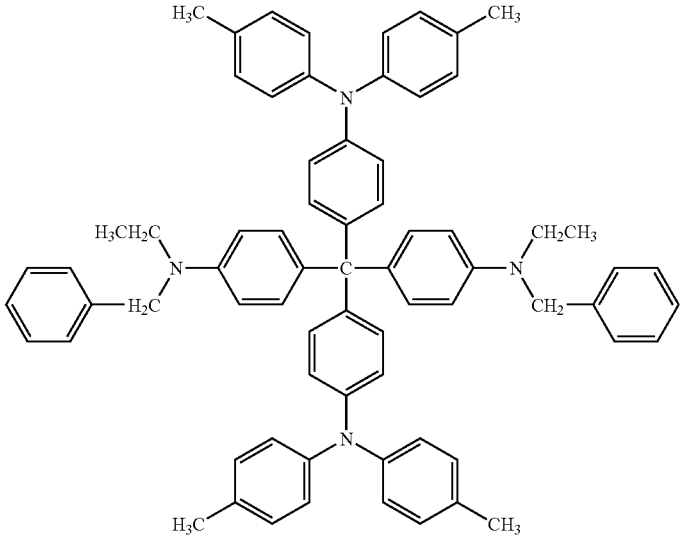 |
| A-10-1 | 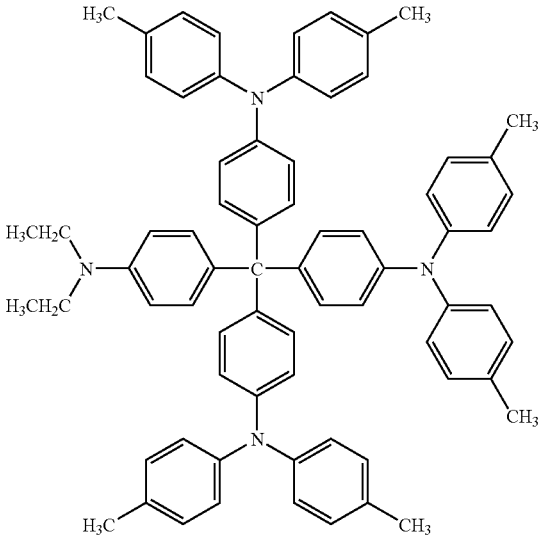 |
| A-10-2 | 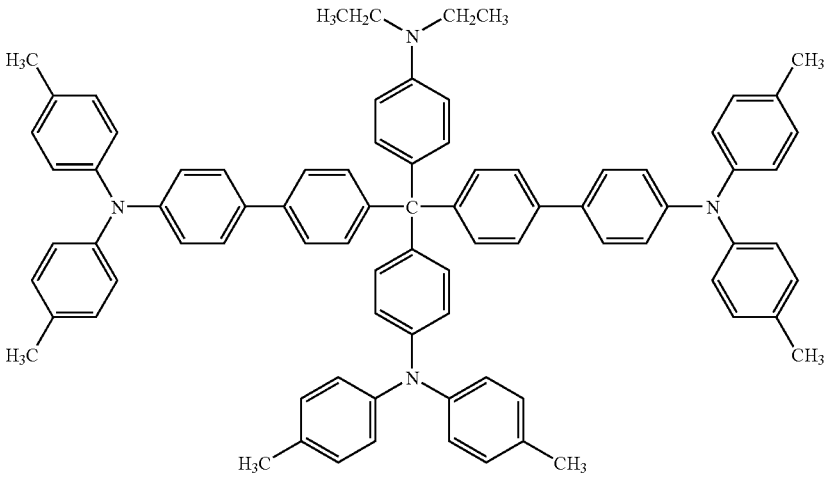 |

-continued
| No. | Exemplified Compounds |
|---|---|
| A-10-3 | 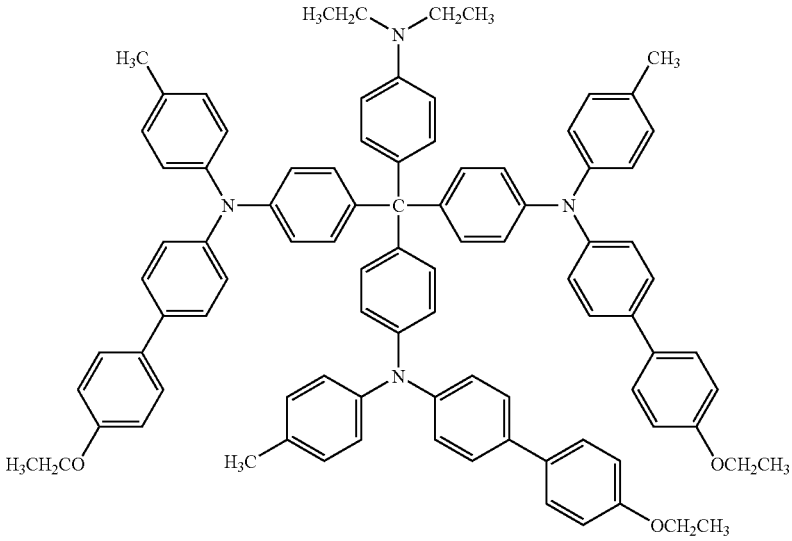 |
| A-10-4 | 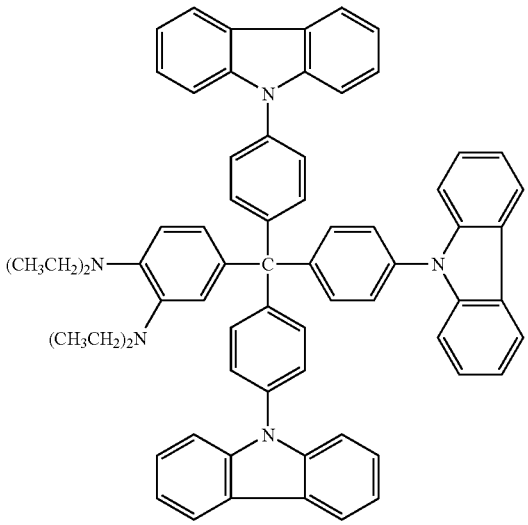 |

-continued
| No. | Exemplified Compounds |
|---|---|
| A-10-5 | 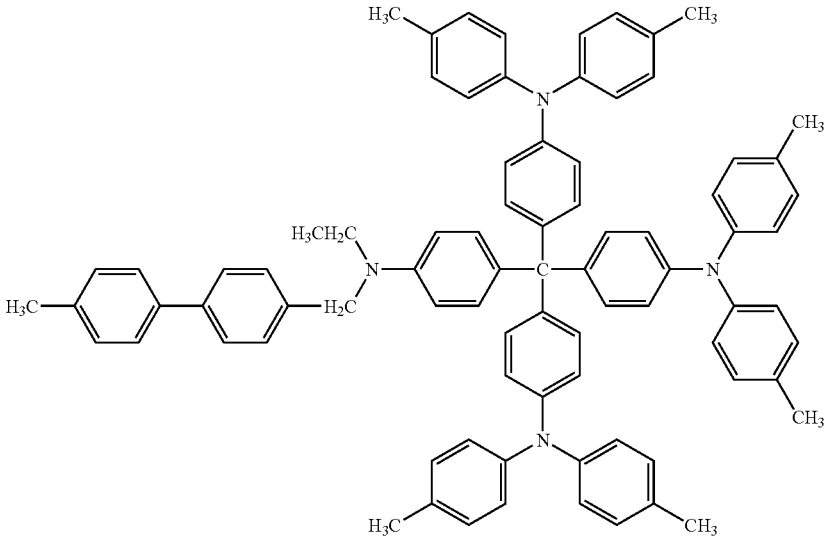 |
| A-11-1 | 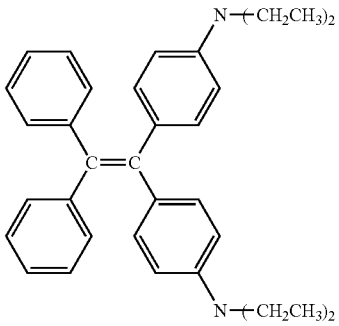 |
| A-11-2 | 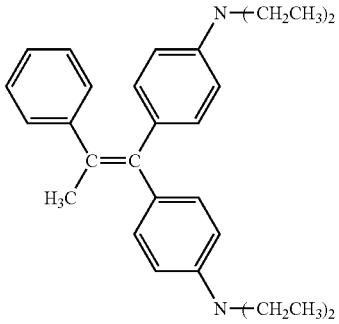 |
| A-11-3 | 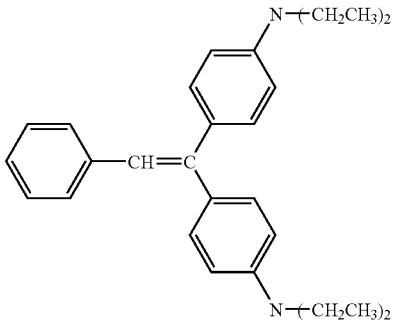 |

-continued
| No. | Exemplified Compounds |
|---|---|
| A-11-4 | 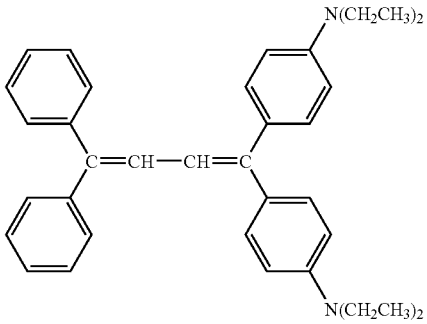 |
| A-11-5 | 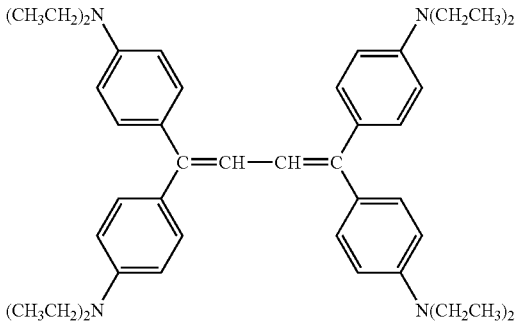 |
| A-11-6 | 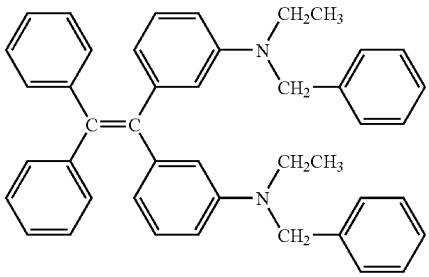 |
| A-11-7 | 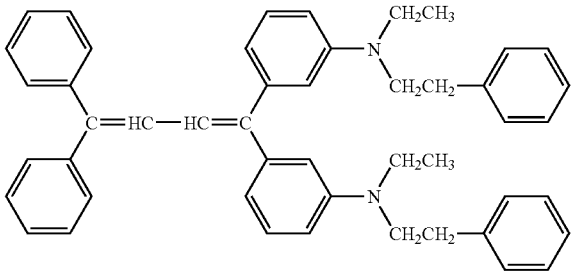 |
| A-12-1 | 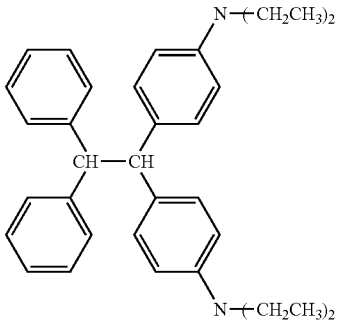 |

-continued
| No. | Exemplified Compounds |
|---|---|
| A-12-2 | 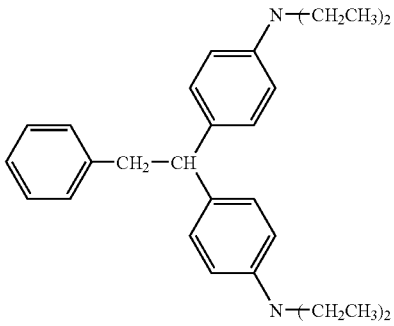 |
| A-12-3 | 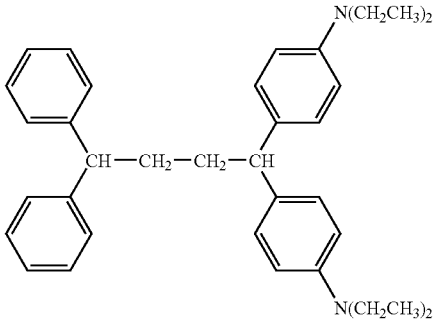 |
| A-12-4 | 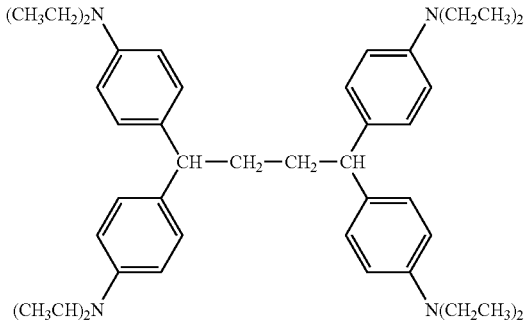 |
| A-12-5 | 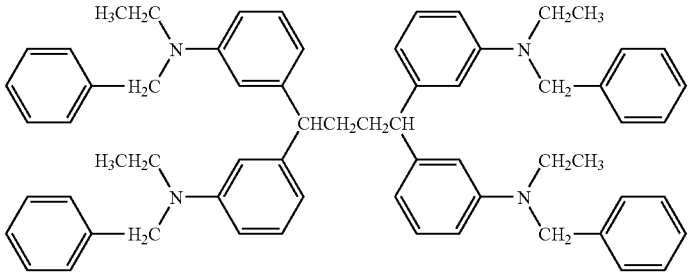 |

-continued
| No. | Exemplified Compounds |
|---|---|
| A-13-1 | 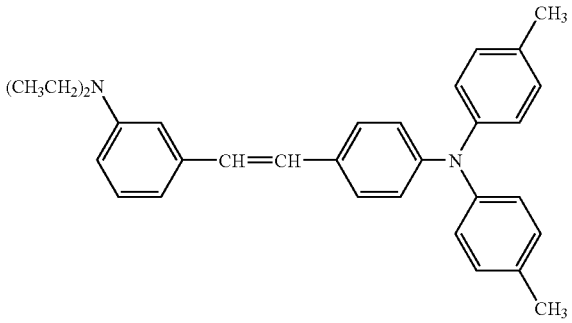 |
| A-13-2 | 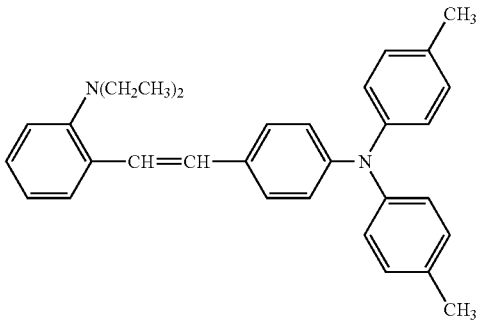 |
| A-13-3 | 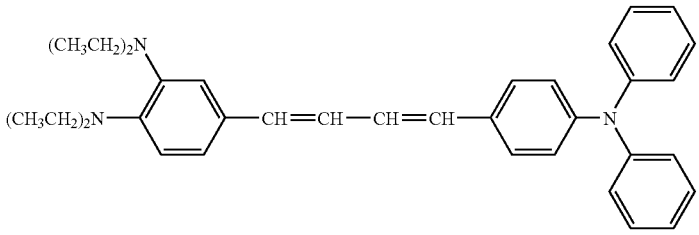 |
| A-13-4 | 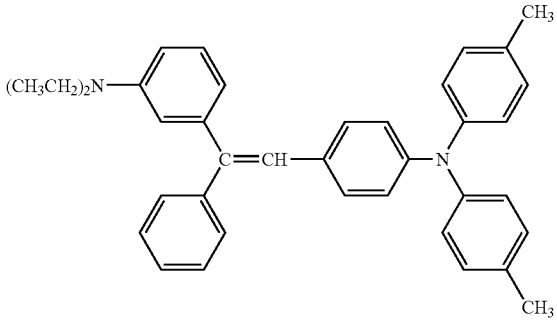 |
| A-13-5 | 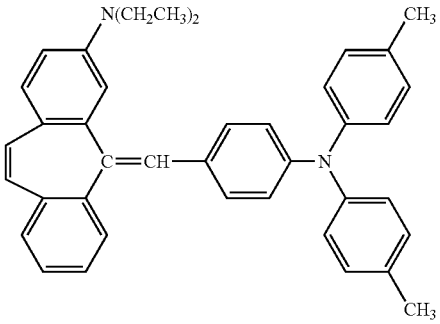 |

-continued
| No. | Exemplified Compounds |
|---|---|
| A-13-6 | 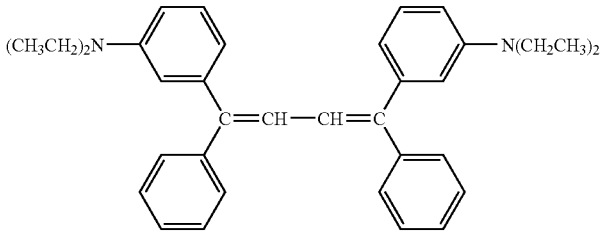 |
| A-13-7 | 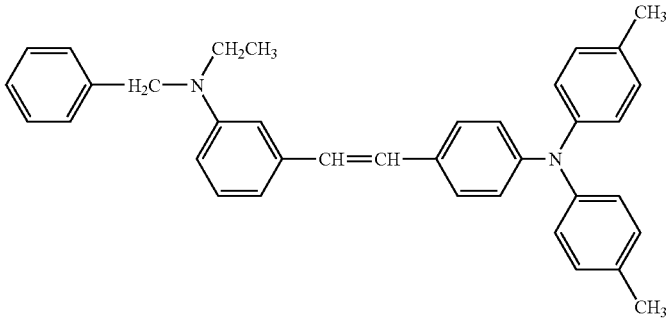 |
| A-13-8 | 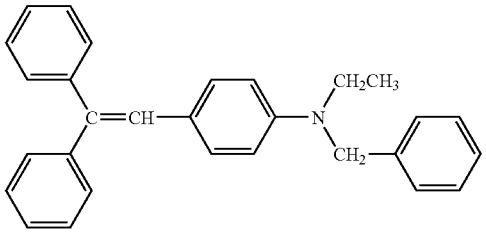 |
| A-13-9 | 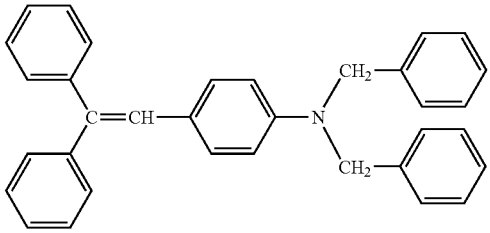 |
| A-14-1 | 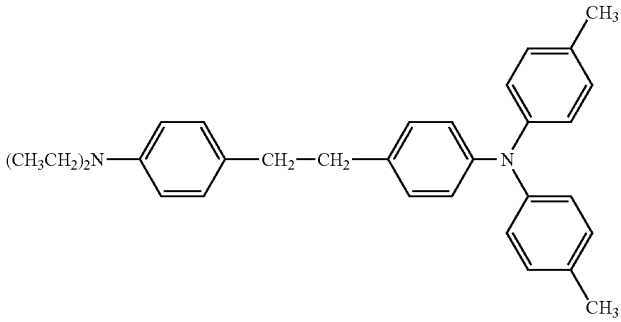 |

-continued
| No. | Exemplified Compounds |
|---|---|
| A-14-2 | 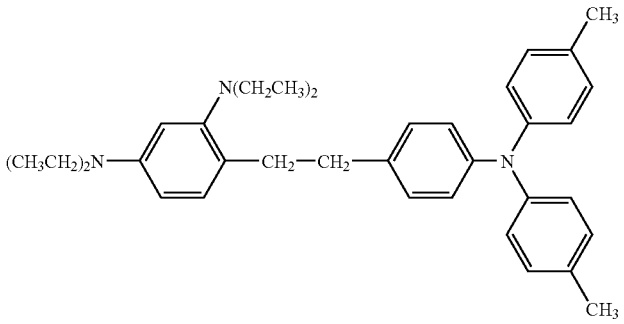 |
| A-14-3 | 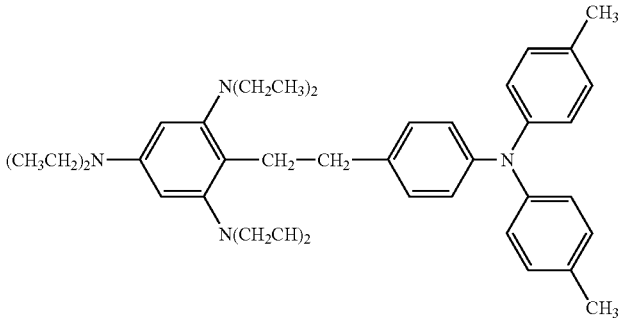 |
| A-14-4 | 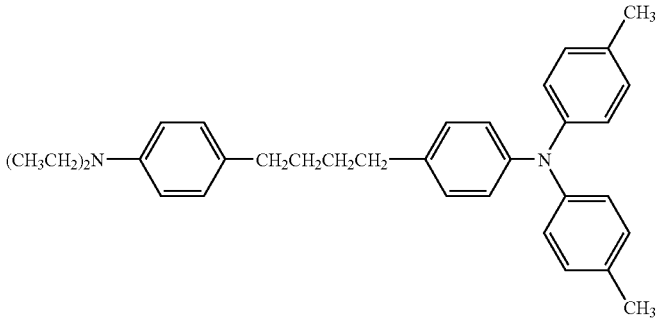 |
| A-14-5 | 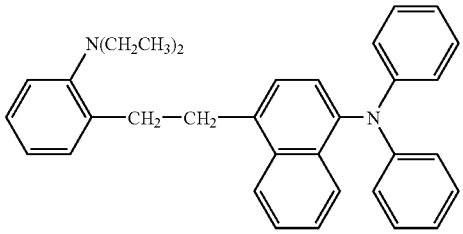 |
| A-14-6 | 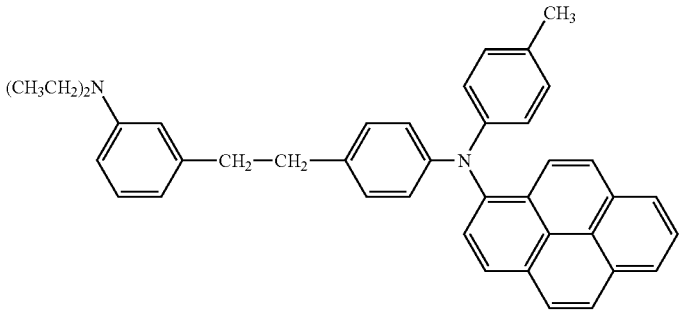 |

-continued
| No. | Exemplified Compounds |
|---|---|
| A-14-7 | 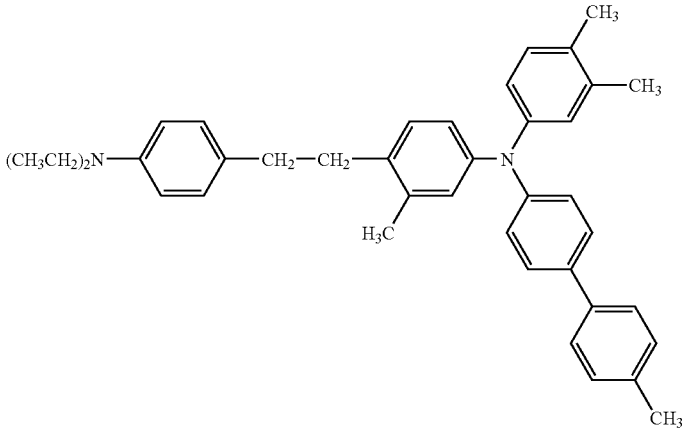 |
| A-14-8 | 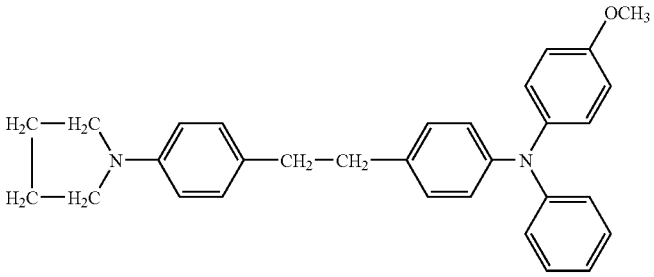 |
| A-14-9 | 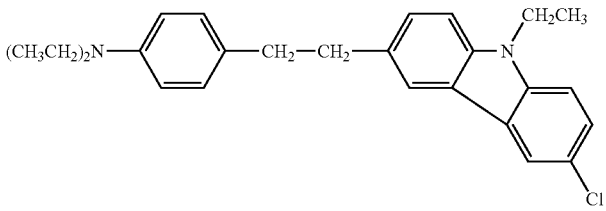 |
| A-14-10 | 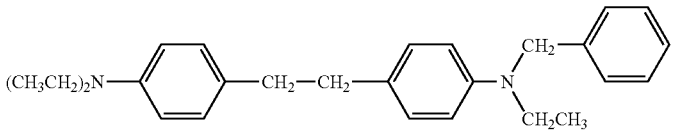 |
| A-14-11 | 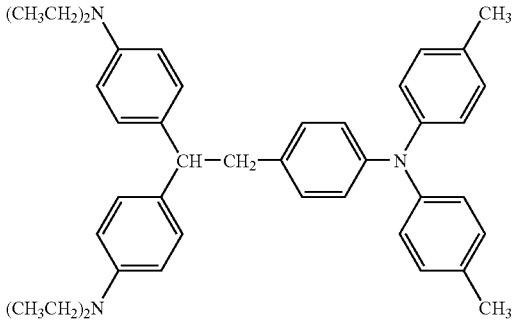 |

-continued
| No. | Exemplified Compounds |
|---|---|
| A-14-12 | 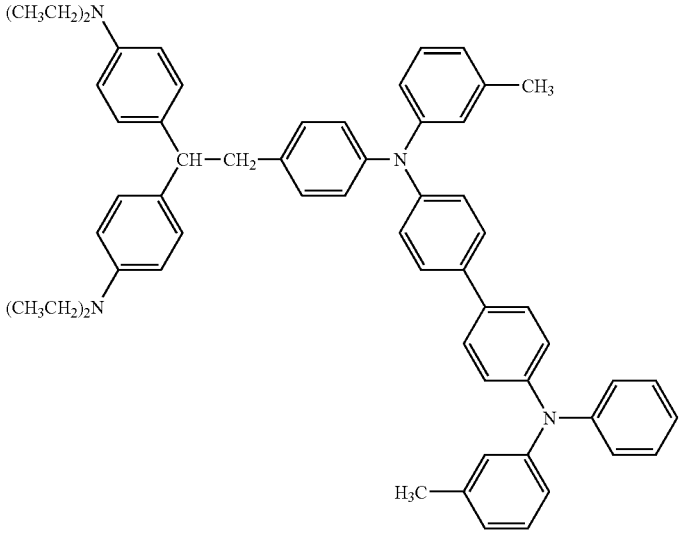 |
| A-14-13 | 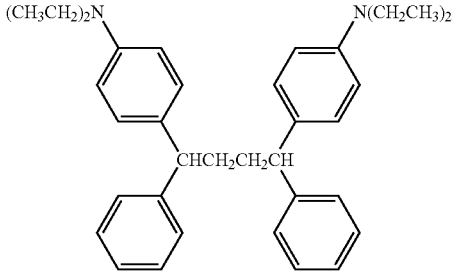 |
| A-14-14 | 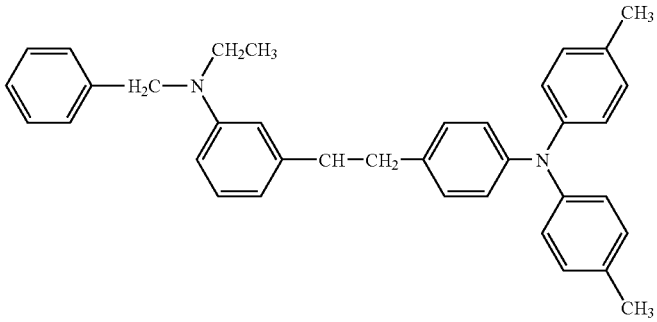 |
| A-15-1 | 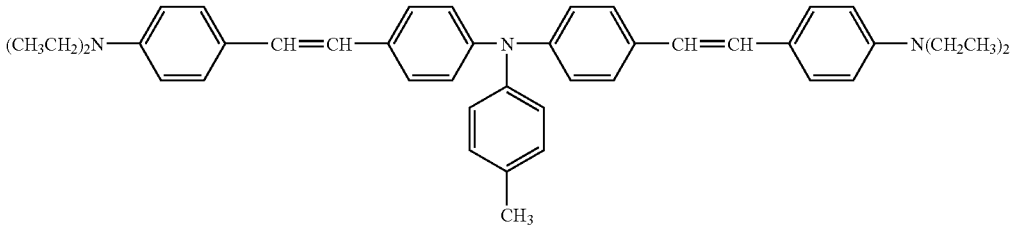 |

-continued
| No. | Exemplified Compounds |
|---|---|
| A-15-2 | 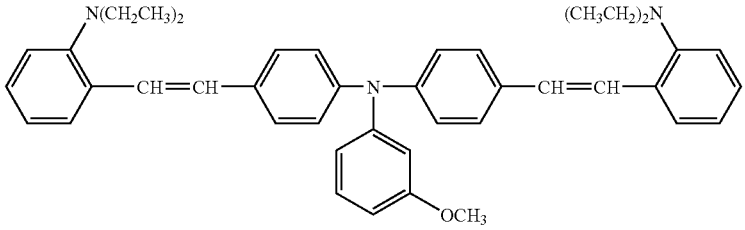 |
| A-15-3 | 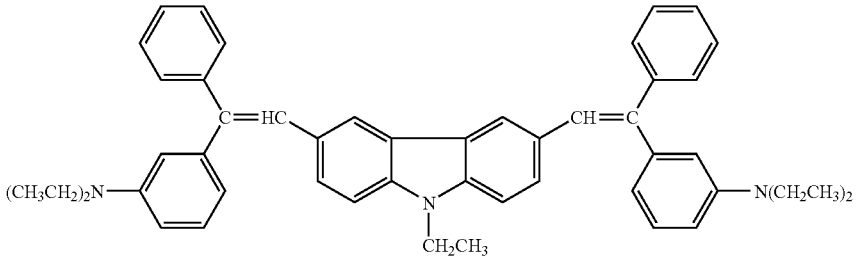 |
| A-15-4 | 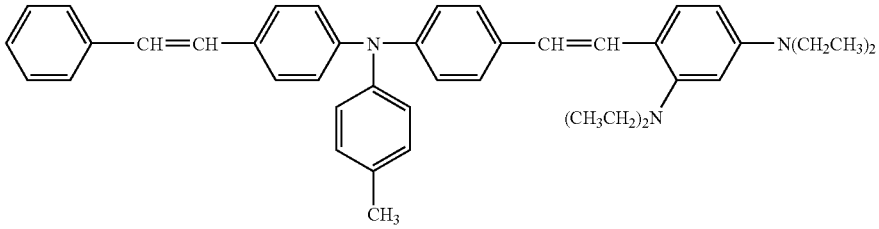 |
| A-15-5 | 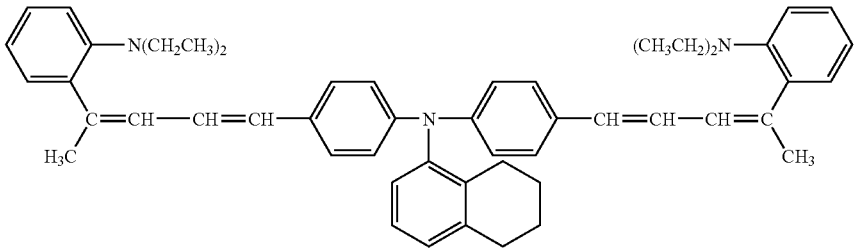 |
| A-15-6 | 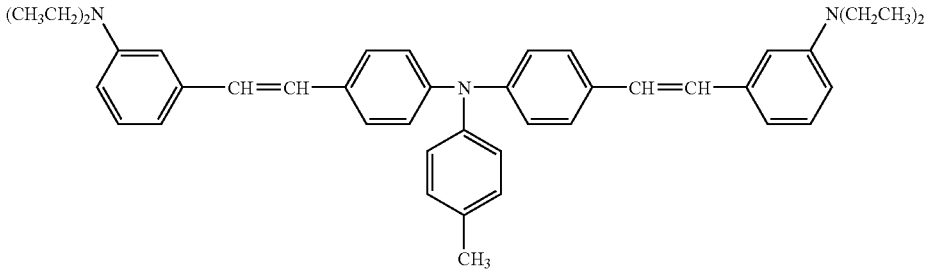 |

-continued
| No. | Exemplified Compounds |
|---|---|
| A-15-7 | 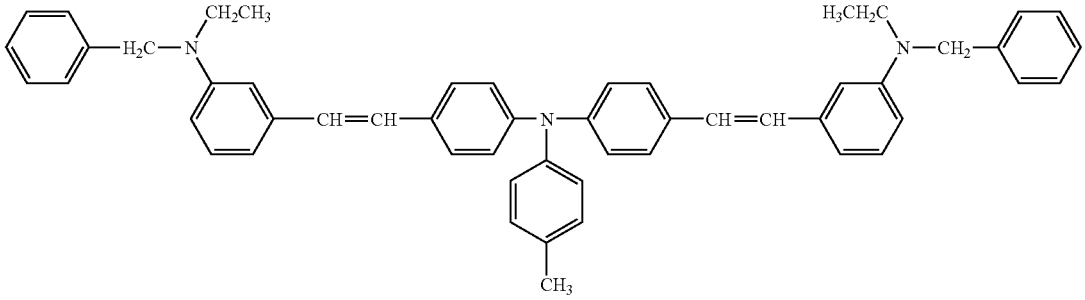 |
| A-15-8 | 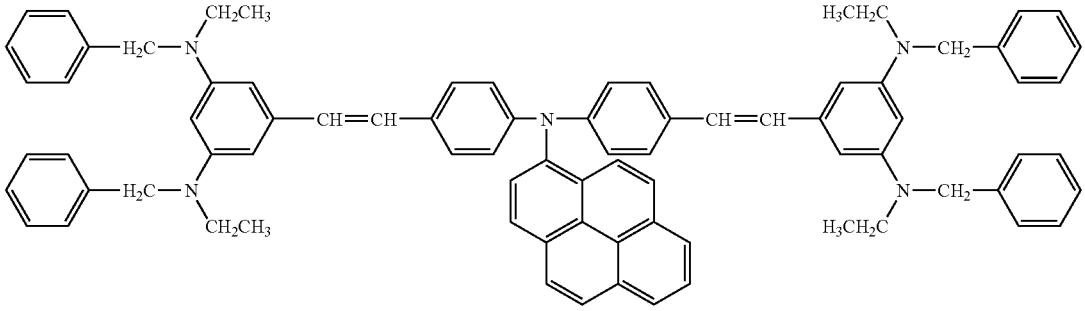 |
| A-16-1 | 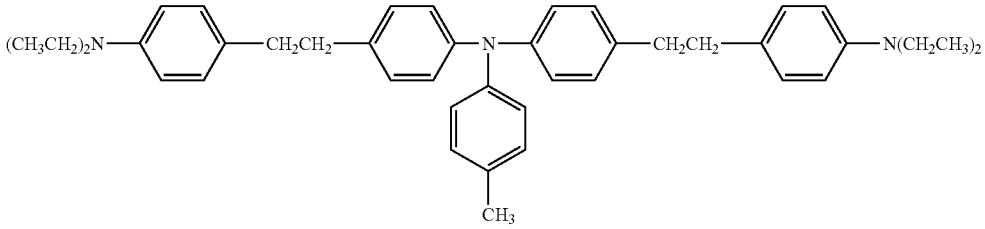 |
| A-16-2 | 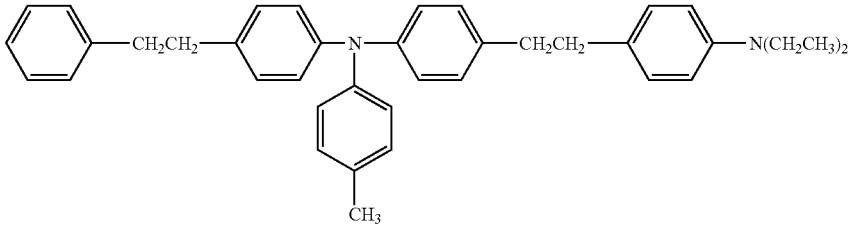 |
| A-16-3 | 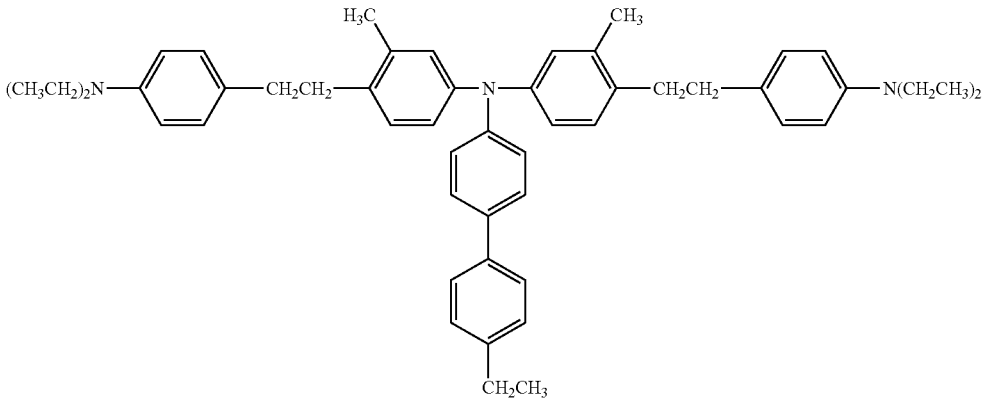 |

-continued
| No. | Exemplified Compounds |
|---|---|
| A-16-4 | 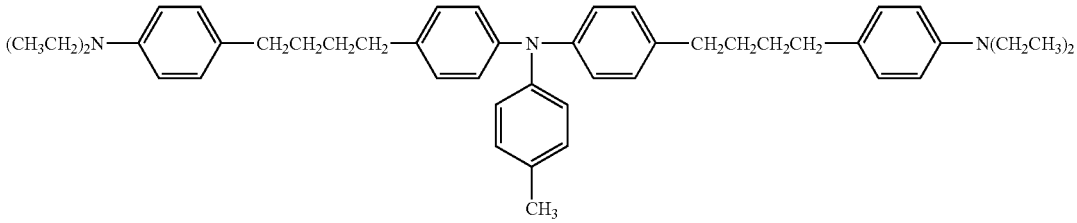 |
| A-16-5 | 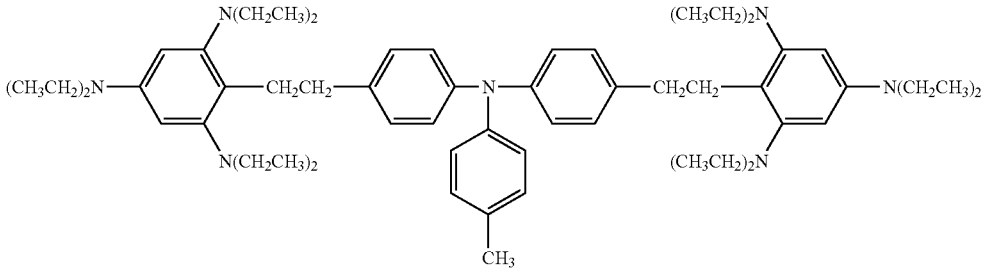 |
| A-16-6 | 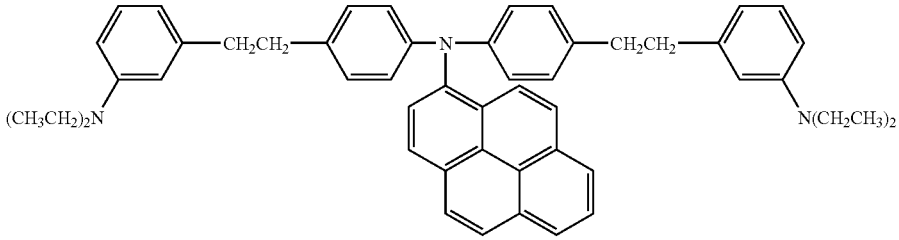 |
| A-16-7 | 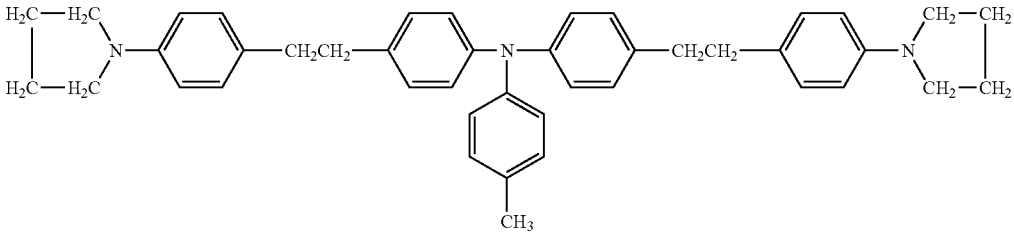 |
| A-16-8 | 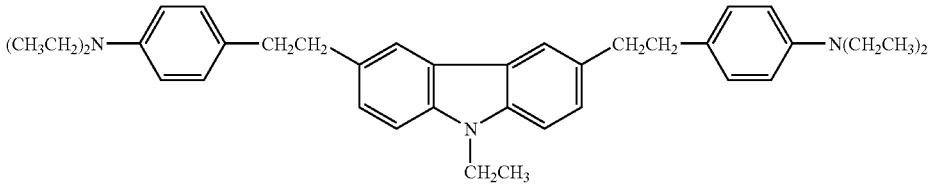 |
| A-16-9 | 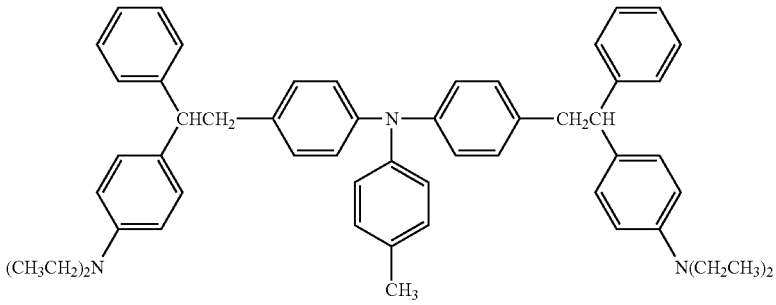 |

-continued
| No. | Exemplified Compounds |
|---|---|
| A-16-10 | 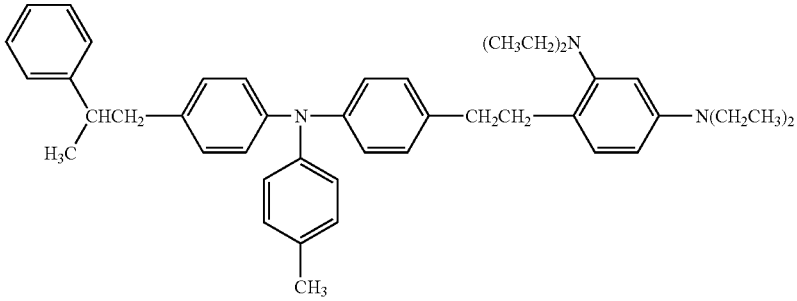 |
| A-16-11 | 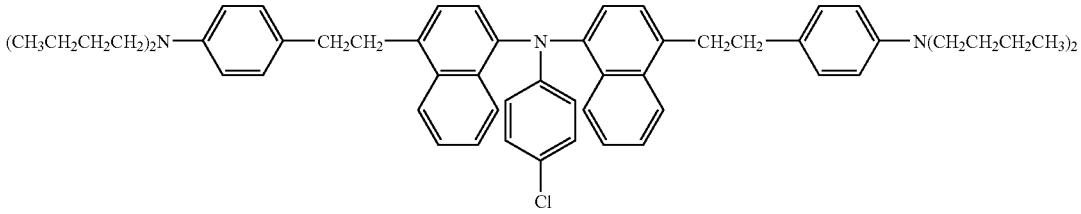 |
| A-16-12 | 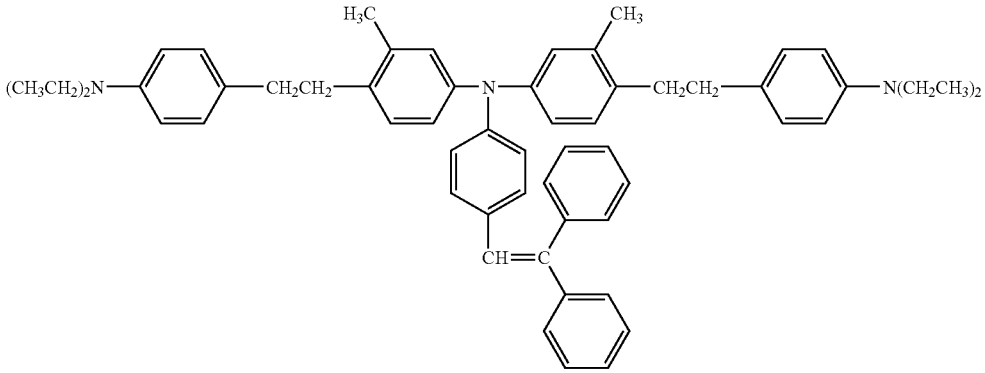 |
| A-16-13 | 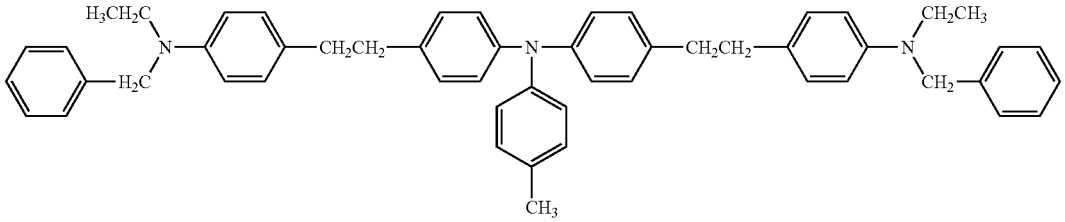 |
| A-16-14 | 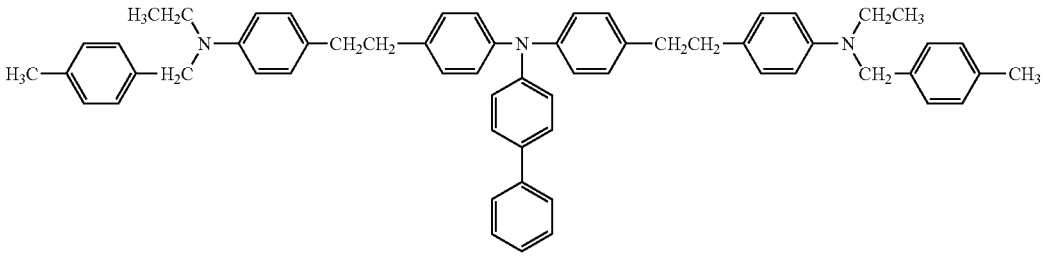 |

-continued
| No. | Exemplified Compounds |
|---|---|
| A-17-1 | 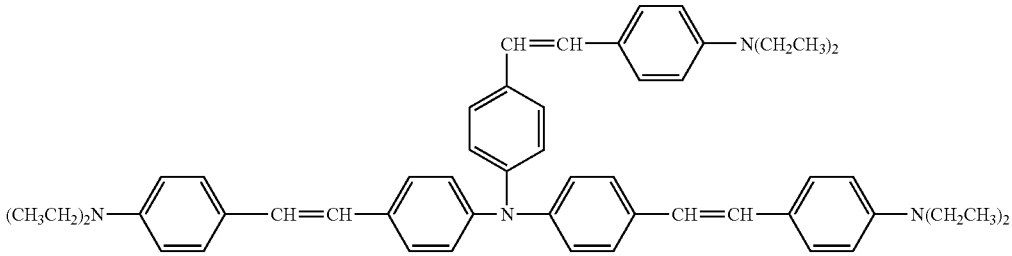 |
| A-17-2 | 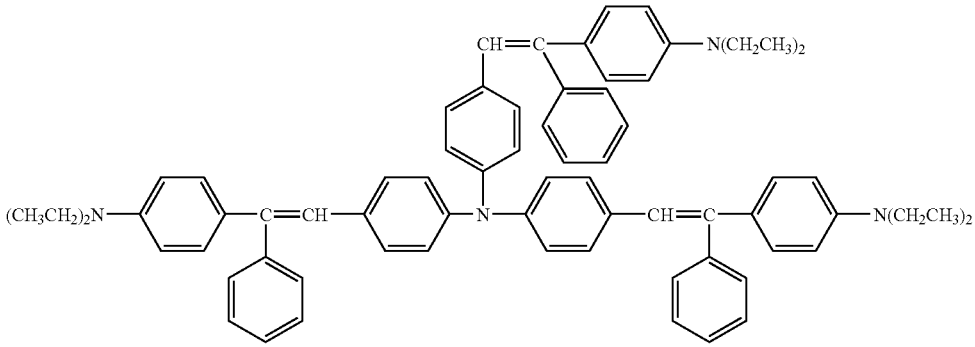 |
| A-17-3 | 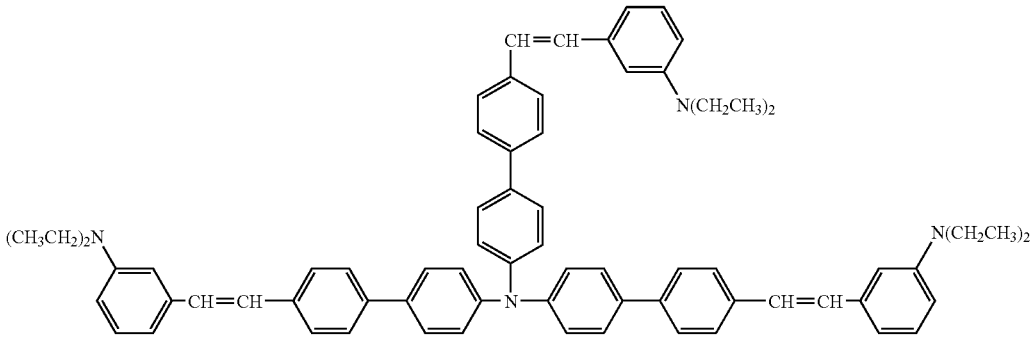 |
| A-17-4 | 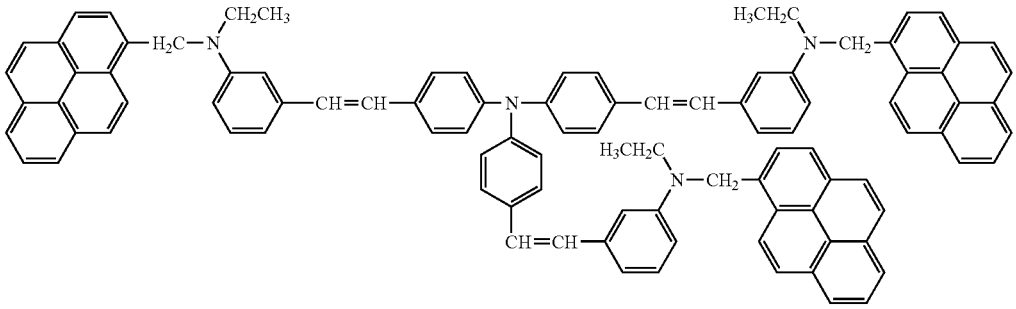 |
| A-18-1 | 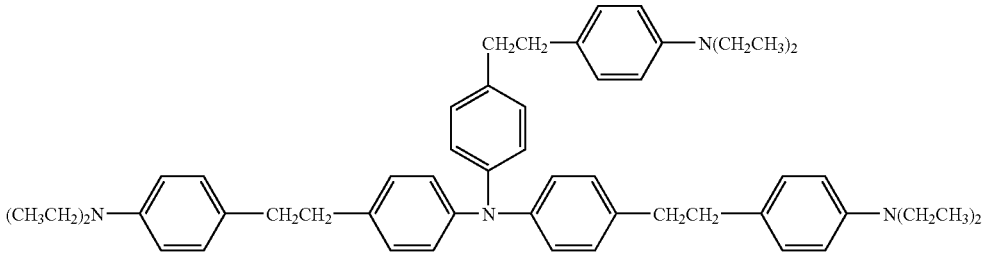 |

-continued
| No. | Exemplified Compounds |
|---|---|
| A-18-2 | 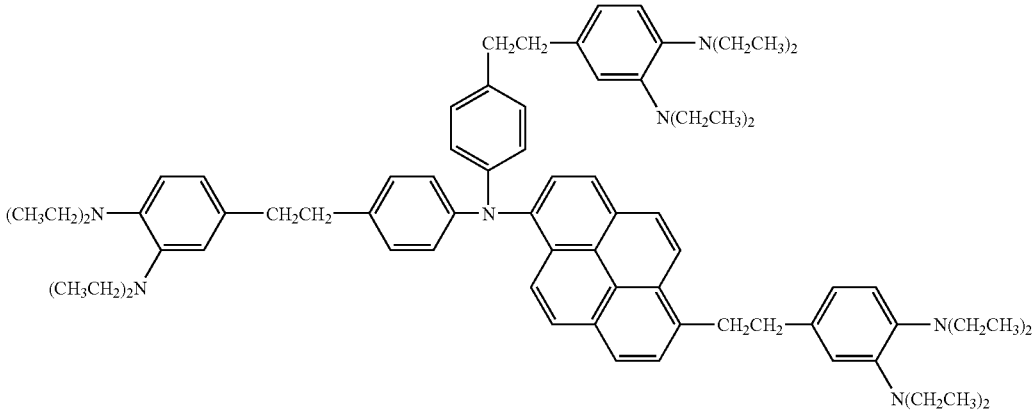 |
| A-18-3 | 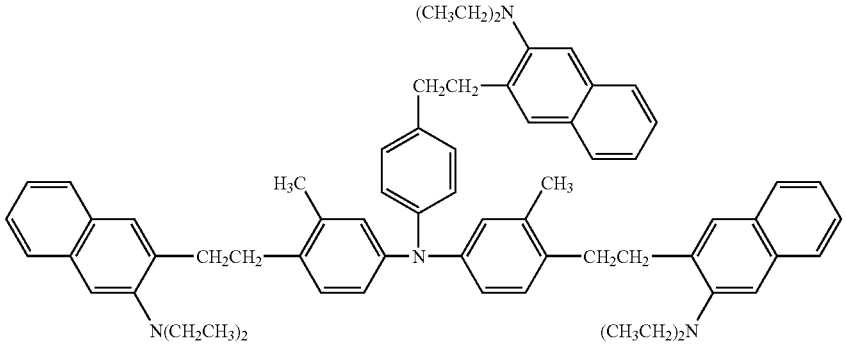 |
| A-18-4 | 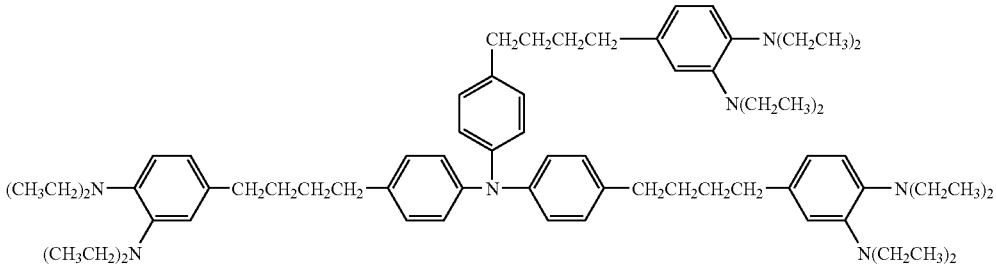 |
| A-18-5 | 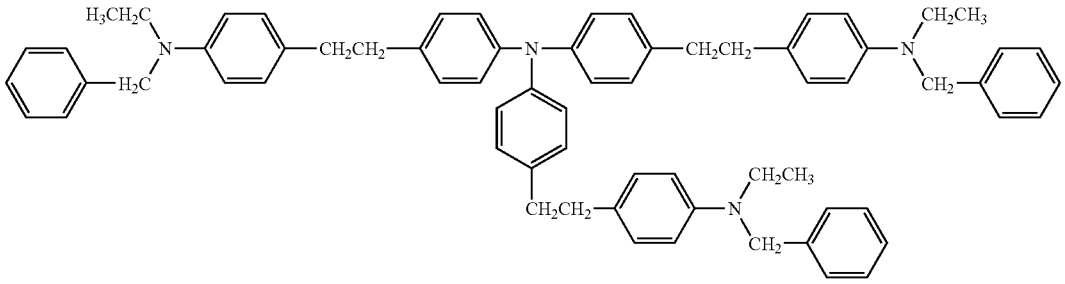 |

-continued
| No. | Exemplified Compounds |
|---|---|
| A-19-1 | 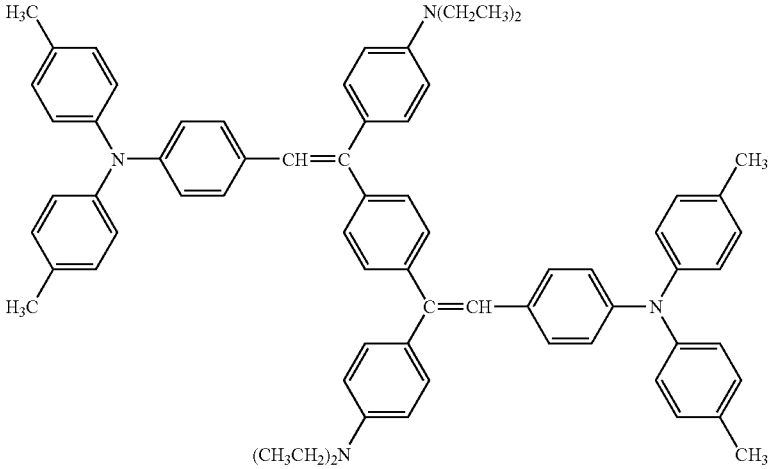 |
| A-19-2 | 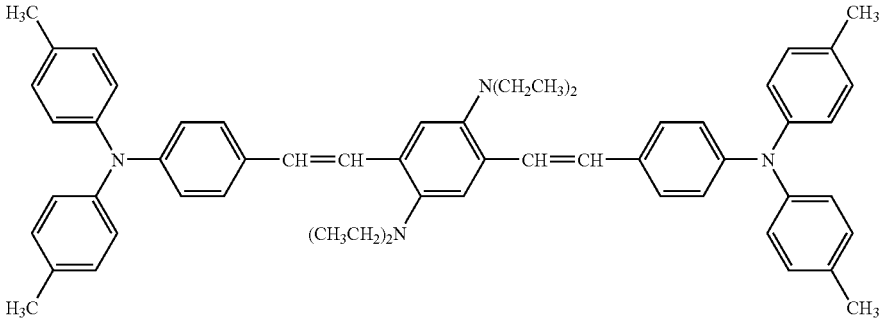 |
| A-19-3 | 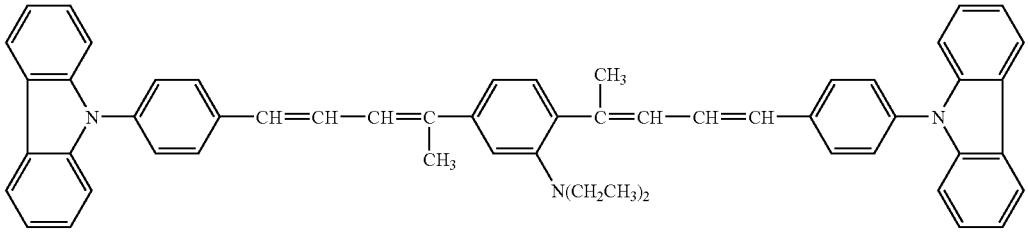 |

-continued
| No. | Exemplified Compounds |
|---|---|
| A-19-4 | 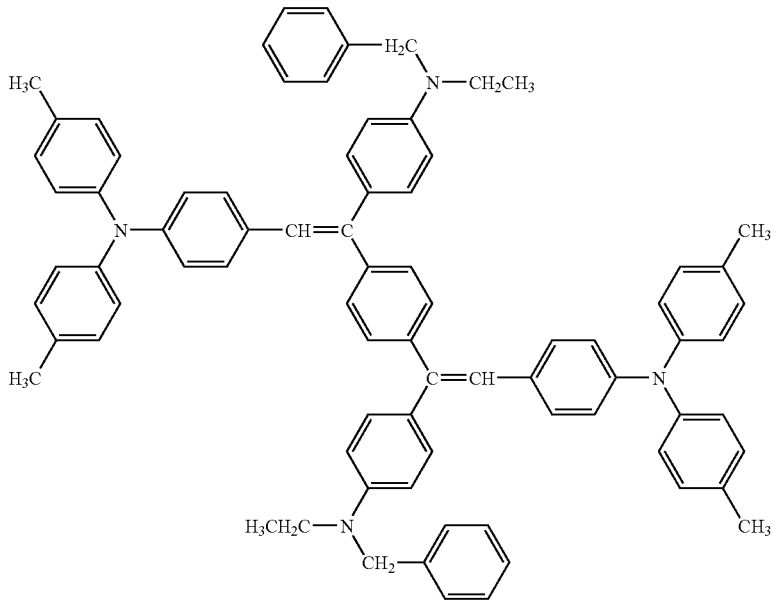 |
| A-20-1 | 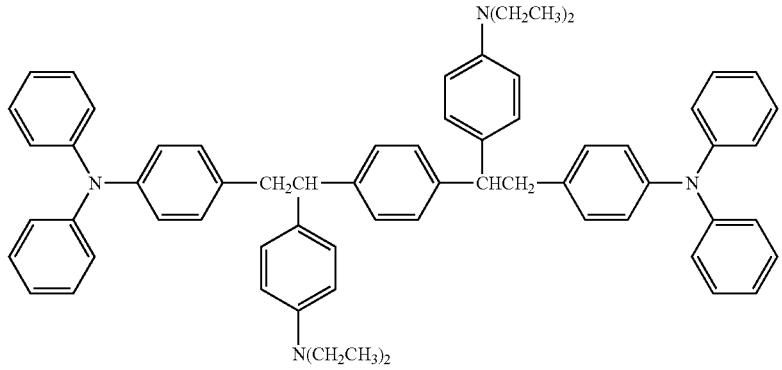 |
| A-20-2 | 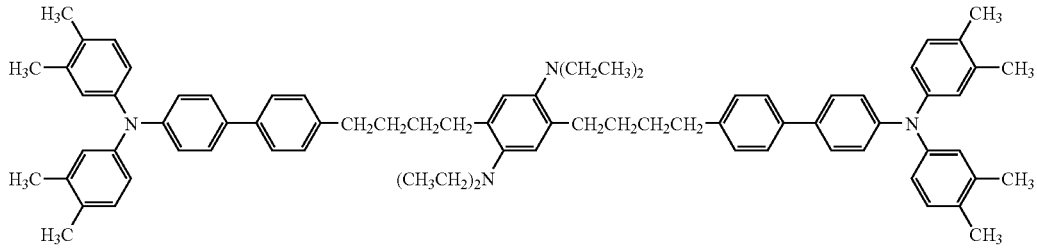 |

-continued
| No. | Exemplified Compounds |
|---|---|
| A-20-3 | 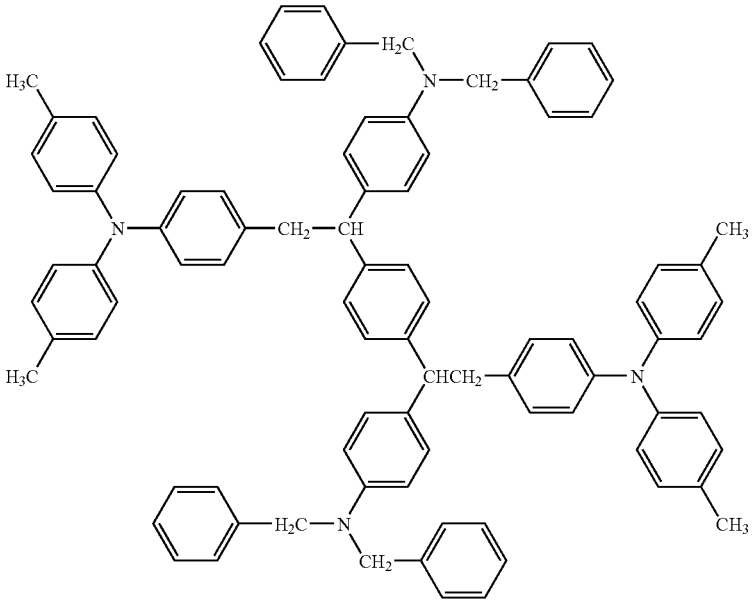 |
| A-21-1 | 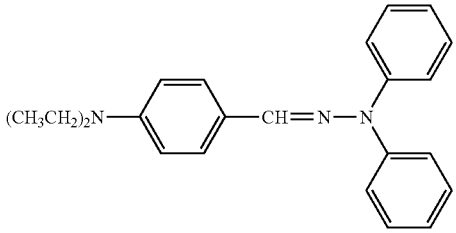 |
| A-21-2 | 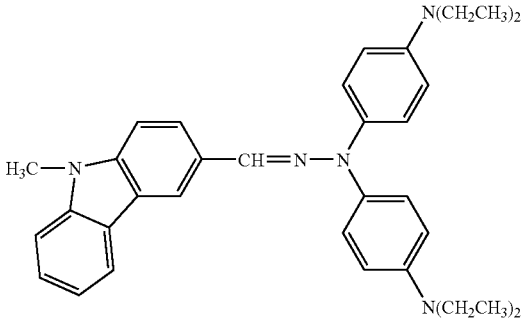 |
| A-21-3 | 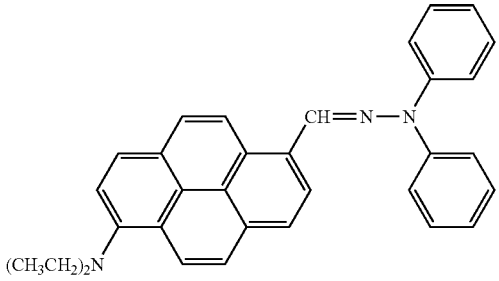 |

-continued
| No. | Exemplified Compounds |
|---|---|
| A-21-4 | 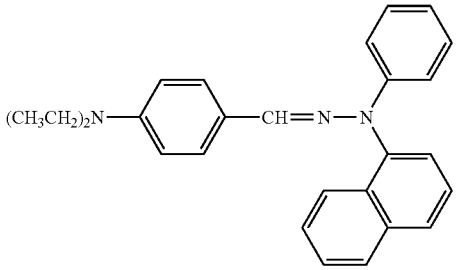 |
| A-21-5 | 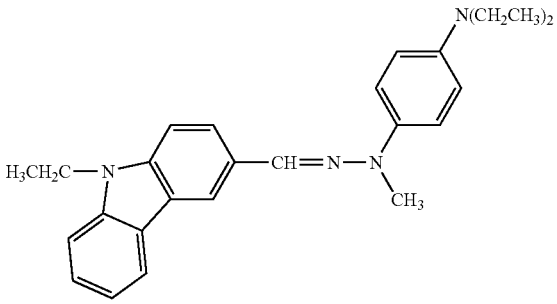 |
| A-21-6 | 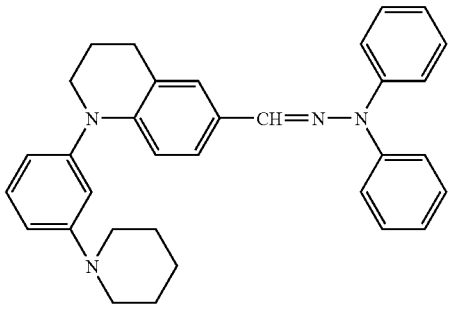 |
| A-21-7 | 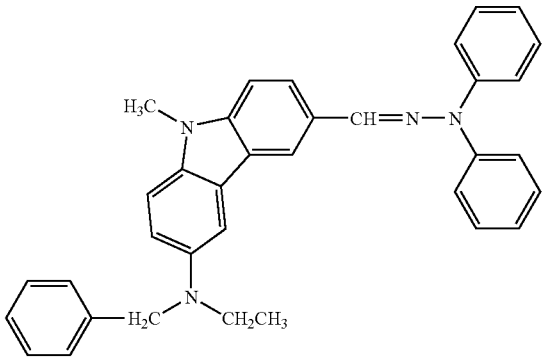 |
| A-22-1 | 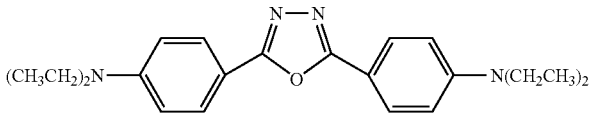 |

-continued

| No. | Exemplified Compounds |
|---|---|
| A-22-2 | 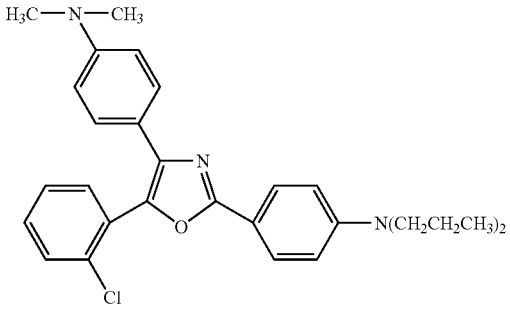 |
| A-22-3 | 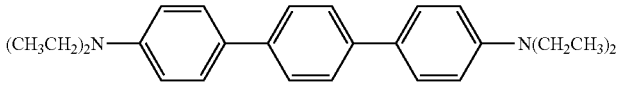 |
| A-22-4 | 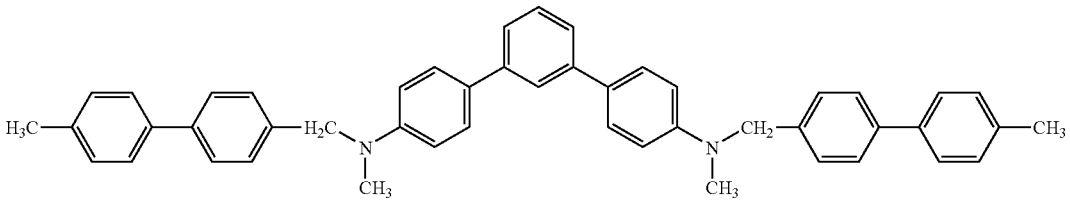 |

The content of the compounds expressed by the general formulas (1) to (22) is preferably 0.01 to 150 weight % based on the binder resin. If the content is insufficient, the resistance to acid gases may be lower, if too much, the film tends to lack the strength and wear resistance.

The compounds expressed by the general formulas (25) to (27) will be explained.

The content of the compounds expressed by the general formulas (25) to (27) is preferably 0.01 to 150 weight % based on the binder resin. If the content is insufficient, the resistance to acid gases may be lower, if too much, the film tends to lack the strength and wear resistance.

Examples of the alkyl group in the general formulas (25) to (27) include methyl, ethyl, propyl, butyl, hexyl and undecyl. Examples of cyclic aromatic groups are monovalent-hexavalent aromatic hydrocarbon groups having an aromatic hydrocarbon ring, such as benzene, naphthalene, anthracene and pyrene, and monovalent-hexavalent heterocyclic groups having a heterocyclic aromatic ring such as pyridine, quinoline, thiophene, furan, oxazole, oxadiazole and carbazole. Examples of substituents thereof are the alkyl groups given in the aforesaid examples, alkoxy groups such as methoxy, ethoxy, propoxy and butoxy, halogen atoms such as fluorine, chlorine, bromine and iodine, and aromatic rings. Examples of heterocyclic groups wherein $R^1$ and $R^2$ are bonded together comprising a nitrogen atom, are pyrrolidinyl, piperidinyl and pyrolinyl. Other examples of heterocyclic groups all comprising a nitrogen atom are aromatic heterocyclic groups such as N-methyl carbazole, N-ethyl carbazole, N-phenyl carbazole, indole, and quinoline.

Preferred examples of the general formulas (25) to (27) are given below. The present invention is not limited to these compounds.

General Formula (25)

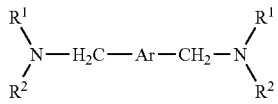

| No. | Ar | $R^1$ | $R^2$ |
|---|---|---|---|
| B-1 | 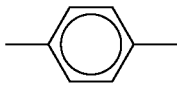 | —$CH_3$ | 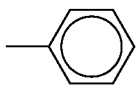 |

-continued
General Formula (25)
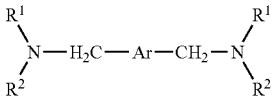
| No. | Ar | $R^1$ | $R^2$ |
|---|---|---|---|
| B-2 | 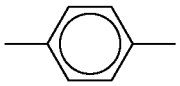 | $—CH_2CH_3$ | 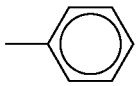 |
| B-3 | 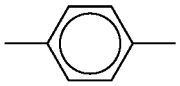 | $—CH_3$ | 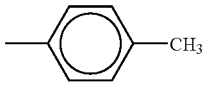 |
| B-4 | 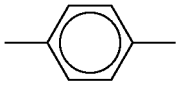 | $—CH_2CH_3$ | 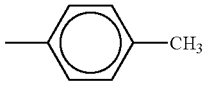 |
| B-5 | 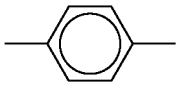 | $—CH_2CH_2CH_3$ | 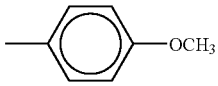 |
| B-6 | 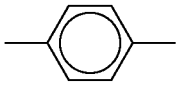 | $—CH_2CH_3$ | 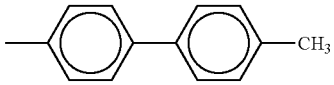 |
| B-7 | 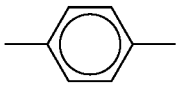 | 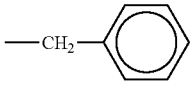 | 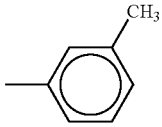 |
| B-8 | 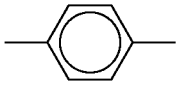 | 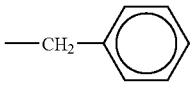 | 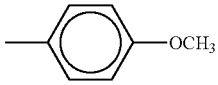 |
| B-9 | 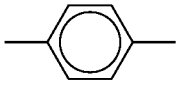 | $—CH_2CH_3$ | 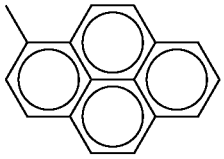 |
| B-10 | 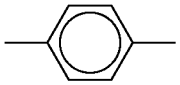 | 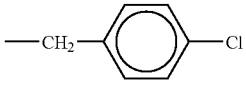 | 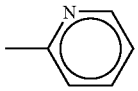 |
| B-11 | 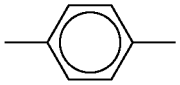 | $—CH_2CH_3$ | 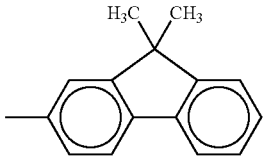 |
| B-12 | 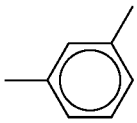 | $—CH_2CH_3$ | 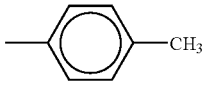 |

-continued
General Formula (25)
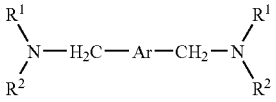
| No. | Ar | $R^1$ | $R^2$ |
|---|---|---|---|
| B-13 | 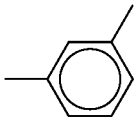 | 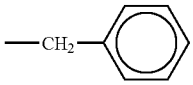 | 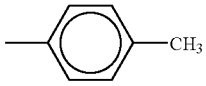 |
| B-14 | 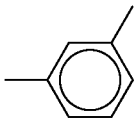 | 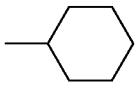 | 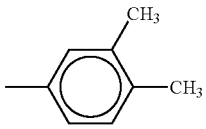 |
| B-15 | 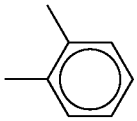 | $—CH_2CH_3$ | 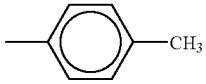 |
| B-16 | 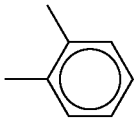 | $—CH_3$ | 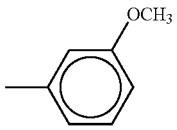 |
| B-17 | 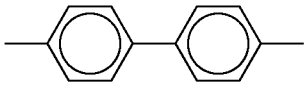 | $—CH_2CH_3$ | 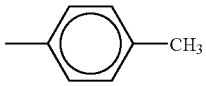 |
| B-18 | 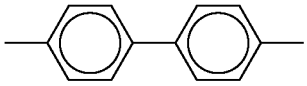 | 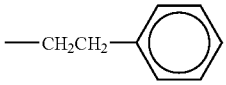 | 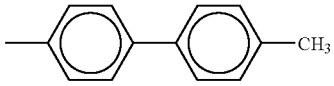 |
| B-19 | 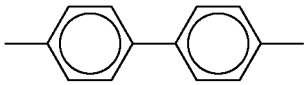 | $—CH_3$ | 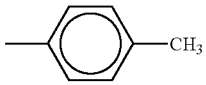 |
| B-20 | 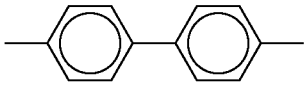 | $—CH_2CH_3$ | 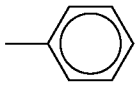 |
| B-21 | 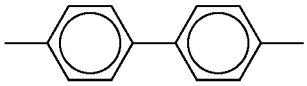 | 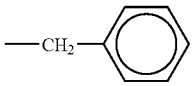 | 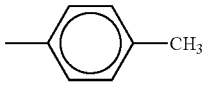 |
| B-22 | 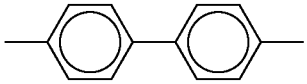 | 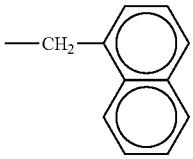 | 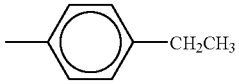 |
| B-23 | 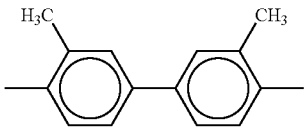 | $—CH_2CH_3$ | 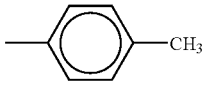 |

-continued
General Formula (25)
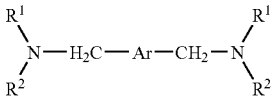
| No. | Ar | $R^1$ | $R^2$ |
|---|---|---|---|
| B-24 | 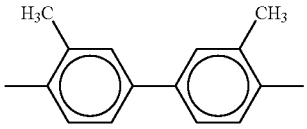 | 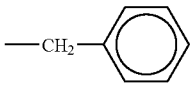 | 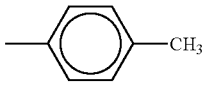 |
| B-25 | 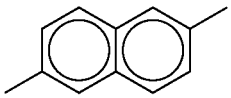 | $—CH_2CH_3$ | 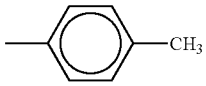 |
| B-26 | 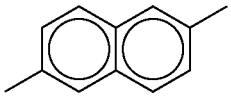 | $—CH_3$ | 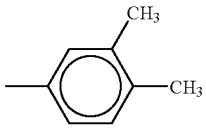 |
| B-27 | 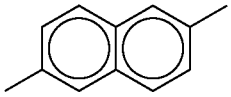 | 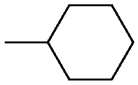 | 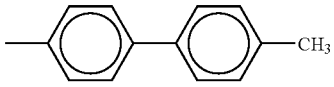 |
| B-28 | 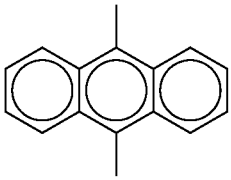 | $—CH_2CH_3$ | 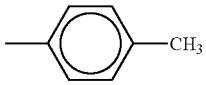 |
| B-29 | 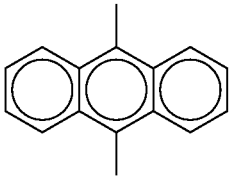 | $—CH_3$ | 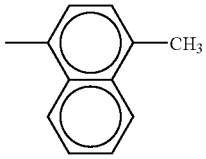 |
| B-30 | 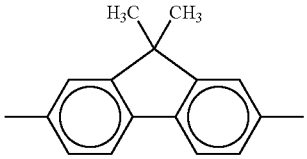 | $—CH_2CH_3$ | 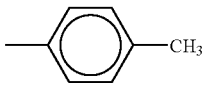 |
| B-31 | 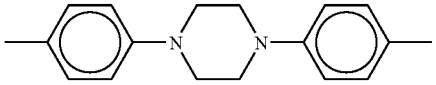 | $—CH_2CH_3$ | 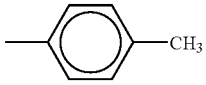 |
| B-32 | 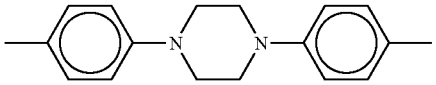 | $—CH_2CH_3$ | 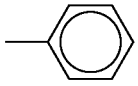 |
| B-33 | 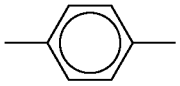 | $—CH_2CH_3$ | 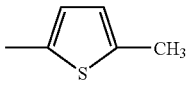 |

-continued
General Formula (25)
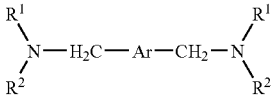
| No. | Ar | $R^1$ | $R^2$ |
|---|---|---|---|
| B-34 | 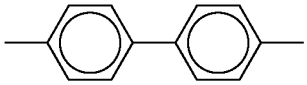 | 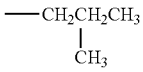 | 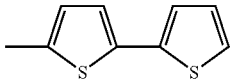 |
| B-35 | 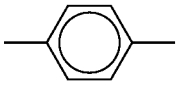 | | 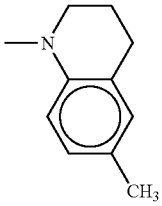 |
| B-36 | 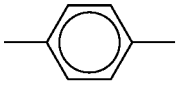 | | 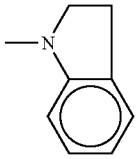 |
| B-37 | 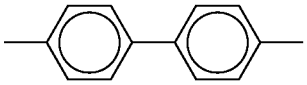 | | 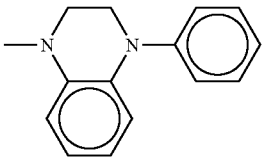 |
General Formula (26)
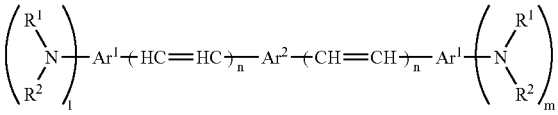
| No. | Exemplified Compounds |
|---|---|
| B-1-1 | 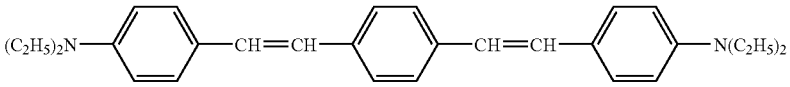 |
| B-1-2 | 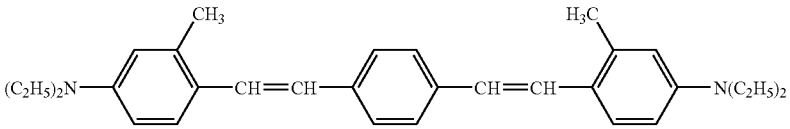 |
| B-1-3 | 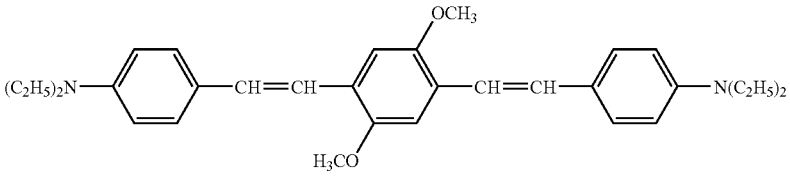 |

-continued
General Formula (26)
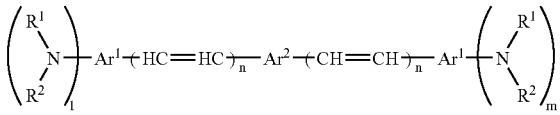
| No. | Exemplified Compounds |
|---|---|
| B-1-4 | 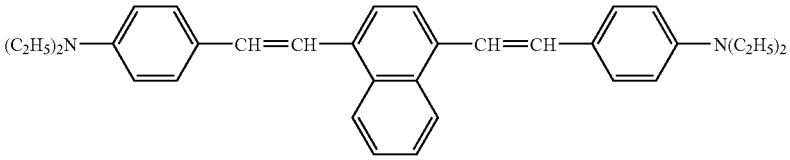 |
| B-1-5 | 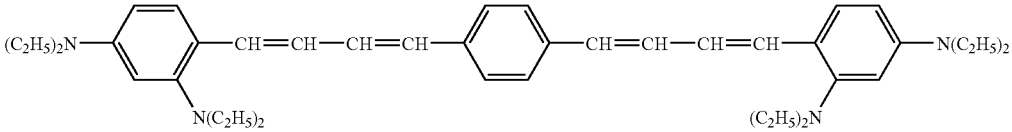 |
| B-1-6 | 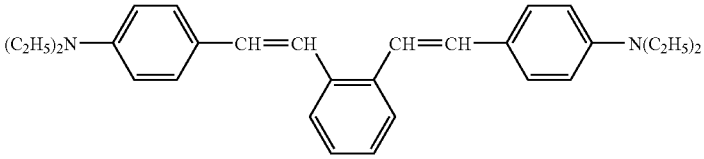 |
| B-1-7 | 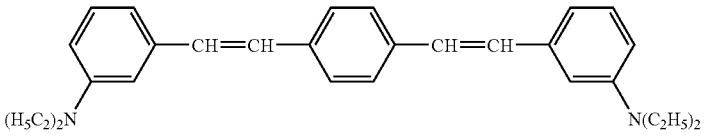 |
| B-1-8 | 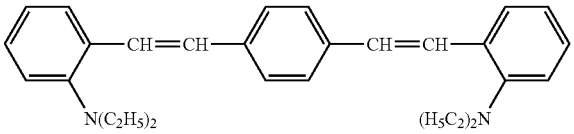 |
| B-1-9 | 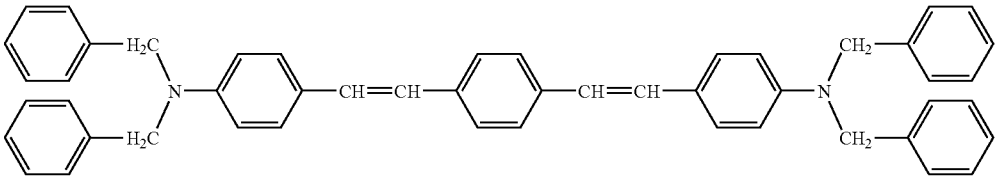 |
| B-1-10 | 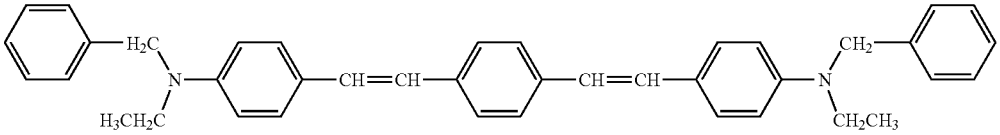 |
| B-1-11 | 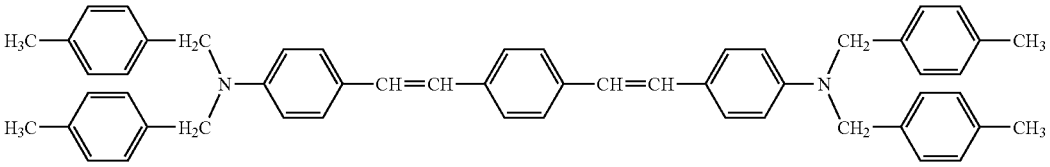 |

-continued
General Formula (26)
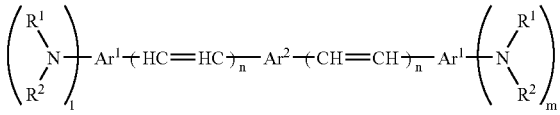
| No. | Exemplified Compounds |
|---|---|
| B-1-12 | 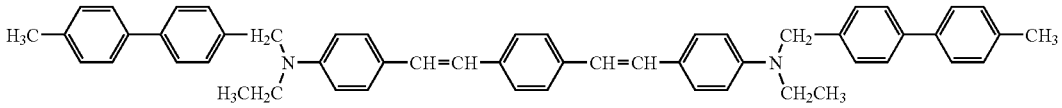 |
| B-1-13 | 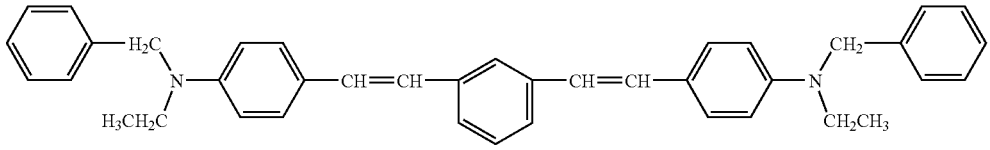 |
| B-1-14 | 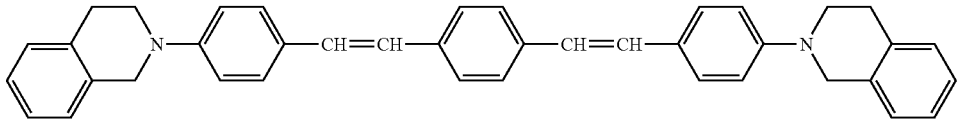 |
| B-1-15 | 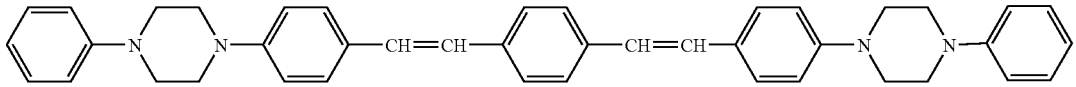 |
General Formula (27)
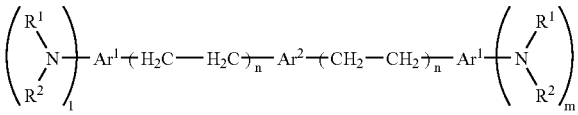
| No. | Exemplified Compounds |
|---|---|
| B-2-1 | 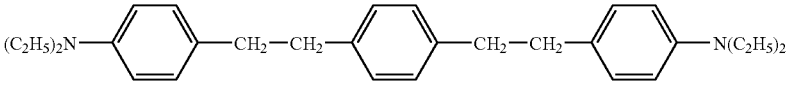 |
| B-2-2 | 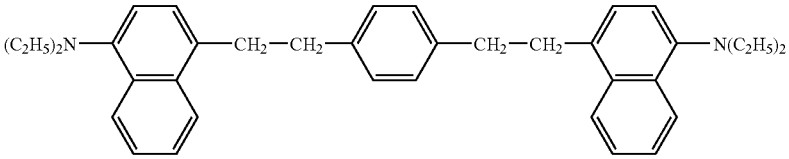 |
| B-2-3 | 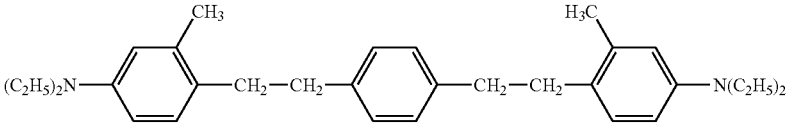 |
| B-2-4 | 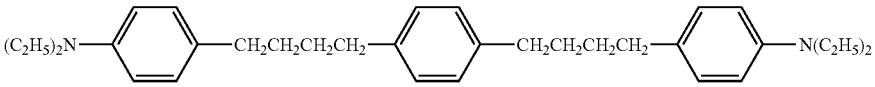 |

-continued
General Formula (27)
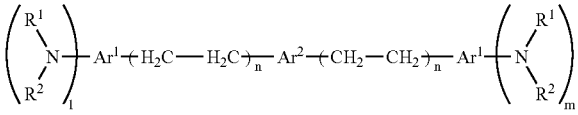
| No. | Exemplified Compounds |
|---|---|
| B-2-5 | 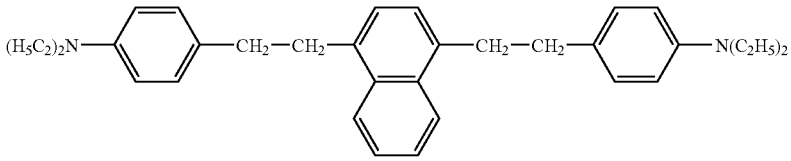 |
| B-2-6 | 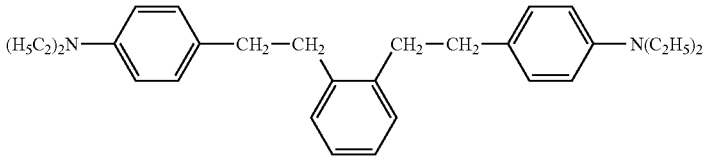 |
| B-2-7 | 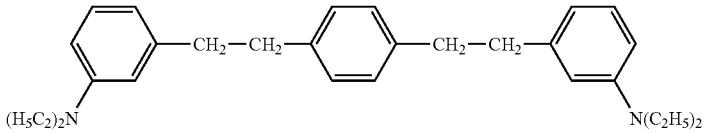 |
| B-2-8 | 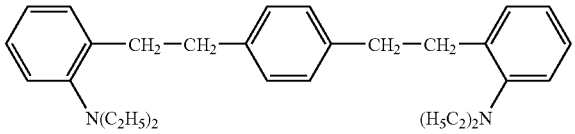 |
| B-2-9 | 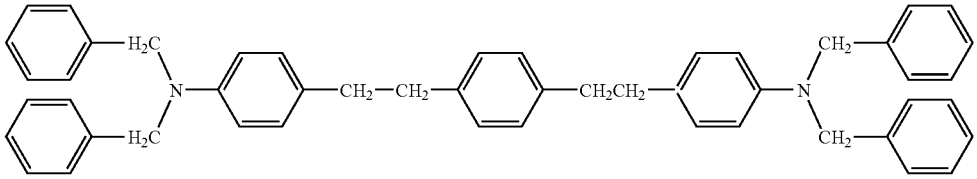 |
| B-2-10 | 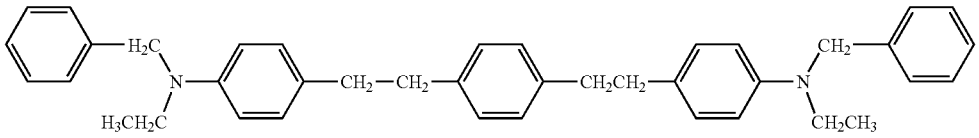 |
| B-2-11 | 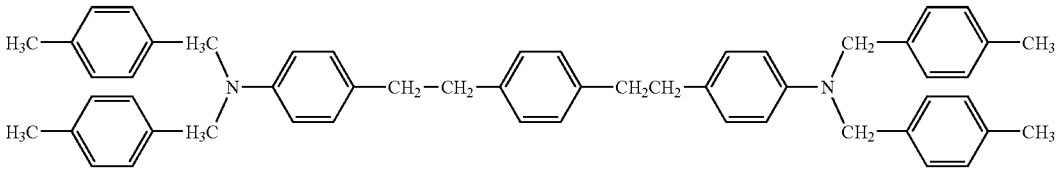 |

-continued

General Formula (27)

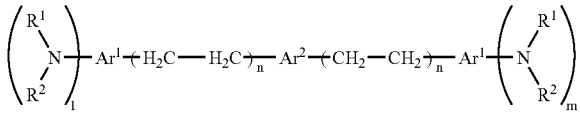

| No. | Exemplified Compounds |
|---|---|
| B-2-12 | 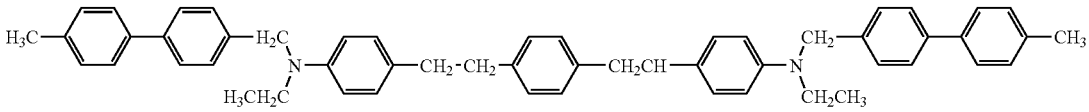 |
| B-2-13 | 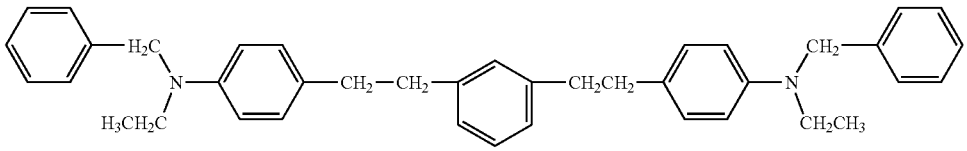 |
| B-2-14 | 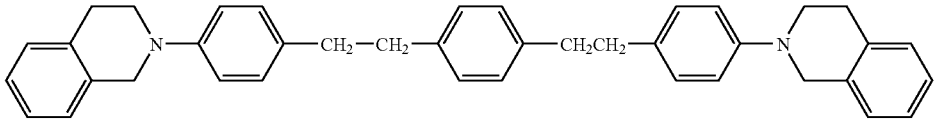 |
| B-2-15 | 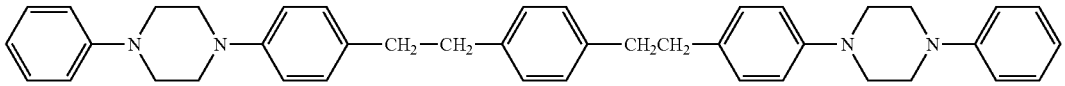 |

The compounds expressed by the general formula (28) will be explained.

General Formula (28)

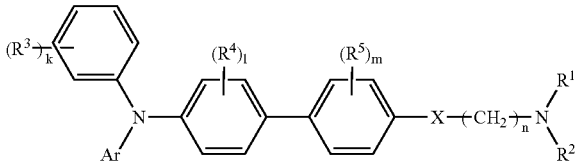

in the general formula (28), $R^1$ and $R^2$ are each a substituted or unsubstituted alkyl group, or a substituted or unsubstituted aromatic hydrocarbon group, may be identical or different; or $R^1$ and $R^2$ may combine each other to form a substituted or unsubstituted heterocyclic ring group containing a nitrogen atom; $R^3$, $R^4$, and $R^5$ are each a substituted or unsubstituted alkyl group, alkoxy group, or halogen atom; Ar is substituted or unsubstituted aromatic hydrocarbon group, or aromatic heterocyclic ring group; X is an oxygen atom, sulfur atom, or bond thereof, n is an integer of 2 to 4, k, l, m are each an integer of 0 to 3.

Examples of the alkyl group in the general formula (28) include methyl, ethyl, propyl, butyl, hexyl and undecyl. Examples of cyclic aromatic groups are monovalent-hexavalent aromatic hydrocarbon groups having an aromatic hydrocarbon ring, such as benzene, naphthalene, anthracene and pyrene, and monovalent-hexavalent heterocyclic groups having a heterocyclic aromatic ring such as pyridine, quinoline, thiophene, furan, oxazole, oxadiazole and carbazole. Examples of substituents thereof are the alkyl groups given in the aforesaid examples, alkoxy groups such as methoxy, ethoxy, propoxy and butoxy, halogen atoms such as fluorine, chlorine, bromine and iodine, and aromatic rings. Examples of heterocyclic groups wherein $R^1$ and $R^2$ are bonded together comprising a nitrogen atom, are pyrrolidinyl, piperidinyl and pyrolinyl. Other examples of heterocyclic groups all comprising a nitrogen atom are aromatic heterocyclic groups such as N-methyl carbazole, N-ethyl carbazole, N-phenyl carbazole, indole, and quinoline.

Preferred examples of the general formula (28) are given below. The present invention is not limited to these compounds.

The following exemplified compounds are those X being oxygen or sulfur atom in the general formula (28).

| No. | Exemplified Compounds |
|---|---|
| C-1-1 | 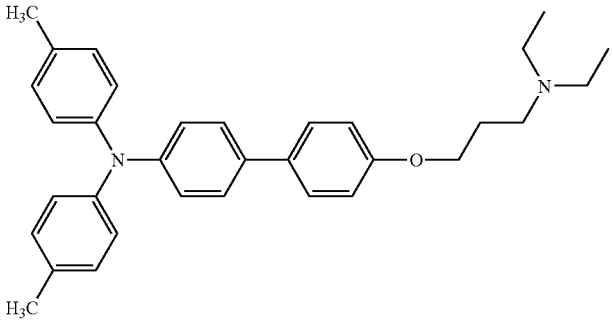 |
| C-1-2 | 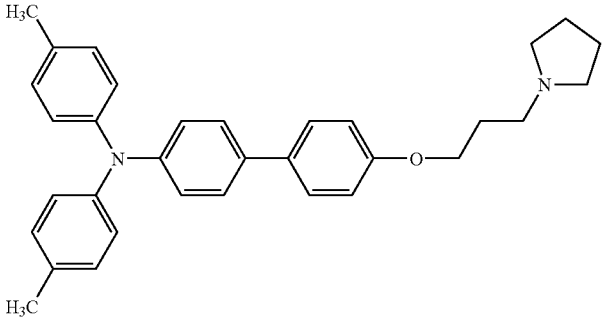 |
| C-1-3 | 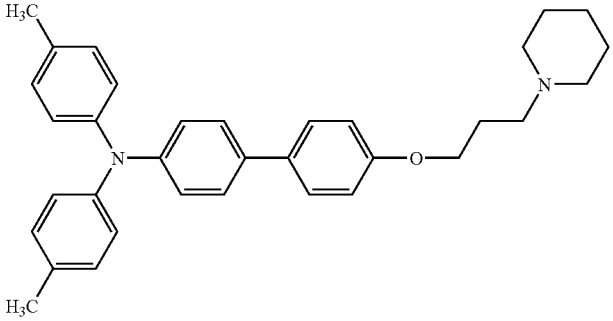 |
| C-1-4 | 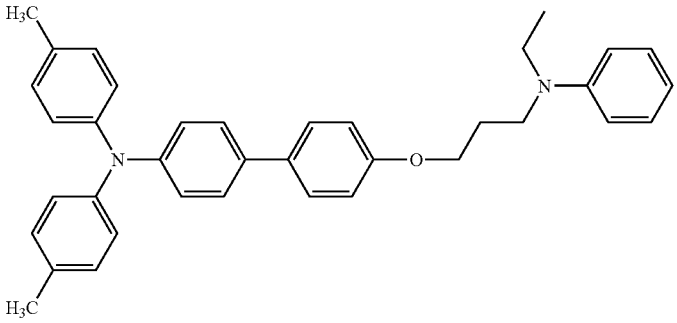 |

-continued
| No. | Exemplified Compounds |
|---|---|
| C-1-5 | 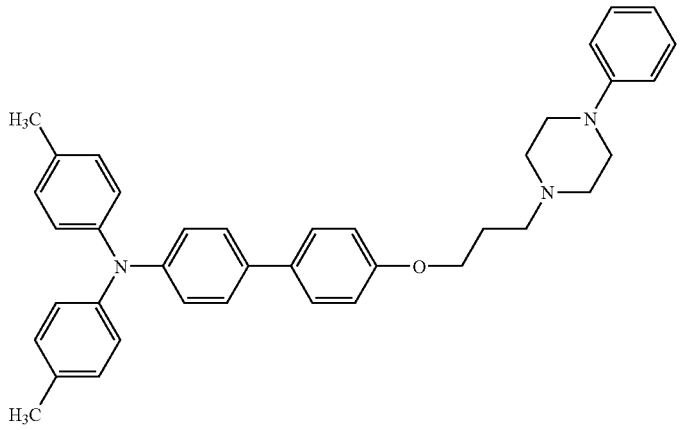 |
| C-1-6 | 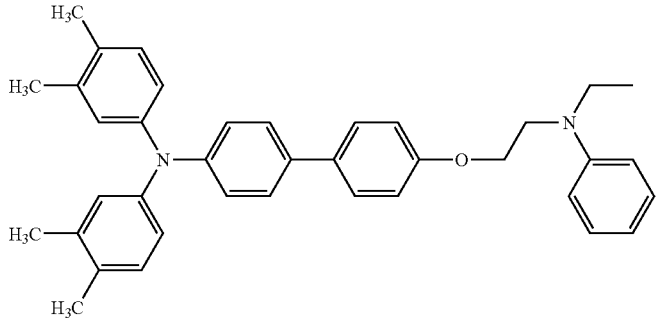 |
| C-1-7 | 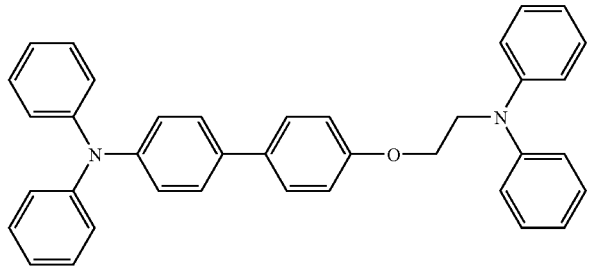 |
| C-1-8 | 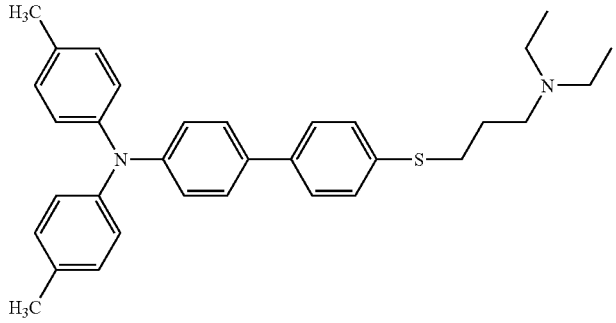 |

-continued
| No. | Exemplified Compounds |
|---|---|
| C-1-9 | 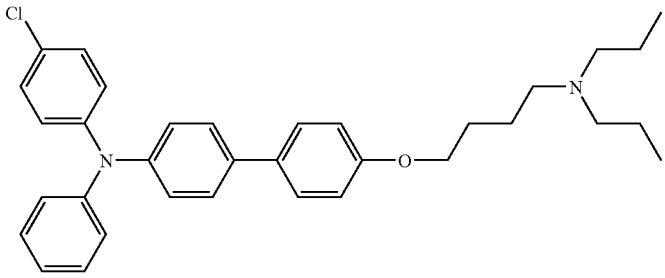 |
| C-1-10 | 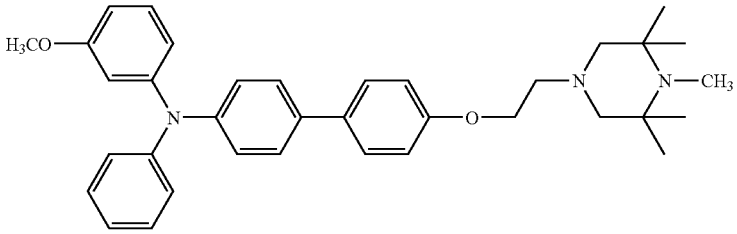 |
| C-1-11 | 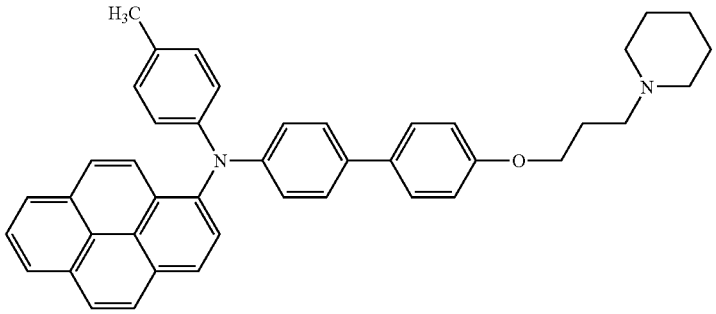 |
| C-1-12 | 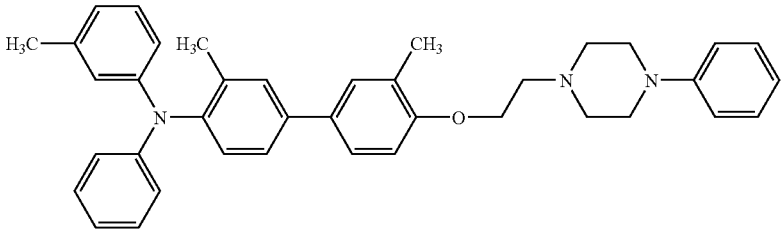 |
| C-1-13 | 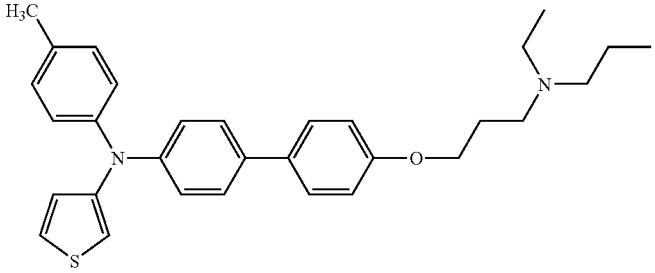 |

The following exemplified compounds are those X being a bonding in the general formula (28).
| No. | Exemplified Compounds |
|---|---|
| C-2-1 | 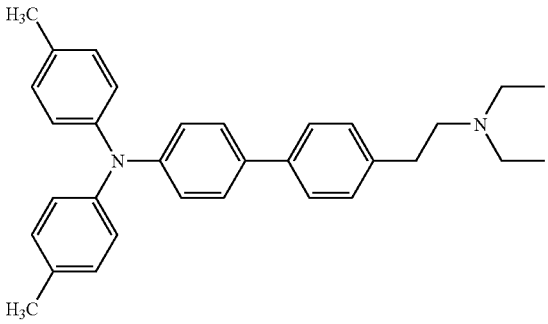 |
| C-2-2 | 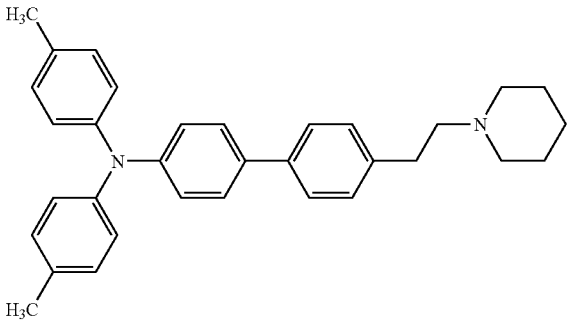 |
| C-2-3 | 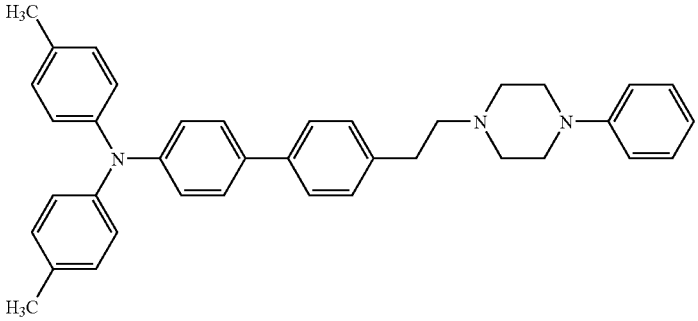 |
| C-2-4 | 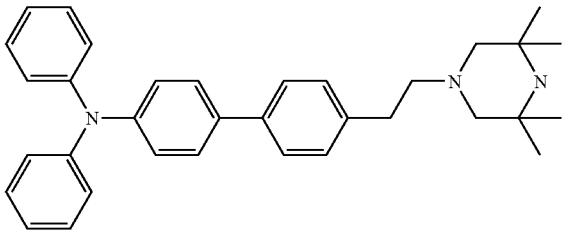 |

-continued
| No. | Exemplified Compounds |
|---|---|
| C-2-5 | 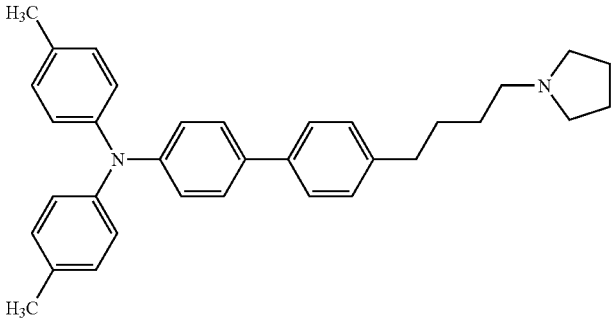 |
| C-2-6 | 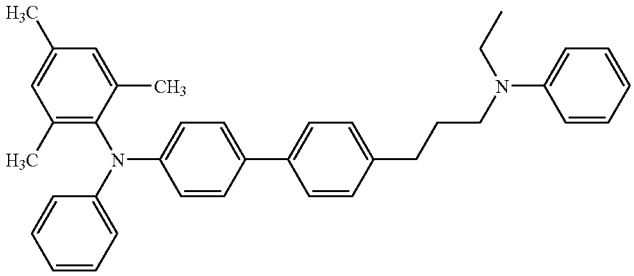 |
| C-2-7 | 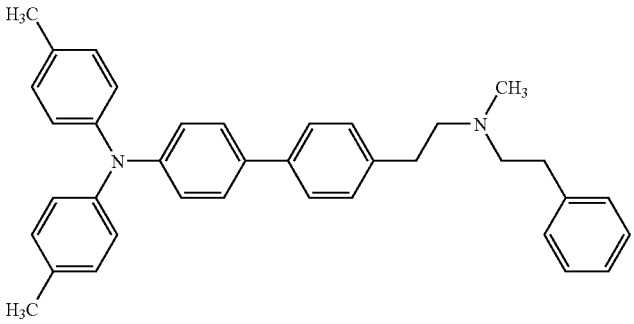 |
| C-2-8 | 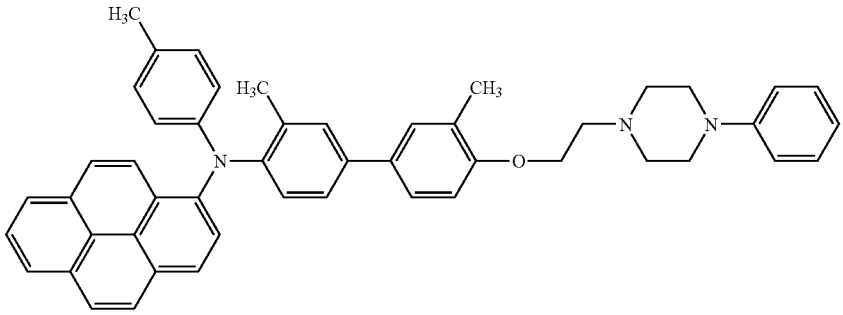 |

-continued

| No. | Exemplified Compounds |
|---|---|
| C-2-9 | 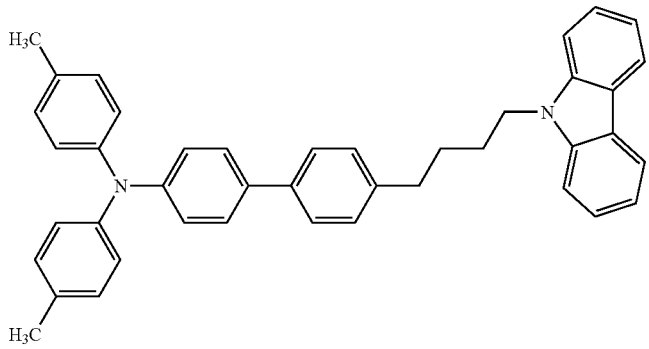 |
| C-2-10 | 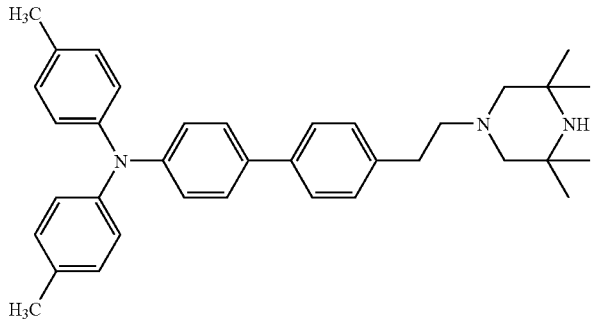 |
| C-2-11 | 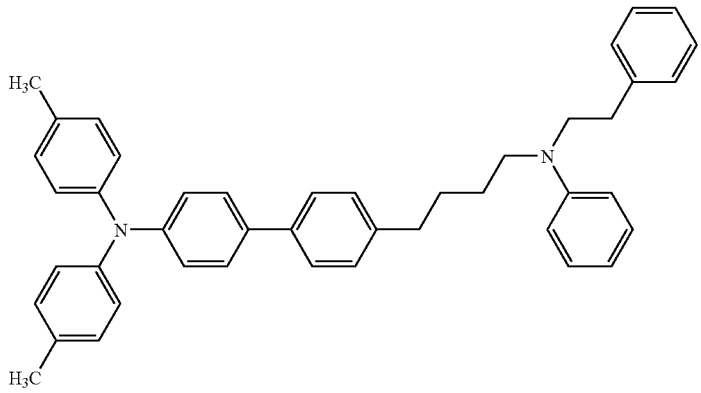 |

The content of the compounds expressed by the general formula (28) is preferably 0.01 to 150 weight % based on the binder resin. If the content is insufficient, the resistance to acid gases may be lower, if too much, the film tends to lack the strength and wear resistance.

The hydroxy aromatic compounds expressed by the general formulas (101) to (112) will be explained. The aromatic hydroxy compounds adapted to the present invention are those expressed by the general formulas (101) to (112).

The specific compounds expressed by the general formula (101) are D-1-1 to D-1-15 below, but not limited to.

| No. | Exemplified Compounds |
|---|---|
| D-1-1 | 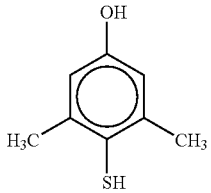 |

-continued
| No. | Exemplified Compounds |
|---|---|
| D-1-2 | 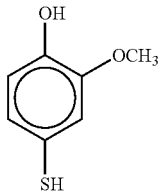 |
| D-1-3 | 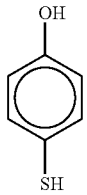 |
| D-1-4 | 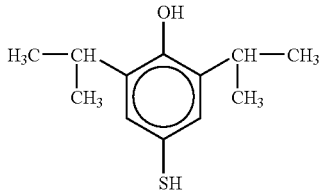 |
| D-1-5 | 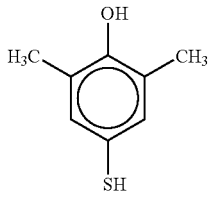 |
| D-1-6 | 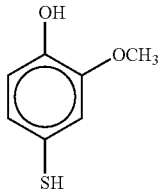 |
| D-1-7 | 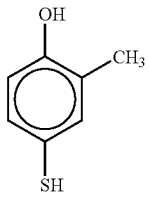 |
| D-1-8 | 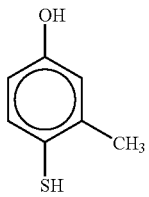 |
-continued
| No. | Exemplified Compounds |
|---|---|
| D-1-9 | 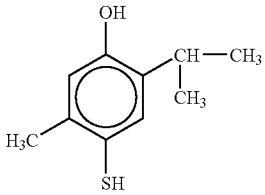 |
| D-1-10 | 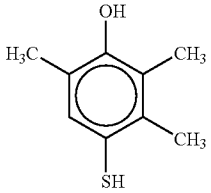 |
| D-1-11 | 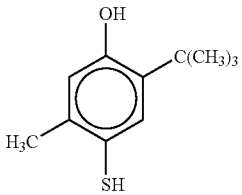 |
| D-1-12 | 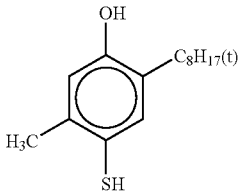 |
| D-1-13 | 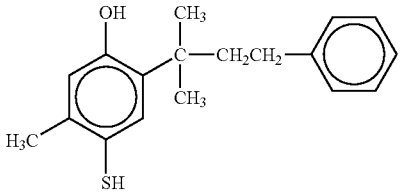 |
| D-1-14 | 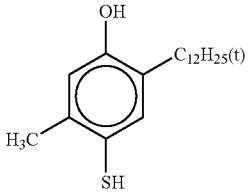 |
| D-1-15 | 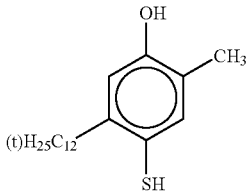 |
Examples of the compounds expressed by the general formula (102) include D-2-1 to D-2-224, D-3-1 to D-3-48, and D-4-1 to D-4-13 below.

| No. | Exemplified Compounds |
|---|---|
| D-2-1 | 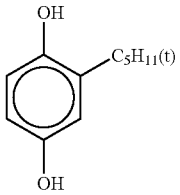 |
| D-2-2 | 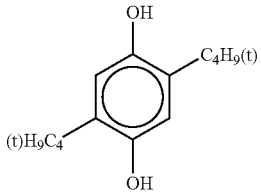 |
| D-2-3 | 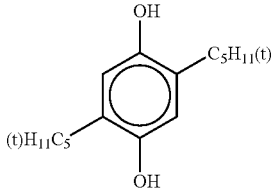 |
| D-2-4 | 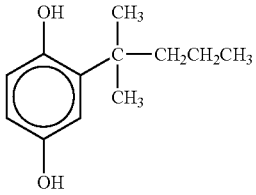 |
| D-2-5 | 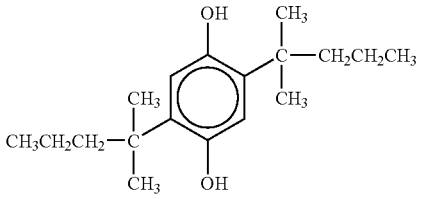 |
| D-2-6 | 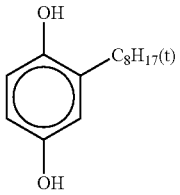 |
| D-2-7 | 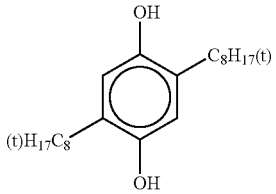 |

-continued
| No. | Exemplified Compounds |
|---|---|
| D-2-8 | 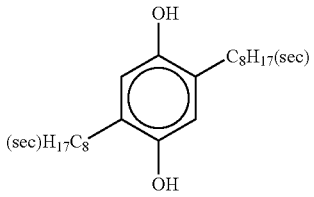 |
| D-2-9 | 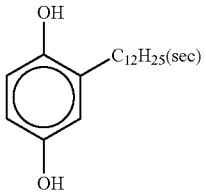 |
| D-2-10 | 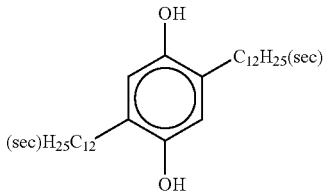 |
| D-2-11 | 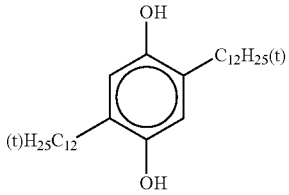 |
| D-2-12 | 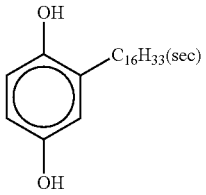 |
| D-2-13 | 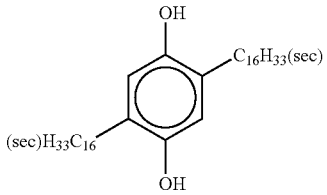 |
| D-2-14 | 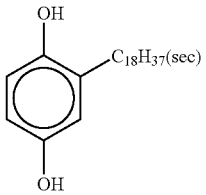 |

-continued
| No. | Exemplified Compounds |
|---|---|
| D-2-15 | 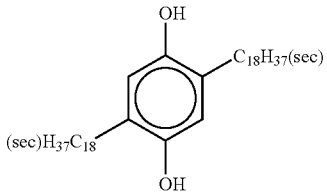 |
| D-2-16 | 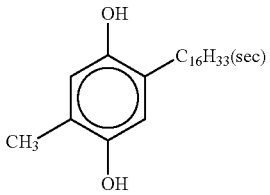 |
| D-2-17 | 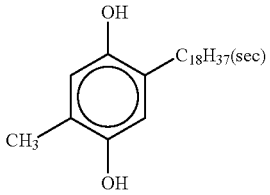 |
| D-2-18 | 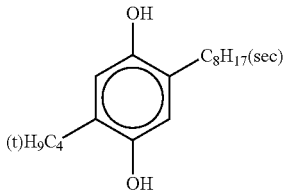 |
| D-2-19 | 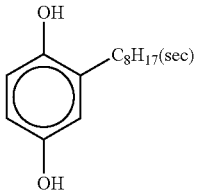 |
| D-2-20 | 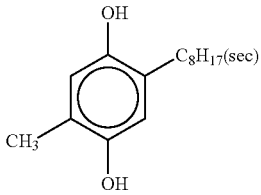 |
| D-2-21 | 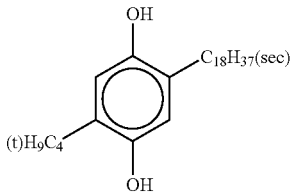 |

-continued
| No. | Exemplified Compounds |
|---|---|
| D-2-22 | 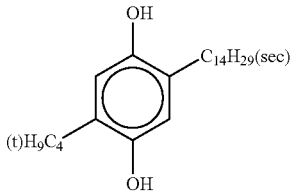 |
| D-2-23 | 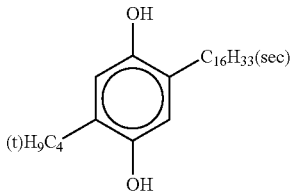 |
| D-2-24 | 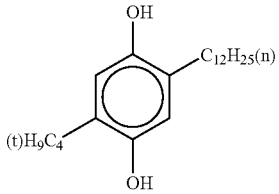 |
| D-2-25 | 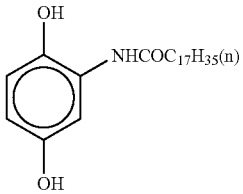 |
| D-2-26 | 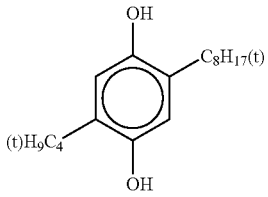 |
| D-2-27 | 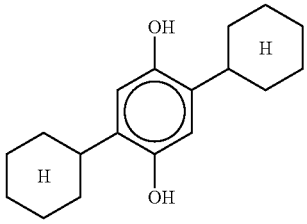 |
| D-2-28 | 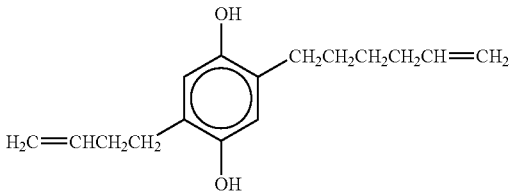 |

-continued
| No. | Exemplified Compounds |
|---|---|
| D-2-29 | 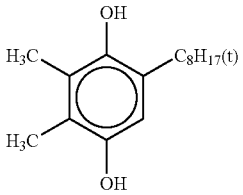 |
| D-2-30 | 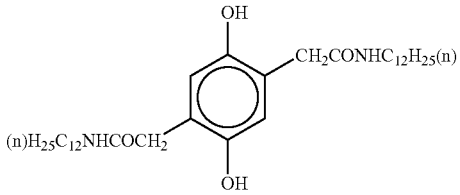 |
| D-2-31 | 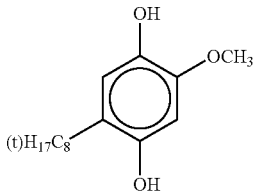 |
| D-2-32 | 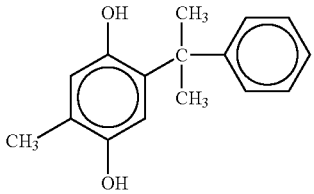 |
| D-2-33 | 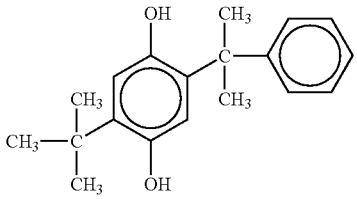 |
| D-2-34 | 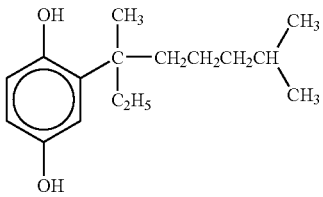 |
| D-2-35 | 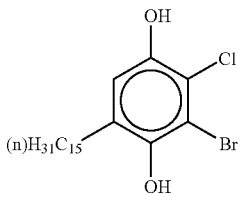 |

-continued
| No. | Exemplified Compounds |
|---|---|
| D-2-36 | 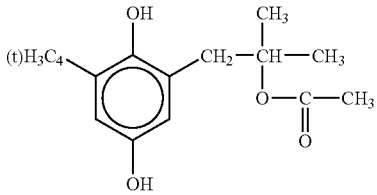 |
| D-2-37 | 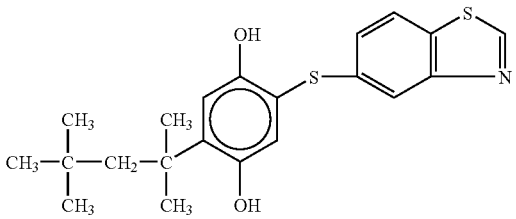 |
| D-2-38 | 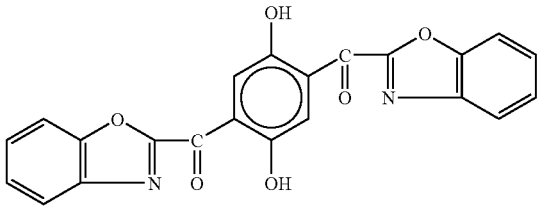 |
| D-2-39 | 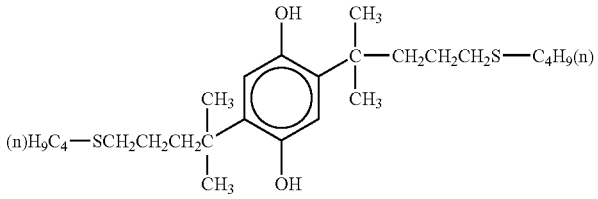 |
| D-2-40 | 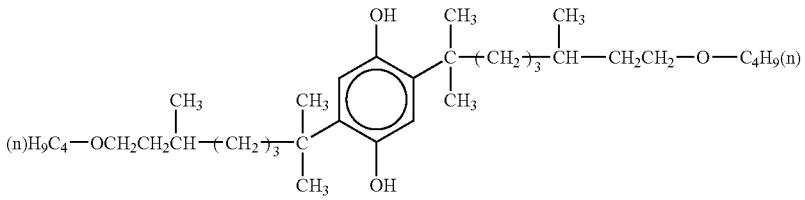 |
| D-2-41 | 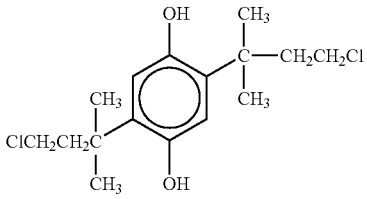 |

-continued
| No. | Exemplified Compounds |
|---|---|
| D-2-42 | 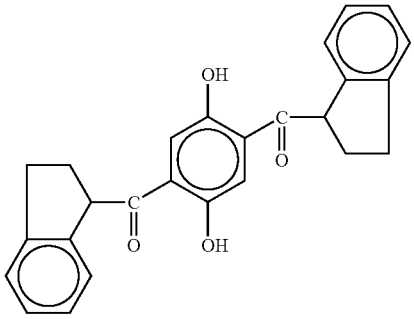 |
| D-2-43 | 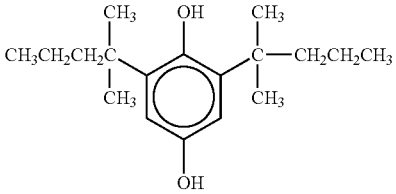 |
| D-2-44 | 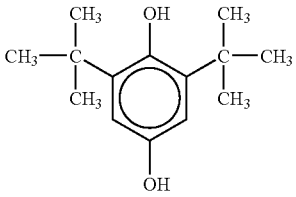 |
| D-2-45 | 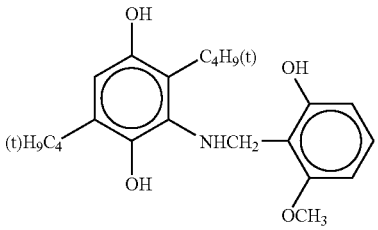 |
| D-2-46 | 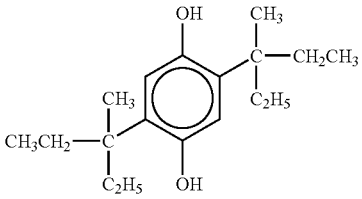 |
| D-2-47 | 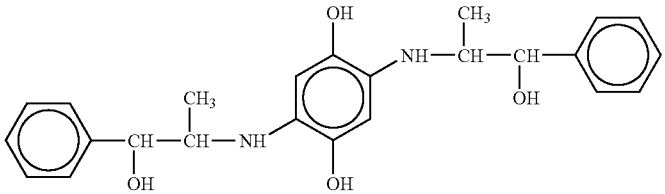 |

-continued
| No. | Exemplified Compounds |
|---|---|
| D-2-48 | 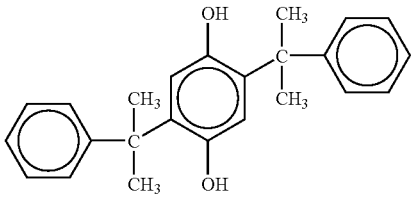 |
| D-2-49 | 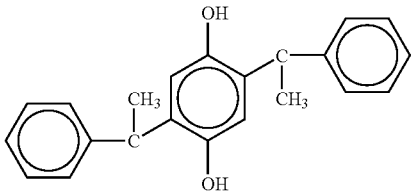 |
| D-2-50 | 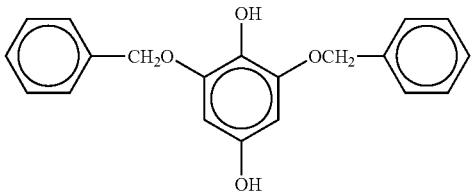 |
| D-2-51 | 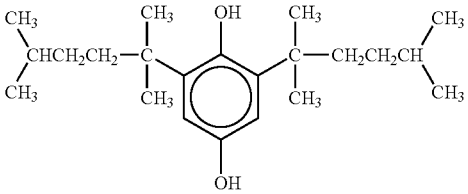 |
| D-2-52 | 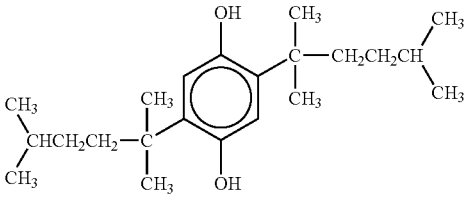 |
| D-2-53 | 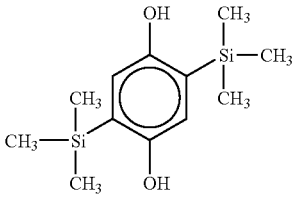 |
| D-2-54 | 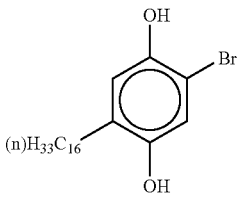 |

-continued
| No. | Exemplified Compounds |
|---|---|
| D-2-55 | 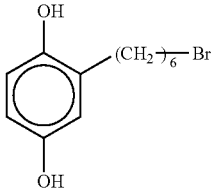 |
| D-2-56 | 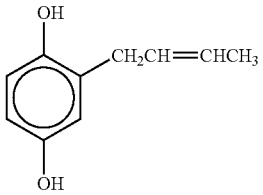 |
| D-2-57 | 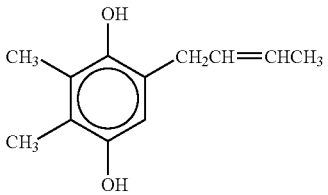 |
| D-2-58 | 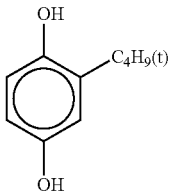 |
| D-2-59 | 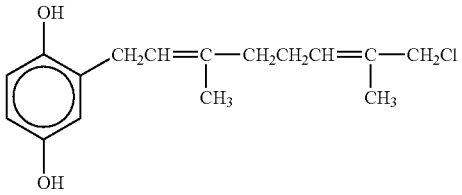 |
| D-2-60 | 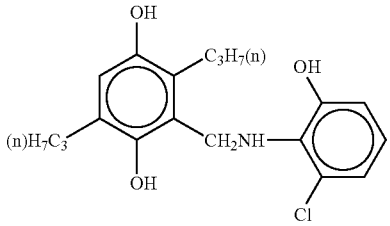 |
| D-2-61 | 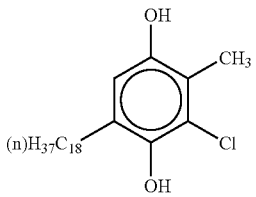 |

-continued
| No. | Exemplified Compounds |
|---|---|
| D-2-62 | 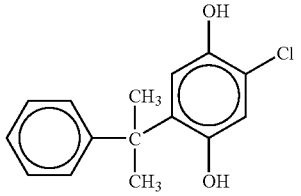 |
| D-2-63 | 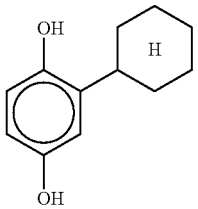 |
| D-2-64 | 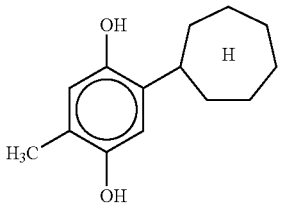 |
| D-2-65 | 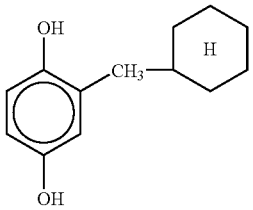 |
| D-2-66 | 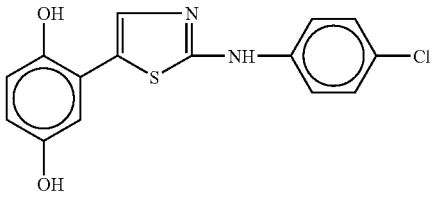 |
| D-2-67 | 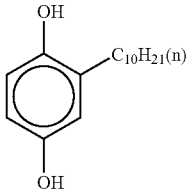 |
| D-2-68 | 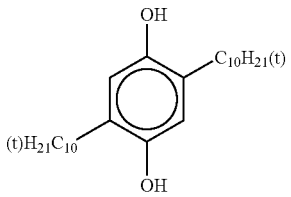 |

-continued
| No. | Exemplified Compounds |
|---|---|
| D-2-69 | 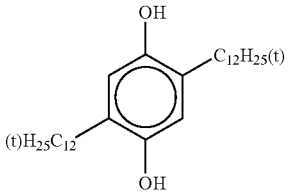 |
| D-2-70 | 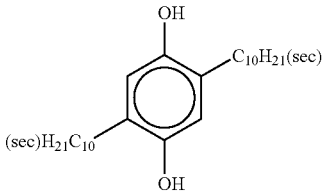 |
| D-2-71 | 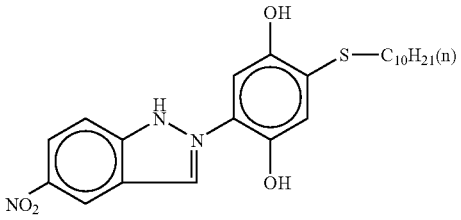 |
| D-2-72 | 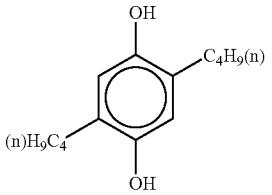 |
| D-2-73 | 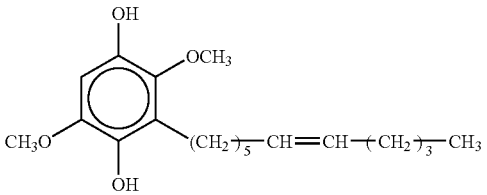 |
| D-2-74 | 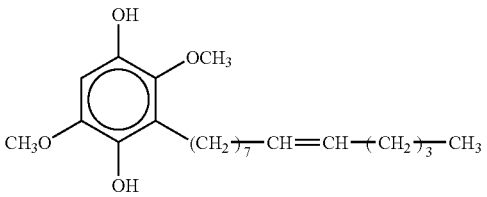 |
| D-2-75 | 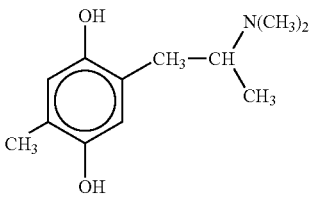 |

-continued
| No. | Exemplified Compounds |
|---|---|
| D-2-76 | 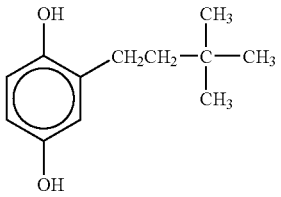 |
| D-2-77 | 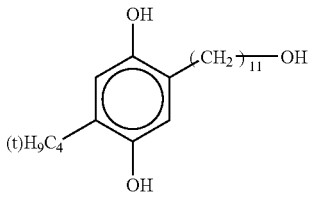 |
| D-2-78 | 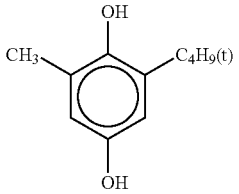 |
| D-2-79 | 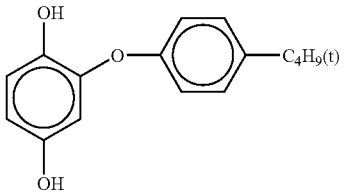 |
| D-2-80 | 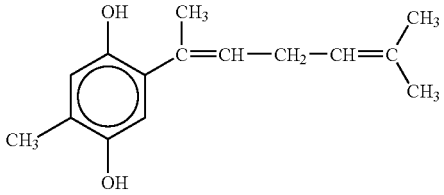 |
| D-2-81 | 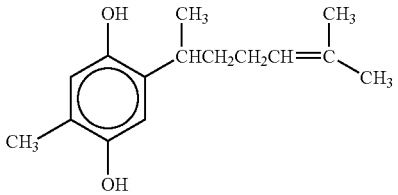 |
| D-2-82 | 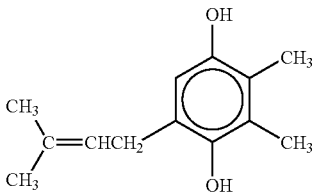 |

-continued
| No. | Exemplified Compounds |
|---|---|
| D-2-83 | 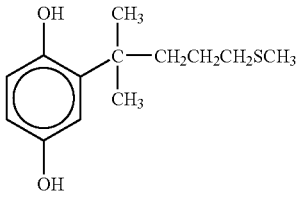 |
| D-2-84 | 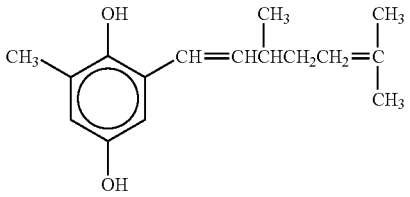 |
| D-2-85 | 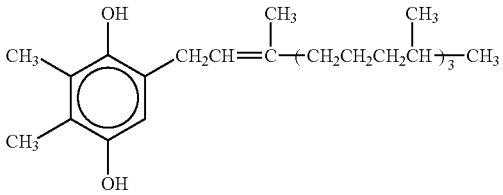 |
| D-2-86 | 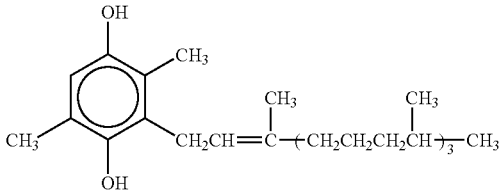 |
| D-2-87 | 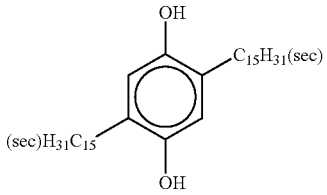 |
| D-2-88 | 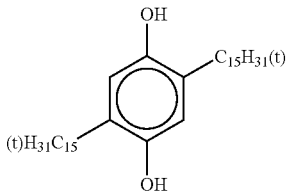 |
| D-2-89 | 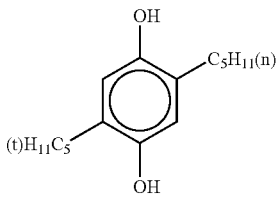 |

-continued
| No. | Exemplified Compounds |
|---|---|
| D-2-90 | 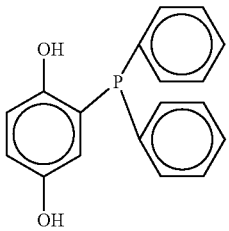 |
| D-2-91 | 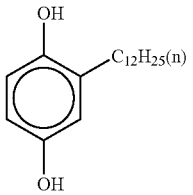 |
| D-2-92 | 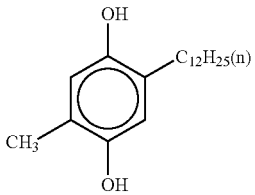 |
| D-2-93 | 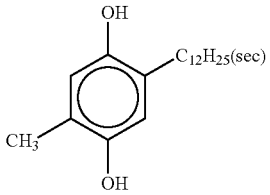 |
| D-2-94 | 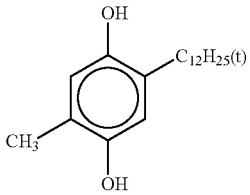 |
| D-2-95 | 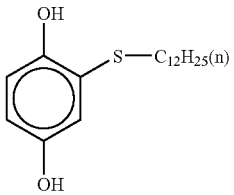 |
| D-2-96 | 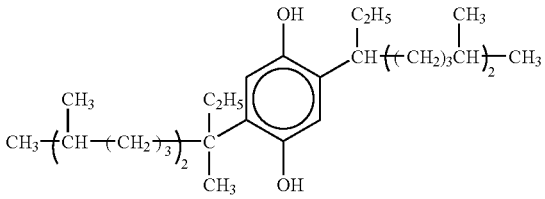 |

-continued
| No. | Exemplified Compounds |
|---|---|
| D-2-97 | 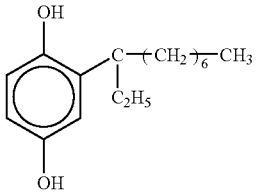 |
| D-2-98 | 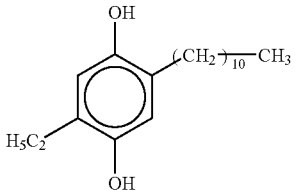 |
| D-2-99 | 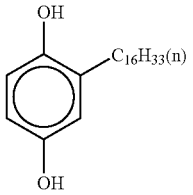 |
| D-2-100 | 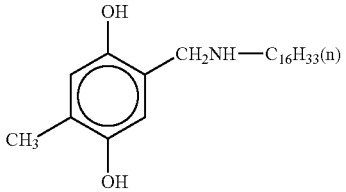 |
| D-2-101 | 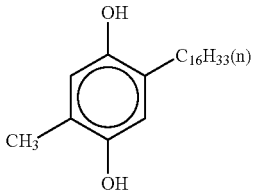 |
| D-2-102 | 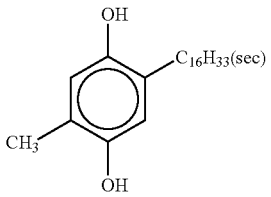 |
| D-2-103 | 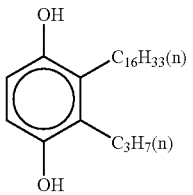 |

-continued
| No. | Exemplified Compounds |
|---|---|
| D-2-104 | 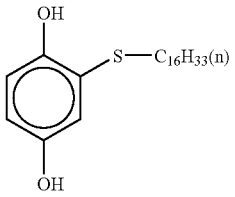 |
| D-2-105 | 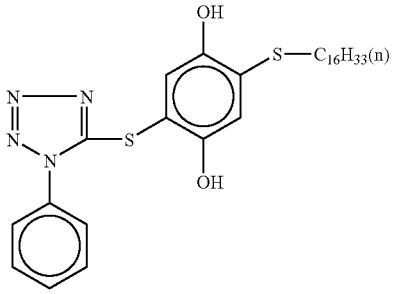 |
| D-2-106 | 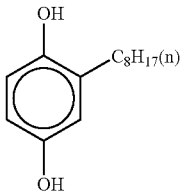 |
| D-2-107 | 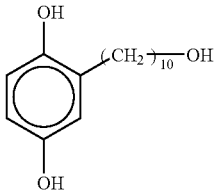 |
| D-2-108 | 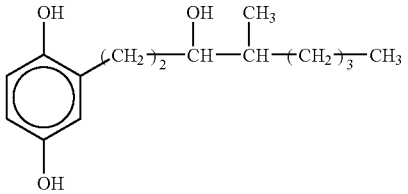 |
| D-2-109 | 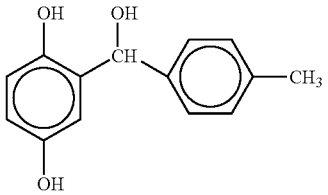 |
| D-2-110 | 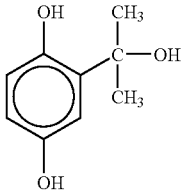 |

-continued
| No. | Exemplified Compounds |
|---|---|
| D-2-111 | 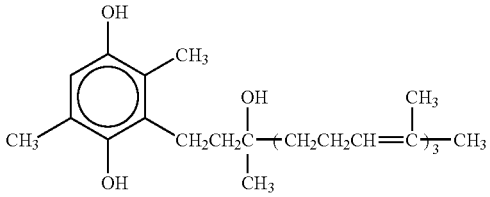 |
| D-2-112 | 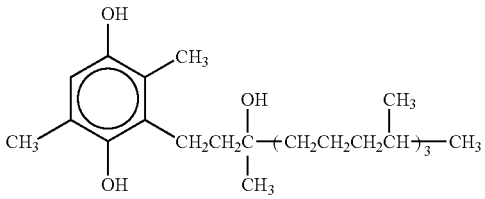 |
| D-2-113 | 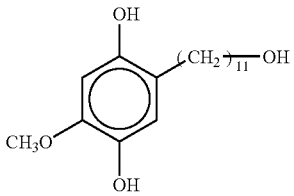 |
| D-2-114 | 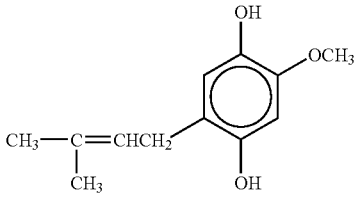 |
| D-2-115 | 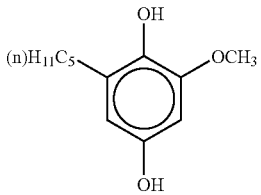 |
| D-2-116 | 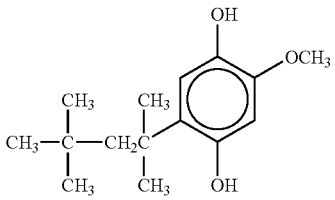 |
| D-2-117 | 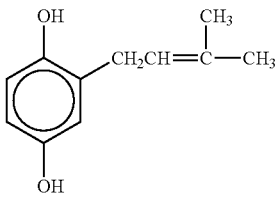 |

-continued
| No. | Exemplified Compounds |
|---|---|
| D-2-118 | 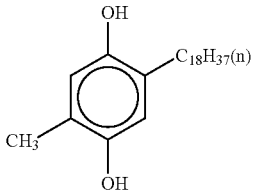 |
| D-2-119 | 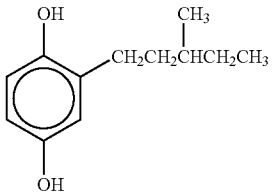 |
| D-2-120 | 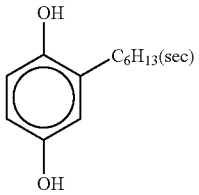 |
| D-2-121 | 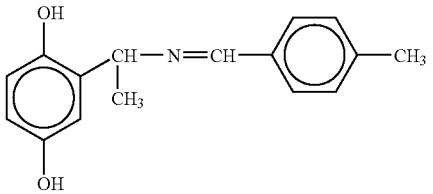 |
| D-2-122 | 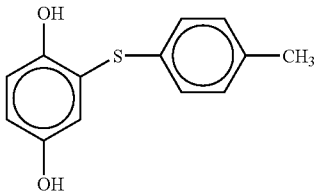 |
| D-2-123 | 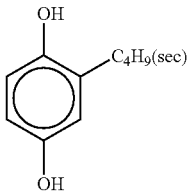 |
| D-2-124 | 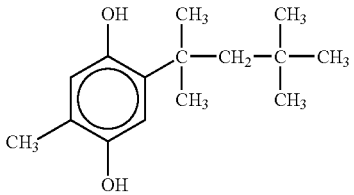 |

-continued
| No. | Exemplified Compounds |
|---|---|
| D-2-125 | 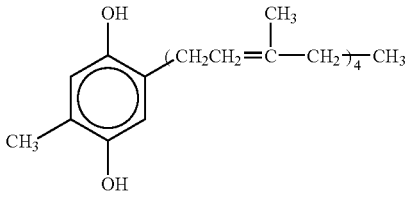 |
| D-2-126 | 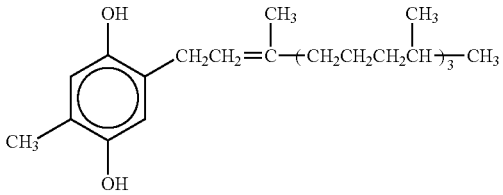 |
| D-2-127 | 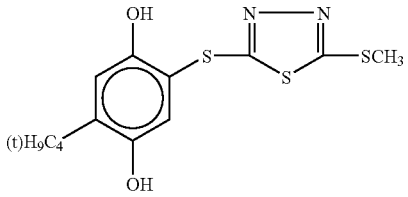 |
| D-2-128 | 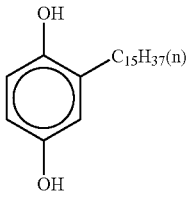 |
| D-2-129 | 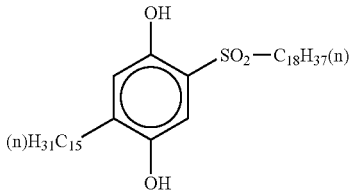 |
| D-2-130 | 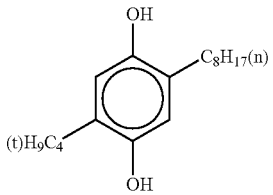 |
| D-2-131 | 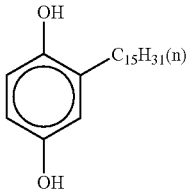 |

-continued
| No. | Exemplified Compounds |
|---|---|
| D-2-132 | 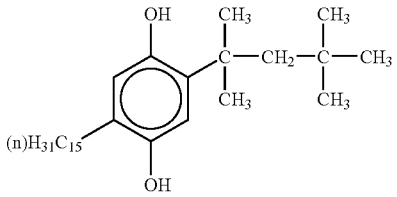 |
| D-2-133 | 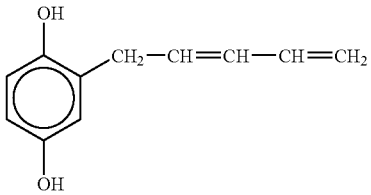 |
| D-2-134 | 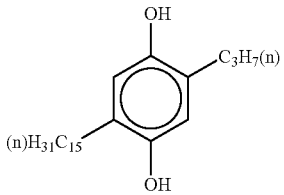 |
| D-2-135 | 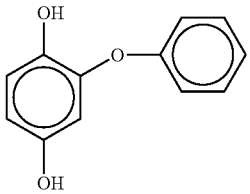 |
| D-2-136 | 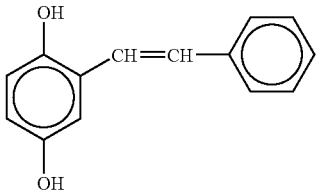 |
| D-2-137 | 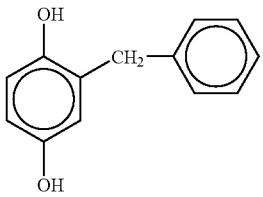 |
| D-2-138 | 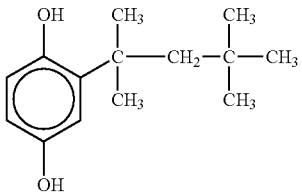 |

-continued
| No. | Exemplified Compounds |
|---|---|
| D-2-139 | 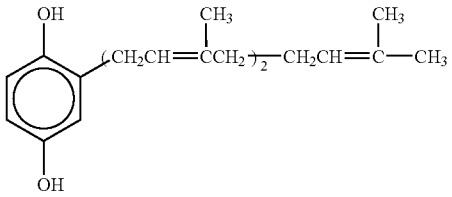 |
| D-2-140 | 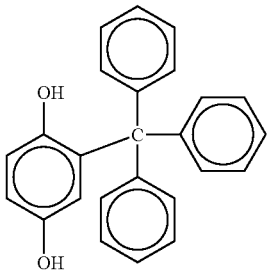 |
| D-2-141 | 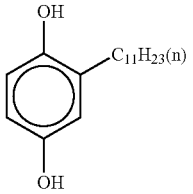 |
| D-2-142 | 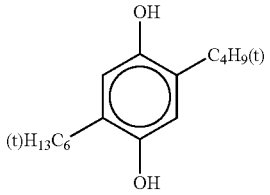 |
| D-2-143 | 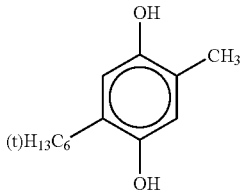 |
| D-2-144 | 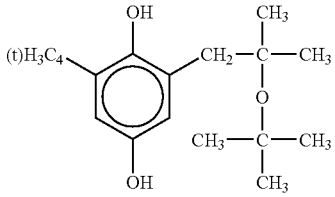 |
| D-2-145 | 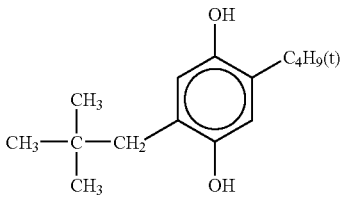 |

-continued
| No. | Exemplified Compounds |
|---|---|
| D-2-146 | 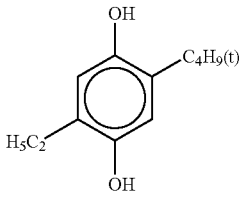 |
| D-2-147 | 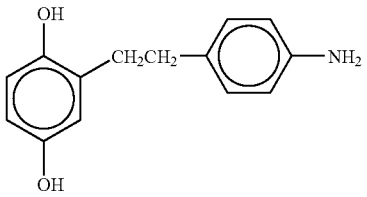 |
| D-2-148 | 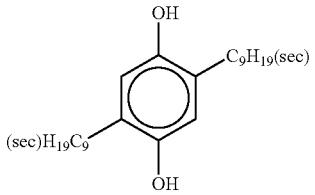 |
| D-2-149 | 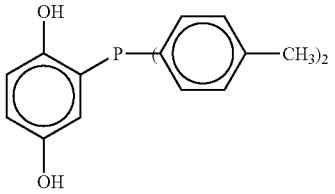 |
| D-2-150 | 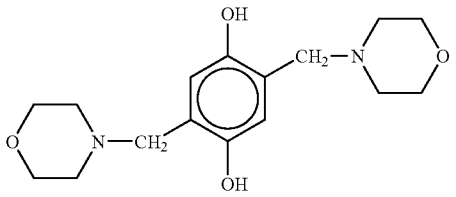 |
| D-2-151 | 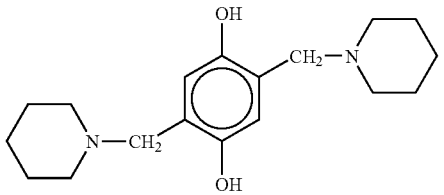 |
| D-2-152 | 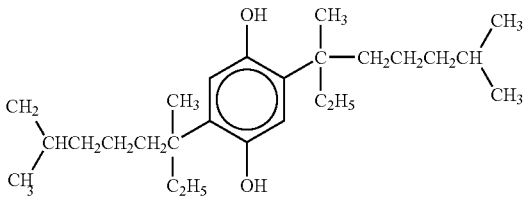 |

-continued
| No. | Exemplified Compounds |
|---|---|
| D-2-153 | 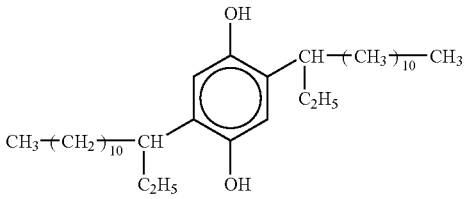 |
| D-2-154 | 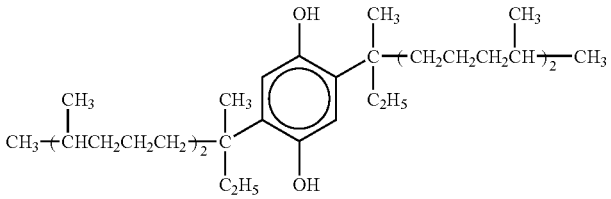 |
| D-2-155 | 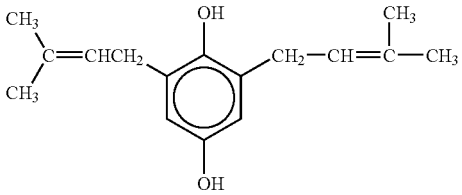 |
| D-2-156 | 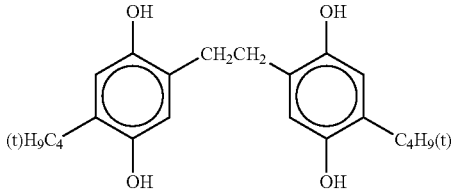 |
| D-2-157 | 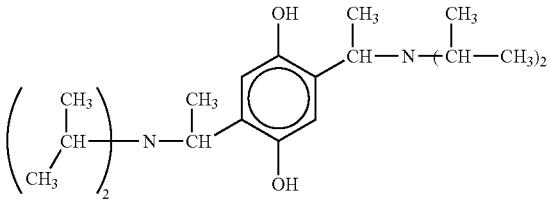 |
| D-2-158 | 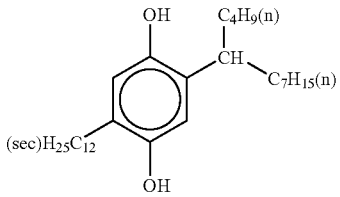 |
| D-2-159 | 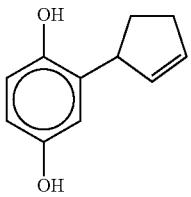 |

-continued
| No. | Exemplified Compounds |
|---|---|
| D-2-160 | 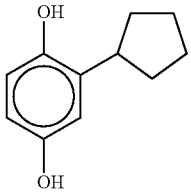 |
| D-2-161 | 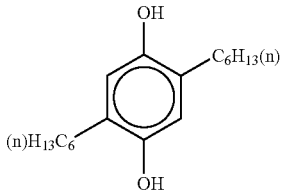 |
| D-2-162 | 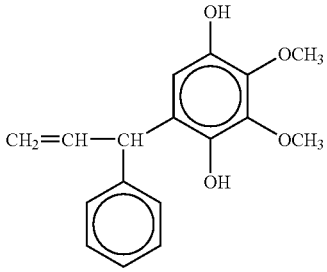 |
| D-2-163 | 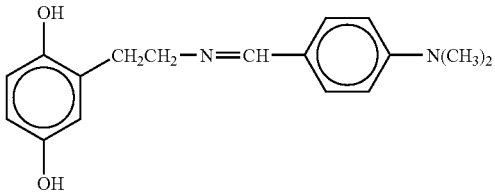 |
| D-2-164 | 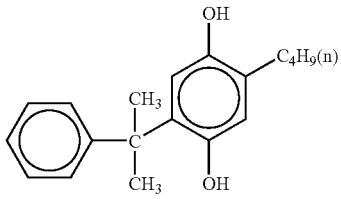 |
| D-2-165 | 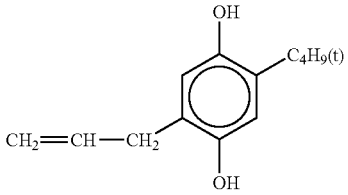 |
| D-2-166 | 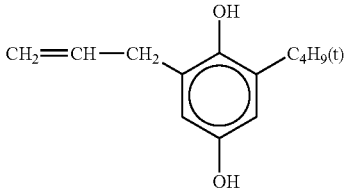 |

-continued
| No. | Exemplified Compounds |
|---|---|
| D-2-167 | 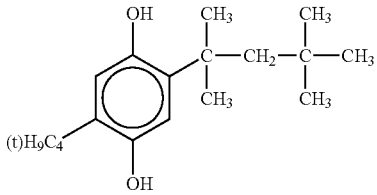 |
| D-2-168 | 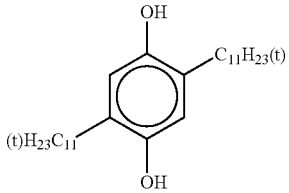 |
| D-2-169 | 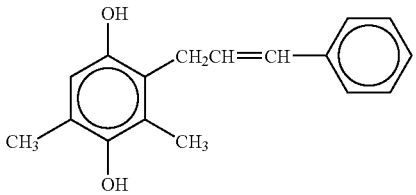 |
| D-2-170 | 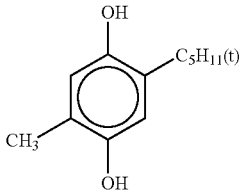 |
| D-2-171 | 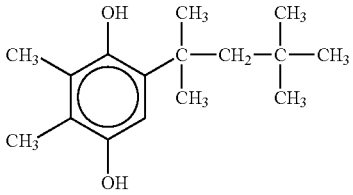 |
| D-2-172 | 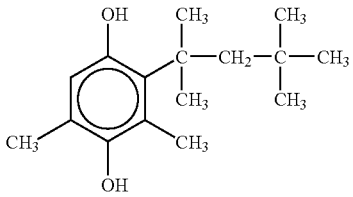 |
| D-2-173 | 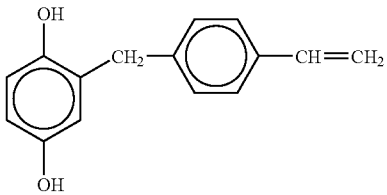 |

-continued
| No. | Exemplified Compounds |
|---|---|
| D-2-174 | 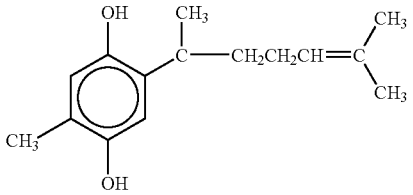 |
| D-2-175 | 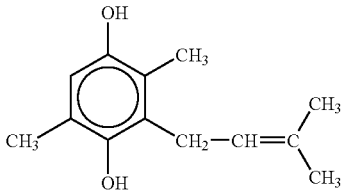 |
| D-2-176 | 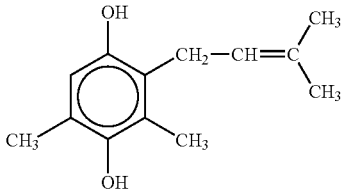 |
| D-2-177 | 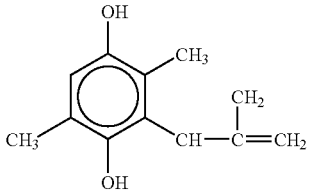 |
| D-2-178 | 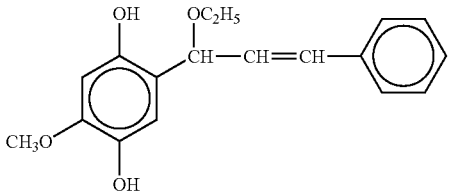 |
| D-2-179 | 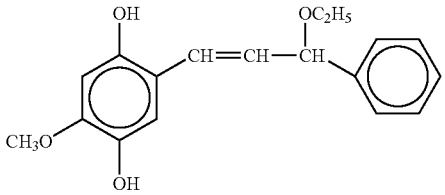 |
| D-2-180 | 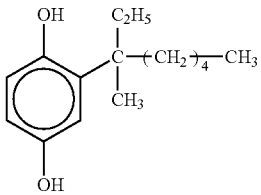 |

-continued
| No. | Exemplified Compounds |
|---|---|
| D-2-181 | 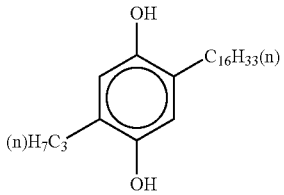 |
| D-2-182 | 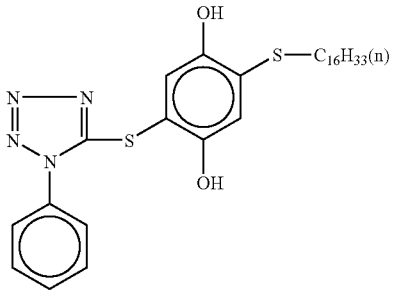 |
| D-2-183 | 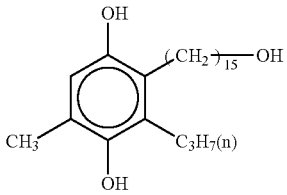 |
| D-2-184 | 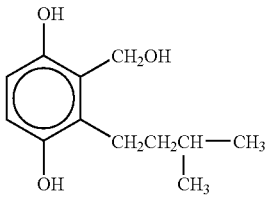 |
| D-2-185 | 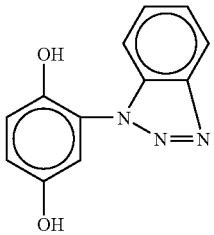 |
| D-2-186 | 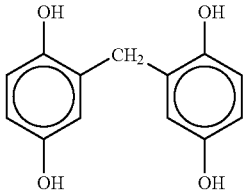 |
| D-2-187 | 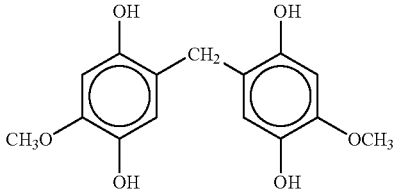 |

-continued
| No. | Exemplified Compounds |
|---|---|
| D-2-188 | 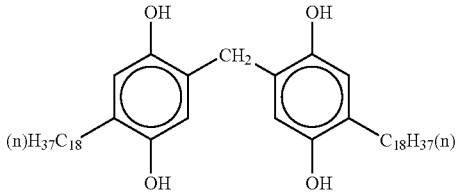 |
| D-2-189 | 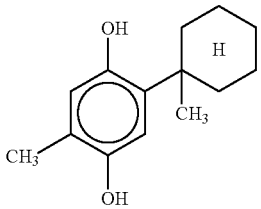 |
| D-2-190 | 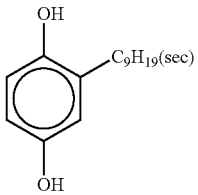 |
| D-2-191 | 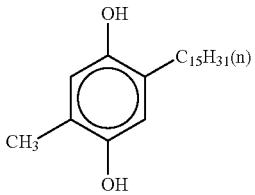 |
| D-2-192 | 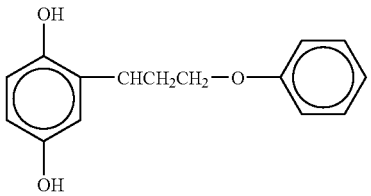 |
| D-2-193 | 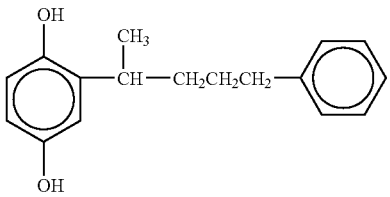 |
| D-2-194 | 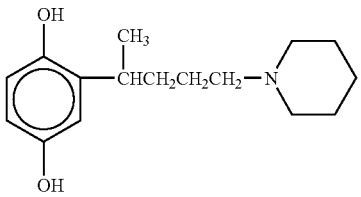 |

-continued
| No. | Exemplified Compounds |
|---|---|
| D-2-195 | 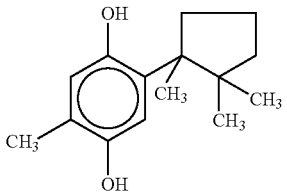 |
| D-2-196 | 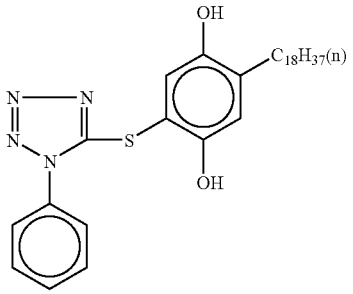 |
| D-2-197 | 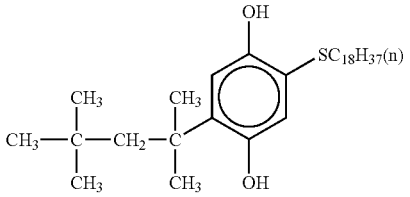 |
| D-2-198 | 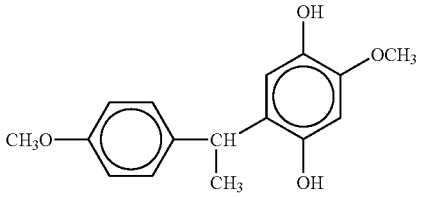 |
| D-2-199 | 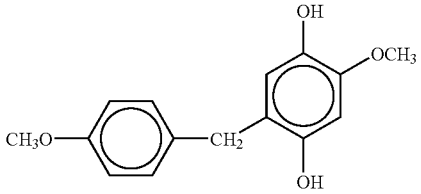 |
| D-2-200 | 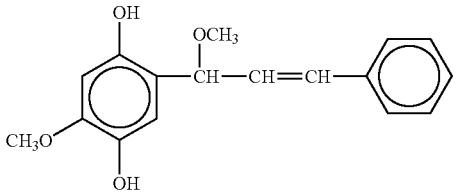 |
| D-2-201 | 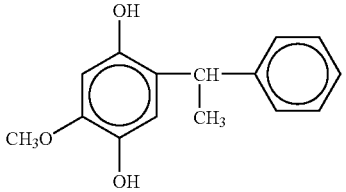 |

-continued
| No. | Exemplified Compounds |
|---|---|
| D-2-202 | 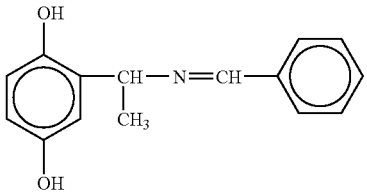 |
| D-2-203 | 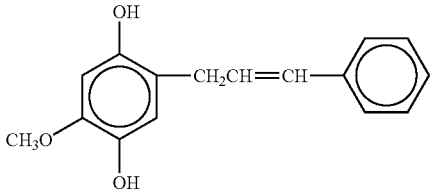 |
| D-2-204 | 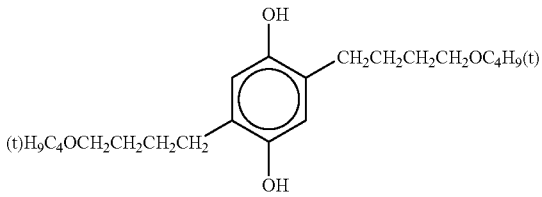 |
| D-2-205 | 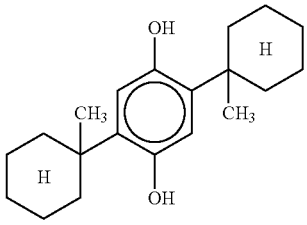 |
| D-2-206 | 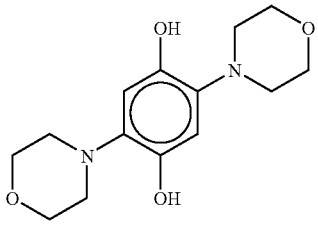 |
| D-2-207 | 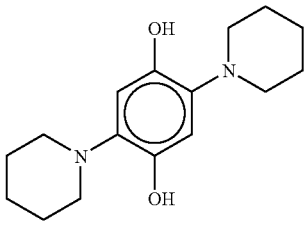 |
| D-2-208 | 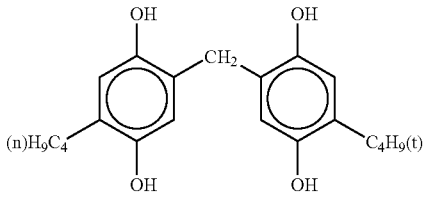 |

-continued
| No. | Exemplified Compounds |
|---|---|
| D-2-209 | 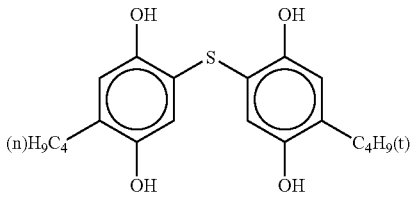 |
| D-2-210 | 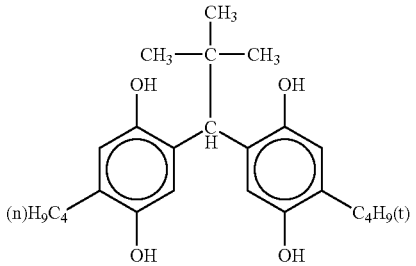 |
| D-2-211 | 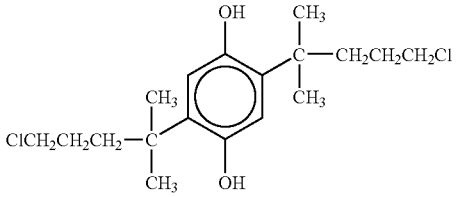 |
| D-2-212 | 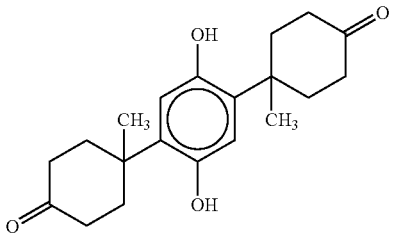 |
| D-2-213 | 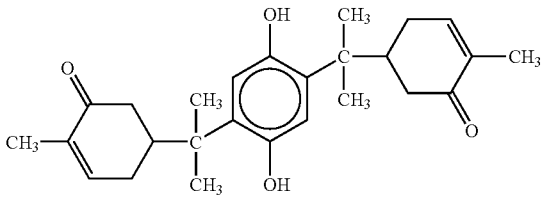 |
| D-2-214 | 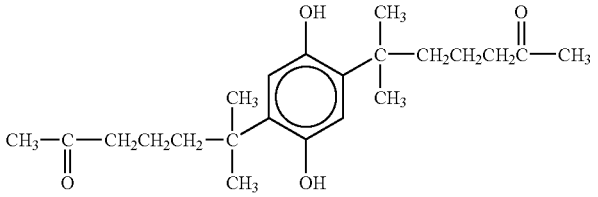 |
| D-2-215 | 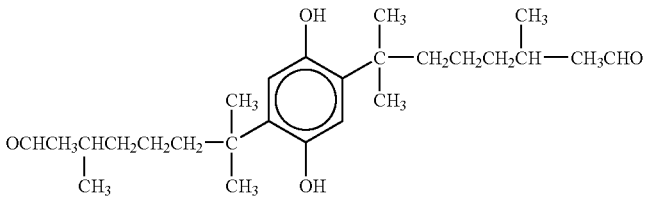 |

-continued
| No. | Exemplified Compounds |
|---|---|
| D-2-216 | 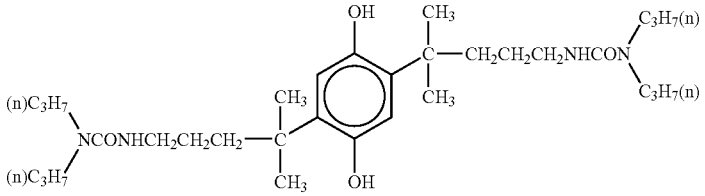 |
| D-2-217 | 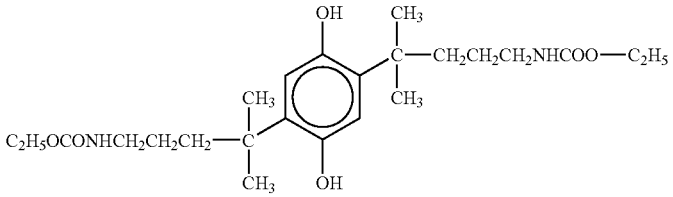 |
| D-2-218 | 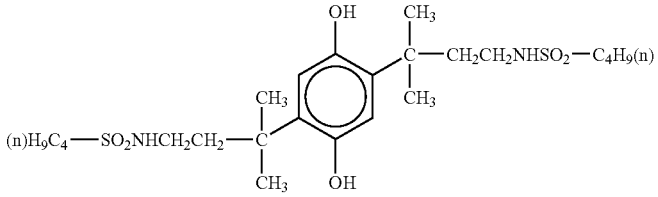 |
| D-2-219 | 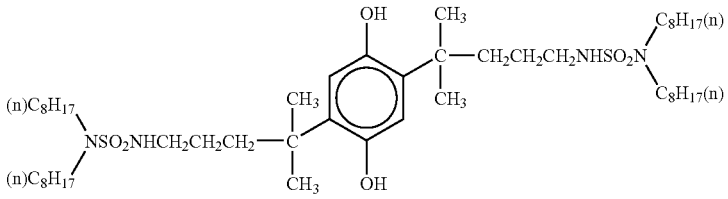 |
| D-2-220 | 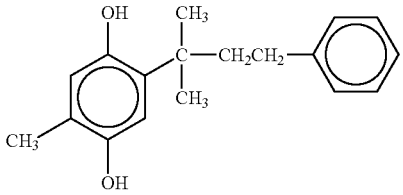 |
| D-2-221 | 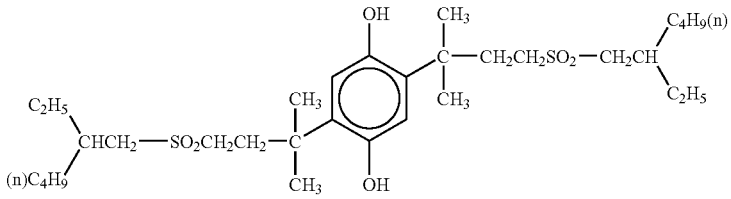 |
| D-2-222 | 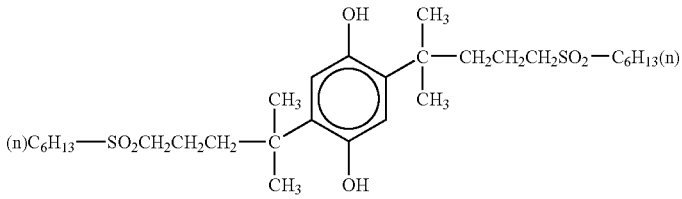 |

-continued
| No. | Exemplified Compounds |
|---|---|
| D-2-223 | 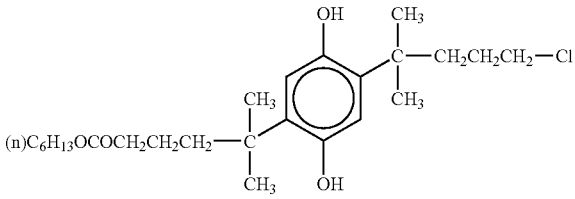 |
| D-2-224 | 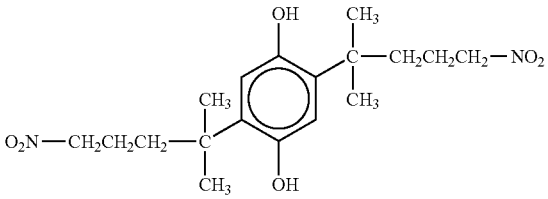 |
| D-3-1 | 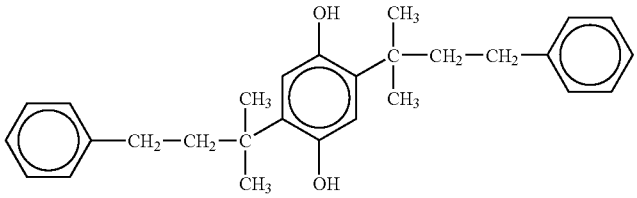 |
| D-3-2 | 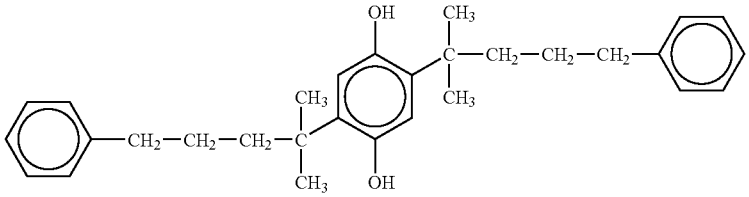 |
| D-3-3 | 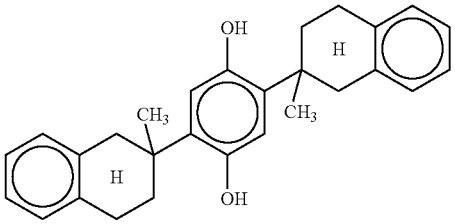 |
| D-3-4 | 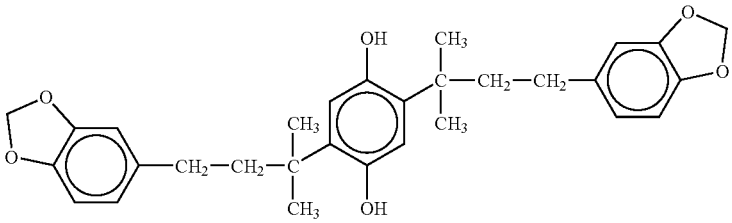 |
| D-3-5 | 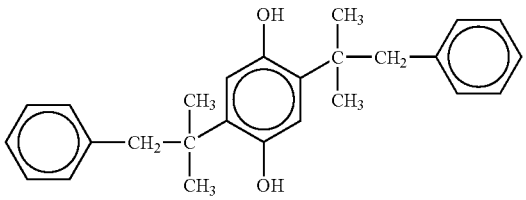 |

-continued
| No. | Exemplified Compounds |
|---|---|
| D-3-6 | 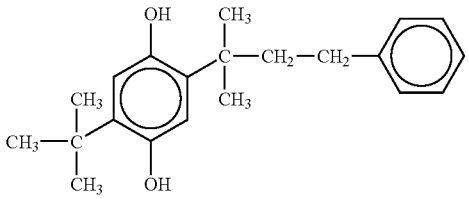 |
| D-3-7 | 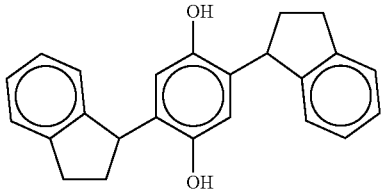 |
| D-3-8 | 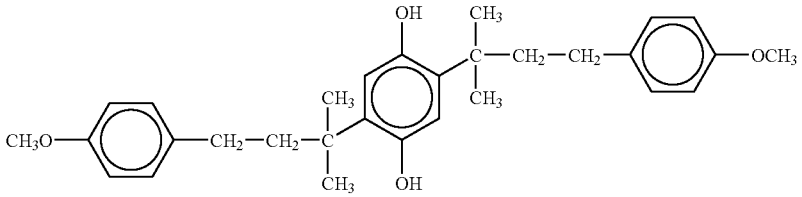 |
| D-3-9 | 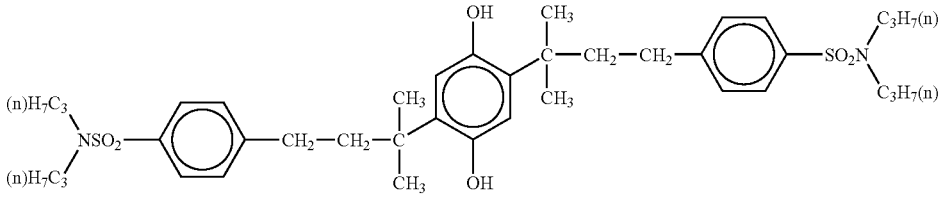 |
| D-3-10 | 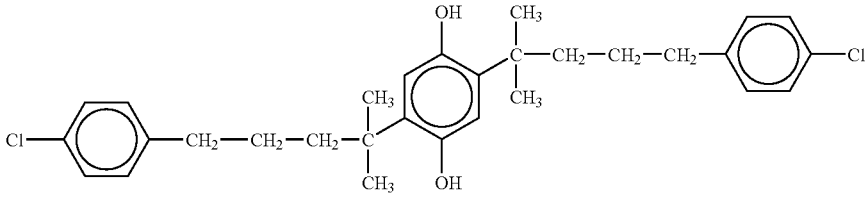 |
| D-3-11 | 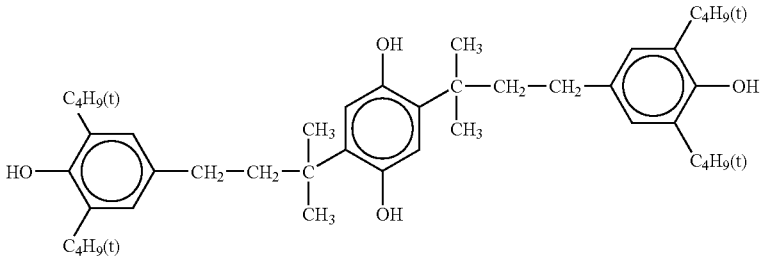 |
| D-3-12 | 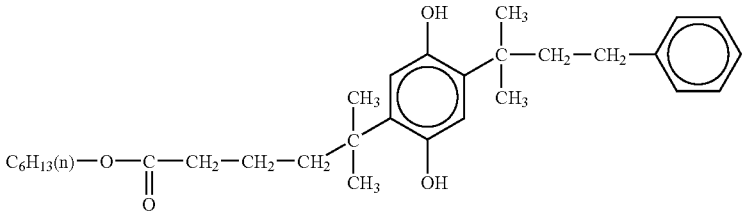 |

-continued
| No. | Exemplified Compounds |
|---|---|
| D-3-13 | 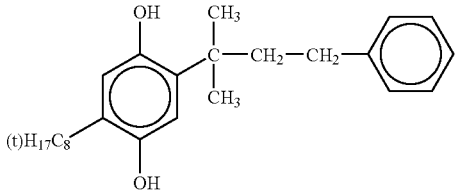 |
| D-3-14 | 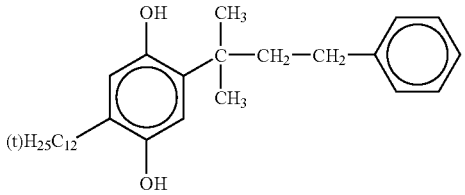 |
| D-3-15 | 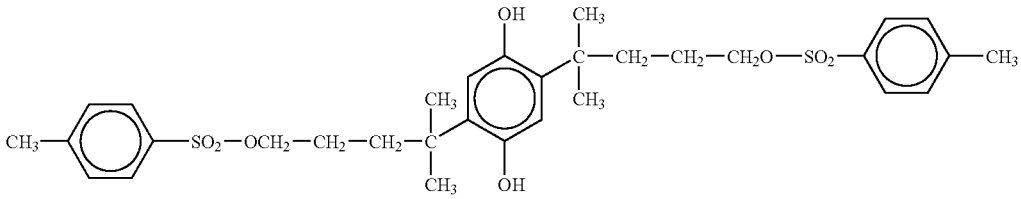 |
| D-3-16 | 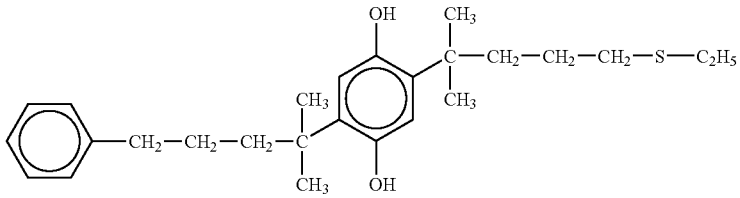 |
| D-3-17 | 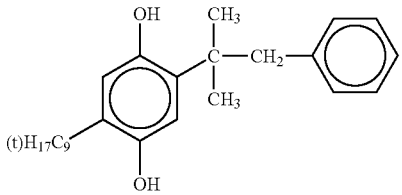 |
| D-3-18 | 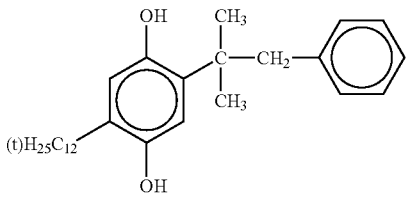 |
| D-3-19 | 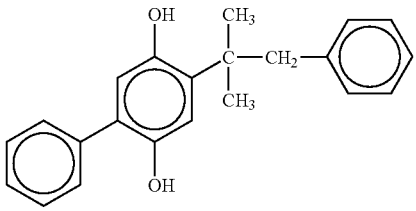 |

-continued
| No. | Exemplified Compounds |
|---|---|
| D-3-20 | 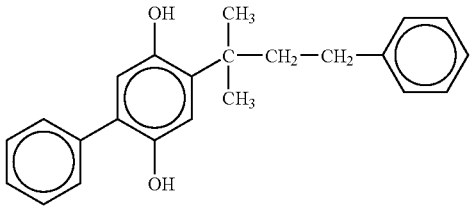 |
| D-3-21 | 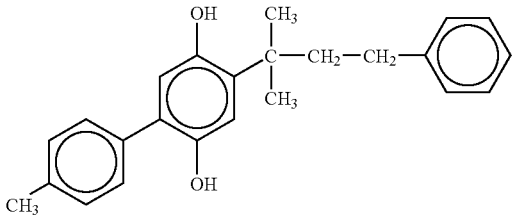 |
| D-3-22 | 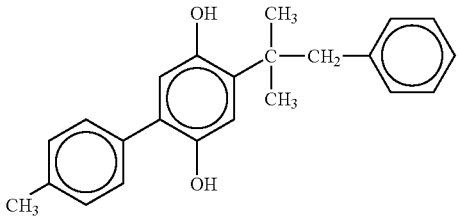 |
| D-3-23 | 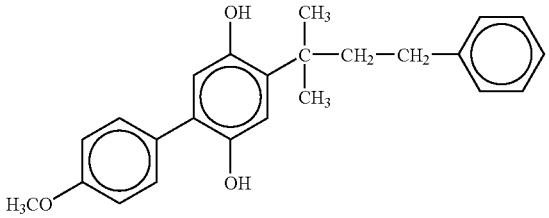 |
| D-3-24 | 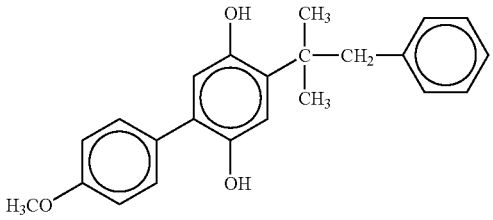 |
| D-3-25 | 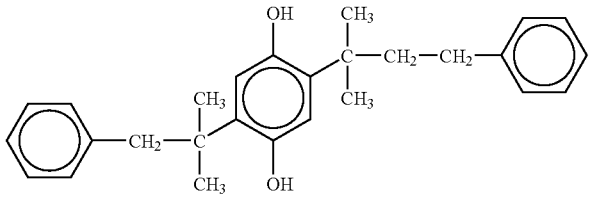 |
| D-3-26 | 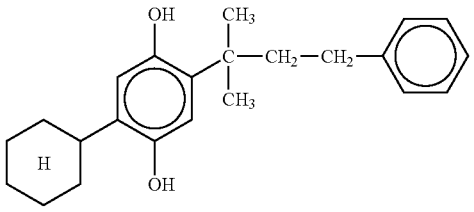 |

-continued
| No. | Exemplified Compounds |
|---|---|
| D-3-27 | 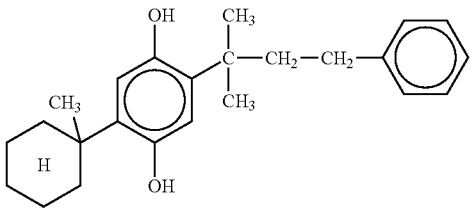 |
| D-3-28 | 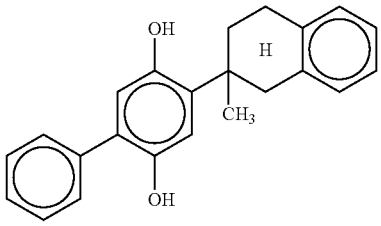 |
| D-3-29 | 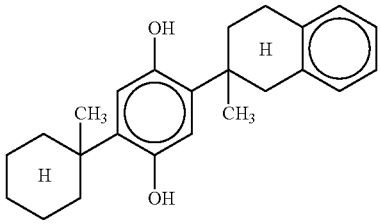 |
| D-3-30 | 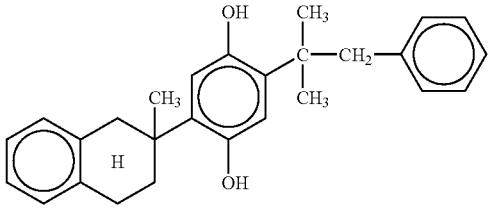 |
| D-3-31 | 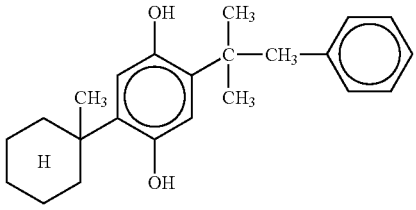 |
| D-3-32 | 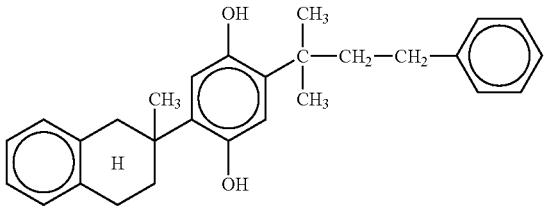 |
| D-3-33 | 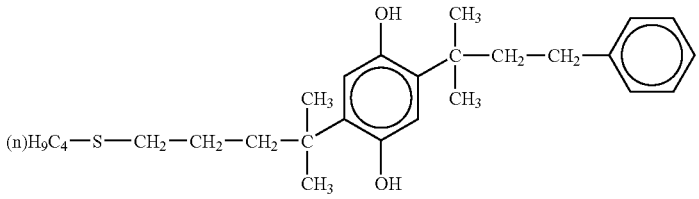 |

-continued
| No. | Exemplified Compounds |
|---|---|
| D-3-34 | 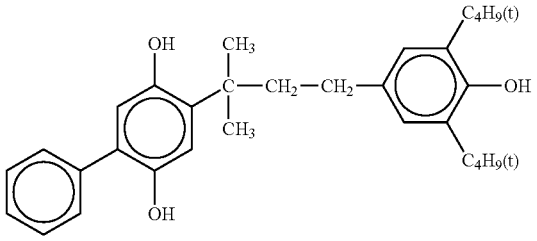 |
| D-3-35 | 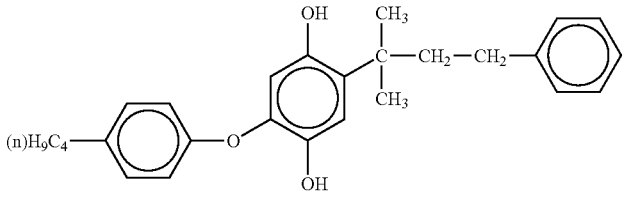 |
| D-3-36 | 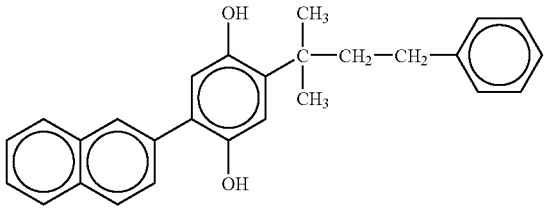 |
| D-3-37 | 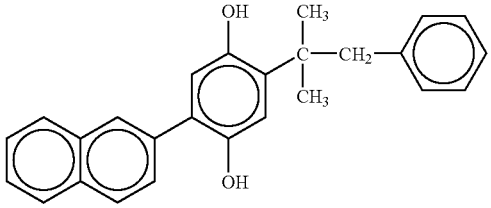 |
| D-3-38 | 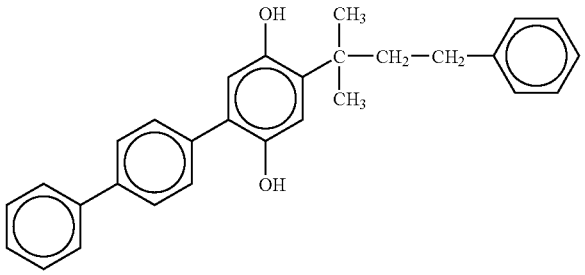 |
| D-3-39 | 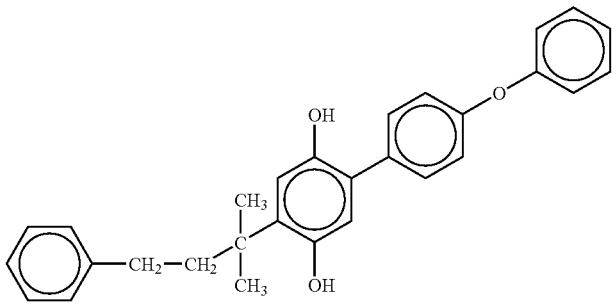 |

-continued
| No. | Exemplified Compounds |
|---|---|
| D-3-40 | 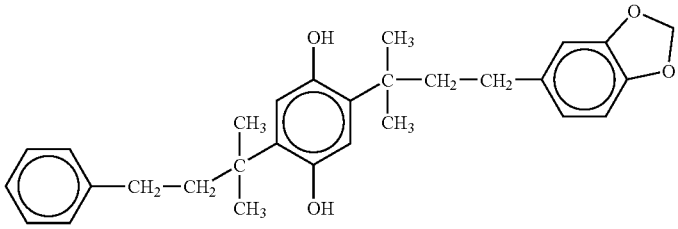 |
| D-3-41 | 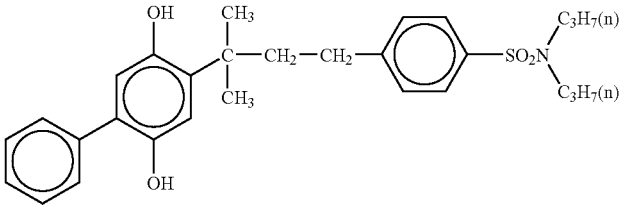 |
| D-3-42 | 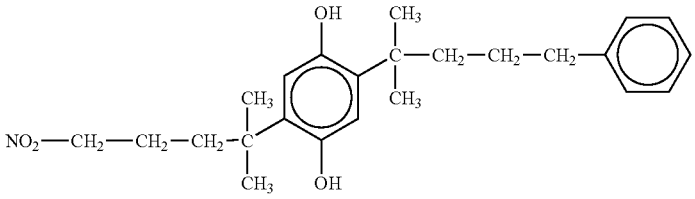 |
| D-3-43 | 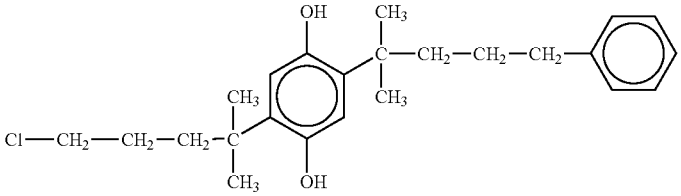 |
| D-3-44 | 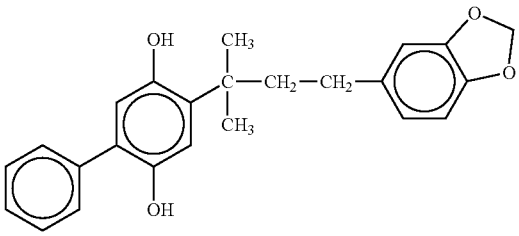 |
| D-3-45 | 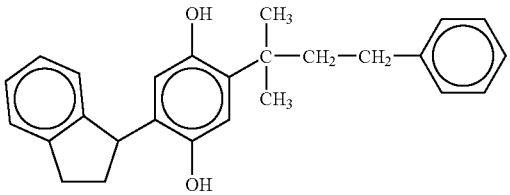 |
| D-3-46 | 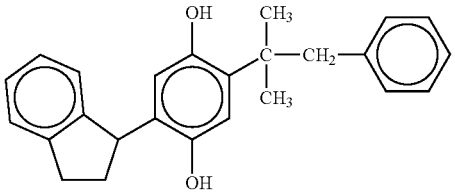 |

-continued
| No. | Exemplified Compounds |
|---|---|
| D-3-47 | 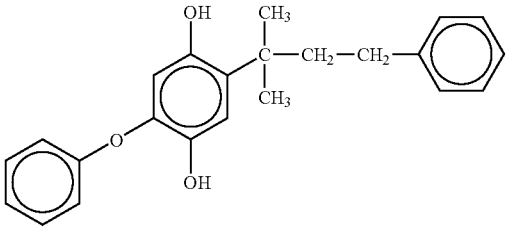 |
| D-3-48 | 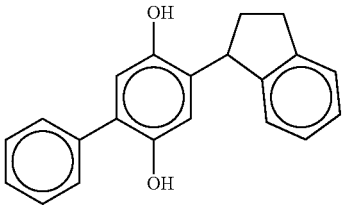 |
| D-4-1 | 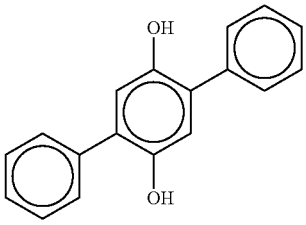 |
| D-4-2 | 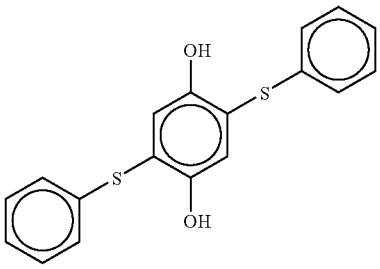 |
| D-4-3 | 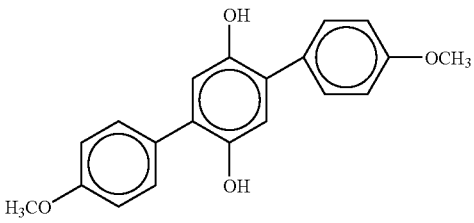 |
| D-4-4 | 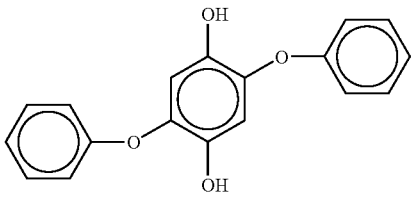 |

-continued
| No. | Exemplified Compounds |
|---|---|
| D-4-5 | 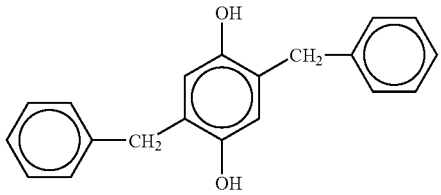 |
| D-4-6 | 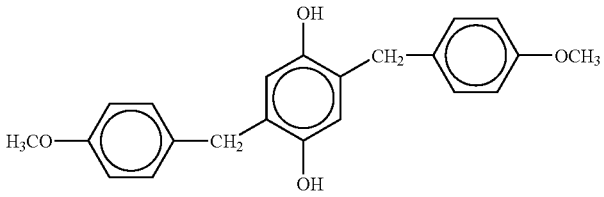 |
| D-4-7 | 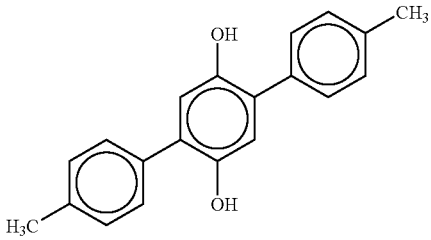 |
| D-4-8 | 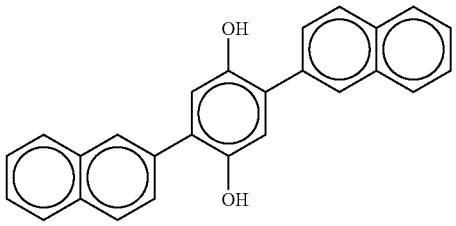 |
| D-4-9 | 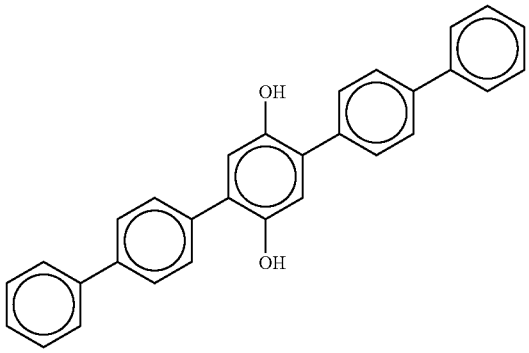 |
| D-4-10 | 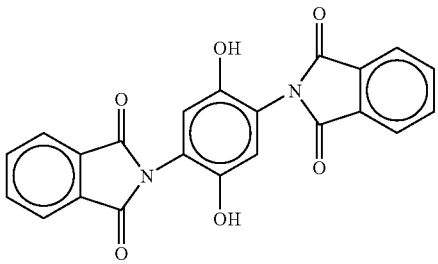 |

-continued
| No. | Exemplified Compounds |
|---|---|
| D-4-11 | 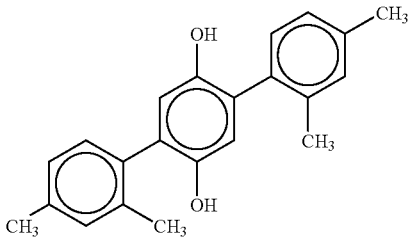 |
| D-4-12 | 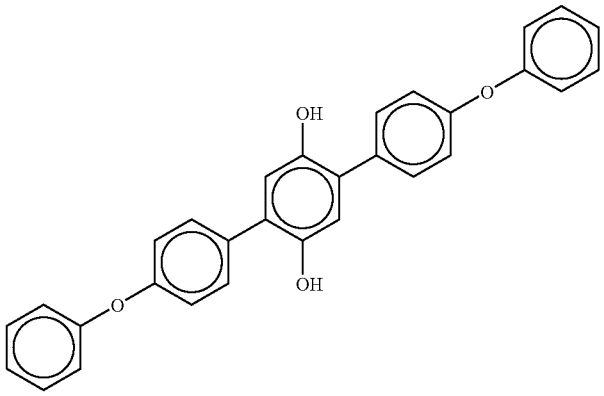 |
| D-4-13 | 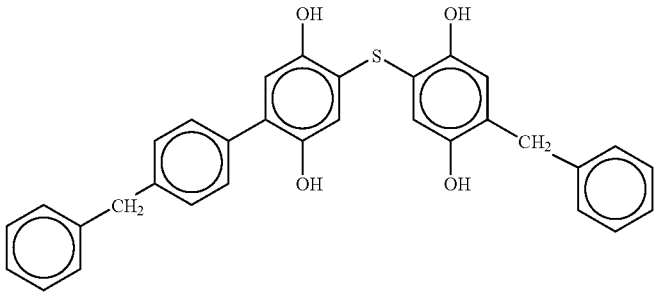 |
Examples of the compounds expressed by the general formula (103) may be reviewed referring to JP-A No. 7-219256, which lists possible compounds in Tables 20 (1) to 20 (9) thereof such as V-1 to V-209, and D-5-210 to D-5-231 below. Among the compounds of V-1 to V-209, D-5-49 and D-5-72 below are preferable.
| No. | Exemplified Compounds |
|---|---|
| D-5-49 | 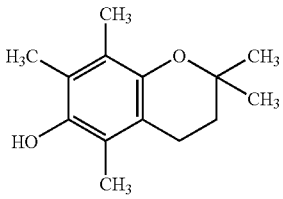 |

-continued
| No. | Exemplified Compounds |
|---|---|
| D-5-72 | 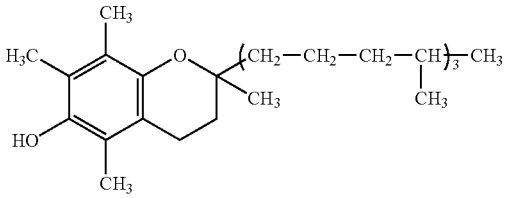 |
| D-5-210 | 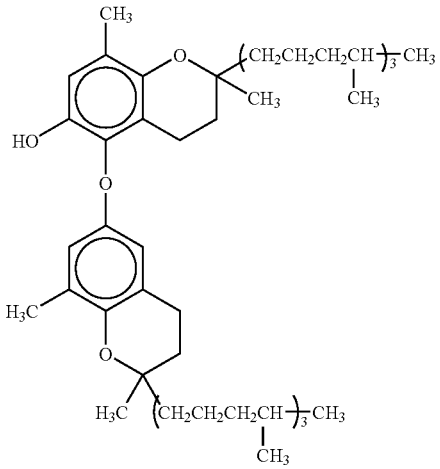 |
| D-5-211 | 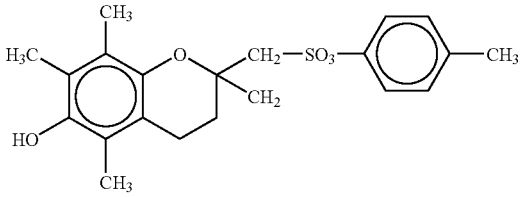 |
| D-5-212 | 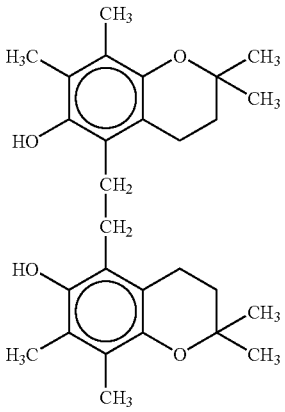 |

-continued
| No. | Exemplified Compounds |
|---|---|
| D-5-213 | 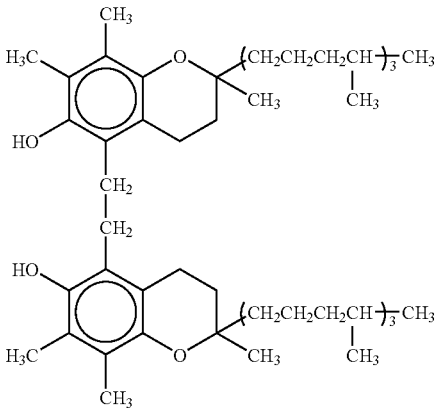 |
| D-5-214 | 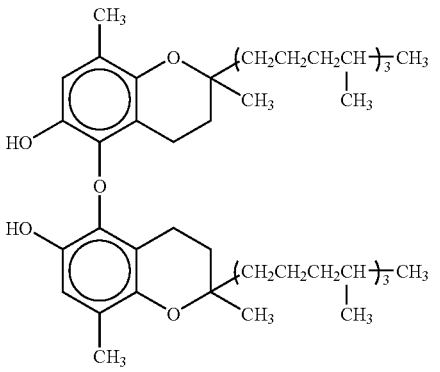 |
| D-5-215 | 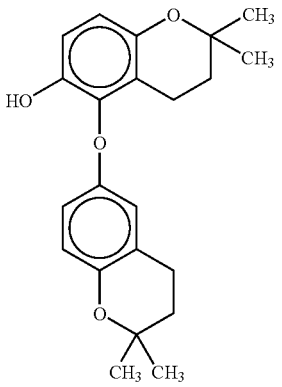 |

-continued
| No. | Exemplified Compounds |
|---|---|
| D-5-216 | 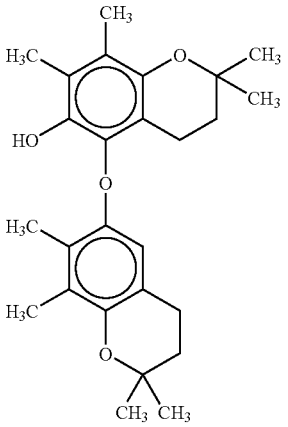 |
| D-5-217 | 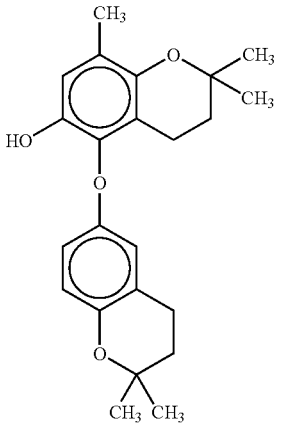 |
| D-5-218 | 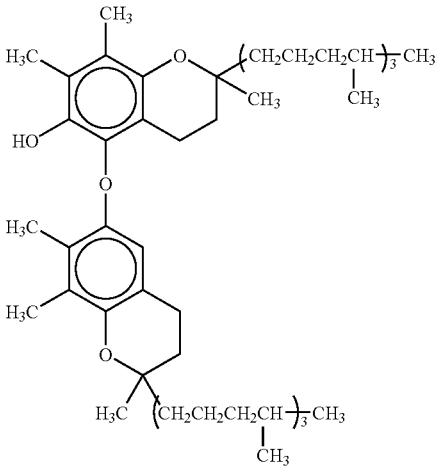 |

-continued
| No. | Exemplified Compounds |
|---|---|
| D-5-219 | 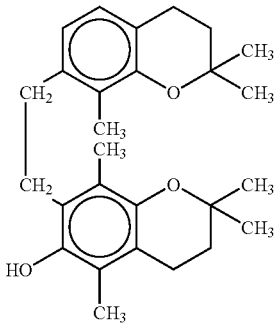 |
| D-5-220 | 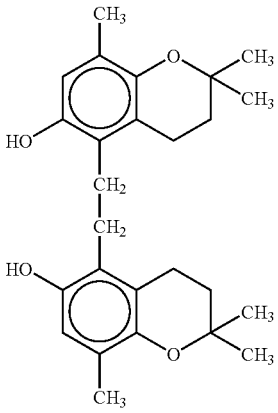 |
| D-5-221 | 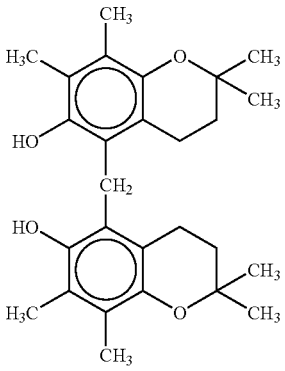 |
| D-5-222 | 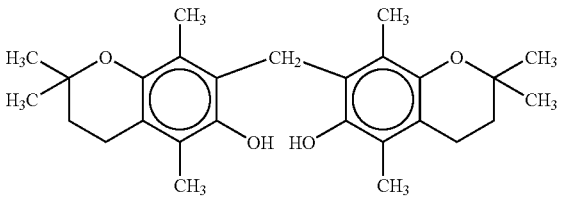 |
| D-5-223 | 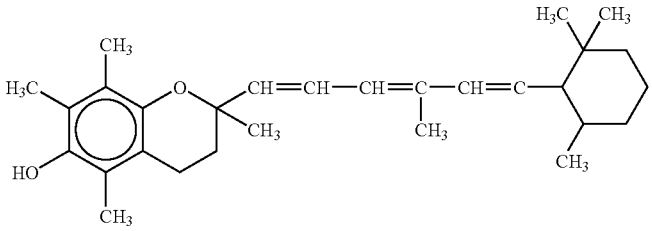 |

-continued
| No. | Exemplified Compounds |
|---|---|
| D-5-224 | 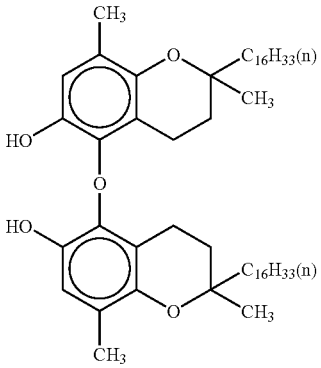 |
| D-5-225 | 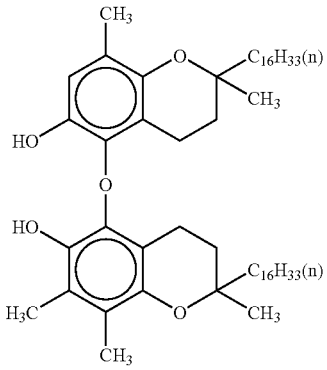 |
| D-5-226 | 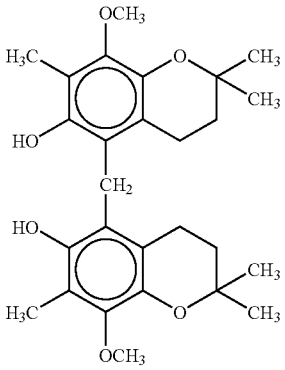 |
| D-5-227 | 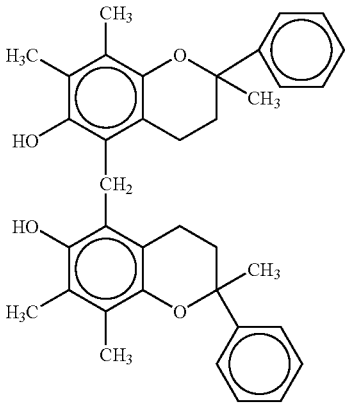 |

-continued
| No. | Exemplified Compounds |
|---|---|
| D-5-228 | 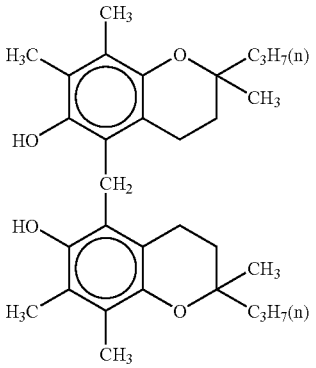 |
| D-5-229 | 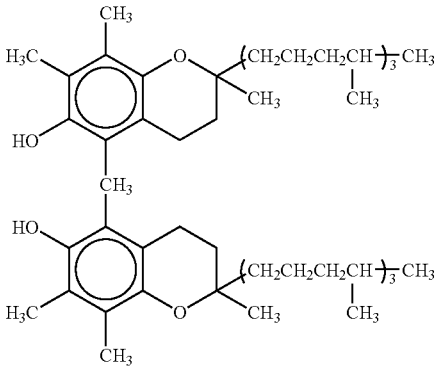 |
| D-5-230 | 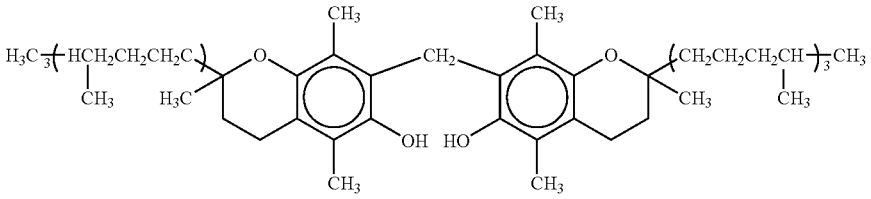 |
| D-5-231 | 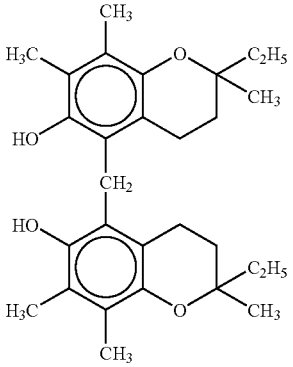 |

Examples of the compounds expressed by the general formula (104) may be reviewed referring to JP-A No. 7-219256, which lists possible compounds in Tables 21 (1) to 21 (2) thereof such as VI-1 to VI-37. Among the compounds, the following D-6-6 is preferable.

No. D-6-6

Exemplified Compound

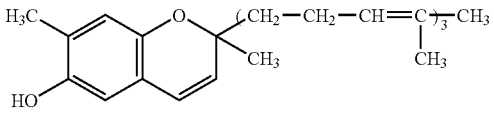

Examples of the compounds expressed by the general formula (105) may be reviewed referring to JP-A No. 7-219256, which lists possible compounds in Tables 22 (1) to 22 (7) thereof such as VII-1 to VII-147. Among the compounds, the following D-7-18 is preferable.

No. D-7-18

Exemplified Compound

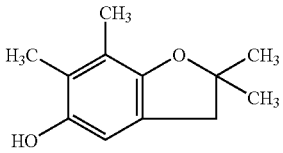

Examples of the compounds expressed by the general formula (106) may be reviewed referring to JP-A No. 7-219256, which lists possible compounds in Tables 23 (1) to 23 (5) thereof such as VIII-1 to VIII-100. Among the compounds, the following D-8-23 is preferable.

No. D-8-23

Exemplified Compound

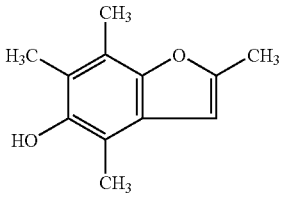

Examples of the compounds expressed by the general formula (107) include the compounds D-9-1 to D-9-10 below.

| No. | Exemplified Compounds |
|---|---|
| D-9-1 | 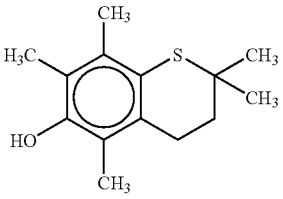 |

-continued

| No. | Exemplified Compounds |
|---|---|
| D-9-2 | 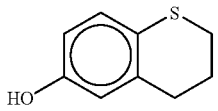 |
| D-9-3 | 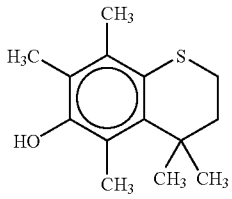 |
| D-9-4 | 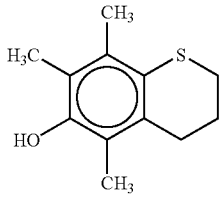 |
| D-9-5 | 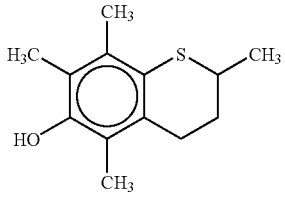 |
| D-9-6 | 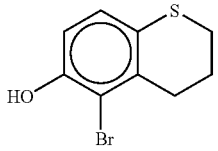 |
| D-9-7 | 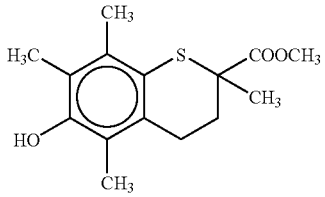 |
| D-9-8 | 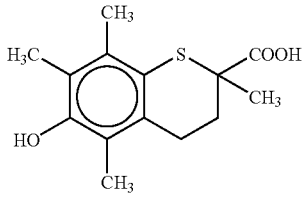 |
| D-9-9 | 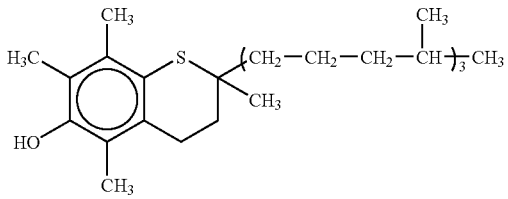 |

-continued
| No. | Exemplified Compounds |
|---|---|
| D-9-10 | 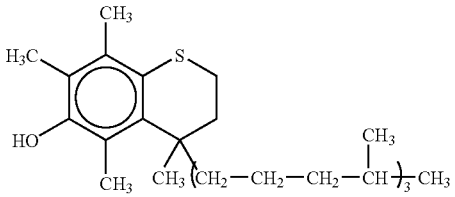 |
Examples of the compounds expressed by the general formulas (108) and (109) include the compounds D-10-1 to D-10-27 below.
| No. | Exemplified Compounds |
|---|---|
| D-10-1 | 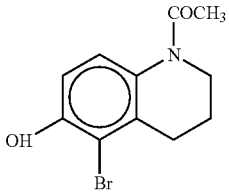 |
| D-10-2 | 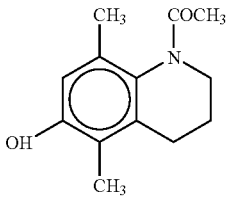 |
| D-10-3 | 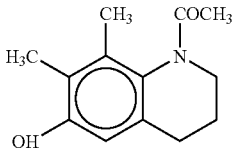 |
| D-10-4 | 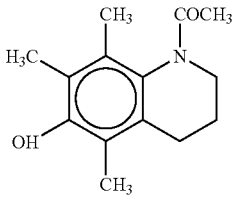 |
| D-10-5 | 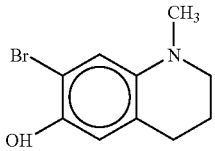 |
| D-10-6 | 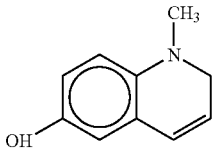 |
-continued
| No. | Exemplified Compounds |
|---|---|
| D-10-7 | 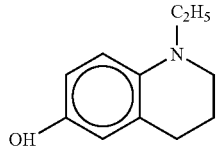 |
| D-10-8 | 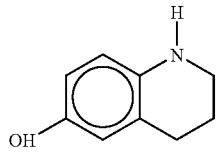 |
| D-10-9 | 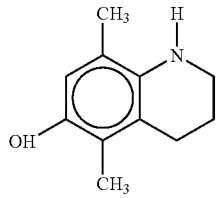 |
| D-10-10 | 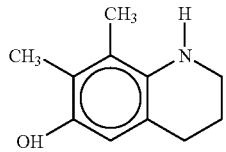 |
| D-10-11 | 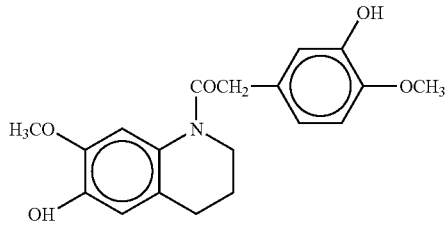 |
| D-10-12 | 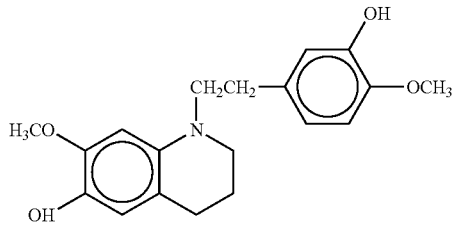 |
| D-10-13 | 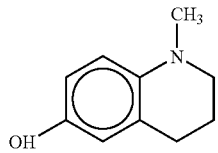 |
| D-10-14 | 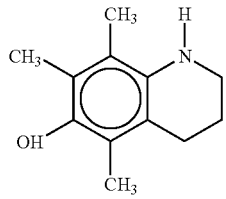 |

-continued
| No. | Exemplified Compounds |
|---|---|
| D-10-15 | 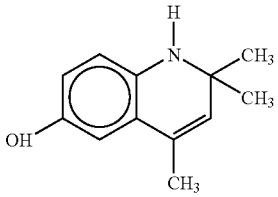 |
| D-10-16 | 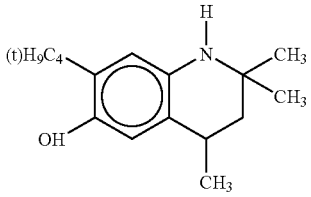 |
| D-10-17 | 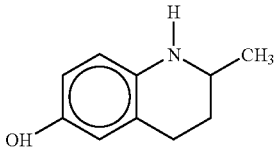 |
| D-10-18 | 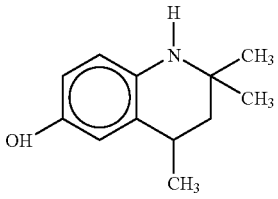 |
| D-10-19 | 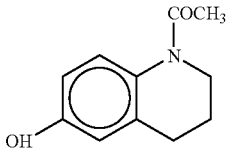 |
| D-10-20 | 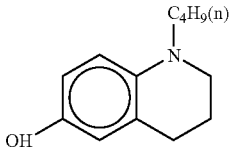 |
| D-10-21 | 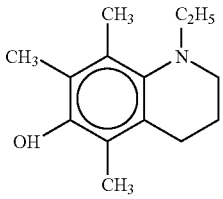 |
| D-10-22 | 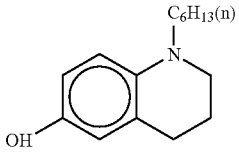 |
-continued
| No. | Exemplified Compounds |
|---|---|
| D-10-23 | 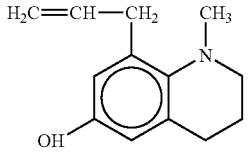 |
| D-10-24 | 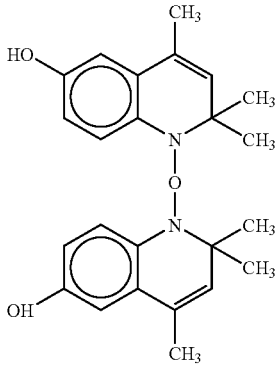 |
| D-10-25 | 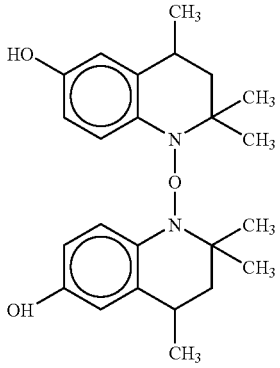 |
| D-10-26 | 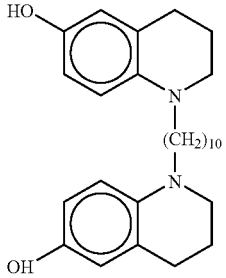 |
| D-10-27 | 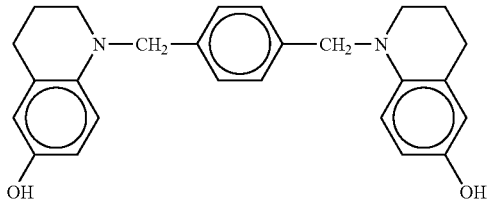 |
Examples of the compounds expressed by the general formulas (110) and (120) include the compounds D-11-1 to D-11-29 below.

| No. | Exemplified Compounds |
|---|---|
| D-11-1 | 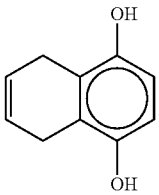 |
| D-11-2 | 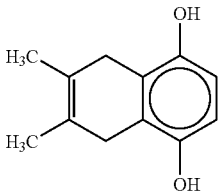 |
| D-11-3 | 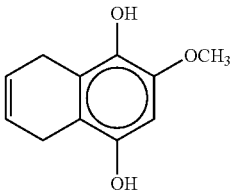 |
| D-11-4 | 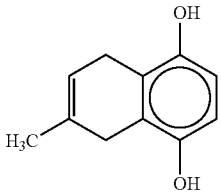 |
| D-11-5 | 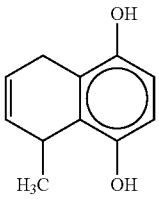 |
| D-11-6 | 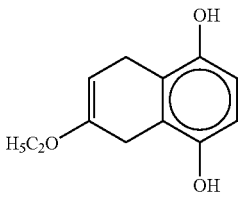 |
-continued
| No. | Exemplified Compounds |
|---|---|
| D-11-7 | 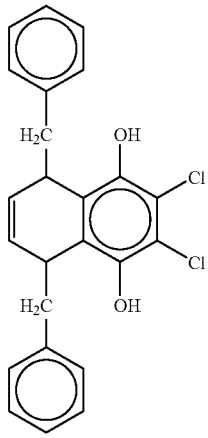 |
| D-11-8 | 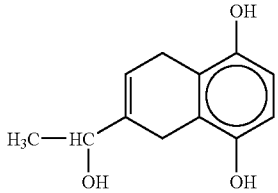 |
| D-11-9 | 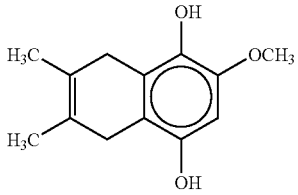 |
| D-11-10 | 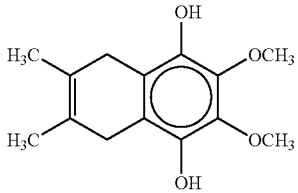 |
| D-11-11 | 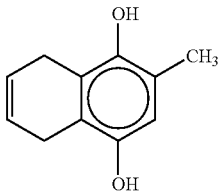 |
| D-11-12 | 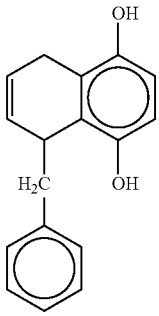 |

-continued
| No. | Exemplified Compounds |
|---|---|
| D-11-13 | 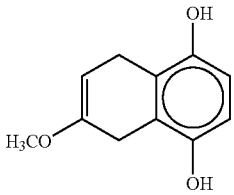 |
| D-11-14 | 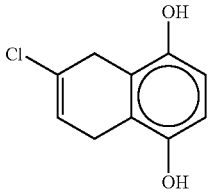 |
| D-11-15 | 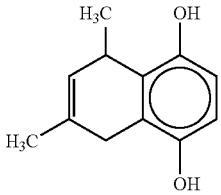 |
| D-11-16 | 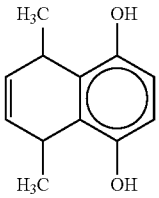 |
| D-11-17 | 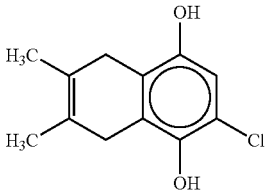 |
| D-11-18 | 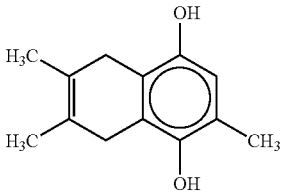 |
| D-11-19 | 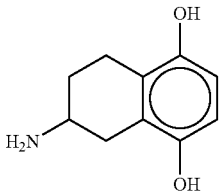 |
-continued
| No. | Exemplified Compounds |
|---|---|
| D-11-20 | 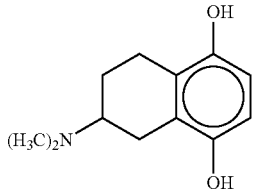 |
| D-11-21 | 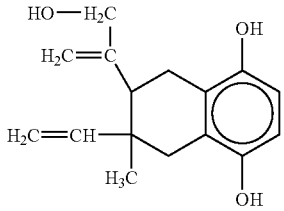 |
| D-11-22 | 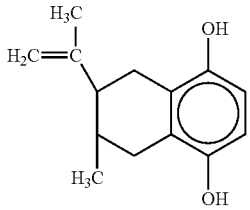 |
| D-11-23 | 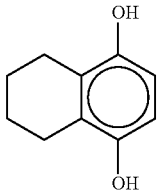 |
| D-11-24 | 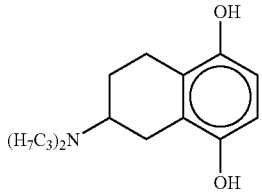 |
| D-11-25 | 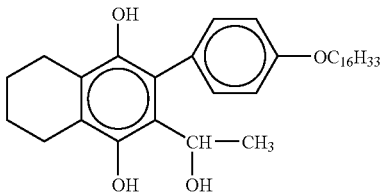 |
| D-11-26 | 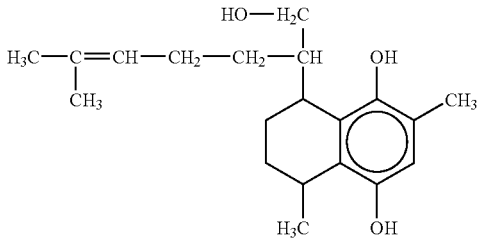 |

-continued
| No. | Exemplified Compounds |
|---|---|
| D-11-27 | 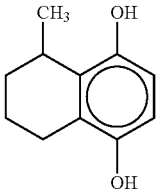 |
| D-11-28 | 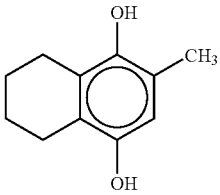 |
| D-11-29 | 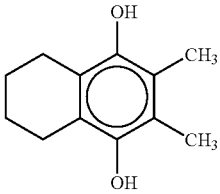 |
Examples of the compounds expressed by the general formula (112) include the compounds of D-12-1 to D-12-61 below.
| No. | Exemplified Compounds |
|---|---|
| D-12-1 | 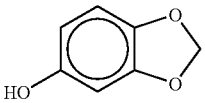 |
| D-12-2 | 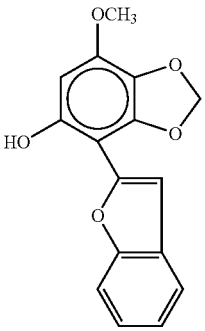 |
| D-12-3 | 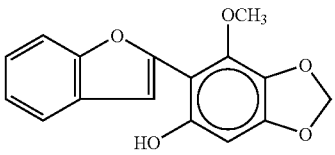 |
-continued
| No. | Exemplified Compounds |
|---|---|
| D-12-4 | 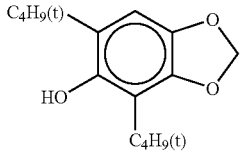 |
| D-12-5 | 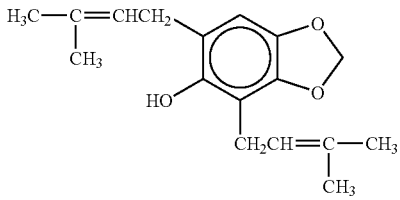 |
| D-12-6 | 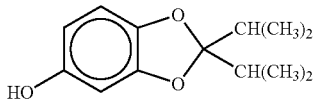 |
| D-12-7 | 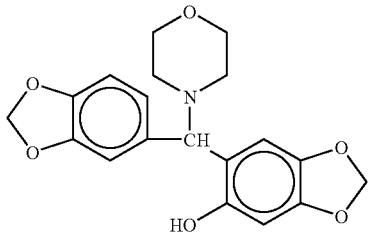 |
| D-12-8 | 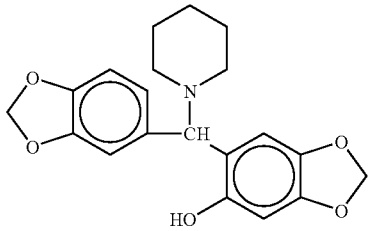 |
| D-12-9 | 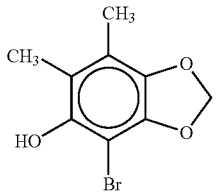 |
| D-12-10 | 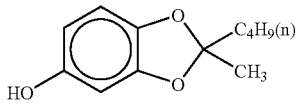 |
| D-12-11 | 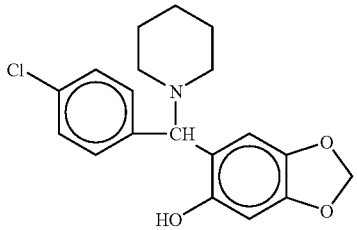 |

-continued
| No. | Exemplified Compounds |
|---|---|
| D-12-12 | 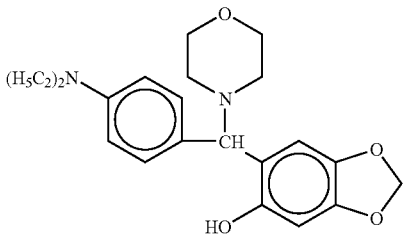 |
| D-12-13 | 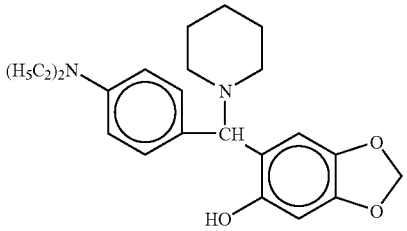 |
| D-12-14 | 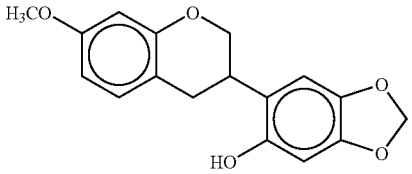 |
| D-12-15 | 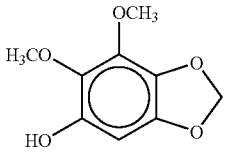 |
| D-12-16 | 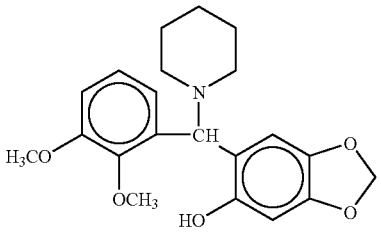 |
| D-12-17 | 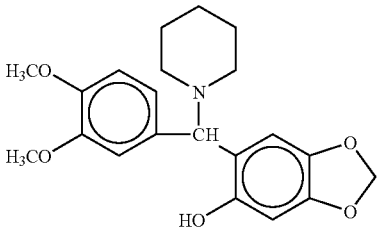 |
| D-12-18 | 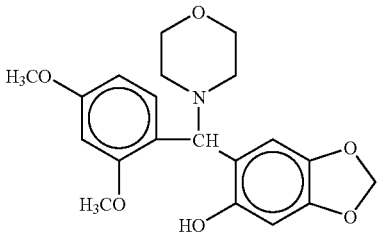 |
-continued
| No. | Exemplified Compounds |
|---|---|
| D-12-19 | 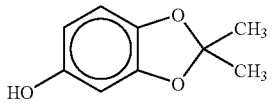 |
| D-12-20 | 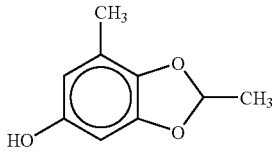 |
| D-12-21 | 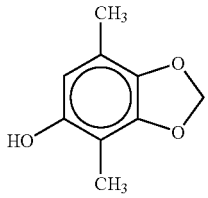 |
| D-12-22 | 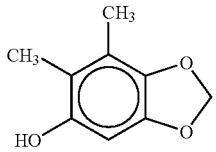 |
| D-12-23 | 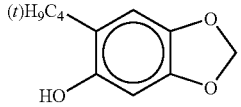 |
| D-12-24 | 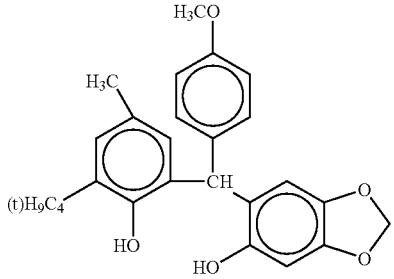 |
| D-12-25 | 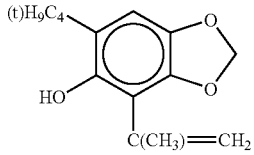 |
| D-12-26 | 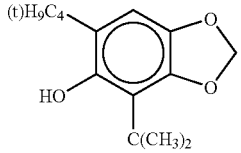 |
| D-12-27 | 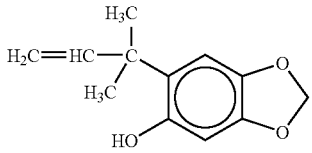 |

-continued
| No. | Exemplified Compounds |
|---|---|
| D-12-28 | 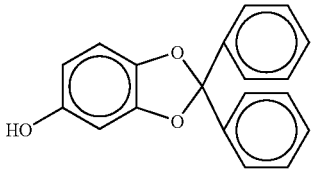 |
| D-12-29 | 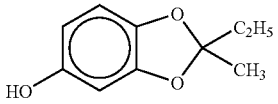 |
| D-12-30 | 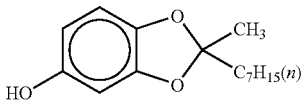 |
| D-12-31 | 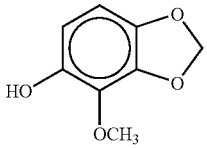 |
| D-12-32 | 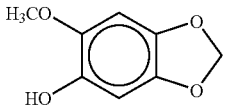 |
| D-12-33 | 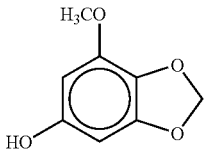 |
| D-12-34 | 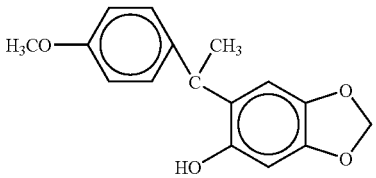 |
| D-12-35 | 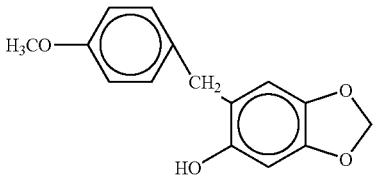 |
| D-12-36 | 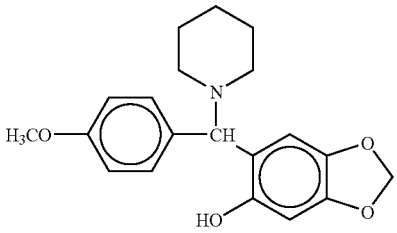 |
-continued
| No. | Exemplified Compounds |
|---|---|
| D-12-37 | 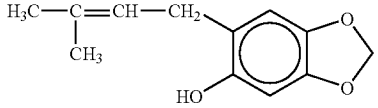 |
| D-12-38 | 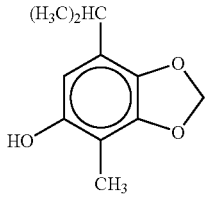 |
| D-12-39 | 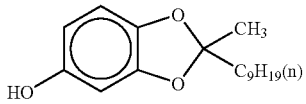 |
| D-12-40 | 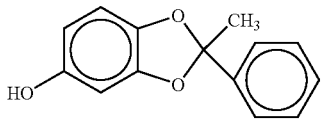 |
| D-12-41 | 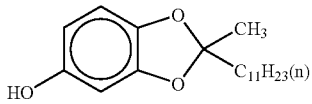 |
| D-12-42 | 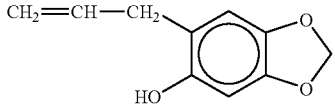 |
| D-12-43 | 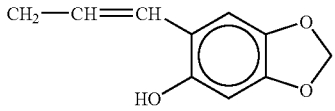 |
| D-12-44 | 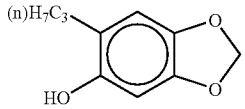 |
| D-12-45 | 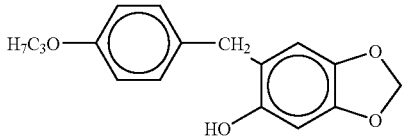 |
| D-12-46 | 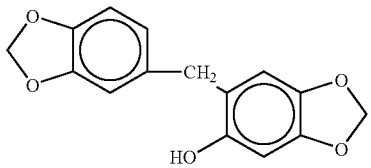 |
| D-12-47 | 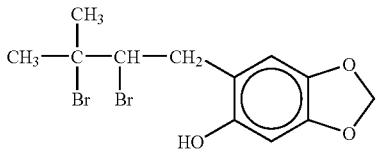 |

-continued

| No. | Exemplified Compounds |
|---|---|
| D-12-48 | 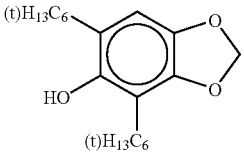 |
| D-12-49 | 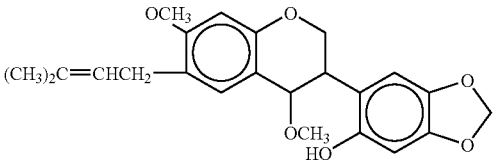 |
| D-12-50 | 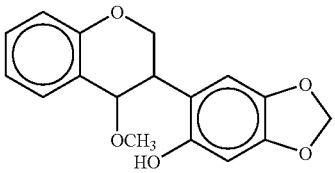 |
| D-12-51 | 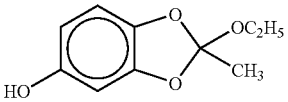 |
| D-12-52 | 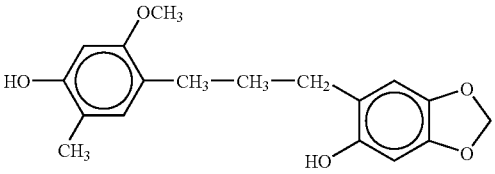 |
| D-12-53 | 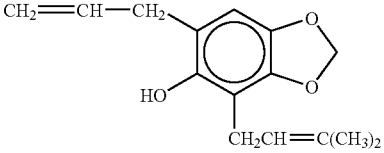 |
| D-12-54 | 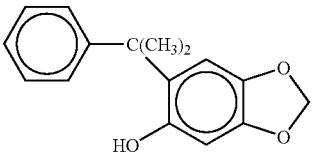 |
| D-12-55 | 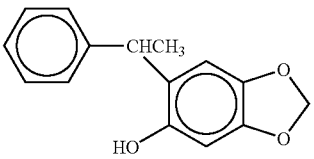 |
| D-12-56 | 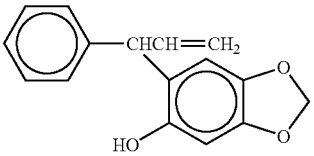 |

-continued

| No. | Exemplified Compounds |
|---|---|
| D-12-57 | 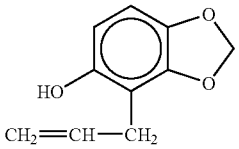 |
| D-12-58 | 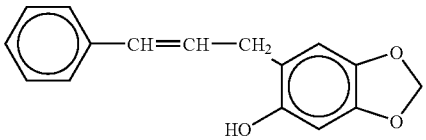 |
| D-12-59 | 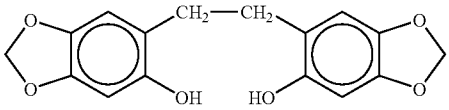 |
| D-12-60 | 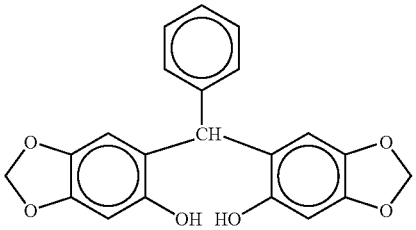 |
| D-12-61 | 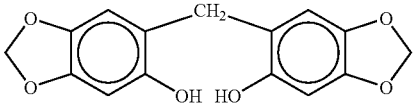 |

These exemplified hydroxy aromatic compounds are known as antioxidant agents. On the contrary, the effect of the hydroxy aromatic compounds according to the present invention is essentially to reduce the image lag or memory action, which effect can be derived synergistically with the incorporation of fine particles of fluorine-contained resin into the outermost layer of the photoconductive layer. The effect is surprising in a sense that the other antioxidants cannot induce the same effect as demonstrated in Examples later.

The formation of the protective layer may be carried out by dip coating, spray coating, bead coating, nozzle coating, spinner coating, ring coating, and the like. Among these, the spray coating is preferable from the viewpoint of uniformity of coated film. Further, the protective layer is preferably formed of two or more laminated layers by several overlapped coatings from the uniformity viewpoint of fine particles of fluorine-contained resin rather than one layer of the necessary coating thickness. The thickness of the protective layer is preferably within a necessary minimum range, since the image quality tends to decrease when the layer thickness is excessively large. The thickness of the protective layer is preferably 0.1 to 10 μm.

In the protective layer of the electrophotographic photoconductor, antioxidant may be incorporated. Specific examples thereof include antioxidants for plastics, rubber, petroleum, and fats and oils; ultraviolet absorbers; and light stabilizers such as phenol and phenol derivatives, paraphenylenediamines, hydroquinone and derivatives thereof, organic sulfur-containing compounds, organic phosphorus-containing compounds, hydroxy anisoles, piperidine and oxopiperidine, carotenes, amines, tocophenols, Ni(II) complexes, and sulfides, as disclosed in JP-A No. 57-122444, No. 60-188956, No. 63-18355, and No. 63-18356.

The content of the antioxidant in the outermost layer is preferably 0.01 to 5.0% by weight; since when the content is lower than the range, the effect on the charging stability is insufficient, when the content is higher than the range, the sensitivity may be lowered and/or the residual potential may be raised.

The layer constitution of the inventive electrophotographic photoconductor will be explained in the following referring to Figures. The electrophotographic photoconductor shown in FIG. 1 has such a constitution that photoconductive layer 33 based on the charge-generating substance and the charge-transporting substance, and protective layer 39 are laminated on conductive support 31 in order. Protective layer 39 comprises fine particles of fluorine-contained resin.

Figure 2:
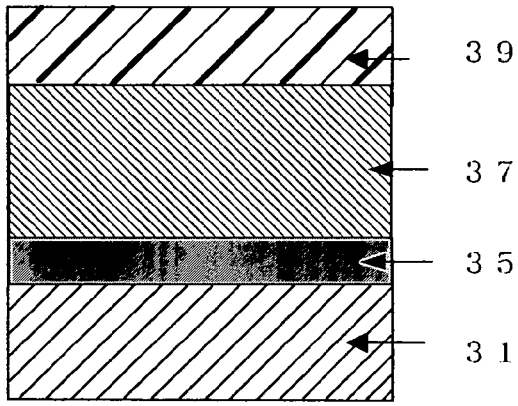
FIG. 2 schematically shows another exemplary layer construction of the photoconductor according to the present invention.

The electrophotographic photoconductor shown in FIG. 2 has such a constitution that charge-generating layer 35 based on charge-generating substance, charge-transporting layer 37 based on charge-transporting substance, and protective layer 39 are laminated on conductive support 31 in order. Protective layer 39 comprises fine particles of fluorine-contained resin.

Figure 3:
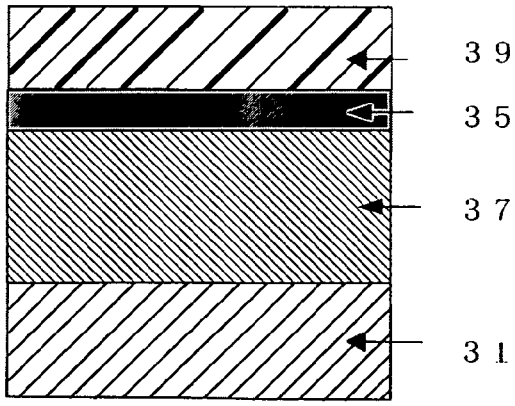
FIG. 3 schematically shows still another exemplary layer construction of the photoconductor according to the present invention.

The electrophotographic photoconductor shown in FIG. 3 has such a constitution that charge-transporting layer 37 based on charge-transporting substance, charge-generating layer 35 based on charge-generating substance, and protective layer 39 are laminated on conductive support 31 in order. Protective layer 39 comprises fine particles of fluorine-contained resin.

The conductive support 31 may be a film-shaped or cylindrically-shaped plastic or paper covered with a conducting material having a volume resistivity of $10^{10}$ Ω·cm, e.g., a metal such as aluminum, nickel, chromium, nichrome, copper, gold, silver or platinum, or a metal oxide such as tin oxide or indium oxide, by vapor deposition or sputtering, or it may be a plate of aluminum, aluminum alloy, nickel or stainless steel, and this may be formed into a tube by extrusion or drawing, cut, polished and surface-treated. The endless nickel belt and-endless stainless steel belt disclosed in JP-A No. 52-36016 may also be employed as the conductive support 31.

In addition, a conductive powder may be dispersed into the binder resin and coated on the conductive support, and the resulting material may be employed as the conductive support 31 adapted to the present invention. Examples of the conductive powder are carbon black, acetylene black, metal powders such as aluminum, nickel, iron, nichrome, copper, zinc and silver, and metal oxide powder such as conductive tin oxide and ITO or the like.

Examples of the available binder resin include thermoplastic resin, thermosetting resin or photosetting resin such as polystyrene, styrene-acrylonitrile copolymer, styrene-butadiene copolymer, styrene-maleic anhydride copolymer, polyester, polyvinyl chloride, vinyl chloride, vinyl acetate copolymer, polyvinyl acetate, polyvinylidene chloride, polyarylate resin, phenoxy resin, polycarbonate, cellulose acetate resin, ethyl cellulose resin, polyvinyl butyral, polyvinyl formal, polyvinyl toluene, poly-N-vinylcarbazole, acrylic resin, silicone resin, epoxy resin, melamine resin, urethane resin, phenol resin or alkyd resin. Such a conductive layer can be provided by dispersing and applying these conductive powders and binder resin in a suitable solvent, for example, tetrahydrofuran, dichloromethane, methyl ethyl ketone or toluene.

A construction apparatus wherein a conductive layer is provided on a suitable cylindrical substrate by a heat-shrinkable tubing containing these conductive powders in a material such as polyvinyl chloride, polypropylene, polyester, polystyrene, polyvinylidene chloride, polyethylene, chlorinated rubber or polytetrafluoroethylene fluoro-resin, may also be employed as the conductive support 31 adapted to the present invention.

Next the photosensitive layer will be described. The photosensitive layer may be a single layer or laminated layers; for convenience of explanation, the case comprising the charge generating layer 35 and charge transport layer 37, i.e. the case of FIGS. 2 and 3, will be described.

The charge-generating layer 35 is a layer that comprises a charge-generating substance as the main component. The charge-generating layer 35 may be formed from a charge-generating substance known in the art; examples thereof include monoazo pigments, diazo pigments, triazo pigments, perylene pigments, perinone pigments, quinacridone pigmets, quinone condensation polycyclic compounds, squalic acid dyes, other phthalocyanine pigments, naphthalocyanine pigments and azulenium salt dyes, and the like. These charge-generating substances may be used alone or in combination.

The charge-generating layer 35 is formed by dispersing the charge-generating substance together with the binder resin if necessary in a suitable solvent using a ball mill, attritor or sand mill, or by ultrasonic waves, then coating the composition on the conductive support, and drying.

Examples of the binder resin which is available in the charge-generating layer 35 depending on the requirements, are polyamide, polyurethane, epoxy resin, polyketone, polycarbonate, silicone resin, acrylic resin, polyvinyl butyral, polyvinyl formal, polyvinyl ketone, polystyrene, polysulfone, poly-N-vinylcarbazole, polyacrylamide, polyvinyl benzal, polyester, phenoxy resin, vinyl chloride-vinyl acetate copolymer, poly vinyl acetate, polyphenylene oxide, polyamide, polyvinyl pyridine, cellulose resin, casein, polyvinyl alcohol and polyvinyl pyrrolidone. The amount of binder resin is 0 part by weight to 500 parts by weight, and preferably 10 parts by weight to 300 parts by weight, relative to 100 parts by weight of the charge-generating substance. The binder resin may be optionally added before or after the dispersion.

The solvent may be isopropanol, acetone, methyl ethyl ketone, cyclohexanone, tetrahydrofuran, dioxane, ethyl cellosolve, ethyl acetate, methyl acetate, dichloromethane, dichloroethane, monochlorobenzene, cyclohexane, toluene, xylene or ligroin; ketone solvents, ester solvents and ether solvents are particularly preferred. These solvents may be used alone or in combination.

The charge-generating layer 35 comprises the charge-generating substance, solvent and binder resin as main components; it may also contain any other additives such as intensifier, dispersant, surfactant or silicone oil.

The coating solution may be applied by impregnation coating, spray coating, beat coating, nozzle coating, spinner coating or ring coating.

The film thickness of the charge-generating layer 35 is 0.01 to 5 μm, and preferably 0.1 to 2 μm.

The charge-transport layer 37 is formed by dissolving the charge-transporting substance and binder resin in a suitable solvent, applying the composition to the charge-generating layer 35, and drying it. If required, one or more of a plasticizer, leveling agent and antioxidant may also be added.

The charge-transporting substance may be an electron-transporting substance or positive-hole-transporting substance.

Examples of the electron-transporting substance include electron-accepting substance such as chloranyl, bromanyl, tetracyanoethylene, tetracyanoquinodimethane , 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno [1,2-b]thiophene-4-one, 1,3,7-trinitrodibenzothiophene-5,5-dioxide and benzoquinone derivatives.

Examples of positive-hole-transporting substances include poly-N-vinylcarbazole and its derivatives, poly-γ-carbazole ethyl glutamate and its derivatives, pyrene-formaldehyde condensate and its derivatives, polyvinyl pyrene, polyvinyl phenanthrene and polysilane, oxazole derivatives, oxadiazole derivatives, imidazole derivatives, monoarylamine derivatives, diarylamine derivatives, triarylamine derivatives, stilbene derivatives, α-phenylstilbene derivatives, benzidine derivatives, diarylmethane derivatives, triaryl methane derivatives, 9-stylanthracene derivatives, pyrazoline derivatives, divinylbenzene derivatives, hydrazone derivatives, indene derivatives, butadiene derivatives and pyrene derivatives, bisstilbene derivatives, enamine derivatives, and other known substances may be used. These charge-transporting substances may be used alone or in combination.

Examples of the binder resin include thermoplastic or thermosetting resins such as polystyrene, styrene-acrylonitrile copolymer, styrene-butadiene copolymer, styrene-maleic anhydride copolymer, polyester, polyvinyl chloride, vinyl chloride-vinyl acetate copolymer, polyvinyl acetate, polyvinylidene chloride, polyarylate resin, phenoxy resin, polycarbonate, cellulose acetate resin, ethyl cellulose resin, polyvinyl butyral, polyvinyl formal, polyvinyl toluene, poly-N-vinylcarbazole, acrylic resin, silicone resin, epoxy resin, melamine resin, urethane resin, phenol resin and alkyd resin.

The amount of charge transport substance is 20 to 300 parts by weight, and preferably 40 to 150 parts by weight based on 100 parts by weight of the binder resin. From the viewpoint of resolution and response, the thickness of the charge-transporting layer is preferably 25 μm or less. The lower limit differs depending on the employed system, charging potential in particular; 5 μm or more of the lower limit is preferred.

Examples of the solvent include tetrahydrofuran, dioxane, toluene, dichloromethane, monochlorobenzene, dichloroethane, cyclohexanone, methyl ethyl ketone and acetone. These may be used alone or in combination.

As for the charge-transporting layer, polymer charge-transporting substances may also be appropriately utilized those having the properties of the charge-transporting substance and the properties of the binder resin. The charge-transporting layer formed from such polymer charge-transporting substance may exhibit superior abrasion resistance. The polymer charge-transporting substance may be conventional substances in the art, preferably is polycarbonate having a triaryl amine structure in the backbone chain or side chain. In particular, the polymer charge-transporting substances expressed by the following general formulas (I) to (X) are preferable; those will be exemplified in the following.

Formula (I)

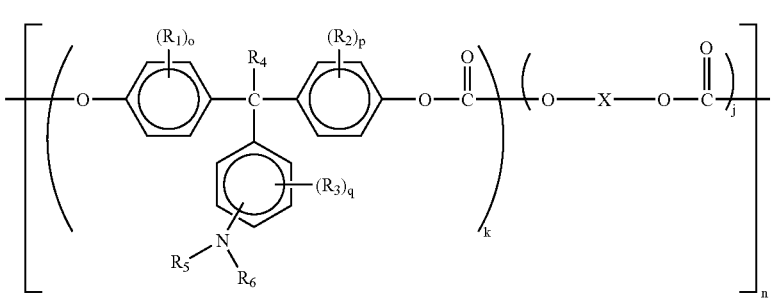

In Formula (I), $R_1$, $R_2$, $R_3$ are respectively substituted or unsubsituted alkyl groups or halogen atoms, $R_4$ is a hydrogen atom or a substituted or unsubsituted alkyl group, $R_5$, $R_6$ are substituted or unsubsituted aryl groups, o, p, q are integers in the range of 0 to 4, k, j represent compositional fractions where $0.1 \leqq k \leqq 1$, $0 \leqq j \leqq 0.9$, n represents the number of repeating units and is an integer in the range of 5 to 5000. X is an aliphatic divalent group, a cyclic aliphatic divalent group, or the divalent group expressed by the following two formulas (I)-1 and (I)-2.

Formula (I)-1

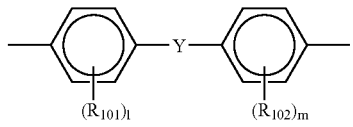

In the above formula, $R_{101}$, $R_{102}$ are respectively substituted or unsubsituted alkyl groups, an aryl group, or a halogen atom, l, m are integers in the range of 0 to 4, Y is a single bond, straight-chain, branched or cyclic alkylene group having 1 to 12 carbon atoms, —O—, —S—, —SO—, —$SO_2$—, —CO—, —CO—O-Z-O—CO— (Z is an aliphatic divalent group), or:

Formula (I)-2

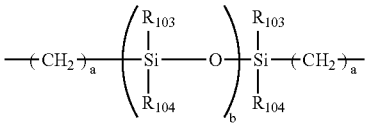

a is an integer in the range of 1 to 20, b is an integer in the range of 1 to 2,000, $R_{103}$, $R_{104}$ are substituted or unsubstituted alkyl groups or aryl groups. $R_{101}$, $R_{102}$, $R_{103}$, $R_{104}$ may be respectively identical or different.

Formula (II)

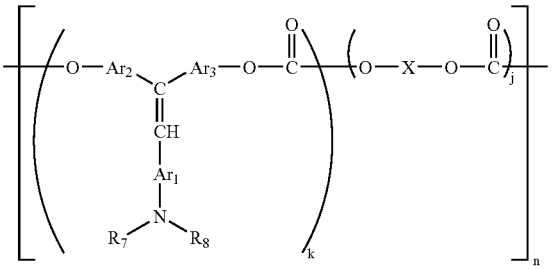

In Formula (II), $R_7$, $R_8$ are substituted or unsubstituted aryl groups, $Ar_1$, $Ar_2$, $Ar_3$ are arylene groups which may be identical or different, X, k, j and n are the same as in Formula (I).

Formula (III)

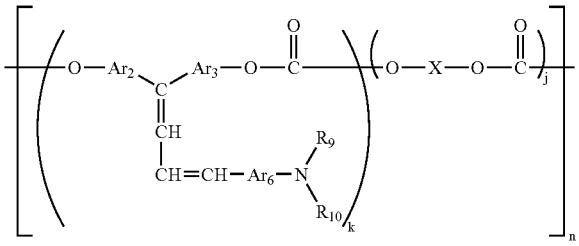

In Formula (III), $R_9$, $R_{10}$ are substituted or unsubstituted aryl groups, $Ar_4$, $Ar_5$, $Ar_6$ are arylene groups which may be identical or different, X, k, j and n are the same as in Formula (II).

Formula (IV)

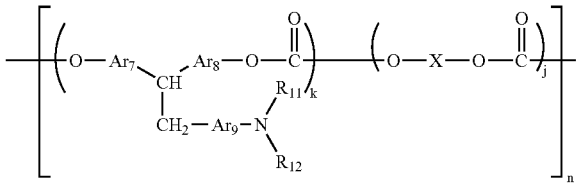

In Formula (IV), $R_{11}$, $R_{12}$ are substituted or unsubstituted aryl groups, $Ar_7$, $Ar_8$, $Ar_9$ are arylene groups which may be identical or different, p is an integer in the range of 1 to 5, X, k, j and n are the same as in Formula (I).

Formula (V)

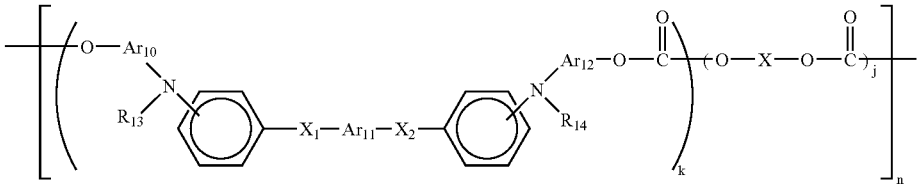

In Formula (V), $R_{13}$, $R_{14}$ are substituted or unsubstituted aryl groups, $Ar_{10}$, $Ar_{11}$, $Ar_{12}$ are arylene groups which may be identical or different, $X_1$, $X_2$ are substituted or unsubstituted ethylene groups, or substituted or unsubstituted vinylene groups. X, k, j and n are the same as in Formula (I).

Formula (VI)

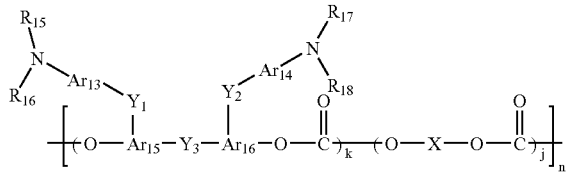

In Formula (VI), $R_{15}$, $R_{16}$, $R_{17}$, $R_{18}$ are substituted or unsubstituted aryl groups, $Ar_1$, $Ar_2$, $Ar_3$ are arylene groups which may be identical or different, $Y_1$, $Y_2$, $Y_3$ are single bond, substituted or unsubstituted alkylene groups, substituted or unsubstituted cycloalkylene groups, substituted or unsubstituted alkylene ether groups, oxygen atoms, sulfur atoms or vinylene groups. X, k, j and n are the same as in Formula (I).

Formula (VII)

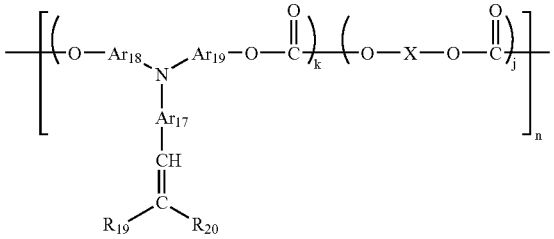

In Formula (VII), $R_{19}$, $R_{20}$ are hydrogen atoms, or substituted or unsubstituted aryl groups, and $R_{19}$, $R_{20}$ may form a ring. $Ar_{17}$, $A_{18}$, $A_{19}$ are arylene groups which may be identical or different. X, k, j and n are the same as in Formula (I).

Formula (IX)

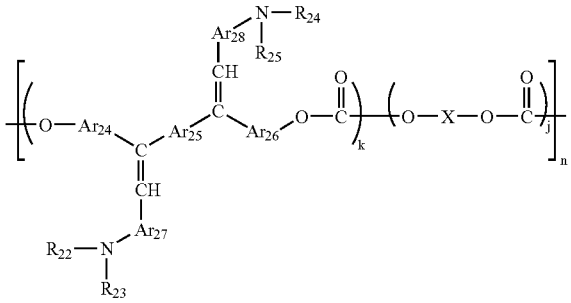

In Formula (IX), $R_{22}$, $R_{23}$, $R_{24}$, $R_{25}$ are substituted or unsubstituted aryl groups, $Ar_{24}$, $Ar_{25}$, $Ar_{26}$, $Ar_{27}$, $Ar_{28}$ are arylene groups which may be identical or different. X, k, j and n are the same as in Formula (I).

Formula (X)

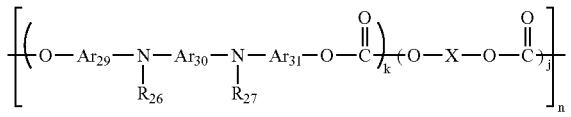

In Formula (X), $R_{26}$, $R_{27}$ are substituted or unsubstituted aryl groups, $Ar_{29}$, $Ar_{30}$, $Ar_{31}$ are arylene groups which may be identical or different. X, k, j and n are the same as in Formula (I).

The case will be described where the photoconductive layer is formed of mono layer, i.e. the constitution of FIG. 1. In this case, the photoconductor may be of the configuration that the charge-generating substance is dispersed into the binder resin. Photoconductor layer 33 may be produced by dissolving or dispersing the charge-generating substance, charge-transporting substance and binder resin into a proper solvent, then coating and drying the solution or dispersion.

Formula (VIII)

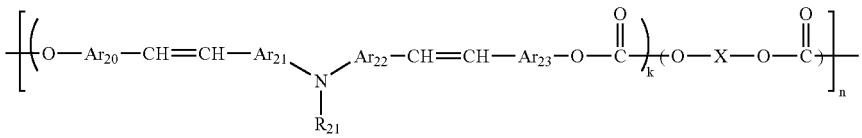

In Formula (VIII), $R_{21}$ is a substituted or unsubstituted aryl group, $Ar_{20}$, $Ar_{21}$, $Ar_{22}$, $Ar_{23}$ are arylene groups which may be identical or different, X, k, j and n are the same as in Formula (I).

Further, a plasticizer, leveling agent, and antioxidant may also be added depending on the requirement.

The binder resin may be that exemplified in relation to charge-transporting layer 37, or charge-generating layer 35.

Clearly, the polymer charge-transporting substances described above may be properly employed. The content of the charge-generating substance is preferably 5 to 40 weight parts based on 100 parts of the binder resin. The content of the charge-transporting substance is preferably 0 to 190 weight parts, more preferably 50 to 150 weight parts based on 100 parts of the binder resin.

The photoconductive layer may be prepared by dispersing the charge-generating substance, binder resin, charge-transporting substance, and the solvent such as tetrahydrofuran, dioxane, cyclohexane to prepare a coating liquid; then coating it by dip coating, spray coating, bead coating, or ring coating. The film thickness of the photoconductive layer is preferably 5 to 25 μm.

In the photoconductor of the present invention, an under-coating layer may be provided between the conductive substrate 31 and the photoconductive layer. The under-coating layer is usually formed from a resin as the main component, the resin is desirable to be solvent-resistant against common organic solvents from the view point that a photoconductive layer will be coated onto it with a solvent. Examples of such resin include water-soluble resins such as polyvinyl alcohol, casein, sodium polyacrylate, alcohol-soluble resins such as copolymer nylon and methoxymethylated nylon, and hardening resins capable of forming a three-dimensional network such as polyurethane, melamine resin, phenol resin, alkyd-melamine resin and epoxy resin. Also, fine powder pigments of metal oxide such as titanium oxide, silica, alumina, zirconium oxide, tin oxide or indium oxide may be added into the under-coating layer to prevent Moire patterns and to reduce residual potential.

The under-coating layer may be formed by using a suitable solvent and a coating process as the photoconductive layer explained above. A silane coupling agent, titanium coupling agent, chromium coupling agent, or the like may be employed in the under-coating layer; $Al_2O_3$ may be provided by anodic oxidation in some cases, alternatively organic substances such as polyparaxylylene (parylene) or inorganic substances such as $SiO_2$, $SnO_2$, $TiO_2$, ITO, $CeO_2$ may be provided by a thin-film-forming process under vacuum to the under-coating layer. Other substances known in the art may also be used. The film thickness of the under-coating layer is in the range of 0 to 5 μm.

In the electrophotographic photoconductor according to the present invention, protective layer 39 may be provided in order to protect the photoconductive layer and to maintain the lower level of skin-friction coefficient. Examples of substances employed for the protective layer 39 include ABS resins, ACS resins, olefine-vinyl monomer copolymers, chlorinated polyethers, aryl resins, phenol resins, polyacetals, polyamides, polyamidoimides, polyacrylates, polyallyl sulfones, polybutylenes, polybutylene terephthalates, polycarbonates, polyethersulfones, polyethylenes, polyethylene terephthalates, polyimides, acrylic resins, polymethylpentenes, polypropylenes, polyphenylene oxides, polysulfones, polystyrenes, polyarylates, AS resins, butadiene-styrene copolymers, polyurethanes, polyvinyl chlorides, polyvinylidene chlorides and epoxy resins. Among these, polycarbonates and polyarylates are preferred from the viewpoints of dispersibility of fine particles of fluorine-contained resin, residual potential, and coating defects.

Further, fillers may be incorporated into the protective layer in order to improve the wear resistance. Fillers are classified into organic fillers and inorganic fillers; inorganic fillers are advantageous in order to enhance the wear resistance owing to the higher hardness of filler. Examples of the inorganic filler include metal powders such as copper, tin, aluminum, indium and the like; metal oxides such silica, tin oxide, zinc oxide, titanium oxide alumina, zirconium oxide, indium oxide, antimony oxide, bismuth oxide, calcium oxide, tin oxide doped with antimony, indium oxide doped with tin and the like; metal fluorides such tin fluoride, calcium fluoride, aluminum fluoride and the like; potassium titanate, boron nitride, and the like.

Also, these fillers may be surface-treated with at least one surface-treating agent, which is preferable in terms of dispersion properties of the inorganic filler. Poor dispersion properties of the inorganic filler cause decreased transparency of coated film and formation of film defects as well as increase of residual potential. Furthermore, it may deteriorate wear resistance of the coated film and thus may lead to serious problems impeding high durability or image quality.

As the surface-treating agent, though any one commonly used in the prior art can be used, a surface-treating agent capable of maintaining the insulation of the inorganic filler is preferred. For example, the inorganic filler may be preferably treated with titanate coupling agents, aluminum coupling agents, zirco-aluminate coupling agents, high molecular fatty acid or a combination thereof with a silane coupling agents, $Al_2O_3$, $TiO_2$, $ZrO_2$, silicone, aluminum stearate or a combination thereof, from the view points of dispersibility of the inorganic filler and image blurs.

The treatment with silane coupling agents alone may increase image blurs, however, such adverse effect may be overcome by treating with a silane coupling agent and other coupling agents. The amount of the surface-treating agent is preferably 3 to 30% by weight, more preferably 5 to 20% by weight, wherein the amount usually is different depending on the average primary particle size of inorganic filler. When the amount of the surface-treating agent is less than the range, the dispersibility of the inorganic filler may be relatively poor. When it exceeds the range, the residual potential may increase significantly.

Examples of the fine particles of fluorine-contained resin adapted to the present invention include the fine particles of tetrafluoroethylene resin, perfluoroalkoxy resin, trifluorochloroethylene resin, hexaethylenepropylene resin, vinylfluoride resin, vinylidenefluoride resin, dichloroethylene fluoride resin, and copolymer of these resin, preferably one or more type of fine particles is employed. In particular, fine particles of tetrafluoroethylene resin and perfluoroalkoxy resin are preferred. The usable particle diameter is 0.1 to 10 μm, preferably 0.05 to 2.0 μm. The particle diameter is adjustable in a dispersion process depending on the necessity as described later.

Preferably, 10 to 60% of the surface of the photoconductor is covered by the fine particles of fluorine-contained resin of which the secondary particle diameter is 0.3 to 4 μm, more preferably 0.3 to 1.5 μm. When the covering ratio is less than 10%, the skin-friction coefficient at micro or spotted areas is not sufficiently low, whereas when the covering ratio is over 60%, the electrostatic latent images are difficult to be formed since the transmittance of laser radiation comes to extremely low. Further, when the secondary particle size is over 4 μm, the contacting area with toner comes to insufficient, or abnormal images may be induced due to the scattering of laser radiation.

Preferably, the protective layer contains 20 to 60% by volume, more preferably 30 to 50% by volume of fine particles of fluorine-contained resin in order to maintain the lower skin-friction coefficient even after repeated usage. Thereby, the photoconductor exhibits remarkably lower abrasion wear due to the lower skin-friction coefficient, and the necessary and sufficient amount of fine particles of fluorine-contained resin is successively extended or elongated, as a result the lower skin-friction coefficient and higher durability may be achieved. When the fine particles of fluorine-contained resin is less than 20% by volume, the lower skin-friction coefficient can not be maintained when the inner portion of the protective layer is exposed due to the wear, even though the covering ratio may be assured at near the surface. On the other hand, when the fine particles of fluorine-contained resin is more than 60% by volume, the mechanical strength of the coated film remarkably decreases due to the less amount of the binder resin, resulting in shorter life of the photoconductor.

In the preparation of the protective layer, the aforesaid any solvents with respect to charge-transporting layer 37 are available i.e. tetrahydrofuran, dioxane, toluene, dichloromethane, monochlorobenzene, dichloroethane, cyclohexanone, methylethylketone, acetone, and the like for example. Preferably, the solvent affords higher viscosities at dispersing the fine particles of fluorine-contained resin and exhibits higher volatilities at coating the dispersion. If there is no solvent satisfying such requirements, two or more solvents each of which satisfies such requirements in part may be mixed together so as to favorably affect dispersibility of fine particles of fluorine-contained resin.

Further, the polymer charge-transporting substances exemplified with respect to charge-transporting layer 37 may be effectively added to the protective layer so as to decrease the residual potential and to enhance the image quality.

The fine particles of fluorine-contained resin are dispersed into at least an organic solvent by means of a ball mil, attritor, sand mill, vibration mill, sonification methods known to the art. Among these, the ball mill and vibration mill are preferred since impurities are seldom introduced from the outside and the dispersion is well performed. As for the medium, any one conventionally used such as zirconia, alumina, agate and the like may be utilized, in particular zirconia is preferred in light of dispersibility of the fine particles of fluorine-contained resin. In some cases, two or more of these methods may be combined to enhance still more the dispersibility. Furthermore, a dispersant may be added to the fine particles of fluorine-contained resin in order to control the dispersibility of the resin. As for such dispersant, fluorine-contained surfactants, graft polymers, block polymers, and coupling agents may be utilized.

The protective layer may be formed by dip coating, spray coating, bead coating, nozzle coating, spinner coating, ring coating, and the like. Among these, the spray coating is preferable from the uniformity viewpoint of the coated film. Further, the protective layer is preferably formed of two or more laminated layers through several overlapped coatings, since the plural times coating is likely to produce higher uniformity of fine particles of fluorine-contained resin than one time coating of the necessary thickness.

The thickness of the protective layer may be optionally determined; however, the thickness is preferably designed to be minimum within the necessary range, since the image quality tends to decrease when the layer thickness is unnecessarily large. The thickness of the protective layer is preferably 0.1 to 10 μm.

In the photoconductor according to the present invention, an intermediate layer may be provided between the photoconductive layer and the protective layer. The intermediate layer is generally based on a binder resin. As for the binder resin, polyamide, alcohol-soluble nylon, water-soluble polyvinyl butyral, polyvinyl butyral, polyvinyl alcohol and the like may be exemplified. The intermediate layer may be formed by conventional method described before. The thickness of the intermediate layer is preferably 0.05 to 2 μm.

Figure 4:
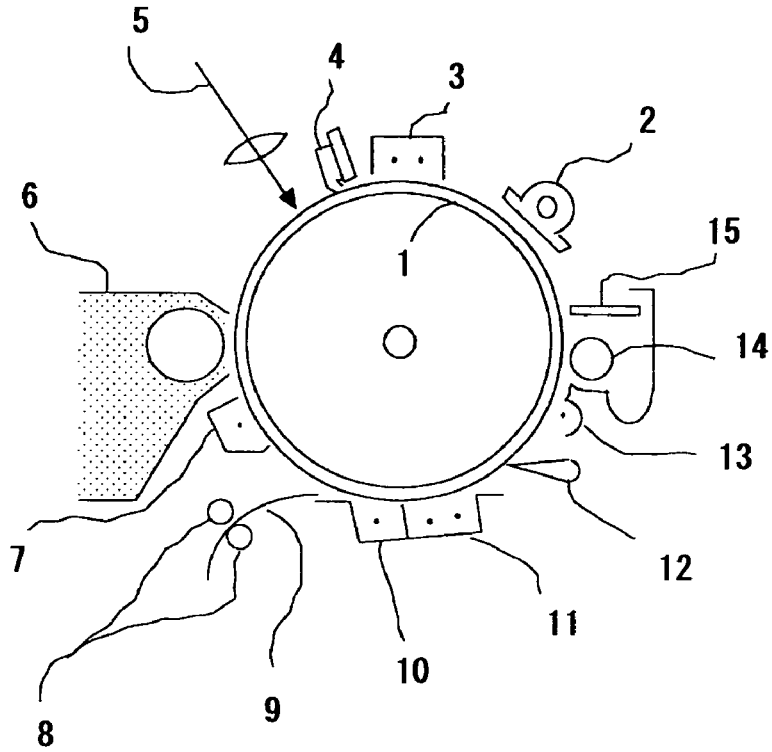
FIG. 4 schematically shows a view that explains the electrophotographic process and the electrophotographic apparatus according to the present invention.

The electrophotographic process and the electrophotographic apparatus according to the present invention will be explained referring to the attached figures. FIG. 4 schematically shows a view that explains the electrophotographic process and the electrophotographic apparatus according to the present invention; the following modifications are included into the scope of the present invention.

The photoconductor 1 shown in FIG. 4 is provided with at least a photoconductive layer, which contains filler at outermost layer. The photoconductor 1 is of drum-like shape, otherwise a sheet-like or endless belt-like shape may be allowable. A corotron, scorotoron, solid charger, charging roller is utilized for the charging charger 3, pre-transferring charger 7, transferring charger 10, separating charger 11, and pre-cleaning charger 13; the conventional units or devices may be employed entirely.

These chargers may be applied to the transferring unit; the combined type of transferring charger and separating charger is effectively utilized.

The light source of image-irradiating portion 5, charge-eliminating lamp 2 and other members may be a fluorescent lamp, tungsten lamp, halogen lamp, mercury lamp, sodium lamp, light emitting diode (LED), semiconductor laser (LD) and electroluminescent (EL) lamp. To irradiate light of desired wavelengths alone, various filters may be utilized such as a sharp-cut filter, band pass filter, near-infrared cut filter, dichroic filter, interference filter and color conversion filter.

The light source works to apply light to the photoconductor in the process shown in FIG. 4, as well as in another process in combination with light irradiation, such as transferring process, charge-eliminating process, cleaning process or pre-exposing process.

The toner developed on the photoconductor 1 by action of the developing unit 6 is transferred to the transfer sheet 9, wherein all of the toner is not transferred, a minor portion of the toner remains on the photoconductor 1. The residual toner on the photoconductor 1 is removed from the photoconductor 1 by a fur brush 14 and cleaning brush 15; the cleaning process may be performed with the cleaning brush alone. Examples of the cleaning brush include a fur brush, magnetic fur brush and any other conventional brushes.

When the electrophotographic photoconductor is positively (negatively) charged and image exposure is performed, a positive (negative) electrostatic latent image is formed on the electrophotographic photoconductor surface. When developed with a toner (charge-seeking particulates) of negative (positive) polarity, a positive image will be obtained, and when developed with a toner of positive (negative) polarity, a negative image will be obtained.

The developing unit may be any known in the art, and the charge-eliminating unit may also be any known in the art.

In FIG. 4, reference number 4 indicates an eraser, reference number 5 indicates a resist roller, and reference number 12 indicates a separating claw.

The electrophotographic apparatus according to the present invention may be equipped with a contacting member that contacts with the electrophotographic photoconductor and slide and scrub on it. The contacting member may comprise a contacting portion to slide and scrub with the exposed portion of the fine particles of fluorine-contained resin, alternatively the contacting member may be formed by additionally providing a pressurizing mechanism to an usual member in image forming apparatuses i.e. a contacting-charging member such as a charging roller, cleaning member such as a cleaning brush, and transferring member such as charging belt or intermediate charging member.

For example, the cleaning blade 15 will be discussed that slide and scribe the surface of the photoconductor. The cleaning blade slide and scribe approximately the entire surface of the photoconductor while urging the photoconductor surface with approximately uniform pressure, and performs a significant effect of adhering uniformly the fine particles of fluorine-contained resin on the surface.

When the fluorine-contained resin is covered by means of a cleaning blade, the following conditions of cleaning blade will be appropriate such as 10 to 20° of contacting angle, 0.3 to 4 g/mm of contacting pressure, 60 to 70 degrees of urethane rubber hardness for the blade, 30 to 70% of impact resilience, 30 to 60 kgf/cm$^2$ of modulus of elasticity, 1.5 to 3.0 mm of thickness, 7 to 12 mm of free length, 0.2 to 2 mm of blade edge interlocking into the photoconductor.

Figure 5:
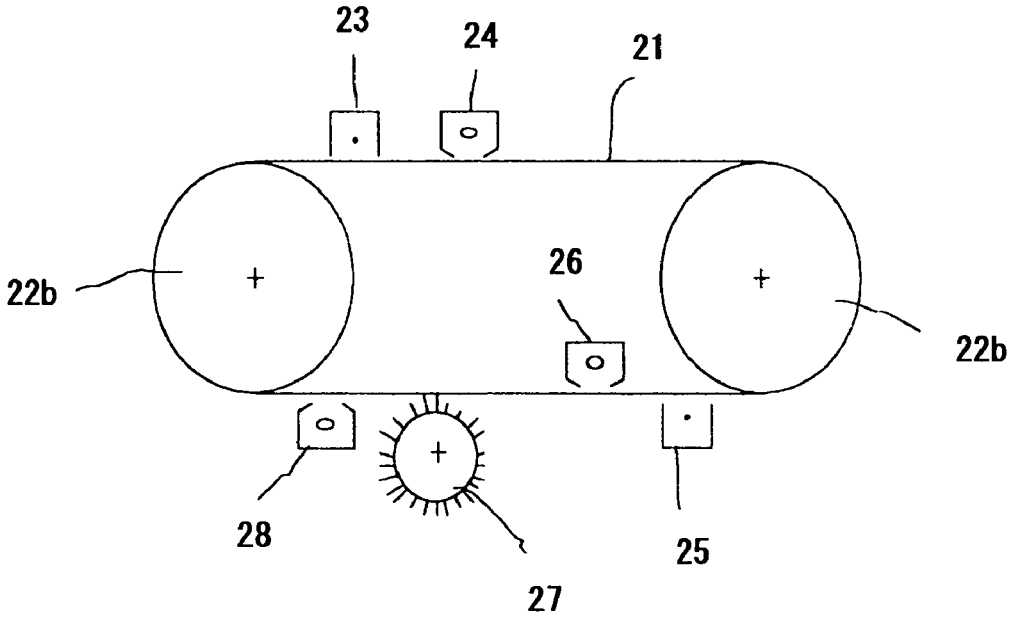
FIG. 5 schematically shows a view that explains another electrophotographic process according to the present invention.

Another example of the electrophotographic process according to the present invention is shown in FIG. 5. The photoconductor 21 is provided with at least a photoconductive layer, which contains filler at outermost layer, is driven by driving rollers 22*a*, 22*b*, and is repeatedly subjected to charging by charging charger 23, to image exposure by light source 24, to developing (not shown), to transferring by transferring charger 25, to pre-cleaning exposure by light source 26, to cleaning by cleaning brush 27, and to charge elimination by light source 28. In the constitution of FIG. 5, light of pre-cleaning exposure is irradiated from the support side to the photoconductor 21, wherein the support is translucent in this constitution.

The electrophotographic process explained above is no more than an example, and the other aspects may be possible, needless to say. For is example, the pre-cleaning exposure may be carried out from the photoconductive layer side instead of from the support side as shown in FIG. 5; the irradiation for image exposure and/or charge elimination may be carried out from the support side.

Further, pre-transferring exposure, pre-exposure of image irradiation, and the other light irradiation processing are provided to irradiate light on the photoconductor instead of image exposure, pre-cleaning exposure, and charge-eliminating exposure as shown in FIG. 5.

Figure 6:
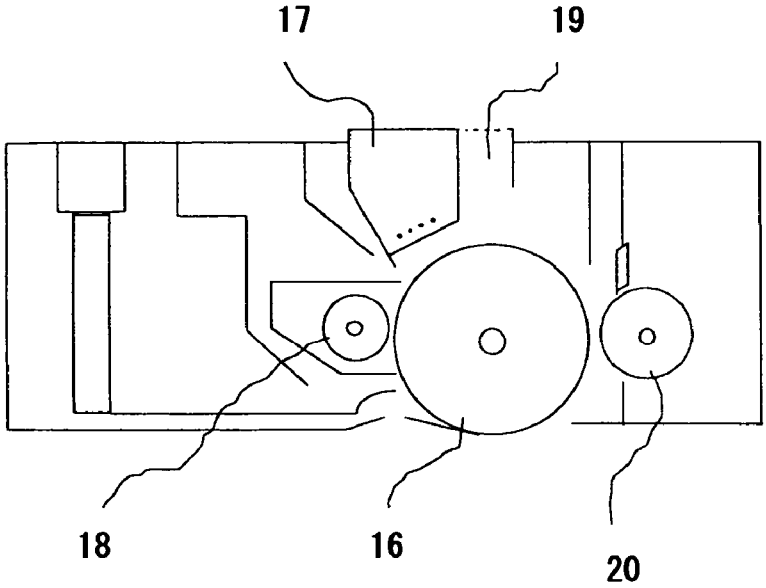
FIG. 6 schematically and exemplarily shows a conventional process cartridge.

The image-forming unit shown above may be fixed and incorporated in a copier, facsimile or printer, and it may also be incorporated in these devices in the form of a process cartridge. The process cartridge is a device or part housing a photoconductor and further comprising at least one of other components such as charging unit, light irradiation unit, developing unit, transferring unit, cleaning unit and charge-eliminating unit. The process cartridge may take many forms; the construction shown in FIG. 6 is given as a common example. The photoconductor 16 comprises at least a photoconductive layer on a conductive support and a filler at the outermost layer; and charging charger 17, cleaning brush 18, image-exposing portion 19, and developing roller 20 are equipped.

As a full-color image forming apparatus, to which the present invention is applied, an aspect of printer of electrophotographic type (hereinafter, referring to "printer") will be discussed.

Figure 7:
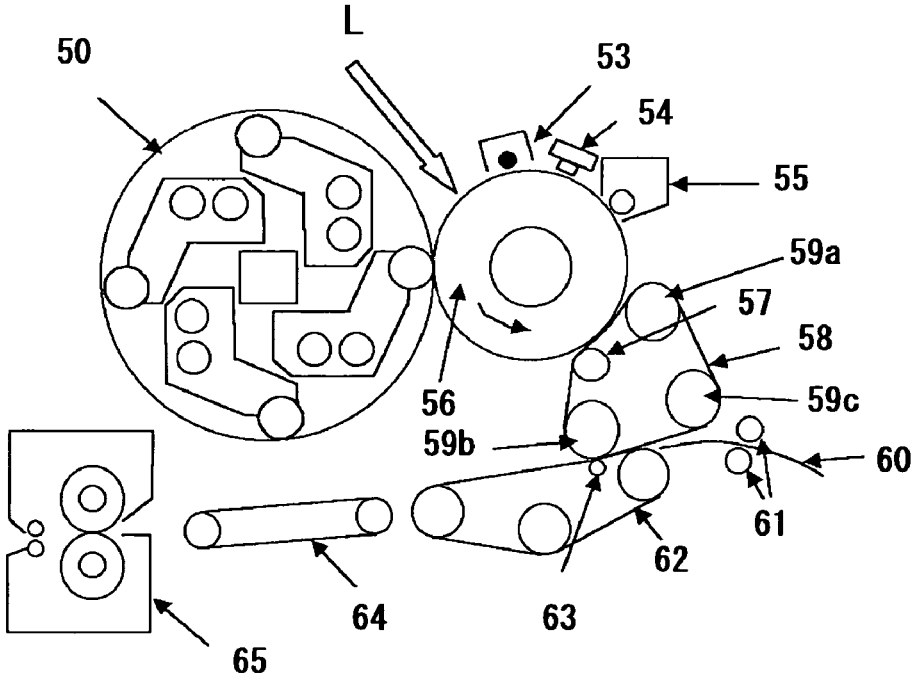
FIG. 7 schematically and exemplarily shows a full-color image forming apparatus according to the present invention.

FIG. 7 shows a schematic constitution of the printer to which the present invention is applied. In FIG. 7, while photoconductor 56, which is a latent image bearing member, is driven to rotate toward the anticlockwise direction in FIG. 7, the surface is charged uniformly by charging charger 53 equipped with corotron or scorotron, then the photoconductor 56 bears latent images through receiving the scanning laser L from a laser apparatus (not shown). The scanning is carried out by the mono-color information of yellow, magenta, cyan, and black based on the full-color image, therefore, the mono-color electrostatic latent images of yellow, magenta, cyan, and black are formed on the photoconductor 56. Revolving developing unit 50 is disposed at the left side of the photoconductor 56 as shown in FIG. 7. The unit 50 comprises a yellow developer, magenta developer, cyan developer, and black developer in the revolving drum-like housing, the respective developers are moved in sequence to the opposite developing site of photoconductor 56 through revolving motion. The yellow developer, magenta developer, cyan developer, and black developer respectively cause the adhesion of yellow toner, magenta toner, cyan toner, and black toner, thereby to develop the electrostatic latent images. The electrostatic latent images of yellow, magenta, cyan, and black images are formed in sequence, and are developed by the respective revolving developer of revolving developing unit 50 in sequence, thereby yellow, magenta, cyan, and black toner images are formed.

An intermediate transferring unit is disposed at the downstream from the developing site in the revolution direction of the photoconductor drum. The intermediate transferring unit is activated by rotating endlessly in clockwise direction the intermediate transferring belt 58, tensioned on tension roller 59*a*, intermediate transferring bias roller 57 as transferring unit, secondary transferring backup roller 59*b*, and belt driving roller 59*c*, by the rotating force of the belt driving roller 59*c*. The yellow toner image, magenta toner image, cyan toner image, and black toner image developed on the photoconductor drum 56 progress into the intermediate nip where photoconductor drum 56 and intermediate transferring belt make contact. Then the color image formed of overlapped four colors is produced by overlapping on intermediate transferring belt under the effect of the bias from the intermediate transferring bias roller 57.

The surface of photoconductor drum 56, passed through the nip with the revolution, is subjected to cleaning of the residual toner by drum cleaning unit 55. Drum cleaning unit 55, which cleans the residual transferring toner by a cleaning roller to which cleaning bias is applied, may equipped with a cleaning brush such as far brush or magnetic fur brush, or a cleaning blade.

The surface of the photoconductor drum 56, where the residual toner is cleaned, is subjected to charge elimination by charge eliminating lamp 54. The charge eliminating lamp 54 may be a fluorescent lamp, tungsten lamp, halogen lamp, mercury lamp, sodium lamp, light emitting diode (LED), semiconductor laser (LD) and electroluminescent (EL) lamp. To irradiate light of desired wavelengths alone, various filters may be utilized such as a sharp-cut filter, band pass filter, near-infrared cut filter, dichroic filter, interference filter and color conversion filter.

On the other hand, the resistant roller pair 61, which nips between the two rollers the transferring paper 60 from the feeding paper cassette (not shown), feeds the transferring paper 60 to the secondary transferring nip in a timing that the transferring paper 60 can be overlapped to the four color duplicated toner image on the intermediate transferring belt 58. The four color duplicated toner image on the intermediate transferring belt 58 is transferred together on the transferring paper 60 under the effect of the secondary transferring bias from the paper transferring bias roller 63 in the secondary transferring nip. Owing to the secondary transfer, full-color images may be formed on the transferring paper. The transferring paper bearing the full-color image is sent to conveying belt 64 by transferring belt 62. Transferring belt 64 feeds the transferring paper 60 from the transferring unit into fixing unit 65. The fixing unit 65 conveys the sent transferring paper 60 while nipping it between the fixing nip formed by contacting the heating roller and backup roller. The full-color image on the transferring paper 60 is fixed on the transferring paper 60 under the effects of heat and pressure from the heating roller and the fixing nip.

Further, a bias (not shown) is applied to the transferring belt 62 and conveying belt 64, in order to adsorb the transferring paper 60. Furthermore, a paper-discharging charger to discharge transferring paper 60, and three belt-discharging charger are disposed to discharge the respective belts of intermediate belt 58, transferring belt 62, and conveying belt 64. The intermediate transferring unit also comprises a belt-cleaning unit of which constitution is similar to the drum-cleaning unit 55, thereby the residual toner on the intermediate transferring belt 58 is cleaned.

Figure 8:
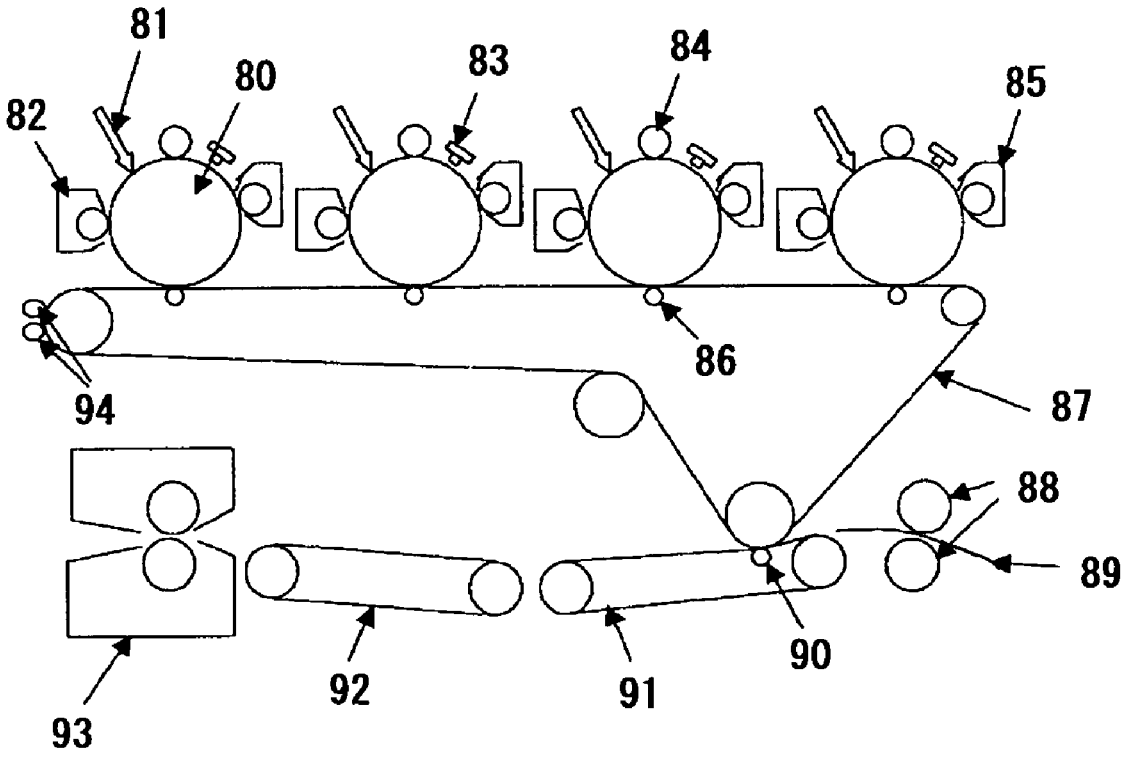
FIG. 8 schematically and exemplarily shows another full-color image forming apparatus according to the present invention.

FIG. 8 shows another aspect of the electrophotographic apparatus according to the present invention. The apparatus is an image forming apparatus of tandem type having an intermediate-transferring belt 87, in which the apparatus involves photoconductor drums 80Y, 80M, 80C and 80Bk individually for respective colors, rather than one photoconductor drum 80 is shared by all of the colors. Further, drum-cleaning unit 85, charge-eliminating lamp 83, and charging roller 84 to charge the drum uniformly are equipped for the respective colors. By the way, the printer shown in FIG. 7 is equipped with charging charger 53 as the unit to charge the drum uniformly, whereas the apparatus is equipped with charging roller 84.

In addition, the electrophotographic apparatus shown in FIG. 8 is equipped with light source 81, developing unit 82, bias roller 86, resist roller 88, transferring paper 89, transferring bias roller 90, transferring belt 91, conveying belt 92, fixing unit 93, and fur brush 94.

In such tandem type, the latent image forming and the developing may be carried out for the respective colors in parallel, therefore, the speed of image forming may be enhanced more easily than the revolving type.

The toner suitable for the present invention will be discussed in the following.

-Preparation Process-

The toner of the present invention may be prepared by a process comprising the steps of dissolving or dispersing a composition in an organic solvent to form a solution or dispersion, the composition comprising at least a resin reactive with an active-hydrogen-containing compound, an active-hydrogen-containing compound, a coloring agent, a releasing agent, and a graft polymer (C) of a polyolefin resin (A) on which a vinyl resin (B) has been at least partially grafted; dispersing the solution or dispersion in an aqueous medium preferably in the presence of an inorganic dispersing agent or fine polymer particles; subjecting the reactive resin and the active-hydrogen-containing compound to addition polymerization; and removing the organic solvent from the resulting emulsion. The toner can also be prepared by a method for producing a dry toner in which a toner composition comprising a polyester resin is dispersed in an aqueous medium to form toner particles, in which an isocyanate-containing polyester prepolymer as the resin reactive with an active-hydrogen-containing compound dispersed in the aqueous medium is subjected to elongation and crosslinking with an amine as the active-hydrogen-containing compound, and the solvent is removed from the resulting emulsion. More specifically, the toner may be prepared as a result of the reaction between an isocyanate-containing polyester prepolymer (A) and an amine (B). An example of the isocyanate-containing polyester prepolymer A is a reaction product of a polyester and a polyisocyanate (PIC), in which the polyester is a polycondensate between a polyol (PO) and a polycarboxylic acid (PC) and has an active hydrogen group. The active hydrogen group of the polyester includes, for example, hydroxyl groups (alcoholic hydroxyl groups and phenolic hydroxyl groups), amino groups, carboxyl groups, and mercapto groups, of which alcoholic hydroxyl groups are preferred.

Examples of the polyol (PO) include diols (DIO) and trihydric or higher polyols (TO). As the polyol (PO), a diol (DIO) alone or a mixture of a diol (DIO) and a small amount of a polyol (TO) is preferred. Examples of the diols (DIO) include alkylene glycols such as ethylene glycol, 1,2-propylene glycol, 1,3-propylene glycol, 1,4-butanediol, and 1,6-hexanediol; alkylene ether glycols such as diethylene glycol, triethylene glycol, dipropylene glycol, polyethylene glycol, polypropylene glycol, and polytetramethylene ether glycol; alicyclic diols such as 1,4-cyclohexaneddimethanol, and hydrogenated bisphenol A; bisphenols such as bisphenol A, bisphenol F, and bisphenol S; alkylene oxide (e.g., ethylene oxide, propylene oxide, and butylene oxide) adducts of the aforementioned alicyclic diols; and alkylene oxide (e.g., ethylene oxide, propylene oxide, and butylene oxide) adducts of the aforementioned bisphenols. Among them, alkylene glycols each having 2 to 12 carbon atoms, and alkylene oxide adducts of bisphenols are preferred, of which alkylene oxide adducts of bisphenols alone or in combination with any of alkylene glycols having 2 to 12 carbon atoms are typically preferred.

The polycarboxylic acid (PC) includes, for example, dicarboxylic acids (DIC) and tri- or higher polycarboxylic acids (TC). As the polycarboxylic acid (PC), a dicarboxylic acid (DIC) alone or in combination with a small amount of a tri- or higher polycarboxylic acid (TC) is preferred. The dicarboxylic acids (DIC) include, but are not limited to, alkylenedicarboxylic acids such as succinic acid, adipic acid, and sebacic acid; alkenylenedicarboxylic acids such as maleic acid, and fumaric acid; aromatic dicarboxylic acids such as phthalic acid, isophthalic acid, terephthalic acid, and naphthalenedicarboxylic acid. Among them, preferred are alkenylenedicarboxylic acids each having 4 to 20 carbon atoms and aromatic dicarboxylic acids each having 8 to 20 carbon atoms. The tri- or higher polycarboxylic acids (TC) include, for example, aromatic polycarboxylic acids each having 9 to 20 carbon atoms, such as trimellitic acid and pyromellitic acid. An acid anhydride or lower alkyl ester (e.g., methyl ester, ethyl ester, and propyl ester) of any of the polycarboxylic acids can be used as the polycarboxylic acid (PC) to react with the polyol (PO).

The polyisocyanate (PIC) includes, but is not limited to, aliphatic polyisocyanates such as tetramethylene diisocyanate, hexamethylene diisocyanate, and 2,6-diisocyanatomethyl caproate; alicyclic polyisocyanates such as isophorone diisocyanate, and cyclohexylmethane diisocyanate; aromatic diisocyanates such as tolylene diusocyanate, and diphenylmethane diisocyanate; aromatic-aliphatic diusocyanates such as $\alpha,\alpha,\alpha'$, $\alpha'$-tetramethylxylylene diisocyanate; isocyanurates; blocked products of the polyisocyanates with, for example, phenol derivatives, oximes, or caprolactams; and mixtures of these compounds.

The molar ratio [NCO]/[OH] of isocyanate groups [NCO] to hydroxyl groups [OH] of the hydroxyl-containing polyester is generally from 5/1 to 1/1, preferably from 4/1 to 1.2/1, and more preferably from 2.5/1 to 1.5/1. If the ratio [NCO]/[OH] exceeds 5, the toner may have insufficient image-fixing properties at low temperatures. If the molar ratio of [NCO]/[OH] is less than 1, a urea content of the modified polyester may be excessively low and the toner may have insufficient hot offset resistance. The content of the polyisocyanate (3) in the prepolymer (A) having an isocyanate group is generally from 0.5% to 40% by weight, preferably from 1% to 30% by weight, and more preferably from 2% to 20% by weight. If the content is less than 0.5% by weight, the hot offset resistance may deteriorate, and satisfactory storage stability at high temperatures and image-fixing properties at low temperatures may not be obtained concurrently. If the content exceeds 40% by weight, the image-fixing properties at low temperatures may deteriorate.

The isocyanate-containing prepolymer (A) generally has, in average, 1 or more, preferably 1.5 to 3, and more preferably 1.8 to 2.5 isocyanate groups per molecule. If the amount of the isocyanate group per molecule is less than 1, the resulting urea-modified polyester may have a low molecular weight and the hot offset resistance may deteriorate.

The amine (B) includes, for example, diamines (B1), tri- or higher polyamines (B2), amine alcohols (B3), aminomercaptans (B4), amino acids (B5), and amino-blocked products (B6) of the amines (B1) to (B5). The diamines (B1) include, but are not limited to, aromatic diamines such as phenylenediamine, diethyltoluenediamine, and 4,4'-diaminodiphenylmethane; alicyclic diamines such as 4,4'-diamino-3,3'-dimethyldicyclohexylmethane, diaminocyclohexanes, and isophoronediamine; and aliphatic diamines such as ethylenediamine, tetramethylenediamine, and hexamethylenediamine. The tri- or higher polyamines (B2) include, for example, diethylenetriamine, and triethylenetetramine. The amino alcohols (B3) include, but are not limited to, ethanolamine, and hydroxyethylaniline. The aminomercaptans (B4) include, for example, aminoethyl mercaptan, and aminopropyl mercaptan. The amino acids (B5) include, but are not limited to, aminopropionic acid, and aminocaproic acid. The amino-blocked products (B6) of the amines (B1) to (B5) includes ketimine compounds and oxazoline compounds derived from the amines (B1) to (B5) and ketones such as acetone, methyl ethyl ketone, and methyl isobutyl ketone. Among these amines (B), preferred are the diamine (B1) alone or in combination with a small amount of the polyamine (B2).

The content of the amine (B) in terms of the equivalence ratio [NCO]/[NHx] of isocyanate groups [NCO] in the polyester prepolymer (A) to amino groups [NHx] of the amine (B) is generally from 1/2 to 2/1, preferably from 1.5/1 to 1/1.5 and more preferably from 1.2/1 to 1/1.2. If the ratio [NCO]/[NHx] exceeds 2/1 or is less than 1/2, the polyester may have a low molecular weight, and the hot offset resistance may deteriorate. The urea-modified polyester (UMPE) can be used as the polyester in the present invention, the urea-modified polyester may further have a urethane bond in addition to the urea bond. The molar ratio of the urea bond to the urethane bond is generally from 100/0 to 10/90, preferably from 80/20 to 20/80, and more preferably from 60/40 to 30/70. If the molar ratio of the urea bond to the urethane bond is less than 10/90, the hot offset resistance may deteriorate.

In the present invention, the urea-modified polyester (UMPE) may be used alone or in combination with an unmodified polyester (PE) as the binder component of the toner. The combination use of the urea-modified polyester (UMPE) with the unmodified polyester (PE) may improve the image-fixing properties at low temperatures and glossiness upon use in a full-color apparatus and is more preferred than the use of the modified polyester alone. The unmodified polyester (PE) and preferred examples thereof include, for example, polycondensation products of a polyol (PO) and a polycarboxylic acid (PC) as in the polyester component of the urea-modified polyester (UMPE). The unmodified polyesters (PE) include unmodified polyesters as well as polyesters modified with a urethane bond or another chemical bond other than urea bond. The urea-modified polyester (UMPE) and the unmodified polyester (PE) are preferably at least partially compatible or miscible with each other for better image-fixing properties at low temperatures and hot-offset resistance. Accordingly, the urea-modified polyester (UMPE) preferably has a polyester component similar to that of the unmodified polyester (PE). The weight ratio of the urea-modified polyester (UMPE) to the unmodified polyester (PE) is generally from 5/95 to 80/20, preferably from 5/95 to 30/70, more preferably from 5/95 to 25/75, and typically preferably from 7/93 to 20/80. If the weight ratio is less than 5/95, the hot offset resistance may deteriorate, and satisfactory storage stability at high temperatures and image fixing properties at low temperatures may not be obtained concurrently.

-Colorant-

Any conventional or known dyes and pigments can be used as the colorant of the present invention. Such dyes and pigments include, but are not limited to, carbon black, nigrosine dyes, black iron oxide, Naphthol Yellow S, Hansa Yellow (10G, 5G, and G), cadmium yellow, yellow iron oxide, yellow ochre, chrome yellow, Titan Yellow, Polyazo Yellow, Oil Yellow, Hansa Yellow (GR, A, RN, and R), Pigment Yellow L, Benzidine Yellow (G, GR), Permanent Yellow (NCG), Vulcan Fast Yellow (5G, R), Tartrazine Lake, Quinoline Yellow Lake, Anthragen Yellow BGL, isoindolinone yellow, red oxide, red lead oxide, red lead, cadmium red, cadmium mercury red, antimony red, Permanent Red 4R, Para Red, Fire Red, p-chloro-o-nitroaniline red, Lithol Fast Scarlet G, Brilliant Fast Scarlet, Brilliant Carmine BS, Permanent Red (F2R, F4R, FRL, FRLL, F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Hello Bordeaux BL, Bordeaux 10B, BON Maroon Light, BON Maroon Medium, eosine lake, Rhodamine Lake B, Rhodamine Lake Y. Alizarine Lake, Thioindigo Red B, Thioindigo Maroon, Oil Red, quinacridone red, Pyrazolone Red, Polyazo Red, Chrome Vermilion, Benzidine Orange, Perynone Orange, Oil Orange, cobalt blue, cerulean blue, Alkali Blue Lake, Peacock Blue Lake, Victoria Blue Lake, metal-free phthalocyanine blue, Phthalocyanine Blue, Fast Sky Blue, Indanthrene Blue (RS, BC), indigo, ultramarine, Prussian blue, and mixtures thereof. The content of the colorant is generally from 1% by weight to 15% by weight, and preferably from 3% by weight to 10% by weight of the toner.

A colorant for use in the present invention may be a master batch prepared by mixing and kneading a pigment with a resin. Examples of binder resins for use in the production of the master batch or in kneading with the master batch are, in addition to the aforementioned modified and unmodified polyester resins, polystyrenes, poly-p-chlorostyrenes, polyvinyltoluenes, and other polymers of styrene and substituted styrenes; styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl a-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers, styrene-maleic ester copolymers, and other styrenic copolymers; poly (methyl methacrylate), poly(butyl methacrylate), poly(vinyl chloride), poly(vinyl acetate), polyethylenes, polypropylenes, polyesters, epoxy resins, epoxy polyol resins, polyurethanes, polyamides, poly(vinyl butyral), poly(acrylic acid) resins, rosin, modified rosin, terpene resins, aliphatic or alicyclic hydrocarbon resins, aromatic petroleum resins, chlorinated paraffins, and paraffin waxes. Each of these resins can be used alone or in combination.

The master batch can be prepared by mixing and kneading a resin for master batch and the colorant under high shearing force. In this procedure, an organic solvent can be used for higher interaction between the colorant and the resin. In addition, a "flushing process" is preferably employed, in which an aqueous paste containing the colorant and water is mixed and kneaded with an organic solvent to thereby transfer the colorant to the resin component, and the water and organic solvent are then removed. According to this process, a wet cake of the colorant can be used as intact without drying. A high shearing dispersing apparatus such as a three-roll mill can be preferably used in mixing and kneading.

-Releasing Agent-

Various conventional releasing agents can be used in the present invention. Examples of the releasing agents are carnauba wax, montan wax, oxidized rice wax, synthetic ester wax, solid silicone wax, high fatty acid high alcohols, montan ester wax, and low-molecular-weight polypropylene wax. Each of these can be used alone or in combination. Among them, carnauba wax, montan wax, oxidized rice wax and synthetic ester wax are preferred for good low-temperature image-fixing properties and hot offset resistance. The carnauba wax is a naturally occurring wax obtained from Copernicia cerifera, of which one having fine crystals and having an acid value of 5 or less is preferred. Such a carnauba wax can be uniformly dispersed in the binder resin.

-Graft Polymer-

The graft polymer (C) for use in the present invention is of a polyolefin resin (A) on which a vinyl resin (B) has been at least partially grafted.

In the toner of the present invention, at least part of the releasing agent is included in the graft polymer (C). The term "included" as used herein means that the releasing agent has good compatibility or affinity for the polyolefin resin (A) moiety of the graft polymer (C) and is selectively captured by or attached to the polyolefin resin (A) moiety of the graft polymer (C).

A toner may be prepared by a method comprising the steps of dissolving or dispersing a composition in an organic solvent to form a solution or dispersion; dispersing the solution or dispersion in an aqueous medium in the presence of an inorganic dispersing agent or fine polymer particles; subjecting the solution or dispersion to addition polymerization; and removing the organic solvent from the resulting emulsion. Such a toner may also be prepared by a method for producing a dry toner for dispersing a toner composition comprising a polyester resin in an aqueous medium to form toner particles. In these procedures, the binder resin, releasing agent and aqueous medium have insufficient compatibility or miscibility with one another and disperse independently. Accordingly, the releasing agent is not contained in the binder occupying a major part of the toner particles but is exposed at the surface of toner particles as dispersed particles with a large particle diameter. To solve the dispersion failure, a graft polymer C of a polyolefin resin A on which a vinyl resin B has been at least partially grafted is added. The graft polymer C has excellent compatibility with both the releasing agent and the binder resin and thereby enters between the releasing agent and the binder resin to thereby prevent the releasing agent from exposing from the particle surface. In addition, the releasing agent can be dispersed in the vicinity of the particle surface to thereby promptly exhibit its releasing function when the toner passes through an image-fixing device.

Examples of olefins for constituting the polyolefin resin A are ethylene, propylene, 1-butene, isobutylene, 1-hexene, 1-dodecene, and 1-octadecene.

Examples of the polyolefin resin (A) include olefinic polymers, oxides of olefinic polymers, modified products of olefinic polymers, and copolymers of an olefin with another copolymerizable monomer.

Examples of the olefinic polymers are polyethylenes, polypropylenes, ethylene/propylene copolymers, ethylene/1-butene copolymers, and propylene/1-hexene copolymers.

Examples of the oxides of olefinic polymers are oxides of the aforementioned olefinic polymers.

Examples of the modified products of olefinic polymers are maleic acid derivative adducts of the olefinic polymers. Such maleic acid derivatives include, for example, maleic anhydride, monomethyl maleate, monobutyl maleate, and dimethyl maleate.

Examples of the copolymers of an olefin with another copolymerizable monomer are copolymers of an olefin with a monomer such as unsaturated carboxylic acids (e.g., (meth)acrylic acid, itaconic acid, and maleic anhydride), alkyl esters of unsaturated carboxylic acids (e.g., $C_1$-$C_{18}$ alkyl esters of (meth)acrylic acid, and $C_1$-$C_{18}$ alkyl esters of maleic acid).

The polyolefin resin for use in the present invention has only to have a polyolefin structure as a polymer, and its constitutional monomer may not have an olefin structure. For example, a polymethylene such as Sasol wax can be used as the polyolefin resin.

Among these polyolefin resins, preferred are olefinic polymers, oxides of olefinic polymers, and modified products of olefinic polymers, of which polyethylenes, polymethylenes, polypropylenes, ethylene/propylene copolymers, oxidized polyethylenes, oxidized polypropylenes, and maleated polypropylenes are more preferred, and polyethylenes and polypropylenes are typically preferred.

As the vinyl resin (B), conventional homopolymers and copolymers of vinyl monomers can be used.

Specific examples of the vinyl resin (B) are homopolymers and copolymers of styrenic monomers, (meth)acrylic monomers, vinyl ester monomers, vinyl ether monomers, halogen containing vinyl monomers, diene monomers such as butadiene and isobutylene, (meth)acrylonitrile, cyanostyrene, and other unsaturated nitrile monomers, and combinations of these monomers.

The vinyl resin (B) preferably has a solubility parameter SP of from 10.6 to 12.6 $(cal/cm^3)^{1/2}$. When the solubility parameter SP of the vinyl resin B is in a range of from 10.6 to 12.6, the difference in solubility parameter SP between the binder resin and the releasing agent falls within an optimum range and these components can be dispersed satisfactorily. The solubility parameter SP can be determined according to a known Fedors method.

The vinyl resin (B) may be a homopolymer having a solubility parameter SP of 10.6 to 12.6 $(cal/cm^3)^{1/2}$ and is preferably a copolymer of a vinyl monomer 1 having a solubility parameter SP in terms of a homopolymer of 11.0 to 18.0 $(cal/cm^3)^{1/2}$, more preferably from 11.0 to 16.0 $(cal/cm^3)^{1/2}$ and a monomer 2 having a solubility parameter SP in terms of a homopolymer of from 8.0 to 11.0 $(cal/cm^3)^{1/2}$, and more preferably from 9.0 to 10.8 $(cal/cm^3)$1/2.

The vinyl monomer 1 includes, for example, unsaturated nitrile monomers 1-1, and α,β-unsaturated carboxylic acids 1-2.

Examples of the unsaturated nitrile monomers 1-1 are (meth)acrylonitrile and cyanostyrene, of which (meth)acrylonitrile is preferred. Examples of the α,β-unsaturated carboxylic acids 1-2 are unsaturated carboxylic acids and anhydrides thereof, such as (meth)acrylic acid, maleic acid, fumaric acid, itaconic acid, and anhydrides thereof, monoesters of unsaturated dicarboxylic acids, such as monomethyl maleate, monobutyl maleate, and monomethyl itaconate, of which (meth)acrylic acid and monoesters of unsaturated dicarboxylic acids are preferred, and (meth) acrylic acid and monoesters of maleic acid such as monomethyl maleate and monobutyl maleate are more preferred.

Examples of the monomer 2 are styrenic monomers such as styrene, α methylstyrene, p methylstyrene, m methylstyrene, p methoxystyrene, p hydroxystyrenes, p acetoxystyrene, vinyltoluenes, ethylstyrenes, phenylstyrenes, and benzylstyrenes; $C_1$-$C_{18}$ alkyl esters of unsaturated carboxylic acids, such as methyl (meth)acrylate, ethyl (meth)acrylate, butyl (meth)acrylate, and 2-ethylhexyl (meth)acrylate; vinyl ester monomers such as vinyl acetate; vinyl ether monomers such as vinyl methyl ether; halogen containing vinyl monomers such as vinyl chloride; diene monomers such as butadiene and isobutylene; and combinations of these monomers. Among them, preferred are a styrenic monomer alone, an alkyl ester of unsaturated carboxylic acid, and combinations of these monomers, of which styrene alone or a combination of styrene and an alkyl ester of (meth)acrylic acid.

-Charge Control Agent

The toner may further comprise a charge control agent according to necessity. Charge control agents include known charge control agents such as nigrosine dyes, triphenylmethane dyes, chromium-containing metal complex dyes, molybdic acid chelate pigments, rhodamine dyes, alkoxyamines, quaternary ammonium salts including fluorine-modified quaternary ammonium salts, alkylamides, elementary substance or compounds of phosphorus, elementary substance or compounds of tungsten, fluorine-containing active agents, metal salts of salicylic acid, and metal salts of salicylic acid derivatives. Examples of the charge control agents include commercially available products under the trade names of BONTRON 03 (Nigrosine dyes), BONTRON P-51 (quaternary ammonium salt), BONTRON S-34 (metal-containing azo dye), BONTRON E-82 (metal complex of oxynaphthoic acid), BONTRON E-84 (metal complex of salicylic acid), and BONTRON E-89 (phenolic condensation product) available from Orient Chemical Industries Co., Ltd.; TP-302 and TP-415 (molybdenum complex of quaternary ammonium salt) available from Hodogaya Chemical Co., Ltd.; COPY CHARGE PSY VP2038 (quaternary ammonium salt), COPY BLUE PR (triphenylmethane derivative), COPY CHARGE NEG VP2036 and COPY CHARGE NX VP434 (quaternary ammonium salt) available from Hoechst AG; LRA-901, and LR-147 (boron complex) available from Japan Carlit Co., Ltd.; as well as copper phthalocyanine pigments, perylene pigments, quinacridone pigments, azo pigments, and polymeric compounds having a functional group such as sulfonic group, carboxyl group, and quaternary ammonium salt.

The amount of the charge control agent is not specifically limited, can be set depending on the type of the binder resin, additives, if any, used according to necessity, and the method for preparing the toner including a dispersing process. Its amount is preferably from 0.1 to 10 parts by weight, and more preferably from 0.2 to 5 parts by weight relative to 100 parts by weight of the binder resin. If the amount exceeds 10 parts by weight, the toner may have an excessively high charge, the charge control agent may not sufficiently play its role, the developer may have increased electrostatic attraction to a development roller, may have decreased fluidity or may induce a decreased density of images. These charge control agent and releasing agent may be fused and kneaded with a master batch and a resin component or may be added to the other materials when they are dissolved and dispersed in an organic solvent.

-External Additive

Inorganic fine particles can be preferably used as the external additive to improve or enhance the flowability, developing properties, and charging ability of the toner particles. The inorganic fine particles have a primary particle diameter of preferably from 5 nm to 2 μm, and more preferably from 5 nm to 500 nm and have a specific surface area as determined by the BET method of preferably from 20 $m^2/g$ to 500 $m^2/g$. The amount of the inorganic fine particles is preferably from 0.01% by weight to 5% by weight, and more preferably from 0.01% by weight to 2.0% by weight of the toner. Examples of the inorganic fine particles are silica, alumina, titanium oxide, barium titanate, magnesium titanate, calcium titanate, strontium titanate, zinc oxide, tin oxide, silica sand, clay, mica, wollastonite, diatomaceous earth, chromium oxide, cerium oxide, iron oxide red, antimony trioxide, magnesium oxide, zirconium oxide, barium sulfate, barium carbonate, calcium carbonate, silicon carbide, and silicon nitride.

A cleaning agent or cleaning improver may also be added in order to remove the developer remained on a photoconductor or on a primary transfer member after transfer. Suitable cleaning agents are, for example, metal salts of stearic acid and other fatty acids such as zinc stearate, and calcium stearate; and poly(methyl methacrylate) fine particles, polystyrene fine particles, and other fine polymer particles prepared by, for example, soap-free emulsion polymerization. Such fine polymer particles preferably have a relatively narrow particle distribution and a volume-average particle diameter of 0.01 μm to 1 μm.

-Toner Preparation in Aqueous Medium

Aqueous media for use in the present invention may comprise water alone or in combination with an organic solvent that is miscible with water. Such miscible organic solvents include, but are not limited to, alcohols such as methanol, isopropyl alcohol, and ethylene glycol; dimethylformamide; tetrahydrofuran; Cellosorves such as methyl cellosolve; and lower ketones such as acetone and methyl ethyl ketone.

To form toner particles, a dispersion containing the isocyanate-containing prepolymer (A) is allowed to react with the amine in an aqueous medium. To stably form the dispersion containing the prepolymer (A), for example, a toner material composition comprising the urea-modified polyester (UMPE) or the prepolymer (A) is dispersed in an aqueous medium by action of shear force. The other toner components (hereinafter referred to as "toner materials") such as the coloring agent, coloring agent master batch, releasing agent, charge control agent, and unmodified polyester resin may be mixed with the prepolymer (A) during a dispersing procedure in the aqueous medium for the formation of a dispersion. However, it is preferred that these toner materials are mixed with one another beforehand and the resulting mixture is added to the aqueous medium. The other toner materials such as the coloring agent, the mold release agent, and the charge control agent is not necessarily added during the formation of the particles in the aqueous medium and can be added to the formed particles. For example, particles containing no coloring agent are formed, and the coloring agent is then added to the formed particles according to a known dying procedure.

The dispersing procedure is not specifically limited and includes known procedures such as low-speed shearing, high-speed shearing, dispersing by friction, high-pressure jetting, and ultrasonic dispersion. To allow the dispersion to have an average particle diameter of from 2 to 20 μm, the high-speed shearing procedure is preferred. When a high-speed shearing dispersing machine is used, the number of rotation is not specifically limited and is generally from 1,000 to 30,000 rpm and preferably from 5,000 to 20,000 rpm. The dispersion time is not specifically limited and is generally from 0.1 to 5 minutes in a batch system. The dispersion is performed at a temperature of generally 20° C. or lower for 30 to 60 minutes for preventing aggregation of the pigment.

-Fine Polymer Particles for Toner

The fine polymer particles adapted to the present invention preferably has a glass transition point Tg of from 50° C. to 70° C. and a weight average molecular weight of from $10\times10^4$ to $30\times10^4$.

The resin constituting the fine polymer particles can be any known resin, as long as it can form an aqueous dispersion, and can be either a thermoplastic resin or a thermosetting resin. Examples of such resins are vinyl resins, polyurethane resins, epoxy resins, polyester resins, polyamide resins, polyimide resins, silicone resins, phenolic resins, melamine resins, urea resins, aniline resins, ionomer resins, and polycarbonate resins. Each of these resins can be used alone or in combination. Among them, vinyl resins, polyurethane resins, epoxy resins, polyester resins, and mixtures of these resins are preferred for easily preparing an aqueous dispersion of fine spherical polymer is particles.

Examples of the vinyl resins are homopolymers or copolymers of vinyl monomers, such as styrene-(meth) acrylic ester resins, styrene-butadiene copolymers, (meth) acrylic acid-acrylic ester copolymers, styrene-acrylonitrile copolymers, styrene-maleic anhydride copolymers, and styrene-(meth)acrylic acid copolymers.

In order to remove the organic solvent from the obtained emulsified dispersion, the whole part thereof can be gradually heated so as to completely evaporate the organic solvent. The circularity (sphericity) of the toner particles can be controlled by adjusting the magnitude of emulsion stirring before the removal of the organic solvent and the time period for removing the organic solvent. By slowly removing the solvent, the toner particles have a substantially spherical shape with a circularity of 0.980 or more. By vigorously stirring the emulsion and removing the solvent in a short time, the toner particles have a rough or irregular shape with a circularity of about 0.900 to 0.960. More specifically, the circularity can be controlled within a range of from 0.850 to 0.990 by removing the solvent from the emulsion after the emulsification and the reaction while stirring the emulsion with a high stirring power at a temperature of 30° C. to 50° C. in a stirring chamber. By rapidly removing the organic solvent such as ethyl acetate during granulation, formed particles may undergo volume shrinkage to thereby have a certain shape with a certain sphericity. However, the solvent should be removed within 1 hour. If it takes 1 hour or more, the pigment particles may aggregate to thereby decrease the volume resistivity.

In addition, a solvent that can dissolve the urea-modified polyester (UMPE) and/or the prepolymer (A) can be used for a lower viscosity of the dispersion (toner composition). The solvent is preferably volatile and has a boiling point of lower than 100° C. for easier removal. Such solvents include, but are not limited to, toluene, xylenes, benzene, carbon tetrachloride, methylene chloride, 1,2-dichloroethane, 1,1,2-trichloroethane, trichloroethylenes, chloroform, monochlorobenzene, dichloroethylidene, methyl acetate, ethyl acetate, methyl ethyl ketone, and methyl isobutyl ketone. Each of these solvents can be used alone or in combination. Among them, preferred solvents are toluene, xylene, and other aromatic hydrocarbon solvents, methylene chloride, 1,2-dichloroethane, chloroform, carbon tetrachloride, and other halogenated hydrocarbons. The amount of the solvent is generally from 0 to 300 parts by weight, preferably from 0 to 100 parts by weight, and more preferably from 25 to 70 parts by weight, relative to 100 parts by weight of the prepolymer (A). The solvent, if any, is removed by heating at atmospheric pressure or under reduced pressure after the elongation and/or crosslinking reaction.

The organic solvent can be removed from the prepared emulsion, for example, by gradually elevating the temperate of the entire system and completely removing the organic solvent in the primary particles by evaporation. Alternatively, the organic solvent can be removed by spraying the emulsion into a dry atmosphere, thereby completely removing the non-water-soluble organic solvent in the primary particles to thereby form fine toner particles while removing the water-based dispersing agent by evaporation. The dry atmosphere to which the emulsion is sprayed includes, for example, heated gases such as air, nitrogen gas, carbon dioxide gas, and combustion gas. The gas is preferably heated to a temperature higher than the boiling point of a solvent having the highest boiling point. A desired product can be obtained by short-time drying by means of a dryer such as spray dryer, belt dryer or rotary kiln.

When the particle distribution of the primary particles is wide and the washing and drying processes are conducted while maintaining the particle distribution, the particles may be classified to adjust the particle distribution thereafter.

-Circularity

Preferably, the toner utilized in the present invention has a substantially spherical shape. The circularity of the dry toner is preferably determined by an optical detection band method, wherein the particle-containing suspension is allowed to pass through a photographic detection band on a plate, and the particle images were optically detected/analyzed with a CCD camera. The average circularity obtained by dividing a boundary length of a corresponding circle having an equal projected area by a boundary length of the measured particle. The present inventors have found that a toner having an average circularity of 0.960 or more is effective to form images with an appropriate density and high precision and reproducibility. The average circularity is more preferably from 0.980 to 1.000.

When an average circularity of the toner is less than about 0.93, namely the irregularly shaped toner being far from a round shape, sufficient transfer ability, high quality images without scattering of the toner may not be obtained. The irregularly shaped toner has higher attraction forces such as van der Waals force and image force, to a smooth medium such as a photoconductor than relatively spherical particles because this toner has more concave portions constituting contact points to the medium, and charges concentrate and stay in the concave portions. In electrostatic transferring step, therefore, irregularly formed toner particles are selectively transferred within the toner which contains irregularly formed toner particles and spherical toner particles, resulting in an image missing on character or line portions. The remained toner on the medium has to be removed for a subsequent developing step, a cleaner needs to be equipped therefor, and a toner yield or a usage ratio of the toner for image formation is low. The circularity of conventional pulverized toner is generally 0.910 to 0.920.

In the photoconductors accordance with the present invention, high durability may be achieved, image degradation such as lags may be controlled from the increase of residual potential and decrease of charging, and high quality images may be formed stably even after the prolonged and repeated usage. Furthermore, an electrophotographic process, electrophotographic apparatus, and process cartridge for electrophotography may be provided, in which the replacement of the photoconductors may be remarkably reduced by virtue of the employment of the photoconductors, the miniaturization of the apparatus may be achieved, and high quality images may be formed stably even after the prolonged and repeated usage.

EXAMPLES

Example A

The present invention will be further explained based on inventive examples and comparative examples, being exemplary and explanatory only, with respect to photoconductors containing the compounds expressed by general formulas (1) to (22) in the protective layer. All percentages and parts are by weight unless indicated otherwise.

The exemplified compounds incorporated into the protective layers in Example A correspond to the exemplified compounds in terms of each reference No. listed earlier as the specific examples of general formulas (1) to (22).

Example A-1

Coating liquids for under-coating layer, charge-generating layer, and charge-transporting layer having the following compositions respectively, were coated individually by immersion coating and drying in turn on an aluminum cylinder, thereby an under-coating layer of 3.5 μm thick, charge-generating layer of 0.2 μm thick, and charge-transporting layer of 22 μm thick were formed.

-Coating Liquid for Under-Coating Layer

| | |
|---|---|
| Titanium dioxide powder | 400 parts |
| Melamine resin | 65 parts |
| Alkyd resin | 120 parts |
| 2-butanone | 400 parts |

-Coating Liquid for Charge-Generating Layer

| | |
|---|---|
| Disazo pigment of following formula | 12 parts |
| Polyvinyl butyral | 5 parts |
| 2-butanone | 200 parts |
| Cyclohexanone | 400 parts |

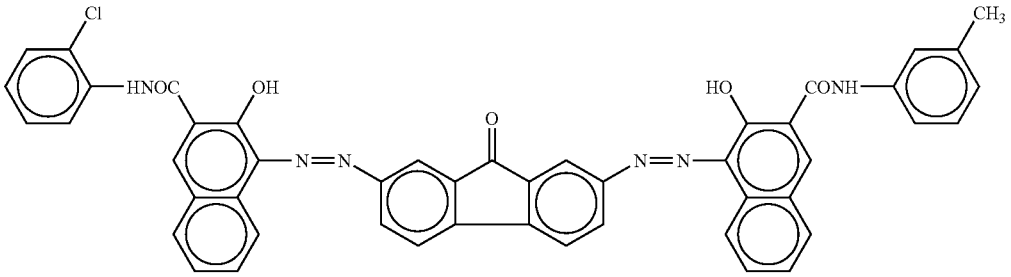

-Coating Liquid for Charge-Transporting Layer

| | |
|---|---|
| Polycarbonate (Z-polyca, by Teijinkasei Co.) | 8 parts |
| Charge-transporting substance of following formula | 10 parts |
| Tetrahydrofuran | 100 parts |

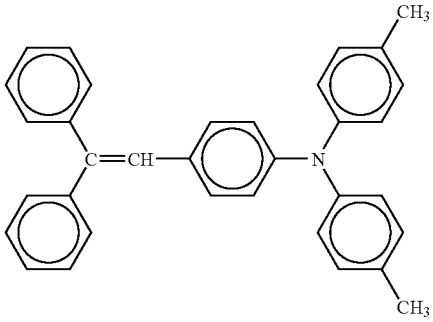

Coating liquid for protective layer was prepared in the following composition; the coating liquid was readied for coating by circulating for 30 minutes at 100 MPa pressure using a high-speed collision dispersion apparatus (Ultimaizer HJP-25005, by Sugino Machine Limited) followed by ultrasonic dispersion for 10 minutes. Then, the coating liquid for protective layer was coated through spray coating by means of a spray gun (Peacecon PC308, by Olinpos Co., 2 kgf/cm$^2$ of air pressure) and drying at 30° C. for 60 minutes to form a protective layer of about 5 μm thick, thereby electrographic photoconductor 1 was prepared.

-Coating Liquid for Protective Layer

| | |
|---|---|
| Particles of perfluoroalkoxy resin *1) | 5.5 parts |
| Dispersion Aid *2) | 1.0 part |
| Exemplified compound No. A-3-4 | 0.4 part |
| Polycarbonate *3) | 4 parts |
| Tetrahydrofuran | 200 parts |
| Cyclohexanone | 60 parts |

*1) MPE-056, by Mitsui Fluorochemical Co.
*2) Modiper F210, by NOF Corporation
*3) Z-polyca, by Teijinkasei Co.

Example A-2

Electrophotographic photoconductor 2 was prepared in the same manner as Example A-1, except that the coating liquid for protective layer was changed to following.

-Coating Liquid for Protective Layer

| | |
|---|---|
| Particles of perfluoroalkoxy resin *1) | 3.3 parts |
| Dispersion Aid *2) | 1.0 part |
| Exemplified compound No. A-3-4 | 0.4 part |
| Polycarbonate *3) | 6.4 parts |
| Tetrahydrofuran | 200 parts |
| Cyclohexanone | 60 parts |

*1) MPE-056, by Mitsui Fluorochemical Co.
*2) Modiper F210, by NOF Corporation
*3) Z-polyca, by Teijinkasei Co.

Example A-3

Electrophotographic photoconductor 3 was prepared in the same manner as Example A-1, except that the coating liquid for protective layer was changed to following.

-Coating Liquid for Protective Layer

| | |
|---|---|
| Particles of perfluoroalkoxy resin *1) | 7.4 parts |
| Dispersion Aid *2) | 1.0 part |
| Exemplified compound No. A-3-4 | 0.4 part |
| Polycarbonate *3) | 2.3 parts |
| Tetrahydrofuran | 200 parts |
| Cyclohexanone | 60 parts |

*1) MPE-056, by Mitsui Fluorochemical Co.
*2) Modiper F210, by NOF Corporation
*3) Z-polyca, by Teijinkasei Co.

Comparative Example A-1

Comparative electrophotographic photoconductor 1 was prepared in the same manner as Example A-1, except that the coating liquid for protective layer was changed to following.

-Coating Liquid for Protective Layer

| | |
|---|---|
| Particles of perfluoroalkoxy resin *1) | 3.0 parts |
| Dispersion Aid *2) | 1.0 part |
| Exemplified compound No. A-3-4 | 0.4 part |
| Polycarbonate *3) | 6.7 parts |
| Tetrahydrofuran | 200 parts |
| Cyclohexanone | 60 parts |

*1) MPE-056, by Mitsui Fluorochemical Co.
*2) Modiper F210, by NOF Corporation
*3) Z-polyca, by Teijinkasei Co.

Comparative Example A-2

Comparative electrophotographic photoconductor 2 was prepared in the same manner as Example A-1, except that the coating liquid for protective layer was changed to following.

-Coating Liquid for Protective Layer

| | |
|---|---|
| Particles of perfluoroalkoxy resin *1) | 7.8 parts |
| Dispersion Aid *2) | 1.0 part |
| Exemplified compound No. A-3-4 | 0.4 part |
| Polycarbonate *3) | 1.9 parts |
| Tetrahydrofuran | 200 parts |
| Cyclohexanone | 60 parts |

*1) MPE-056, by Mitsui Fluorochemical Co.
*2) Modiper F210, by NOF Corporation
*3) Z-polyca, by Teijinkasei Co.

Comparative Example A-3

Comparative electrophotographic photoconductor 3 was prepared in the same manner as Example A-1, except that the coating liquid for protective layer was changed to following.

-Coating Liquid for Protective Layer

| | |
|---|---|
| Particles of perfluoroalkoxy resin *1) | 5.5 parts |
| Dispersion Aid *2) | 1.0 part |
| Polycarbonate *3) | 4.2 parts |
| Tetrahydrofuran | 200 parts |
| Cyclohexanone | 60 parts |

*1) MPE-056, by Mitsui Fluorochemical Co.
*2) Modiper F210, by NOF Corporation
*3) Z-polyca, by Teijinkasei Co.

Example A-4

Electrophotographic photoconductor 4 was prepared in the same manner as Example A-1, except that the fine particles of perfluoroalkoxy resin was changed to fine particles of tetrafluoroethylene resin (Lublon L-2, by Daikin Industries, Ltd.).

Examples A-5 to A-61

Electrophotographic photoconductors 5 to 61 was prepared in the same manner as Example A-1, except that the compound was changed to respective compounds shown in Tables A-1-1 to A-1-4.

Toner Production Example 1

-Preparation of Composition Containing Monomer

| | |
|---|---|
| Styrene Monomer | 70 parts |
| N-butylmethacrylate | 30 parts |
| Polystyrene | 5 parts |
| 3,5-di-tert-butyl zincsalicylate | 2 parts |
| Carbon black | 6 parts |

The above-noted ingredients were blended for 24 hours by means of a ball mill to prepare a polymerizable composition containing monomer.

-Granulation and Polymerization

To a flask, which was equipped with a mixer, thermometer, inlet pipe of inactive gas, and porous glass tube of 10 mm Φ×50 mm having 110,000 Å of pore size and 0.42 cc/g of pore volume, 400 ml of 2% aqueous solution of polyvinyl alcohol was poured and stirred at ambient temperature while feeding nitrogen gas to replace the oxygen gas in the reaction vessel.

Separately, 1.56 grams of azobis isobutylnitrile was added to 113 grams of the composition containing monomer and was stirred to yield a mixture, then the mixture was passed through the porous glass tube by use of a pump thereby the mixture was added to the aqueous solution of polyvinyl alcohol. Then the mixed solution of the polyvinyl alcohol and the composition containing monomer was circulated for 2 hours at the rate of 120 ml/min while making it pass through the porous glass tube by use of a pump, thereafter the temperature inside the reactor vessel was raised to 70° C. thereby the mixture was allowed to polymerize for 8 hours.

Then, the content of the reaction vessel was cooled to room temperature and allowed to stand overnight, thereafter the supernatant was removed then de-ionized water was poured additionally. After the content was stirred for one hour, was filtered and dried to prepare a toner. From the measurement by Coulter Counter, the toner exhibited 8.5 μm of average particle diameter and a narrow particle size distribution such that the particles in the range of 0 to 5 μm from the average particle diameter occupied 95% of the entire particles.

<Evaluation 1: Average Circularity>

The toner particles obtained in the Toner Production Example 1 were dispersed in water to prepare a suspension, the suspension was directed to pass through a plate-like image detecting region, where the particle images were detected by means of a CCD camera, then the average circularity was evaluated. The "average circularity" means the ratio between the peripheral length of corresponding circle having the same projected area and the peripheral length of the actual particle, i.e. (peripheral length of corresponding circle)÷(peripheral length of actual particle). This value can be measured as the average circularity using a is flow-type particle image analyzing apparatus FPIA-2000. Specifically, a surfactant preferably 0.1 to 0.5 ml of alkyl benzene sulfonate is added into 100 to 150 ml of pure water of distilled or de-ionized water as dispersant, and the sample to be evaluated is added about 0.1 to 0.5 gram, the dispersion containing the sample is subjected to ultrasonic dispersing treatment for 1 to 3 minutes, and the dispersion concentration is adjusted in the range of 3000 to 10000 particles/microliter, then the measurement is conducted by the apparatus in the mode of shape and distribution. It has been demonstrated from the investigation until now that the toner having an average circularity of 0.960 or more is effective to provide images with high reproducibility and high precision, more preferably, the average circularity is 0.980 to 1.000. By the way, the average circularity of the toner prepared in the Toner Production Example 1 was 0.98.

<Evaluation 2: Covering Ratio>

The electrophotographic photoconductors of Examples 1 to 61 and Comparative Examples 1 to 3 were respectively sampled from their randomly selected 10 sites, and the surfaces of the sampled coatings were taken pictures with FE-SEM at 4000 times. From the SEM photographs, the fine particle number of fluorine-contained resin, each average diameter, area, and covering ratio of the particles were analyzed by means of an image processing software (Image Pro Plus), wherein the covering ratio refers to the ratio of surface area where the fine particles of fluorine-contained resin exist within the entire photoconductor surface.

<Evaluation 3: Skin-Friction Coefficient>

Figure 9:
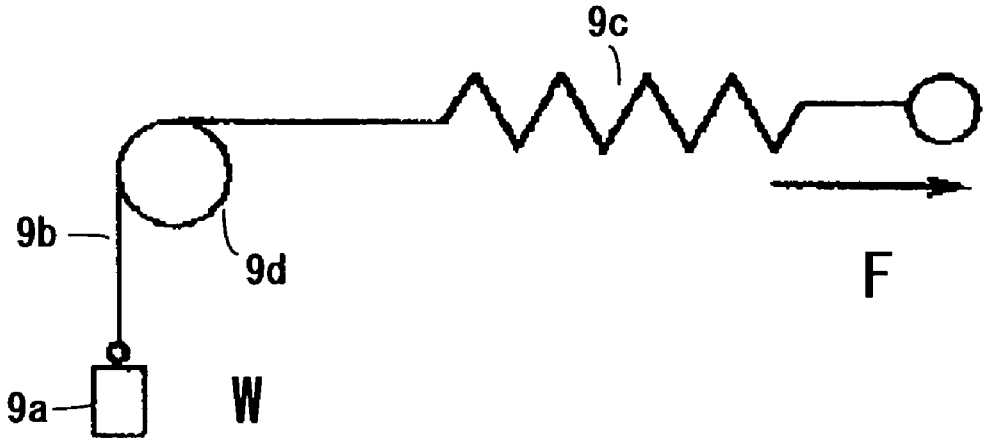
FIG. 9 schematically shows a measuring unit configured to measure the skin-friction coefficient in Examples A to D according to Evaluation 3.

As for the resulting inventive electrophotographic photoconductors 1 to 61 and comparative electrophotographic photoconductors 1 to 3, the respective skin-friction coefficients were measured using an Euler-belt system described in JP-A No. 9-166919. The belt referrers to a high quality paper with a moderate thickness that is tensioned on one-forth of photoconductor circular as shown in FIG. 9, wherein the longitudinal direction corresponds the paper-making direction. A balance weight 9*a* of 100 grams was attached to one end of the high quality paper belt 9*b*, and a force gauge (spring balance) 9*c* was attached to the other end of the high quality paper belt; the digital force gauge was slowly pulled, at the moment when the belt begun to move due to sliding of belt 9*b* on sample 9*d*, the weight indicated by the digital force gauge was read, and the coefficient of (static) friction was calculated from the following formula. In the formula, t represents the friction coefficient, F represents the tensile stress, and W represents the load. In the constitution shown in FIG. 9, a balance (100 grams), belt (Type 6200, long grain, A4 size paper, 30 mm width cut in paper-making direction), and two double clips were equipped.

$$\mu=2/\pi\times\ln(F/W)\quad W=100\text{ grams}$$

<Evaluation 4: Durable Life A>

As for the resulting inventive electrophotographic photoconductors 1 to 61 and comparative electrophotographic photoconductors 1 to 3, the respective photoconductors were mounted on modified-type Imagio Color 5100 (by Ricoh Company, Ltd., light source for image irradiation being changed to a semiconductor laser of wavelength 655 nm, and the unit for coating lubricant being removed), then 100,000 sheets of paper in total were printed sequentially using a ground-type toner (Imagio Color toner type S, circularity 0.91) which being often employed in evaluation apparatuses; and the initial images and 100,000 th printed images were evaluated. Further, the potential voltages at the illuminated parts were measured after the initial printing and the 100,000 th printing. Furthermore, the abrasion wears were evaluated from the difference of layer thicknesses between at the initial and the 100,000 th.

<Evaluation 5: Durable Life B>

As for the resulting inventive electrophotographic photoconductors 1 to 61 and comparative electrophotographic photoconductors 1 to 3, the respective photoconductors were mounted on modified-type Imagio Color 5100 (by Ricoh Company, Ltd., the toner being changed to that of Toner Production Example 1 described earlier, the light source for image irradiation being changed to a semiconductor laser of wavelength 655 nm, and the unit for coating lubricant being removed), then 100,000 sheets of paper in total were printed sequentially, and the initial images and 100,000 th printed images were evaluated. Further, the potential voltages at the illuminated parts were measured after the initial printing and the 100,000 th printing. Furthermore, the abrasion wears were evaluated from the difference of layer thicknesses between at the initial and the 100,000 th.

<Evaluation 6: Durable Life C>

As for the resulting inventive electrophotographic photoconductors 1 to 61 and comparative electrophotographic photoconductors 1 to 3, the respective photoconductors were mounted on Modified Imagio Color 8100 (by Ricoh Company, Ltd., the toner being changed to that of Toner Production Example 1), then 50,000 sheets of paper in total were printed sequentially, and the initial images and 50,000 th printed images were evaluated. Further, the potential voltages at the illuminated parts were measured after the initial printing and the 50,000 th printing. Furthermore, the abrasion wears were evaluated from the difference of layer thicknesses between at the initial and the 50,000 th.

These results are shown in Tables A-1-1 to A-1-4, Tables A-2-1 to A-2-4, and Tables A-3-1 to A-3-4.

In these Tables and Tables as to Examples B to D described later, the properties indicated by abbreviated term mean as follows:

*a) F-Resin Volume %: volume % of fine particles of fluorine-contained resin incorporated into the outer most layer of the photoconductive layer;

*b) F-Resin Covering Ratio: ratio of surface area where the fine particles of fluorine-contained resin exist within the entire photoconductor surface;

*c) Exemp. Comp.: exemplified compound of amine aromatic compounds or hydroxy aromatic compounds;

*d) Skin-Friction: skin-friction coefficient measured using an Euler-belt system as shown in FIG. 9;

*e) Potential Illumi.: potential voltage at the illuminated part expressed by the unit of Volt.

TABLE A-1-1

| | | | | Durability Test A | | | | | | |
|---|---|---|---|---|---|---|---|---|---|---|
| | | | | Initial | | | Durability A: 100,0000 Sheets Printing | | | |
| Example | F-Resin Volume % *a) | F-Resin Covering Ratio *b) | Exemp. Comp. *c) | Skin-Friction *d) | Potential Illumi. (−V) *e) | Image Quality | Skin-Friction *d) | Potential Illumi. (−V) *e) | Image Quality | Abrasion Wear μm |
| Ex. A-1 | 39 | 20 | A-3-4 | 0.25 | 100 | A*1 | 0.26 | 120 | A*1 | 2.6 |
| Ex. A-2 | 21 | 14 | A-3-4 | 0.30 | 95 | A | 0.36 | 125 | A | 3.6 |
| Ex. A-3 | 60 | 31 | A-3-4 | 0.21 | 105 | A | 0.20 | 115 | A | 3.3 |
| Com. Ex. A-1 | 18 | 10 | A-3-4 | 0.33 | 90 | A | 0.51 | 140 | *2 | 4.2 |
| Com. Ex. A-2 | 65 | 35 | A-3-4 | 0.21 | 120 | A | 0.21 | 110 | *3 | 4.5 |
| Com. Ex. A-3 | 39 | 21 | — | 0.26 | 100 | A | 0.28 | 85 | *4 | 2.6 |
| Ex. A-4 | 39 | 19 | A-3-4 | 0.21 | 110 | A | 0.23 | 135 | A | 2.5 |
| Ex. A-5 | 39 | 20 | A-1-2 | 0.25 | 100 | A | 0.27 | 120 | A | 2.4 |
| Ex. A-6 | 39 | 21 | A-1-6 | 0.26 | 105 | A | 0.27 | 125 | A | 2.6 |
| Ex. A-7 | 39 | 20 | A-1-8 | 0.25 | 100 | A | 0.27 | 120 | A | 2.5 |
| Ex. A-8 | 39 | 19 | A-2-4 | 0.25 | 100 | A | 0.26 | 125 | A | 2.5 |
| Ex. A-9 | 39 | 20 | A-2-6 | 0.25 | 100 | A | 0.26 | 120 | A | 2.5 |
| Ex. A-10 | 39 | 20 | A-3-5 | 0.24 | 105 | A | 0.25 | 130 | A | 2.5 |
| Ex. A-11 | 39 | 20 | A-3-8 | 0.24 | 100 | A | 0.25 | 125 | A | 0.25 |
| Ex. A-12 | 39 | 18 | A-4-3 | 0.25 | 105 | A | 0.25 | 125 | A | 2.7 |

*1Good

*2: Occurrence of inferior cleaning from about 50,000 th printings

*3: Occurrence of image lags from about 90,000 th printings

*4: Occurrence of image lags from about 20,000 th printings

TABLE A-1-2

| | | | | Durability Test A | | | | | | |
|---|---|---|---|---|---|---|---|---|---|---|
| | | | | Initial | | | Durability A: 100,0000 Sheets Printing | | | |
| Example | F-Resin Volume % *a) | F-Resin Covering Ratio *b) | Exemp. Comp. *c) | Skin-Friction *d) | Potential Illumi. (−V) *e) | Image Quality | Skin-Friction *d) | Potential Illumi. (−V) *e) | Image Quality | Abrasion Wear μm |
| Ex. A-13 | 39 | 20 | A-4-6 | 0.25 | 100 | A | 0.26 | 130 | A | 2.6 |
| Ex. A-14 | 39 | 20 | A-4-7 | 0.25 | 100 | A | 0.26 | 125 | A | 2.5 |
| Ex. A-15 | 39 | 19 | A-5-1 | 0.26 | 105 | A | 0.25 | 125 | A | 2.8 |
| Ex. A-16 | 39 | 20 | A-5-2 | 0.26 | 105 | A | 0.26 | 130 | A | 2.7 |
| Ex. A-17 | 39 | 20 | A-5-4 | 0.25 | 100 | A | 0.25 | 120 | A | 2.6 |
| Ex. A-18 | 39 | 21 | A-6-1 | 0.25 | 110 | A | 0.27 | 125 | A | 2.5 |
| Ex. A-19 | 39 | 19 | A-6-3 | 0.24 | 105 | A | 0.25 | 125 | A | 2.6 |
| Ex. A-20 | 39 | 20 | A-6-4 | 0.24 | 100 | A | 0.26 | 120 | A | 2.5 |
| Ex. A-21 | 39 | 19 | A-7-2 | 0.25 | 110 | A | 0.25 | 130 | A | 2.7 |
| Ex. A-22 | 39 | 20 | A-7-5 | 0.25 | 100 | A | 0.25 | 120 | A | 2.5 |
| Ex. A-23 | 39 | 19 | A-8-1 | 0.25 | 105 | A | 0.26 | 135 | A | 2.6 |
| Ex. A-24 | 39 | 20 | A-8-6 | 0.24 | 105 | A | 0.25 | 120 | A | 2.6 |
| Ex. A-25 | 39 | 20 | A-8-7 | 0.25 | 100 | A | 0.26 | 120 | A | 2.5 |
| Ex. A-26 | 39 | 20 | A-9-1 | 0.26 | 100 | A | 0.28 | 125 | A | 2.7 |
| Ex. A-27 | 39 | 19 | A-9-3 | 0.26 | 100 | A | 0.27 | 125 | A | 2.8 |
| Ex. A-28 | 39 | 20 | A-9-5 | 0.26 | 100 | A | 0.27 | 120 | A | 2.6 |

TABLE A-1-3

| | | | | Durability Test A | | | | | | |
|---|---|---|---|---|---|---|---|---|---|---|
| | | | | Initial | | | Durability A: 100,0000 Sheets Printing | | | |
| Example | F-Resin Volume % *a) | F-Resin Covering Ratio *b) | Exemp. Comp. *c) | Skin-Friction *d) | Potential Illumi. (−V) e) | Image Quality | Skin-Friction *d) | Potential Illumi. (−V) e) | Image Quality | Abrasion Wear μm |
| Ex. A-29 | 39 | 20 | A-10-2 | 0.25 | 105 | A | 0.26 | 135 | A | 2.6 |
| Ex. A-30 | 39 | 20 | A-10-4 | 0.24 | 110 | A | 0.26 | 130 | A | 2.7 |
| Ex. A-31 | 39 | 20 | A-10-5 | 0.25 | 100 | A | 0.26 | 125 | A | 2.6 |
| Ex. A-32 | 39 | 21 | A-11-2 | 0.26 | 100 | A | 0.27 | 125 | A | 2.7 |
| Ex. A-33 | 39 | 20 | A-11-6 | 0.26 | 100 | A | 0.26 | 120 | A | 2.6 |
| Ex. A-34 | 39 | 20 | A-12-2 | 0.26 | 100 | A | 0.28 | 130 | A | 2.8 |
| Ex. A-35 | 39 | 19 | A-12-4 | 0.25 | 100 | A | 0.26 | 125 | A | 2.7 |
| Ex. A-36 | 39 | 20 | A-12-5 | 0.25 | 100 | A | 0.26 | 120 | A | 2.6 |
| Ex. A-37 | 39 | 18 | A-13-1 | 0.25 | 105 | A | 0.27 | 135 | A | 2.6 |
| Ex. A-38 | 39 | 20 | A-13-4 | 0.25 | 105 | A | 0.26 | 130 | A | 2.6 |
| Ex. A-39 | 39 | 20 | A-13-7 | 0.25 | 100 | A | 0.26 | 125 | A | 2.6 |
| Ex. A-40 | 39 | 20 | A-14-1 | 0.24 | 100 | A | 0.26 | 130 | A | 2.7 |
| Ex. A-41 | 39 | 19 | A-14-2 | 0.26 | 105 | A | 0.27 | 125 | A | 2.6 |
| Ex. A-42 | 39 | 21 | A-14-8 | 0.25 | 110 | A | 0.27 | 140 | A | 2.6 |
| Ex. A-43 | 39 | 20 | A-14-11 | 0.26 | 105 | A | 0.28 | 125 | A | 2.7 |
| Ex. A-44 | 39 | 20 | A-14-14 | 0.25 | 100 | A | 0.26 | 120 | A | 2.5 |

TABLE A-1-4

| | | | | Durability Test A | | | | | | |
|---|---|---|---|---|---|---|---|---|---|---|
| | | | | Initial | | | Durability A: 100,0000 Sheets Printing | | | |
| Example | F-Resin Volume % *a) | F-Resin Covering Ratio *b) | Exemp. Comp. *c) | Skin-Friction *d) | Potential Illumi. (−V) *e) | Image Quality | Skin-Friction *d) | Potential Illumi. (−V) *e) | Image Quality | Abrasion Wear μm |
| Ex. A-45 | 39 | 20 | A-15-6 | 0.26 | 105 | A | 0.27 | 130 | A | 2.8 |
| Ex. A-46 | 39 | 20 | A-15-7 | 0.25 | 100 | A | 0.26 | 125 | A | 2.6 |
| Ex. A-47 | 39 | 19 | A-16-1 | 0.26 | 105 | A | 0.26 | 135 | A | 2.8 |
| Ex. A-48 | 39 | 20 | A-16-3 | 0.26 | 100 | A | 0.27 | 120 | A | 2.7 |
| Ex. A-49 | 39 | 20 | A-16-9 | 0.25 | 105 | A | 0.25 | 125 | A | 2.6 |
| Ex. A-50 | 39 | 19 | A-16-14 | 0.25 | 100 | A | 0.26 | 120 | A | 2.6 |
| Ex. A-51 | 39 | 21 | A-17-3 | 0.25 | 100 | A | 0.26 | 130 | A | 2.7 |
| Ex. A-52 | 39 | 20 | A-17-4 | 0.25 | 100 | A | 0.26 | 125 | A | 2.6 |
| Ex. A-53 | 39 | 20 | A-18-4 | 0.25 | 105 | A | 0.26 | 125 | A | 2.6 |
| Ex. A-54 | 39 | 20 | A-18-5 | 0.25 | 100 | A | 0.26 | 120 | A | 2.6 |
| Ex. A-55 | 39 | 20 | A-19-1 | 0.24 | 105 | A | 0.26 | 135 | A | 2.7 |
| Ex. A-56 | 39 | 19 | A-19-4 | 0.25 | 100 | A | 0.26 | 130 | A | 2.6 |

TABLE A-1-4-continued

| | | | | Durability Test A | | | | | | |
|---|---|---|---|---|---|---|---|---|---|---|
| | | | | Initial | | | Durability A: 100,0000 Sheets Printing | | | |
| Example | F-Resin Volume % *a) | F-Resin Covering Ratio *b) | Exemp. Comp. *c) | Skin-Friction *d) | Potential Illumi. (−V) *e) | Image Quality | Skin-Friction *d) | Potential Illumi. (−V) *e) | Image Quality | Abrasion Wear μm |
| Ex. A-57 | 39 | 18 | A-20-1 | 0.25 | 110 | A | 0.27 | 135 | A | 2.8 |
| Ex. A-58 | 39 | 20 | A-20-3 | 0.25 | 100 | A | 0.26 | 130 | A | 2.6 |
| Ex. A-59 | 39 | 20 | A-21-7 | 0.25 | 100 | A | 0.26 | 125 | A | 2.6 |
| Ex. A-60 | 39 | 19 | A-22-2 | 0.25 | 105 | A | 0.26 | 125 | A | 2.8 |
| Ex. A-61 | 39 | 20 | A-22-4 | 0.25 | 100 | A | 0.26 | 120 | A | 0.26 |

The evaluation results shown in Tables A-1-1 to A-1-4 demonstrate that the inclusions of the fine particles of fluorine-contained resin in the range of 20 to 60% by volume as well as specific amine compound into the outermost surface layer of the photoconductor make possible to maintain the lower skin-friction coefficient stably. Further, it is confirmed that the abrasion wear is reduced i.e. the abrasion resistance is remarkably improved. Further, the increase of the potential at the illuminated part is not significant even after the 100,000 th printing, the lag occurrence is not apparent in the photoconductors that were added specific amine compounds, as such it is confirmed that high quality images may be obtained stably.

On the other hand, cleaning failures and/or lag occurrences were induced in the photoconductors that did not satisfy the range of 20 to 60% by volume of fine particles of fluorine-contained resin or that did not contain specific amine compound.

TABLE A-2-1

| | | | | Durability Test B | | | | | | |
|---|---|---|---|---|---|---|---|---|---|---|
| | | | | Initial | | | Durability B: 100,0000 Sheets Printing | | | |
| Example | F-Resin Volume % *a) | F-Resin Covering Ratio *b) | Exemp. Comp. *c) | Skin-Friction *d) | Potential Illumi. (−V) *e) | Image Quality | Skin-Friction *d) | Potential Illumi. (−V) *e) | Image Quality | Abrasion Wear μm |
| Ex. A-1 | 39 | 20 | A-3-4 | 0.25 | 105 | A*1 | 0.25 | 115 | A*1 | 2.7 |
| Ex. A-2 | 21 | 14 | A-3-4 | 0.30 | 100 | A | 0.32 | 125 | *2 | 3.7 |
| Ex. A-3 | 60 | 31 | A-3-4 | 0.21 | 110 | A | 0.20 | 115 | A | 3.4 |
| Com. Ex. A-1 | 18 | 10 | A-3-4 | 0.33 | 95 | A | 0.54 | 140 | *3 | 6.2 |
| Com. Ex. A-2 | 65 | 35 | A-3-4 | 0.21 | 120 | A | 0.21 | 110 | *4 | 4.7 |
| Com. Ex. A-3 | 39 | 21 | — | 0.26 | 100 | A | 0.27 | 85 | *5 | 2.6 |
| Ex. A-4 | 39 | 19 | A-3-4 | 0.19 | 120 | A | 0.21 | 135 | A | 2.6 |
| Ex. A-5 | 39 | 20 | A-1-2 | 0.25 | 100 | A | 0.27 | 125 | A | 2.7 |
| Ex. A-6 | 39 | 21 | A-1-6 | 0.26 | 105 | A | 0.27 | 125 | A | 2.8 |
| Ex. A-7 | 39 | 20 | A-1-8 | 0.25 | 100 | A | 0.27 | 120 | A | 2.7 |
| Ex. A-8 | 39 | 19 | A-2-4 | 0.25 | 100 | A | 0.26 | 125 | A | 2.9 |
| Ex. A-9 | 39 | 20 | A-2-6 | 0.25 | 100 | A | 0.27 | 120 | A | 2.8 |
| Ex. A-10 | 39 | 20 | A-3-5 | 0.24 | 105 | A | 0.25 | 125 | A | 3.0 |
| Ex. A-11 | 39 | 20 | A-3-8 | 0.24 | 100 | A | 0.26 | 120 | A | 2.9 |
| Ex. A-12 | 39 | 18 | A-4-3 | 0.25 | 105 | A | 0.25 | 125 | A | 2.9 |

*1Good
*2: Occurrence of inferior cleaning from about 80,000 th printings
*3: Occurrence of inferior cleaning from about 30,000 th printings
*4: Occurrence of image lags from about 90,000 th printings
*5: Occurrence of image lags from about 20,000 th printings

TABLE A-2-2

| | | | | Durability Test B | | | | | | |
|---|---|---|---|---|---|---|---|---|---|---|
| | | | | Initial | | | Durability B: 100,0000 Sheets Printing | | | |
| Example | F-Resin Volume % *a) | F-Resin Covering Ratio *b) | Exemp. Comp. *c) | Skin-Friction *d) | Potential Illumi. (−V) *e) | Image Quality | Skin-Friction *d) | Potential Illumi. (−V) *e) | Image Quality | Abrasion Wear μm |
| Ex. A-13 | 39 | 20 | A-4-6 | 0.25 | 100 | A | 0.26 | 130 | A | 2.6 |
| Ex. A-14 | 39 | 20 | A-4-7 | 0.25 | 100 | A | 0.27 | 125 | A | 2.8 |
| Ex. A-15 | 39 | 19 | A-5-1 | 0.26 | 105 | A | 0.25 | 125 | A | 2.8 |
| Ex. A-16 | 39 | 20 | A-5-2 | 0.26 | 105 | A | 0.26 | 130 | A | 2.7 |
| Ex. A-17 | 39 | 20 | A-5-4 | 0.25 | 100 | A | 0.26 | 125 | A | 2.7 |
| Ex. A-18 | 39 | 21 | A-6-1 | 0.25 | 110 | A | 0.27 | 130 | A | 2.9 |

TABLE A-2-2-continued

| | | | | Durability Test B | | | | | | |
|---|---|---|---|---|---|---|---|---|---|---|
| | | | | Initial | | | Durability B: 100,0000 Sheets Printing | | | |
| Example | F-Resin Volume % *a) | F-Resin Covering Ratio *b) | Exemp. Comp. *c) | Skin-Friction *d) | Potential Illumi. (−V) *e) | Image Quality | Skin-Friction *d) | Potential Illumi. (−V) *e) | Image Quality | Abrasion Wear μm |
| Ex. A-19 | 39 | 19 | A-6-3 | 0.24 | 105 | A | 0.25 | 125 | A | 2.8 |
| Ex. A-20 | 39 | 20 | A-6-4 | 0.24 | 100 | A | 0.26 | 125 | A | 2.8 |
| Ex. A-21 | 39 | 19 | A-7-2 | 0.25 | 110 | A | 0.25 | 130 | A | 2.7 |
| Ex. A-22 | 39 | 20 | A-7-5 | 0.25 | 100 | A | 0.26 | 130 | A | 2.7 |
| Ex. A-23 | 39 | 19 | A-8-1 | 0.25 | 105 | A | 0.26 | 135 | A | 2.8 |
| Ex. A-24 | 39 | 20 | A-8-6 | 0.24 | 105 | A | 0.25 | 125 | A | 2.9 |
| Ex. A-25 | 39 | 20 | A-8-7 | 0.25 | 100 | A | 0.26 | 125 | A | 2.8 |
| Ex. A-26 | 39 | 20 | A-9-1 | 0.26 | 100 | A | 0.28 | 125 | A | 2.9 |
| Ex. A-27 | 39 | 19 | A-9-3 | 0.26 | 100 | A | 0.27 | 130 | A | 3.0 |
| Ex. A-28 | 39 | 20 | A-9-5 | 0.26 | 100 | A | 0.27 | 125 | A | 2.8 |

TABLE A-2-3

| | | | | Durability Test B | | | | | | |
|---|---|---|---|---|---|---|---|---|---|---|
| | | | | Initial | | | Durability B: 100,0000 Sheets Printing | | | |
| Example | F-Resin Volume % *1 | F-Resin Covering Ratio *2 | Exemp. Comp. *3 | Skin-Friction *4 | Potential Illumi. (−V) *5 | Image Quality | Skin-Friction *4 | Potential Illumi. (−V) *5 | Image Quality | Abrasion Wear μm |
| Ex. A-29 | 39 | 20 | A-10-2 | 0.25 | 105 | A | 0.26 | 135 | A | 2.8 |
| Ex. A-30 | 39 | 20 | A-10-4 | 0.24 | 110 | A | 0.26 | 135 | A | 2.8 |
| Ex. A-31 | 39 | 20 | A-10-5 | 0.25 | 100 | A | 0.26 | 130 | A | 2.8 |
| Ex. A-32 | 39 | 21 | A-11-2 | 0.26 | 100 | A | 0.27 | 130 | A | 2.9 |
| Ex. A-33 | 39 | 20 | A-11-6 | 0.26 | 100 | A | 0.27 | 125 | A | 2.8 |
| Ex. A-34 | 39 | 20 | A-12-2 | 0.26 | 100 | A | 0.28 | 135 | A | 2.9 |
| Ex. A-35 | 39 | 19 | A-12-4 | 0.25 | 100 | A | 0.26 | 125 | A | 2.9 |
| Ex. A-36 | 39 | 20 | A-12-5 | 0.25 | 100 | A | 0.26 | 120 | A | 2.8 |
| Ex. A-37 | 39 | 18 | A-13-1 | 0.25 | 105 | A | 0.27 | 135 | A | 2.8 |
| Ex. A-38 | 39 | 20 | A-13-4 | 0.25 | 105 | A | 0.26 | 130 | A | 2.7 |
| Ex. A-39 | 39 | 20 | A-13-7 | 0.25 | 100 | A | 0.26 | 130 | A | 2.7 |
| Ex. A-40 | 39 | 20 | A-14-1 | 0.24 | 100 | A | 0.26 | 135 | A | 2.8 |
| Ex. A-41 | 39 | 19 | A-14-2 | 0.26 | 105 | A | 0.27 | 130 | A | 2.8 |
| Ex. A-42 | 39 | 21 | A-14-8 | 0.25 | 110 | A | 0.27 | 145 | A | 2.9 |
| Ex. A-43 | 39 | 20 | A-14-11 | 0.26 | 105 | A | 0.28 | 130 | A | 2.9 |
| Ex. A-44 | 39 | 20 | A-14-14 | 0.25 | 100 | A | 0.27 | 130 | A | 2.8 |

TABLE A-2-4

| | | | | Durability Test B | | | | | | |
|---|---|---|---|---|---|---|---|---|---|---|
| | | | | Initial | | | Durability B: 100,0000 Sheets Printing | | | |
| Example | F-Resin Volume % *1 | F-Resin Covering Ratio *2 | Exemp. Comp. *3 | Skin-Friction *4 | Potential Illumi. (−V) *5 | Image Quality | Skin-Friction *4 | Potential Illumi. (−V) *5 | Image Quality | Abrasion Wear μm |
| Ex. A-45 | 39 | 20 | A-15-6 | 0.26 | 105 | A | 0.27 | 135 | A | 3.0 |
| Ex. A-46 | 39 | 20 | A-15-7 | 0.25 | 100 | A | 0.27 | 130 | A | 2.8 |
| Ex. A-47 | 39 | 19 | A-16-1 | 0.26 | 105 | A | 0.26 | 135 | A | 2.9 |
| Ex. A-48 | 39 | 20 | A-16-3 | 0.26 | 100 | A | 0.27 | 125 | A | 2.9 |
| Ex. A-49 | 39 | 20 | A-16-9 | 0.25 | 105 | A | 0.25 | 130 | A | 2.8 |
| Ex. A-50 | 39 | 19 | A-16-14 | 0.25 | 100 | A | 0.26 | 130 | A | 2.8 |
| Ex. A-51 | 39 | 21 | A-17-3 | 0.25 | 100 | A | 0.26 | 130 | A | 2.9 |
| Ex. A-52 | 39 | 20 | A-17-4 | 0.25 | 100 | A | 0.27 | 125 | A | 2.8 |
| Ex. A-53 | 39 | 20 | A-18-4 | 0.25 | 105 | A | 0.26 | 125 | A | 2.8 |
| Ex. A-54 | 39 | 20 | A-18-5 | 0.25 | 100 | A | 0.26 | 125 | A | 2.7 |
| Ex. A-55 | 39 | 20 | A-19-1 | 0.24 | 105 | A | 0.26 | 135 | A | 2.9 |
| Ex. A-56 | 39 | 19 | A-19-4 | 0.25 | 100 | A | 0.27 | 130 | A | 2.8 |
| Ex. A-57 | 39 | 18 | A-20-1 | 0.25 | 110 | A | 0.27 | 135 | A | 3.0 |
| Ex. A-58 | 39 | 20 | A-20-3 | 0.25 | 100 | A | 0.26 | 130 | A | 2.8 |
| Ex. A-59 | 39 | 20 | A-21-7 | 0.25 | 100 | A | 0.27 | 130 | A | 2.8 |
| Ex. A-60 | 39 | 19 | A-22-2 | 0.25 | 105 | A | 0.26 | 130 | A | 3.0 |
| Ex. A-61 | 39 | 20 | A-22-4 | 0.25 | 100 | A | 0.26 | 125 | A | 2.8 |

The results shown in Tables A-2-1 to A-2-4 demonstrate that that the inclusions of the fine particles of fluorine-contained resin in the range of 20 to 60% by volume as well as specific amine compound into the outermost surface layer of the photoconductor make possible to maintain the lower skin-friction coefficient stably, even when a toner having substantially spherical shape is employed. Further, it is confirmed that the abrasion wear is reduced i.e. the abrasion resistance is remarkably improved. Further, the increase of the potential at the illuminated part is not significant even after the 100,000 th printing, the lag occurrence is not apparent in the photoconductors that were added specific amine compounds, as such it is confirmed that high quality images may be obtained stably.

On the other hand, cleaning failures and/or lag occurrences were induced in the photoconductors that did not satisfy the range of 20 to 60% by volume of fine particles of fluorine-contained resin or that did not contain specific amine compound.

TABLE A-3-1

| | | | | Durability Test C | | | | | | |
|---|---|---|---|---|---|---|---|---|---|---|
| | | | | Initial | | | Durability C: 100,0000 Sheets Printing | | | |
| Example | F-Resin Volume % *a) | F-Resin Covering Ratio *b) | Exemp. Comp. *c) | Skin-Friction *d) | Potential Illumi. (−V) *e) | Image Quality | Skin-Friction *d) | Potential Illumi. (−V) *e) | Image Quality | Abrasion Wear μm |
| Ex. A-1 | 39 | 20 | A-3-4 | 0.25 | 125 | A*1 | 0.29 | 130 | A*1 | 3.0 |
| Ex. A-2 | 21 | 14 | A-3-4 | 0.30 | 120 | A | 0.35 | 130 | *2 | 3.7 |
| Ex. A-3 | 60 | 31 | A-3-4 | 0.21 | 130 | A | 0.25 | 120 | A | 4.5 |
| Com. Ex. A-1 | 18 | 10 | A-3-4 | 0.33 | 115 | A | 0.61 | 140 | *3 | 6.3 |
| Com. Ex. A-2 | 65 | 35 | A-3-4 | 0.21 | 140 | A | 0.24 | 110 | *4 | 5.3 |
| Com. Ex. A-3 | 39 | 21 | — | 0.26 | 120 | A | 0.28 | 80 | *5 | 3.0 |
| Ex. A-4 | 39 | 19 | A-3-4 | 0.19 | 130 | A | 0.22 | 160 | A | 2.6 |
| Ex. A-5 | 39 | 20 | A-1-2 | 0.25 | 130 | A | 0.28 | 130 | A | 3.2 |
| Ex. A-6 | 39 | 21 | A-1-6 | 0.26 | 125 | A | 0.29 | 135 | A | 3.1 |
| Ex. A-7 | 39 | 20 | A-1-8 | 0.25 | 120 | A | 0.28 | 125 | A | 3.1 |
| Ex. A-8 | 39 | 19 | A-2-4 | 0.25 | 115 | A | 0.28 | 135 | A | 3.2 |
| Ex. A-9 | 39 | 20 | A-2-6 | 0.25 | 110 | A | 0.28 | 130 | A | 3.1 |
| Ex. A-10 | 39 | 20 | A-3-5 | 0.24 | 120 | A | 0.26 | 140 | A | 3.0 |
| Ex. A-11 | 39 | 20 | A-3-8 | 0.24 | 115 | A | 0.26 | 135 | A | 3.1 |
| Ex. A-12 | 39 | 18 | A-4-3 | 0.25 | 120 | A | 0.27 | 135 | A | 3.1 |

*1Good

*2: Occurrence of inferior cleaning from about 40,000 th printings

*3: Occurrence of inferior cleaning from about 20,000 th printings

*4: Occurrence of image lags from about 40,000 th printings

*5: Occurrence of image lags from about 10,000 th printings

TABLE A-3-2

| | | | | Durability Test C | | | | | | |
|---|---|---|---|---|---|---|---|---|---|---|
| | | | | Initial | | | Durability C: 100,0000 Sheets Printing | | | |
| Example | F-Resin Volume % *a) | F-Resin Covering Ratio *b) | Exemp. Comp. *c) | Skin-Friction *d) | Potential Illumi. (−V) *e) | Image Quality | Skin-Friction *d) | Potential Illumi. (−V) *e) | Image Quality | Abrasion Wear μm |
| Ex. A-13 | 39 | 20 | A-4-6 | 0.25 | 115 | A | 0.28 | 135 | A | 3.2 |
| Ex. A-14 | 39 | 20 | A-4-7 | 0.25 | 110 | A | 0.27 | 130 | A | 3.1 |
| Ex. A-15 | 39 | 19 | A-5-1 | 0.26 | 120 | A | 0.27 | 135 | A | 3.3 |
| Ex. A-16 | 39 | 20 | A-5-2 | 0.26 | 115 | A | 0.28 | 140 | A | 3.0 |
| Ex. A-17 | 39 | 20 | A-5-4 | 0.25 | 110 | A | 0.27 | 130 | A | 3.1 |
| Ex. A-18 | 39 | 21 | A-6-1 | 0.25 | 120 | A | 0.29 | 135 | A | 2.9 |
| Ex. A-19 | 39 | 19 | A-6-3 | 0.24 | 120 | A | 0.27 | 135 | A | 3.1 |
| Ex. A-20 | 39 | 20 | A-6-4 | 0.24 | 115 | A | 0.27 | 130 | A | 3.1 |
| Ex. A-21 | 39 | 19 | A-7-2 | 0.25 | 120 | A | 0.27 | 140 | A | 3.2 |
| Ex. A-22 | 39 | 20 | A-7-5 | 0.25 | 115 | A | 0.27 | 135 | A | 3.1 |
| Ex. A-23 | 39 | 19 | A-8-1 | 0.25 | 120 | A | 0.28 | 145 | A | 3.1 |
| Ex. A-24 | 39 | 20 | A-8-6 | 0.24 | 115 | A | 0.27 | 130 | A | 3.0 |
| Ex. A-25 | 39 | 20 | A-8-7 | 0.25 | 110 | A | 0.27 | 130 | A | 3.1 |
| Ex. A-26 | 39 | 20 | A-9-1 | 0.26 | 120 | A | 0.29 | 135 | A | 3.1 |
| Ex. A-27 | 39 | 19 | A-9-3 | 0.26 | 115 | A | 0.29 | 135 | A | 3.2 |
| Ex. A-28 | 39 | 20 | A-9-5 | 0.26 | 110 | A | 0.28 | 130 | A | 3.1 |

TABLE A-3-3

| | | | | Durability Test C | | | | | | |
|---|---|---|---|---|---|---|---|---|---|---|
| | | | | Initial | | | Durability C: 100,0000 Sheets Printing | | | |
| Example | F-Resin Volume % *a) | F-Resin Covering Ratio *b) | Exemp. Comp. *c) | Skin-Friction *d) | Potential Illumi. (−V) *e) | Image Quality | Skin-Friction *d) | Potential Illumi. (−V) *e) | Image Quality | Abrasion Wear μm |
| Ex. A-29 | 39 | 20 | A-10-2 | 0.25 | 120 | A | 0.28 | 140 | A | 3.1 |
| Ex. A-30 | 39 | 20 | A-10-4 | 0.24 | 120 | A | 0.28 | 140 | A | 3.2 |
| Ex. A-31 | 39 | 20 | A-10-5 | 0.25 | 115 | A | 0.28 | 135 | A | 3.1 |
| Ex. A-32 | 39 | 21 | A-11-2 | 0.26 | 115 | A | 0.29 | 135 | A | 3.1 |
| Ex. A-33 | 39 | 20 | A-11-6 | 0.26 | 110 | A | 0.28 | 130 | A | 3.1 |
| Ex. A-34 | 39 | 20 | A-12-2 | 0.26 | 115 | A | 0.30 | 140 | A | 3.3 |
| Ex. A-35 | 39 | 19 | A-12-4 | 0.25 | 115 | A | 0.27 | 140 | A | 3.1 |
| Ex. A-36 | 39 | 20 | A-12-5 | 0.25 | 110 | A | 0.27 | 135 | A | 3.1 |
| Ex. A-37 | 39 | 18 | A-13-1 | 0.25 | 120 | A | 0.28 | 145 | A | 3.1 |
| Ex. A-38 | 39 | 20 | A-13-4 | 0.25 | 120 | A | 0.28 | 140 | A | 3.0 |
| Ex. A-39 | 39 | 20 | A-13-7 | 0.25 | 115 | A | 0.28 | 135 | A | 3.1 |
| Ex. A-40 | 39 | 20 | A-14-1 | 0.24 | 115 | A | 0.28 | 135 | A | 3.2 |
| Ex. A-41 | 39 | 19 | A-14-2 | 0.26 | 115 | A | 0.29 | 135 | A | 3.0 |
| Ex. A-42 | 39 | 21 | A-14-8 | 0.25 | 120 | A | 0.28 | 150 | A | 3.1 |
| Ex. A-43 | 39 | 20 | A-14-11 | 0.26 | 120 | A | 0.29 | 135 | A | 3.2 |
| Ex. A-44 | 39 | 20 | A-14-14 | 0.25 | 115 | A | 0.28 | 130 | A | 3.1 |

TABLE A-3-4

| | | | | Durability Test C | | | | | | |
|---|---|---|---|---|---|---|---|---|---|---|
| | | | | Initial | | | Durability C: 100,0000 Sheets Printing | | | |
| Example | F-Resin Volume % *a) | F-Resin Covering Ratio *b) | Exemp. Comp. *c) | Skin-Friction *d) | Potential Illumi. (−V) *e) | Image Quality | Skin-Friction *d) | Potential Illumi. (−V) *e) | Image Quality | Abrasion Wear μm |
| Ex. A-45 | 39 | 20 | A-15-6 | 0.26 | 115 | A | 0.29 | 140 | A | 3.3 |
| Ex. A-46 | 39 | 20 | A-15-7 | 0.25 | 110 | A | 0.28 | 135 | A | 3.2 |
| Ex. A-47 | 39 | 19 | A-16-1 | 0.26 | 115 | A | 0.28 | 145 | A | 3.4 |
| Ex. A-48 | 39 | 20 | A-16-3 | 0.26 | 115 | A | 0.29 | 135 | A | 3.2 |
| Ex. A-49 | 39 | 20 | A-16-9 | 0.25 | 115 | A | 0.27 | 135 | A | 3.0 |
| Ex. A-50 | 39 | 19 | A-16-14 | 0.25 | 110 | A | 0.28 | 130 | A | 3.1 |
| Ex. A-51 | 39 | 21 | A-17-3 | 0.25 | 110 | A | 0.28 | 140 | A | 3.1 |
| Ex. A-52 | 39 | 20 | A-17-4 | 0.25 | 110 | A | 0.28 | 135 | A | 3.1 |
| Ex. A-53 | 39 | 20 | A-18-4 | 0.25 | 115 | A | 0.28 | 135 | A | 3.0 |
| Ex. A-54 | 39 | 20 | A-18-5 | 0.25 | 110 | A | 0.28 | 130 | A | 3.1 |
| Ex. A-55 | 39 | 20 | A-19-1 | 0.24 | 115 | A | 0.28 | 140 | A | 3.2 |
| Ex. A-56 | 39 | 19 | A-19-4 | 0.25 | 110 | A | 0.28 | 135 | A | 3.1 |
| Ex. A-57 | 39 | 18 | A-20-1 | 0.25 | 120 | A | 0.29 | 145 | A | 3.1 |
| Ex. A-58 | 39 | 20 | A-20-3 | 0.25 | 115 | A | 0.28 | 140 | A | 3.1 |
| Ex. A-59 | 39 | 20 | A-21-7 | 0.25 | 120 | A | 0.28 | 140 | A | 3.1 |
| Ex. A-60 | 39 | 19 | A-22-2 | 0.25 | 115 | A | 0.28 | 135 | A | 3.2 |
| Ex. A-61 | 39 | 20 | A-22-4 | 0.25 | 115 | A | 0.28 | 130 | A | 3.1 |

The results shown in Tables A-3-1 to A-3-4 demonstrate that that the inclusions of the fine particles of fluorine-contained resin in the range of 20 to 60% by volume as well as specific amine compound into the outermost surface layer of the photoconductor make possible to maintain the lower skin-friction coefficient stably, even when a toner having substantially spherical shape is employed. Further, it is confirmed that the abrasion wear is reduced i.e. the abrasion resistance is remarkably improved. Further, the increase of the potential at the illuminated part is not significant even after the 50,000 th printing, the lag occurrence is not apparent in the photoconductors that were added specific amine compounds, as such it is confirmed that high quality images may be obtained stably.

On the other hand, cleaning failures and/or lag occurrences were induced in the photoconductors that did not satisfy the range of 20 to 60% by volume of fine particles of fluorine-contained resin or that did not contain specific amine compound.

Example B

The present invention will be further explained based on examples and comparative examples, being exemplary and explanatory only, with respect to photoconductors containing the compounds expressed by general formulas (25) to (27) in the protective layer. All percentages and parts are by weight unless indicated otherwise.

The exemplified compounds incorporated into the protective layers in Example B correspond to the exemplified compounds in terms of each reference No. listed earlier as the specific examples of general formulas (25) to (27).

Example B-1

Coating liquids for under-coating layer, charge-generating layer, and charge-transporting layer having the following compositions respectively, were coated individually by immersion coating and drying in turn on an aluminum cylinder, thereby an under-coating layer of 3.5 μm thick, charge-generating layer of 0.2 μm thick, and charge-transporting layer of 22 μm thick were formed.

-Coating Liquid for Under-Coating Layer

| | |
|---|---|
| Titanium dioxide powder *1) | 400 parts |
| Melamine resin *2) | 65 parts |
| Alkyd resin *3) | 120 parts |
| 2-butanone | 400 parts |

*1) Tie Pail CR-EL, by Ishihara Sangyo Co. Ltd.
*2) Super Beckamine G-821-60, by Dainippon and Chemicals, Co.
*3) Becolite M6401-50, by Dainippon and Chemicals, Co.

-Coating Liquid for Charge-Generating Layer

| | |
|---|---|
| Bisazo pigment shown below | 12 parts |
| Polyvinylbutyral | 5 parts |
| 2-butanone | 200 parts |
| Cyclohexanone | 400 parts |

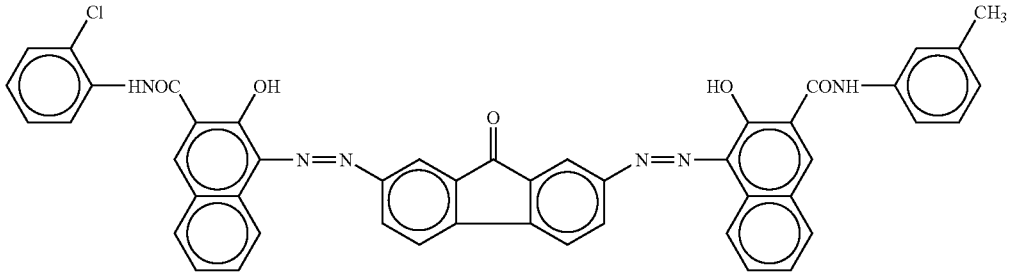

-Coating Liquid for Charge-Transporting Layer

| | |
|---|---|
| Polycarbonate*1) | 8 parts |
| Bisazo pigment shown below | 10 parts |
| Tetrahydrofuran | 100 parts |

*1)Z-polyca, by Teijinkasei Co.

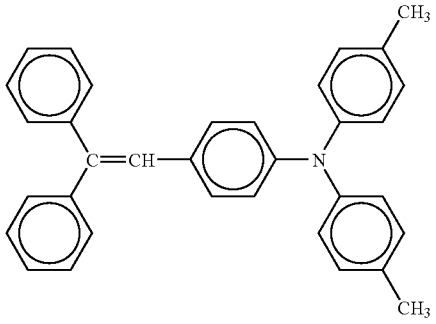

Further, a coating liquid for protective layer was prepared in the following composition; the coating liquid was readied for coating by circulating for 30 minutes at 100 MPa pressure using a high-speed collision dispersion apparatus (Ultimaizer HJP-25005, by Sugino Machine Limited) followed by ultrasonic dispersion for 10 minutes. Then, the coating liquid for protective layer was coated through spray coating by means of a spray gun (Peacecon PC308, by Olinpos Co., 2 kgf/cm$^2$ of air pressure) and drying at 30° C. for 60 minutes to form a protective layer of about 5 μm thick, thereby electrographic photoconductor 1 was prepared.

-Coating Liquid for Protective Layer

| | |
|---|---|
| Particles of perfluoroalkoxy resin *1) | 5.5 parts |
| Dispersion Aid *2) | 1.0 part |
| Exemplified Compound B-4 | 0.4 part |
| Polycarbonate *3) | 4.0 parts |
| Tetrahydrofuran | 200 parts |
| Cyclohexanone | 60 parts |

*1) MPE-056, by Mitsui Fluorochemical Co.
*2) Modiper F210, by NOF Corporation
*3) Z-polyca, by Teijinkasei Co.

Example B-2

Electrophotographic photoconductor 2 was prepared in the same manner as Example B-1, except for changing the coating liquid for the protective layer as follows.

-Coating Liquid for Protective Layer

| | |
|---|---|
| Particles of perfluoroalkoxy resin *1) | 3.3 parts |
| Dispersion Aid *2) | 1.0 part |
| Exemplified Compound B-4 | 0.4 part |
| Polycarbonate *3) | 6.4 parts |
| Tetrahydrofuran | 200 parts |
| Cyclohexanone | 60 parts |

*1) MPE-056, by Mitsui Fluorochemical Co.
*2) Modiper F210, by NOF Corporation
*3) Z-polyca, by Teijinkasei Co.

Example B-3

Electrophotographic photoconductor 3 was prepared in the same manner as Example B-1, except for changing the coating liquid for the protective layer as follows.

-Coating Liquid for Protective Layer

| | |
|---|---|
| Particles of perfluoroalkoxy resin *1) | 7.4 parts |
| Dispersion Aid *2) | 1.0 part |
| Exemplified Compound B-4 | 0.4 part |
| Polycarbonate *3) | 2.3 parts |
| Tetrahydrofuran | 200 parts |
| Cyclohexanone | 60 parts |

*1) MPE-056, by Mitsui Fluorochemical Co.
*2) Modiper F210, by NOF Corporation
*3) Z-polyca, by Teijinkasei Co.

Comparative Example B-1

Comparative electrophotographic photoconductor 1 was prepared in the same manner as Example B-1, except for changing the coating liquid for the protective layer as follows.

-Coating Liquid for Protective Layer

| | |
|---|---|
| Particles of perfluoroalkoxy resin *1) | 3.0 parts |
| Dispersion Aid *2) | 1.0 part |
| Exemplified Compound B-4 | 0.4 part |
| Polycarbonate *3) | 6.7 parts |
| Tetrahydrofuran | 200 parts |
| Cyclohexanone | 60 parts |

*1) MPE-056, by Mitsui Fluorochemical Co.
*2) Modiper F210, by NOF Corporation
*3) Z-polyca, by Teijinkasei Co.

Comparative Example B-2

Comparative electrophotographic photoconductor 2 was prepared in the same manner as Example B-1, except for changing the coating liquid for the protective layer as follows.

-Coating Liquid for Protective Layer

| | |
|---|---|
| Particles of perfluoroalkoxy resin *1) | 7.8 parts |
| Dispersion Aid *2) | 1.0 part |
| Exemplified Compound B-4 | 0.4 part |
| Polycarbonate *3) | 1.9 parts |
| Tetrahydrofuran | 200 parts |
| Cyclohexanone | 60 parts |

*1) MPE-056, by Mitsui Fluorochemical Co.
*2) Modiper F210, by NOF Corporation
*3) Z-polyca, by Teijinkasei Co.

Comparative Example B-3

Comparative electrophotographic photoconductor 3 was prepared in the same manner as Example B-1, except for changing the coating liquid for the protective layer as follows.

-Coating Liquid for Protective Layer

| | |
|---|---|
| Particles of perfluoroalkoxy resin *1) | 5.5 parts |
| Dispersion Aid *2) | 1.0 part |
| Polycarbonate *3) | 4.2 parts |

-continued

| | |
|---|---|
| Tetrahydrofuran | 200 parts |
| Cyclohexanone | 60 parts |

*1) MPE-056, by Mitsui Fluorochemical Co.
*2) Modiper F210, by NOF Corporation
*3) Z-polyca, by Teijinkasei Co.

Example B-4

Electrophotographic photoconductor 4 was prepared in the same manner as Example B-1, except for changing the fine particles of perfluoroalkoxy resin in the coating liquid for protective layer into fine particles of tetrafluoroethylene resin (Lublon L-2, by Daikin Industries, Ltd.).

Examples B-5 to B10

Electrophotographic photoconductors 5 to 10 were prepared in the same manner as Example B-1, except for changing the exemplified compound 4 in the coating liquid for protective layer into the respective compounds shown in Tables B-1-1, B-2-1, and B-3-1.

Comparative Example B-4

Comparative electrophotographic photoconductors 4 was prepared in the same manner as Example B-1, except for changing the exemplified compound B-4 in the coating liquid for protective layer into the comparative compound 1 shown below.

Comparative Compound (1)

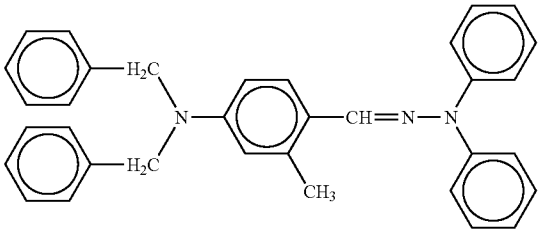

Comparative Example B-5

Comparative electrophotographic photoconductor 5 was prepared in the same manner as Example B-1, except for changing the exemplified compound B-4 in the coating liquid for protective layer into the comparative compound 2 shown below.

Comparative Compound (2)

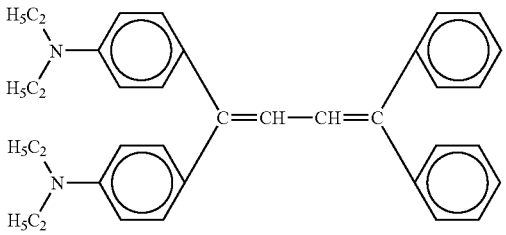

Example B-11

Electrophotographic photoconductor 11 was prepared in the same manner as Example B-1, except for changing the exemplified compound B-4 in the coating liquid for protective layer into the exemplified compound B-1-1.

Example B-12

Electrophotographic photoconductor 12 was prepared in the same manner as Example B-2, except for changing the exemplified compound B-4 in the coating liquid for protective layer into the exemplified compound B-1-1.

Example B-13

Electrophotographic photoconductor 13 was prepared in the same manner as Example B-3, except for changing the exemplified compound B-4 in the coating liquid for protective layer into the exemplified compound B-1-1.

Comparative Example B-6

Comparative electrophotographic photoconductor 6 was prepared in the same manner as Comparative Example B-1, except for changing the exemplified compound B-4 in the coating liquid for protective layer into the exemplified compound B-1-1.

Comparative Example B-7

Comparative electrophotographic photoconductor 7 was prepared in the same manner as Comparative Example B-2, except for changing the exemplified compound B-4 in the coating liquid for protective layer into the exemplified compound B-1-1.

Example B-14

Electrophotographic photoconductor 14 was prepared in the same manner as Example B-4, except for changing the exemplified compound B-4 in the coating liquid for protective layer into the exemplified compound B-1-1.

Examples B-15 to B-24

Electrophotographic photoconductors 15 to 24 were prepared in the same manner as Example B-1, except for changing the exemplified compound B-4 in the coating liquid for protective layer into the compounds exemplified in Tables B-1-2, B-2-2, and B-3-2.

Toner Production Example 1

-Preparation of Composition Containing Monomer

| | |
|---|---|
| Styrene Monomer | 70 parts |
| N-butylmethacrylate | 30 parts |
| Polystyrene | 5 parts |
| 3,5-di-tert-butyl zincsalicylate | 2 parts |
| Carbon black | 6 parts |

The above-noted ingredients were blended for 24 hours by means of a ball mill to prepare a polymerizable composition containing monomer.

-Granulation and Polymerization

To a flask, which was equipped with a mixer, thermometer, inlet pipe of inactive gas, and porous glass tube of 10 mm Φ×50 mm having 110,000 A of pore size and 0.42 cc/g of pore volume, 400 ml of 2% aqueous solution of polyvinyl alcohol was poured and stirred at ambient temperature while feeding nitrogen gas to replace the oxygen gas in the reaction vessel.

Separately, 1.56 grams of azobis isobutylnitrile was added to 113 grams of the composition containing monomer and was stirred to yield a mixture, then the mixture was passed through the porous glass tube by use of a pump thereby the mixture was added to the aqueous solution of polyvinyl alcohol. Then the mixed solution of the polyvinyl alcohol and the composition containing monomer was circulated for 2 hours at the rate of 120 ml/min while making it pass through the porous glass tube by use of a pump, thereafter the temperature inside the reactor vessel was raised to 70° C. thereby the mixture was allowed to polymerize for 8 hours.

Then, the content of the reaction vessel was cooled to room temperature and allowed to stand overnight, thereafter the supernatant was removed then de-ionized water was poured additionally. After the content was stirred for one hour, was filtered and dried to prepare a toner. From the measurement by Coulter Counter, the toner exhibited 8.5 μm of average particle diameter and a narrow particle size distribution such that the particles in the range of 0 to 5 μm from the average particle diameter occupied 95% of the entire particles.

<Evaluation 1: Average Circularity>

The toner particles obtained in the Toner Production Example 1 were dispersed in water to prepare a suspension, the suspension was directed to pass through a plate-like image detecting region, where the particle images were detected by means of a CCD camera, then the average circularity was evaluated. The "average circularity" means the ratio between the peripheral length of corresponding circle having the same projected area and the peripheral length of the actual particle, i.e. (peripheral length of corresponding circle)÷(peripheral length of actual particle). This value can be measured as the average circularity using a flow-type particle image analyzing apparatus FPIA-2000. Specifically, a surfactant preferably 0.1 to 0.5 ml of alkyl benzene sulfonate is added into 100 to 150 ml of pure water of distilled or de-ionized water as dispersant, and the sample to be evaluated is added about 0.1 to 0.5 gram, the dispersion containing the sample is subjected to ultrasonic dispersing treatment for 1 to 3 minutes, and the dispersion concentration is adjusted in the range of 3000 to 10000 particles/microliter, then the measurement is conducted by the apparatus in the mode of shape and distribution. It has been demonstrated from the investigation until now that the toner having an average circularity of 0.960 or more is effective to provide images with high reproducibility and high precision, more preferably, the average circularity is 0.980 to 1.000. By the way, the average circularity of the toner prepared in the Toner Production Example 1 was 0.98.

<Evaluation 2: Covering Ratio>

The electrophotographic photoconductors of Examples 1 to 24 and Comparative Examples 1 to 7 were respectively sampled from their randomly selected 10 sites, and the surfaces of the sampled coatings were taken pictures with FE-SEM (scanning electron microscope of S-4200 type, by Hitachi Ltd.) at 4000 times with an accelerating voltage of 2 kV. From the SEM photographs, the fine particle number of fluorine-contained resin (primary particle, and agglomerated secondary particle), each average diameter, area, and covering ratio of the particles were analyzed by means of an image processing software (Image Pro Plus), and the sum of area ratio of particles having average diameter of 0.15 to 3 μm was calculated as S1, the sum of area ratio of particles having average diameter of 0.2 to 1.5 μm was calculated as S2; wherein the covering ratio refers to the ratio of surface area where the fine particles of fluorine-contained resin exist within the entire photoconductor surface.

<Evaluation 3: Skin-Friction Coefficient>

As for the resulting inventive electrophotographic photoconductors 1 to 61 and comparative electrophotographic photoconductors 1 to 3, the respective skin-friction coefficients were measured using an Euler-belt system described in JP-A No. 9-166919. The belt referrers to a high quality paper with moderate thickness that is tensioned on one-forth of photoconductor circular as shown in FIG. 9, wherein the longitudinal direction corresponds the paper-making direction. A balance weight 9*a* of 100 grams was attached to one end of the high quality paper belt 9*b*, and a force gauge (spring balance) 9*c* was attached to the other end of the high quality paper belt; the digital force gauge was slowly pulled, at the moment when the belt begun to move due to sliding of belt 9*b* on sample 9*d*, the weight indicated by the digital force gauge was read, and the coefficient of (static) friction was calculated from the following formula. In the formula, μ represents the friction coefficient, F represents the tensile stress, and W represents the load. In the constitution shown in FIG. 9, a balance (100 grams), belt (Type 6200, long grain, A4 size paper, 30 mm width cut in paper-making direction), and two double clips were equipped.

$$\mu=2/\pi\times\ln(F/W)\quad W=100\text{ grams}$$

<Evaluation 4: Durable Life A>

As for the resulting inventive electrophotographic photoconductors 1 to 24 and comparative electrophotographic photoconductors 1 to 7, the respective photoconductors were mounted on modified-type Imagio Color 5100 (by Ricoh Company, Ltd., light source for image irradiation being changed to a semiconductor laser of wavelength 655 nm, and the unit for coating lubricant being removed), then 100,000 sheets of paper in total were printed sequentially using a ground-type toner (Imagio Color toner type S, circularity 0.91) which being often employed in evaluation apparatuses; and the initial images and 100,000 th printed images were evaluated. Further, the potential voltages at the illuminated parts were measured after the initial printing and the 100,000 th printing. Furthermore, the abrasion wears were evaluated from the difference of layer thicknesses between at the initial and the 100,000 th.

<Evaluation 5: Durable Life B>

As for the resulting inventive electrophotographic photoconductors 1 to 24 and comparative electrophotographic photoconductors 1 to 7, the respective photoconductors were mounted on modified-type Imagio Color 5100 (by Ricoh Company, Ltd., the toner being changed to that of Toner Production Example 1 described earlier, the light source for image irradiation being changed to a semiconductor laser of wavelength 655 nm, and the unit for coating lubricant being removed), then 100,000 sheets of paper in total were printed sequentially, and the initial images and 100,000 th printed images were evaluated. Further, the potential voltages at the illuminated parts were measured after the initial printing and the 100,000 th printing. Furthermore, the abrasion wears were evaluated from the difference of layer thicknesses between at the initial and the 100,000 th.

<Evaluation 6: Durable Life C>

As for the resulting inventive electrophotographic photoconductors 1 to 24 and comparative electrophotographic photoconductors 1 to 7, the respective photoconductors were mounted on Modified Imagio Color 8100 (by Ricoh Company, Ltd., the toner being changed to that of Toner Production Example 1), then 50,000 sheets of paper in total were printed sequentially, and the initial images and 50,000 th printed images were evaluated. Further, the potential voltages at the illuminated parts were measured after the initial printing and the 50,000 th printing. Furthermore, the abrasion wears were evaluated from the difference of layer thicknesses between at the initial and the 50,000 th.

Tables B-1-1, B-1-2, B-2-1, B-2-2, B-3-1, and B-3-2 show the results of evaluation with respect to the durable lives A to C.

The results shown in Tables B-1-1 and B-1-2 demonstrate that the inclusions of the fine particles of fluorine-contained resin in the range of 20 to 60% by volume into the outermost surface layer of the photoconductor make possible to maintain the lower skin-friction coefficient stably. Further, it is confirmed that the abrasion wear is reduced i.e. the abrasion resistance is remarkably improved. Further, the increase of the potential at the illuminated part is not significant even after the 100,000 th printing, the lag occurrence is not apparent in the photoconductors that were added specific amine compounds, as such it is confirmed that high quality images may be obtained stably.

On the other hand, cleaning failures and/or lag occurrences were induced in the photoconductors that did not satisfy the range of 20 to 60% by volume of fine particles of fluorine-contained resin (Comparative Examples B-1, 2, 6 and 7) or that did not contain exemplified compounds (Comparative Example B-3) or that contained other compounds than the exemplified compounds (Comparative Examples B-4 and 5).

The results shown in Tables B-2-1, B-2-2, B-3-1, and B-3-2 demonstrate that the spherical toner result in the similar tendency with Tables B-1-1 and B-1-2.

TABLE B-1-1

| | | | | Durability Test A | | | | | | |
|---|---|---|---|---|---|---|---|---|---|---|
| | | | | Initial | | | Durability A: 100,0000 Sheets Printing | | | |
| Example | F-Resin Volume % *a) | F-Resin Covering Ratio *b) | Exemp. Comp. *c) | Skin-Friction *d) | Potential Illumi. (−V) *e) | Image Quality | Skin-Friction *d) | Potential Illumi. (−V) *e) | Image Quality | Abrasion Wear μm |
| Ex. B-1 | 39 | 20 | B-4 | 0.25 | 110 | A*1 | 0.26 | 130 | A*1 | 2.6 |
| Ex. B-2 | 21 | 14 | B-4 | 0.30 | 105 | A | 0.35 | 135 | A | 3.7 |

TABLE B-1-1-continued

| | | | | Durability Test A | | | | | | |
|---|---|---|---|---|---|---|---|---|---|---|
| | | | | Initial | | | Durability A: 100,0000 Sheets Printing | | | |
| Example | F-Resin Volume % *a) | F-Resin Covering Ratio *b) | Exemp. Comp. *c) | Skin-Friction *d) | Potential Illumi. (−V) *e) | Image Quality | Skin-Friction *d) | Potential Illumi. (−V) *e) | Image Quality | Abrasion Wear μm |
| Ex. B-3 | 60 | 31 | B-4 | 0.21 | 115 | A | 0.21 | 125 | A | 3.4 |
| Com. Ex. B-1 | 18 | 10 | B-4 | 0.33 | 100 | A | 0.52 | 140 | *3 | 4.3 |
| Com. Ex. B-2 | 65 | 35 | B-4 | 0.21 | 130 | A | 0.20 | 125 | *4 | 4.6 |
| Com. Ex. B-3 | 39 | 21 | — | 0.26 | 100 | A | 0.28 | 85 | *5 | 2.6 |
| Ex. B-4 | 39 | 19 | B-4 | 0.21 | 110 | A | 0.23 | 130 | A | 2.5 |
| Ex. B-5 | 39 | 20 | B-2 | 0.25 | 110 | A | 0.27 | 120 | A | 2.5 |
| Ex. B-6 | 39 | 21 | B-7 | 0.26 | 115 | A | 0.28 | 125 | A | 2.6 |
| Ex. B-7 | 39 | 20 | B-17 | 0.25 | 105 | A | 0.26 | 125 | A | 2.6 |
| Ex. B-8 | 39 | 20 | B-23 | 0.26 | 110 | A | 0.27 | 130 | A | 2.5 |
| Ex. B-9 | 39 | 19 | B-25 | 0.26 | 115 | A | 0.27 | 130 | A | 2.6 |
| Ex. B-10 | 39 | 20 | B-30 | 0.25 | 110 | A | 0.26 | 125 | A | 2.5 |
| Com. Ex. B-4 | 39 | 19 | Com.*2 1 | 0.25 | 180 | A | 0.27 | 260 | *6 | 2.7 |
| Com. Ex. B-5 | 39 | 20 | Com.*2 2 | 0.26 | 200 | A | 0.28 | 310 | *7 | 2.7 |

*1 Good
*2 Comparative compound
*3: Occurrence of inferior cleaning from about 50,000 th printings
*4: Occurrence of image lags from about 90,000 th printings
*5: Occurrence of image lags from about 20,000 th printings
*6: Occurrence of haze in narrow lines from about 70,000 th printings
*7: Occurrence of haze in narrow lines from about 60,000 th printings

TABLE B-1-2

| | | | | Durability Test A | | | | | | |
|---|---|---|---|---|---|---|---|---|---|---|
| | | | | Initial | | | Durability A: 100,0000 Sheets Printing | | | |
| Example | F-Resin Volume % *a) | F-Resin Covering Ratio *b) | Exemp. Comp. *c) | Skin-Friction *d) | Potential Illumi. (−V) *e) | Image Quality | Skin-Friction *d) | Potential Illumi. (−V) *e) | Image Quality | Abrasion Wear μm |
| Ex. B-11 | 39 | 20 | B-1-1 | 0.25 | 110 | A*1 | 0.26 | 120 | A*1 | 2.6 |
| Ex. B-12 | 21 | 14 | B-1-1 | 0.30 | 105 | A | 0.35 | 125 | A | 3.7 |
| Ex. B-13 | 60 | 31 | B-1-1 | 0.21 | 115 | A | 0.21 | 115 | A | 3.4 |
| Com. Ex. B-6 | 18 | 10 | B-1-1 | 0.33 | 100 | A | 0.52 | 135 | *2 | 4.3 |
| Com. Ex. B-7 | 65 | 35 | B-1-1 | 0.21 | 130 | A | 0.20 | 115 | *3 | 4.6 |
| Ex. B-14 | 39 | 19 | B-1-1 | 0.21 | 110 | A | 0.23 | 130 | A | 2.5 |
| Ex. B-15 | 39 | 20 | B-1-2 | 0.25 | 110 | A | 0.27 | 120 | A | 2.5 |
| Ex. B-16 | 39 | 21 | B-1-5 | 0.26 | 115 | A | 0.28 | 125 | A | 2.6 |
| Ex. B-17 | 39 | 20 | B-1-9 | 0.25 | 105 | A | 0.26 | 125 | A | 2.6 |
| Ex. B-18 | 39 | 20 | B-1-13 | 0.26 | 100 | A | 0.27 | 120 | A | 2.5 |
| Ex. B-19 | 39 | 19 | B-2-1 | 0.26 | 105 | A | 0.27 | 120 | A | 2.6 |
| Ex. B-20 | 39 | 20 | B-2-4 | 0.25 | 100 | A | 0.26 | 120 | A | 2.5 |
| Ex. B-21 | 39 | 20 | B-2-8 | 0.25 | 105 | A | 0.26 | 120 | A | 2.6 |
| Ex. B-22 | 39 | 20 | B-2-9 | 0.24 | 100 | A | 0.26 | 115 | A | 2.5 |
| Ex. B-23 | 39 | 20 | B-2-10 | 0.24 | 100 | A | 0.25 | 120 | A | 2.6 |
| Ex. B-24 | 39 | 20 | B-2-13 | 0.24 | 100 | A | 0.26 | 120 | A | 2.6 |

*1 Good
*2: Occurrence of inferior cleaning from about 50,000 th printings
*3: Occurrence of image lags from about 90,000 th printings

TABLE B-2-1

| | | | | Durability Test B | | | | | | |
|---|---|---|---|---|---|---|---|---|---|---|
| | | | | Initial | | | Durability B: 100,0000 Sheets Printing | | | |
| Example | F-Resin Volume % *a) | F-Resin Covering Ratio *b) | Exemp. Comp. *c) | Skin-Friction *d) | Potential Illumi. (−V) *e) | Image Quality | Skin-Friction *d) | Potential Illumi. (−V) *e) | Image Quality | Abrasion Wear μm |
| Ex. B-1 | 39 | 20 | B-4 | 0.25 | 115 | A*1 | 0.26 | 135 | A*1 | 2.7 |
| Ex. B-2 | 21 | 14 | B-4 | 0.30 | 110 | A | 0.35 | 135 | *3 | 3.8 |
| Ex. B-3 | 60 | 31 | B-4 | 0.21 | 120 | A | 0.21 | 130 | A | 3.5 |
| Com. Ex. B-1 | 18 | 10 | B-4 | 0.33 | 100 | A | 0.52 | 145 | *4 | 6.2 |
| Com. Ex. B-2 | 65 | 35 | B-4 | 0.21 | 130 | A | 0.20 | 130 | *5 | 4.7 |

TABLE B-2-1-continued

| | | | | Durability Test B | | | | | | |
|---|---|---|---|---|---|---|---|---|---|---|
| | | | | Initial | | | Durability B: 100,0000 Sheets Printing | | | |
| Example | F-Resin Volume % *a) | F-Resin Covering Ratio *b) | Exemp. Comp. *c) | Skin-Friction *d) | Potential Illumi. (−V) *e) | Image Quality | Skin-Friction *d) | Potential Illumi. (−V) *e) | Image Quality | Abrasion Wear μm |
| Com. Ex. B-3 | 39 | 21 | — | 0.26 | 100 | A | 0.27 | 85 | *6 | 2.6 |
| Ex. B-4 | 39 | 19 | B-4 | 0.19 | 120 | A | 0.21 | 135 | A | 2.7 |
| Ex. B-5 | 39 | 20 | B-2 | 0.25 | 115 | A | 0.27 | 130 | A | 2.7 |
| Ex. B-6 | 39 | 21 | B-7 | 0.26 | 110 | A | 0.27 | 130 | A | 2.8 |
| Ex. B-7 | 39 | 20 | B-17 | 0.25 | 110 | A | 0.27 | 130 | A | 2.7 |
| Ex. B-8 | 39 | 19 | B-23 | 0.25 | 115 | A | 0.26 | 135 | A | 2.9 |
| Ex. B-9 | 39 | 20 | B-25 | 0.25 | 120 | A | 0.27 | 135 | A | 2.8 |
| Ex. B-10 | 39 | 20 | B-30 | 0.24 | 115 | A | 0.25 | 125 | A | 2.9 |
| Com. Ex. B-4 | 39 | 19 | Com.*2 1 | 0.25 | 180 | A | 0.27 | 270 | *7 | 2.9 |
| Com. Ex. B-5 | 39 | 20 | Com.*2 2 | 0.26 | 200 | A | 0.28 | 330 | *8 | 3.0 |

*1Good
*2Comparative compound
*3: Occurrence of inferior cleaning from about 80,000 th printings
*4: Occurrence of inferior cleaning from about 30,000 th printings
*5: Occurrence of image lags from about 90,000 th printings
*6: Occurrence of image lags from about 20,000 th printings
*7: Occurrence of haze in narrow lines from about 70,000 th printings
*8: Occurrence of haze in narrow lines from about 60,000 th printings

TABLE B-2-2

| | | | | Durability Test B | | | | | | |
|---|---|---|---|---|---|---|---|---|---|---|
| | | | | Initial | | | Durability B: 100,0000 Sheets Printing | | | |
| Example | F-Resin Volume % *a) | F-Resin Covering Ratio *b) | Exemp. Comp. *c) | Skin-Friction *d) | Potential Illumi. (−V) *e) | Image Quality | Skin-Friction *d) | Potential Illumi. (−V) *e) | Image Quality | Abrasion Wear μm |
| Ex. B-11 | 39 | 20 | B-1-1 | 0.25 | 115 | A*1 | 0.26 | 120 | A*1 | 2.7 |
| Ex. B-12 | 21 | 14 | B-1-1 | 0.30 | 110 | A | 0.35 | 125 | *2 | 3.8 |
| Ex. B-13 | 60 | 31 | B-1-1 | 0.21 | 120 | A | 0.21 | 115 | A | 3.5 |
| Com. Ex. B-6 | 18 | 10 | B-1-1 | 0.33 | 100 | A | 0.52 | 135 | *3 | 6.2 |
| Com. Ex. B-7 | 65 | 35 | B-1-1 | 0.21 | 130 | A | 0.20 | 115 | *4 | 4.7 |
| Ex. B-14 | 39 | 19 | B-1-1 | 0.19 | 120 | A | 0.21 | 135 | A | 2.7 |
| Ex. B-15 | 39 | 20 | B-1-2 | 0.25 | 100 | A | 0.27 | 125 | A | 2.7 |
| Ex. B-16 | 39 | 21 | B-1-5 | 0.26 | 105 | A | 0.27 | 125 | A | 2.8 |
| Ex. B-17 | 39 | 20 | B-1-9 | 0.25 | 100 | A | 0.27 | 120 | A | 2.7 |
| Ex. B-18 | 39 | 19 | B-1-13 | 0.25 | 100 | A | 0.26 | 125 | A | 2.9 |
| Ex. B-19 | 39 | 20 | B-2-1 | 0.25 | 100 | A | 0.27 | 120 | A | 2.8 |
| Ex. B-20 | 39 | 20 | B-2-4 | 0.24 | 105 | A | 0.25 | 125 | A | 2.9 |
| Ex. B-21 | 39 | 20 | B-2-8 | 0.24 | 100 | A | 0.26 | 120 | A | 2.9 |
| Ex. B-22 | 39 | 18 | B-2-9 | 0.25 | 105 | A | 0.25 | 120 | A | 2.8 |
| Ex. B-23 | 39 | 20 | B-2-10 | 0.25 | 100 | A | 0.26 | 125 | A | 2.7 |
| Ex. B-24 | 39 | 20 | B-2-13 | 0.25 | 100 | A | 0.27 | 125 | A | 2.8 |

*1Good
*2: Occurrence of inferior cleaning from about 80,000 th printings
*3: Occurrence of inferior cleaning from about 30,000 th printings
*4: Occurrence of image lags from about 90,000 th printings

TABLE B-3-1

| | | | | Durability Test C | | | | | | |
|---|---|---|---|---|---|---|---|---|---|---|
| | | | | Initial | | | Durability C: 100,0000 Sheets Printing | | | |
| Example | F-Resin Volume % *a) | F-Resin Covering Ratio *b) | Exemp. Comp. *c) | Skin-Friction *d) | Potential Illumi. (−V) *e) | Image Quality | Skin-Friction *d) | Potential Illumi. (−V) *e) | Image Quality | Abrasion Wear μm |
| Ex. B-1 | 39 | 20 | B-4 | 0.25 | 135 | A*1 | 0.29 | 140 | A*1 | 3.1 |
| Ex. B-2 | 21 | 14 | B-4 | 0.30 | 125 | A | 0.35 | 130 | *3 | 3.8 |
| Ex. B-3 | 60 | 31 | B-4 | 0.21 | 135 | A | 0.25 | 125 | A | 4.6 |
| Com. Ex. B-1 | 18 | 10 | B-4 | 0.33 | 120 | A | 0.61 | 140 | *4 | 6.4 |
| Com. Ex. B-2 | 65 | 35 | B-4 | 0.21 | 140 | A | 0.24 | 115 | *5 | 5.2 |
| Com. Ex. B-3 | 39 | 21 | — | 0.26 | 120 | A | 0.28 | 80 | *6 | 3.0 |

TABLE B-3-1-continued

| | | | | Durability Test C | | | | | | |
|---|---|---|---|---|---|---|---|---|---|---|
| | | | | Initial | | | Durability C: 100,0000 Sheets Printing | | | |
| Example | F-Resin Volume % *a) | F-Resin Covering Ratio *b) | Exemp. Comp. *c) | Skin-Friction *d) | Potential Illumi. (−V) *e) | Image Quality | Skin-Friction *d) | Potential Illumi. (−V) *e) | Image Quality | Abrasion Wear μm |
| Ex. B-4 | 39 | 19 | B-4 | 0.19 | 130 | A | 0.22 | 140 | A | 2.6 |
| Ex. B-5 | 39 | 20 | B-2 | 0.25 | 130 | A | 0.28 | 140 | A | 3.2 |
| Ex. B-6 | 39 | 21 | B-7 | 0.26 | 135 | A | 0.29 | 140 | A | 3.1 |
| Ex. B-7 | 39 | 20 | B-17 | 0.25 | 130 | A | 0.28 | 145 | A | 3.1 |
| Ex. B-8 | 39 | 19 | B-23 | 0.25 | 130 | A | 0.28 | 135 | A | 3.2 |
| Ex. B-9 | 39 | 20 | B-25 | 0.25 | 135 | A | 0.28 | 140 | A | 3.1 |
| Ex. B-10 | 39 | 20 | B-30 | 0.24 | 130 | A | 0.26 | 140 | A | 3.0 |
| Com. Ex. B-4 | 39 | 19 | Com.*2 1 | 0.25 | 190 | A | 0.29 | 280 | *7 | 3.3 |
| Com. Ex. B-5 | 39 | 20 | Com.*2 2 | 0.26 | 210 | A | 0.30 | 350 | *7 | 3.2 |

*1Good
*2Comparative compound
*3: Occurrence of inferior cleaning from about 40,000 th printings
*4: Occurrence of inferior cleaning from about 20,000 th printings
*5: Occurrence of image lags from about 40,000 th printings
*6: Occurrence of image lags from about 10,000 th printings
*7: Occurrence of haze in narrow lines from about 40,000 th printings

TABLE B-3-2

| | | | | Durability Test C | | | | | | |
|---|---|---|---|---|---|---|---|---|---|---|
| | | | | Initial | | | Durability C: 100,0000 Sheets Printing | | | |
| Example | F-Resin Volume % *a) | F-Resin Covering Ratio *b) | Exemp. Comp. *c) | Skin-Friction *d) | Potential Illumi. (−V) *e) | Image Quality | Skin-Friction *d) | Potential Illumi. (−V) *e) | Image Quality | Abrasion Wear μm |
| Ex. B-11 | 39 | 20 | B-1-1 | 0.25 | 135 | A*1 | 0.29 | 140 | A*1 | 3.1 |
| Ex. B-12 | 21 | 14 | B-1-1 | 0.30 | 125 | A | 0.35 | 130 | *2 | 3.8 |
| Ex. B-13 | 60 | 31 | B-1-1 | 0.21 | 135 | A | 0.25 | 125 | A | 4.6 |
| Com. Ex. B-6 | 18 | 10 | B-1-1 | 0.33 | 120 | A | 0.61 | 140 | *3 | 6.4 |
| Com. Ex. B-7 | 65 | 35 | B-1-1 | 0.21 | 140 | A | 0.24 | 115 | *4 | 5.2 |
| Ex. B-14 | 39 | 19 | B-1-1 | 0.19 | 130 | A | 0.22 | 150 | A | 2.6 |
| Ex. B-15 | 39 | 20 | B-1-2 | 0.25 | 130 | A | 0.28 | 135 | A | 3.2 |
| Ex. B-16 | 39 | 21 | B-1-5 | 0.26 | 125 | A | 0.29 | 130 | A | 3.1 |
| Ex. B-17 | 39 | 20 | B-1-9 | 0.25 | 120 | A | 0.28 | 125 | A | 3.1 |
| Ex. B-18 | 39 | 19 | B-1-13 | 0.25 | 120 | A | 0.28 | 130 | A | 3.2 |
| Ex. B-19 | 39 | 20 | B-2-1 | 0.25 | 125 | A | 0.28 | 130 | A | 3.1 |
| Ex. B-20 | 39 | 20 | B-2-4 | 0.25 | 120 | A | 0.26 | 130 | A | 3.0 |
| Ex. B-21 | 39 | 20 | B-2-8 | 0.24 | 120 | A | 0.26 | 125 | A | 3.1 |
| Ex. B-22 | 39 | 18 | B-2-9 | 0.25 | 120 | A | 0.27 | 125 | A | 3.1 |
| Ex. B-23 | 39 | 20 | B-2-10 | 0.25 | 120 | A | 0.28 | 125 | A | 3.2 |
| Ex. B-24 | 39 | 20 | B-2-13 | 0.25 | 120 | A | 0.27 | 125 | A | 3.1 |

*1Good
*2: Occurrence of inferior cleaning from about 40,000 th printings
*3: Occurrence of inferior cleaning from about 20,000 th printings
*4: Occurrence of image lags from about 40,000 th printings

Example C

The present invention will be further explained based on examples and comparative examples, being exemplary and explanatory only, with respect to photoconductors containing the compounds expressed by general formula (28) in the protective layer. All percentages and parts are by weight unless indicated otherwise.

The exemplified compounds incorporated into the protective layers in Example C correspond to the exemplified compounds in terms of each reference No. listed earlier as the specific examples of general formula (28).

Example C-1

Coating liquids for under-coating layer, charge-generating layer, and charge-transporting layer having the following compositions respectively, were coated by immersion coating and drying in turn on an aluminum cylinder, thereby an under-coating layer of 3.5 μm thick, charge-generating layer of 0.2 μm thick, and charge-transporting layer of 22 μm thick were formed.

-Coating Liquid for Under-Coating Layer-

| | |
|---|---|
| Titanium dioxide powder *1) | 400 parts |
| Melamine resin *2) | 65 parts |
| Alkyd resin *3) | 120 parts |
| 2-butanone | 400 parts |

*1) Tie Pail CR-EL, by Ishihara Sangyo Co. Ltd.
*2) Super Beckamine G-821-60, by Dainippon and Chemicals, Co.
*3) Becolite M6401-50, by Dainippon and Chemicals, Co.

-Coating Liquid for Charge-Generating Layer-

| | |
|---|---|
| Bisazo pigment shown below | 12 parts |
| Polyvinylbutyral | 5 parts |
| 2-butanone | 200 parts |
| Cyclohexanone | 400 parts |

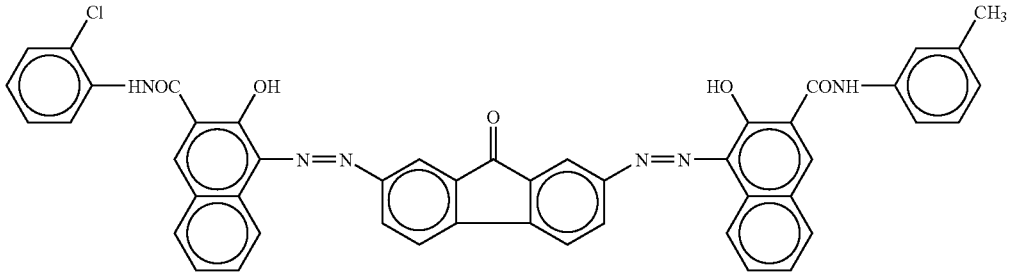

-Coating Liquid for Charge-Transporting Layer-

| | |
|---|---|
| Polycarbonate*1) | 8 parts |
| Charge-transporting substance shown below | 10 parts |
| Tetrahydrofuran | 100 parts |

*1)Z-polyca, by Teijinkasei Co.

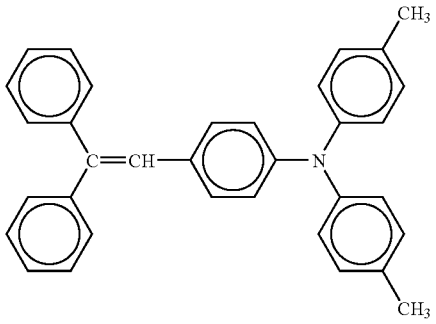

Further, a coating liquid for protective layer was prepared in the following composition; the coating liquid was readied for coating by circulating for 30 minutes at 100 MPa pressure using a high-speed collision dispersion apparatus (Ultimaizer HJP-25005, by Sugino Machine Limited) followed by ultrasonic dispersion for 10 minutes. Then, the coating liquid for protective layer was coated through spray coating by means of a spray gun (Peacecon PC308, by Olinpos Co., 2 kgf/cm$^2$ of air pressure) and drying at 30° C. for 60 minutes to form a protective layer of about 5 μm thick, thereby electrographic photoconductor 1 was prepared.

-Coating Liquid for Protective Layer-

| | |
|---|---|
| Particles of perfluoroalkoxy resin *1) | 5.5 parts |
| Dispersion Aid *2) | 1.0 part |
| Exemplified Compound C-1-1 | 0.4 part |
| Polycarbonate *3) | 4.0 parts |
| Tetrahydrofuran | 200 parts |
| Cyclohexanone | 60 parts |

*1) MPE-056, by Mitsui Fluorochemical Co.
*2) Modiper F210, by NOF Corporation
*3) Z-polyca, by Teijinkasei Co.

Example C-2

Electrophotographic photoconductor 2 was prepared in the same manner as Example C-1, except for changing the coating liquid for the protective layer as follows.

-Coating Liquid for Protective Layer-

| | |
|---|---|
| Particles of perfluoroalkoxy resin *1) | 3.3 parts |
| Dispersion Aid *2) | 1.0 part |
| Exemplified Compound C-1-1 | 0.4 part |
| Polycarbonate *3) | 6.4 parts |
| Tetrahydrofuran | 200 parts |
| Cyclohexanone | 60 parts |

*1) MPE-056, by Mitsui Fluorochemical Co.
*2) Modiper F210, by NOF Corporation
*3) Z-polyca, by Teijinkasei Co.

Example C-3

Electrophotographic photoconductor 3 was prepared in the same manner as Example C-1, except for changing the coating liquid for the protective layer as follows.

-Coating Liquid for Protective Layer-

| | |
|---|---|
| Particles of perfluoroalkoxy resin *1) | 7.4 parts |
| Dispersion Aid *2) | 1.0 part |
| Exemplified Compound C-1-1 | 0.4 part |
| Polycarbonate *3) | 2.3 parts |
| Tetrahydrofuran | 200 parts |
| Cyclohexanone | 60 parts |

*1) MPE-056, by Mitsui Fluorochemical Co.
*2) Modiper F210, by NOF Corporation
*3) Z-polyca, by Teijinkasei Co.

Comparative Example C-1

Comparative electrophotographic photoconductor 1 was prepared in the same manner as Example C-1, except for changing the coating liquid for the protective layer as follows.

-Coating Liquid for Protective Layer-

| | |
|---|---|
| Particles of perfluoroalkoxy resin *1) | 3.0 parts |
| Dispersion Aid *2) | 1.0 part |
| Exemplified Compound C-1-1 | 0.4 part |
| Polycarbonate *3) | 6.7 parts |
| Tetrahydrofuran | 200 parts |
| Cyclohexanone | 60 parts |

*1) MPE-056, by Mitsui Fluorochemical Co.
*2) Modiper F210, by NOF Corporation
*3) Z-polyca, by Teijinkasei Co.

Comparative Example C-2

Comparative electrophotographic photoconductor 2 was prepared in the same manner as Example C-1, except for changing the coating liquid for the protective layer as follows.

-Coating Liquid for Protective Layer-

| | |
|---|---|
| Particles of perfluoroalkoxy resin *1) | 7.8 parts |
| Dispersion Aid *2) | 1.0 part |
| Exemplified Compound C-1-1 | 0.4 part |
| Polycarbonate *3) | 1.9 parts |
| Tetrahydrofuran | 200 parts |
| Cyclohexanone | 60 parts |

*1) MPE-056, by Mitsui Fluorochemical Co.
*2) Modiper F210, by NOF Corporation
*3) Z-polyca, by Teijinkasei Co.

Example C-4

Electrophotographic photoconductor 4 was prepared in the same manner as Example C-1, except for changing the fine particles of perfluoroalkoxy resin in the coating liquid for protective layer into fine particles of tetrafluoroethylene resin (Lublon L-2, by Daikin Industries, is Ltd.).

Examples C-5 to C-7

Electrophotographic photoconductors 5 to 7 were prepared in the same manner as Example C-1, except for changing the exemplified compound in the coating liquid for protective layer into the respective compounds shown in Tables C-1-1 to C-3-2.

Examples C-8 to C-11

Electrophotographic photoconductors 8 to 11 were prepared in the same manner as Examples C-1 to C-4, except for changing the exemplified compound in the coating liquid for protective layer into the respective compounds shown in Tables C-1-1 to C-3-2.

Examples C-12 to C-14

Electrophotographic photoconductors 12 to 14 were prepared in the same manner as Example C-1, except for changing the exemplified compound in the coating liquid for protective layer into the respective compounds shown in Tables C-1-1 to C-3-2.

Comparative Examples C-3 and C-4

Comparative electrophotographic photoconductors 3 and 4 were prepared in the same manner as Comparative Examples C-1 and C-2, except for changing the exemplified compound in the coating liquid for protective layer into the respective compounds shown in Tables C-1-1 to C-3-2.

Comparative Example C-5

Comparative electrophotographic photoconductor 5 was prepared in the same manner as Example C-1, except for changing the coating liquid for the protective layer as follows.

-Coating Liquid for Protective Layer-

| | |
|---|---|
| Particles of perfluoroalkoxy resin *1) | 5.5 parts |
| Dispersion Aid *2) | 1.0 part |
| Polycarbonate *3) | 4.2 parts |
| Tetrahydrofuran | 200 parts |
| Cyclohexanone | 60 parts |

*1) MPE-056, by Mitsui Fluorochemical Co.
*2) Modiper F210, by NOF Corporation
*3) Z-polyca, by Teijinkasei Co.

Comparative Example C-6

Comparative electrophotographic photoconductors 6 was prepared in the same manner as Example C-1, except for changing the exemplified compound in the coating liquid for protective layer into the comparative compound 1 shown below.

Comparative Compound (1)

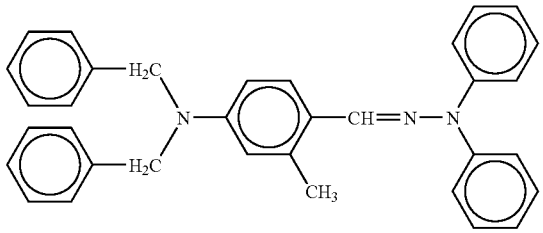

Comparative Example C-7

Comparative electrophotographic photoconductor 7 was prepared in the same manner as Example C-1, except for changing the exemplified compound in the coating liquid for protective layer into the comparative compound 2 shown below.

Comparative Compound (2)

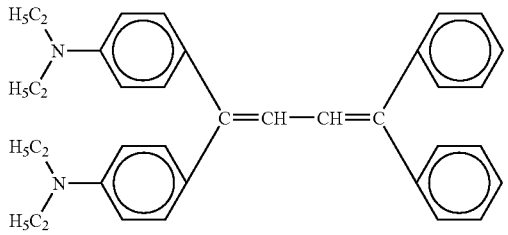

Toner Production Example 1

-Preparation of Composition Containing Monomer-

| | |
|---|---|
| Styrene Monomer | 70 parts |
| N-butylmethacrylate | 30 parts |
| Polystyrene | 5 parts |
| 3,5-di-tert-butyl zincsalicylate | 2 parts |
| Carbon black | 6 parts |

The above-noted ingredients were blended for 24 hours by means of a ball mill to prepare a polymerizable composition containing monomer.

-Granulation and Polymerization-

To a flask, which was equipped with a mixer, thermometer, inlet pipe of inactive gas, and porous glass tube of 10 mm Φ×50 mm having 110,000 Å of pore size and 0.42 cc/g of pore volume, 400 ml of 2% aqueous solution of polyvinyl alcohol was poured and stirred at ambient temperature while feeding nitrogen gas to replace the oxygen gas in the reaction vessel.

Separately, 1.56 grams of azobis isobutylnitrile was added to 113 grams of the composition containing monomer and was stirred to yield a mixture, then the mixture was passed through the porous glass tube by use of a pump thereby the mixture was added to the aqueous solution of polyvinyl alcohol. Then the mixed solution of the polyvinyl alcohol and the composition containing monomer was circulated for 2 hours at the rate of 120 ml/min while making it pass through the porous glass tube by use of a pump, thereafter the temperature inside the reactor vessel was raised to 70° C. thereby the mixture was allowed to polymerize for 8 hours.

Then, the content of the reaction vessel was allowed to cool to room temperature and allowed to stand overnight, thereafter the supernatant was removed then de-ionized water was poured additionally. After the content was stirred for one hour, was filtered and dried to prepare a toner. From the measurement by Coulter Counter, the toner exhibited 8.5 μm of average particle diameter and a narrow particle size distribution such that the particles in the range of 0 to 5 μm from the average particle diameter occupied 95% of the entire particles.

<Evaluation 1: Average Circularity>

The toner particles obtained in the Toner Production Example 1 were dispersed in water to prepare a suspension, the suspension was directed to pass through a plate-like image detecting region, where the particle images were detected by means of a CCD camera, then the average circularity was evaluated. The "average circularity" means the ratio between the peripheral length of corresponding circle having the same projected area and the peripheral length of the actual particle, i.e. (peripheral length of corresponding circle)÷(peripheral length of actual particle). This value can be measured as the average circularity using a flow-type particle image analyzing apparatus FPIA-2000. Specifically, a surfactant preferably 0.1 to 0.5 ml of alkyl benzene sulfonate is added into 100 to 150 ml of pure water of distilled or de-ionized water as dispersant, and the sample to be evaluated is added about 0.1 to 0.5 gram, the dispersion containing the sample is subjected to ultrasonic dispersing treatment for 1 to 3 minutes, and the dispersion concentration is adjusted in the range of 3000 to 10000 particles/microliter, then the measurement is conducted by the apparatus in the mode of shape and distribution. It has been demonstrated from the investigation until now that the toner having an average circularity of 0.960 or more is effective to provide images with high reproducibility and high precision, more preferably, the average circularity is 0.980 to 1.000. By the way, the average circularity of the toner prepared in the Toner Production Example 1 was 0.98.

<Evaluation 2: Covering Ratio>

The electrophotographic photoconductors of Examples 1 to 14 and Comparative Examples 1 to 7 were respectively sampled from their randomly selected 10 sites, and the surfaces of the sampled coatings were taken pictures with FE-SEM at 5000 times. From the SEM photographs and by means of an image processing software (Image Pro Plus), the fine particle number of fluorine-contained resin and each average diameter were obtained then the occupied area by the respective resin particles, thereby covering ratio of the particles was determined, wherein the covering ratio refers to the ratio of surface area where the fine particles of fluorine-contained resin exist within the entire photoconductor surface.

<Evaluation 3: Skin-Friction Coefficient>

As for the resulting inventive electrophotographic photoconductors 1 to 61 and comparative electrophotographic photoconductors 1 to 3, the respective skin-friction coefficients were measured using an Euler-belt system described in JP-A No. 9-166919. The belt referrers to a high quality paper with a moderate thickness that is tensioned on one-forth of photoconductor circular as shown in FIG. 9, wherein the longitudinal direction corresponds the paper-making direction. A balance weight 9*a* of 100 grams was attached to one end of the high quality paper belt 9*b*, and a force gauge (spring balance) 9*c* was attached to the other end of the high quality paper belt; the digital force gauge was slowly pulled, at the moment when the belt begun to move due to sliding of belt 9*b* on sample 9*d*, the weight indicated by the digital force gauge was read, and the coefficient of (static) friction was calculated from the following formula. In the formula, μ represents the friction coefficient, F represents the tensile stress, and W represents the load.

In the constitution shown in FIG. 9, a balance (100 grams), belt (Type 6200, long grain, A4 size paper, 30 mm width cut in paper-making direction), and two double clips were equipped.

$$\mu=2/\pi\times\ln(F/W)\quad W=100\text{ grams}$$

<Evaluation 4: Durable Life A>

As for the resulting inventive electrophotographic photoconductors 1 to 14 and comparative electrophotographic photoconductors 1 to 7, the respective photoconductors were mounted on modified-type Imagio Color 5100 (by Ricoh Company, Ltd., light source for image irradiation being changed to a semiconductor laser of wavelength 655 nm, and the unit for coating lubricant being removed), then 100,000 sheets of paper in total were printed sequentially using a ground toner (Imagio Color toner type S, circularity 0.91) which being often employed in evaluation apparatuses; and the initial images and 100,000 th printed images were evaluated. Further, the potential voltages at the illuminated parts were measured after the initial printing and the 100,000 th printing. Furthermore, the abrasion wears were evaluated from the difference of layer thicknesses between at the initial and the 100,000 th.

<Evaluation 5: Durable Life B>

As for the resulting inventive electrophotographic photoconductors 1 to 14 and comparative electrophotographic photoconductors 1 to 7, the respective photoconductors were mounted on modified-type Imagio Color 5100 (by Ricoh Company, Ltd., the toner being changed to that of Toner Production Example 1 described earlier, the light source for image irradiation being changed to a semiconductor laser of wavelength 655 nm, and the unit for coating lubricant being removed), then 100,000 sheets of paper in total were printed sequentially, and the initial images and 100,000 th printed images were evaluated. Further, the potential voltages at the illuminated parts were measured after the initial printing and the 100,000 th printing. Furthermore, the abrasion wears were evaluated from the difference of layer thicknesses between at the initial and the 100,000 th.

<Evaluation 6: Durable Life C>

As for the resulting inventive electrophotographic photoconductors 1 to 24 and comparative electrophotographic photoconductors 1 to 7, the respective photoconductors were mounted on Modified Imagio Color 8100 (by Ricoh Company, Ltd., the toner being changed to that of Toner Production Example 1), then 50,000 sheets of paper in total were printed sequentially, and the initial images and 50,000 th printed images were evaluated. Further, the potential voltages at the illuminated parts were measured after the initial printing and the 50,000 th printing. Furthermore, the abrasion wears were evaluated from the difference of layer thicknesses between at the initial and the 50,000 th.

TABLE C-1-1

| | | | | Durability Test A | | | | | | |
|---|---|---|---|---|---|---|---|---|---|---|
| | | | | Initial | | | Durability A: 100,0000 Sheets Printing | | | |
| Example | F-Resin Volume % *a) | F-Resin Covering Ratio *b) | Exemp. Comp. *c) | Skin-Friction *d) | Potential Illumi. (−V) *e) | Image Quality | Skin-Friction *d) | Potential Illumi. (−V) *e) | Image Quality | Abrasion Wear μm |
| Ex. C-1 | 39 | 20 | C-1-1 | 0.24 | 105 | A*1 | 0.27 | 130 | A*1 | 2.7 |
| Ex. C-2 | 21 | 14 | C-1-1 | 0.30 | 100 | A | 0.37 | 135 | A | 3.8 |
| Ex. C-3 | 60 | 31 | C-1-1 | 0.21 | 110 | A | 0.21 | 125 | A | 3.4 |
| Com. Ex. C-1 | 18 | 10 | C-1-1 | 0.32 | 95 | A | 0.52 | 150 | *2 | 4.3 |
| Com. Ex. C-2 | 65 | 35 | C-1-1 | 0.22 | 125 | A | 0.22 | 120 | *3 | 4.5 |
| Ex. C-4 | 39 | 19 | C-1-1 | 0.21 | 115 | A | 0.23 | 145 | A | 2.6 |
| Ex. C-5 | 39 | 20 | C-1-4 | 0.24 | 105 | A | 0.27 | 130 | A | 2.5 |
| Ex. C-6 | 39 | 21 | C-1-8 | 0.25 | 110 | A | 0.28 | 135 | A | 2.6 |
| Ex. C-7 | 39 | 19 | C-1-10 | 0.25 | 105 | A | 0.27 | 135 | A | 2.5 |
| Ex. C-8 | 39 | 21 | C-2-1 | 0.25 | 100 | A | 0.26 | 120 | A | 2.6 |
| Ex. C-9 | 21 | 13 | C-2-1 | 0.30 | 95 | A | 0.36 | 125 | A | 3.6 |
| Ex. C-10 | 60 | 30 | C-2-1 | 0.20 | 105 | A | 0.22 | 115 | A | 3.3 |

*1Good

*2: Occurrence of inferior cleaning from about 50,000 th printings

*3: Occurrence of image lags from about 90,000 th printings

TABLE C-1-2

| | | | | Durability Test A | | | | | | |
|---|---|---|---|---|---|---|---|---|---|---|
| | | | | Initial | | | Durability A: 100,0000 Sheets Printing | | | |
| Example | F-Resin Volume % *a) | F-Resin Covering Ratio *b) | Exemp. Comp. *c) | Skin-Friction *d) | Potential Illumi. (−V) *e) | Image Quality | Skin-Friction *d) | Potential Illumi. (−V) *e) | Image Quality | Abrasion Wear μm |
| Com. Ex. C-3 | 18 | 9 | C-2-1 | 0.33 | 90 | A*1 | 0.51 | 140 | *3 | 4.2 |
| Com. Ex. C-4 | 65 | 35 | C-2-1 | 0.21 | 120 | A | 0.21 | 110 | *4 | 4.5 |
| Ex. C-11 | 39 | 19 | C-2-1 | 0.21 | 110 | A | 0.23 | 135 | A | 2.5 |
| Ex. C-12 | 39 | 19 | C-2-2 | 0.25 | 100 | A | 0.27 | 120 | A | 2.4 |
| Ex. C-13 | 39 | 20 | C-2-6 | 0.25 | 105 | A | 0.28 | 125 | A | 2.6 |
| Ex. C-14 | 39 | 19 | C-2-11 | 0.25 | 100 | A | 0.27 | 125 | A | 2.5 |
| Com. Ex. C-5 | 39 | 21 | — | 0.26 | 100 | A | 0.28 | 85 | *5 | 2.6 |

TABLE C-1-2-continued

| | | | | Durability Test A | | | | | | |
|---|---|---|---|---|---|---|---|---|---|---|
| | | | | Initial | | | Durability A: 100,0000 Sheets Printing | | | |
| Example | F-Resin Volume % *a) | F-Resin Covering Ratio *b) | Exemp. Comp. *c) | Skin-Friction *d) | Potential Illumi. (−V) *e) | Image Quality | Skin-Friction *d) | Potential Illumi. (−V) *e) | Image Quality | Abrasion Wear μm |
| Com. Ex. C-6 | 39 | 19 | Com.*2 1 | 0.25 | 180 | A | 0.27 | 260 | *6 | 2.7 |
| Com. Ex. C-7 | 39 | 20 | Com.*2 2 | 0.26 | 200 | A | 0.28 | 310 | *7 | 2.7 |

*1Good
*2Comparative compound
*3: Occurrence of inferior cleaning from about 50,000 th printings
*4: Occurrence of image lags from about 90,000 th printings
*5: Occurrence of image lags from about 20,000 th printings
*6: Occurrence of haze in narrow lines from about 70,000 th printings
*7: Occurrence of haze in narrow lines from about 60,000 th printings The evaluation results shown in Tables C-1-1 and C-1-2 demonstrate that the inclusions of the fine particles of fluorine-contained resin in the range of 20 to 60% by volume as well as a specific compound into the outermost surface layer of the photoconductor make possible to maintain the lower skin-friction coefficient stably. Further, it is confirmed that the abrasion wear is reduced i.e. the abrasion resistance is remarkably improved. Further, the increase of the potential at the illuminated part is not significant even after the 100,000 th printing, the lag occurrence is not apparent in the photoconductors that were added specific amine compounds, as such it is confirmed that high quality images may be obtained stably.

On the other hand, cleaning failures and/or lag occurrences were induced in the photoconductors that did not satisfy the range of 20 to 60% by volume of fine particles of fluorine-contained resin or that did not contain specific amine compound.

TABLE C-2-1

| | | | | Durability Test B | | | | | | |
|---|---|---|---|---|---|---|---|---|---|---|
| | | | | Initial | | | Durability B: 100,0000 Sheets Printing | | | |
| Example | F-Resin Volume % *a) | F-Resin Covering Ratio *b) | Exemp. Comp. *c) | Skin-Friction *d) | Potential Illumi. (−V) *e) | Image Quality | Skin-Friction *d) | Potential Illumi. (−V) *e) | Image Quality | Abrasion Wear μm |
| Ex. C-1 | 39 | 20 | C-1-1 | 0.24 | 105 | A*1 | 0.26 | 130 | A*1 | 2.8 |
| Ex. C-2 | 21 | 14 | C-1-1 | 0.30 | 100 | A | 0.35 | 135 | *2 | 4.0 |
| Ex. C-3 | 60 | 31 | C-1-1 | 0.21 | 110 | A | 0.21 | 125 | A | 3.5 |
| Com. Ex. C-1 | 18 | 10 | C-1-1 | 0.32 | 95 | A | 0.52 | 150 | *3 | 6.3 |
| Com. Ex. C-2 | 65 | 35 | C-1-1 | 0.22 | 125 | A | 0.22 | 120 | *4 | 4.8 |
| Ex. C-4 | 39 | 19 | C-1-1 | 0.21 | 115 | A | 0.23 | 145 | A | 2.7 |
| Ex. C-5 | 39 | 20 | C-1-4 | 0.24 | 105 | A | 0.27 | 130 | A | 2.6 |
| Ex. C-6 | 39 | 21 | C-1-8 | 0.25 | 110 | A | 0.28 | 135 | A | 2.8 |
| Ex. C-7 | 39 | 19 | C-1-10 | 0.25 | 105 | A | 0.27 | 135 | A | 2.7 |
| Ex. C-8 | 39 | 21 | C-2-1 | 0.25 | 100 | A | 0.26 | 120 | A | 2.7 |
| Ex. C-9 | 21 | 13 | C-2-1 | 0.30 | 95 | A | 0.36 | 125 | *2 | 3.9 |

*1Good
*2: Occurrence of inferior cleaning from about 80,000 th printings
*3: Occurrence of inferior cleaning from about 30,000 th printings
*4: Occurrence of image lags from about 90,000 th printings

TABLE C-2-2

| | | | | Durability Test B | | | | | | |
|---|---|---|---|---|---|---|---|---|---|---|
| | | | | Initial | | | Durability B: 100,0000 Sheets Printing | | | |
| Example | F-Resin Volume % *a) | F-Resin Covering Ratio *b) | Exemp. Comp. *c) | Skin-Friction *d) | Potential Illumi. (−V) *e) | Image Quality | Skin-Friction *d) | Potential Illumi. (−V) *e) | Image Quality | Abrasion Wear μm |
| Ex. C-10 | 60 | 30 | C-2-1 | 0.20 | 105 | A*1 | 0.22 | 115 | A*1 | 3.4 |
| Com. Ex. C-3 | 18 | 9 | C-2-1 | 0.33 | 90 | A | 0.51 | 140 | *3 | 6.2 |
| Com. Ex. C-4 | 65 | 35 | C-2-1 | 0.21 | 120 | A | 0.21 | 110 | *4 | 4.5 |
| Ex. C-11 | 39 | 19 | C-2-1 | 0.21 | 110 | A | 0.23 | 135 | A | 2.7 |
| Ex. C-12 | 39 | 19 | C-2-2 | 0.25 | 100 | A | 0.27 | 120 | A | 2.6 |
| Ex. C-13 | 39 | 20 | C-2-6 | 0.25 | 105 | A | 0.28 | 125 | A | 2.8 |
| Ex. C-14 | 39 | 19 | C-2-11 | 0.25 | 100 | A | 0.27 | 125 | A | 2.6 |

TABLE C-2-2-continued

| Example | F-Resin Volume % *a) | F-Resin Covering Ratio *b) | Exemp. Comp. *c) | Durability Test B: Initial Skin-Friction *d) | Initial Potential Illumi. (−V) *e) | Initial Image Quality | Durability B: 100,0000 Sheets Printing Skin-Friction *d) | Durability B: 100,0000 Sheets Printing Potential Illumi. (−V) *e) | Durability B: 100,0000 Sheets Printing Image Quality | Durability B: 100,0000 Sheets Printing Abrasion Wear μm |
|---|---|---|---|---|---|---|---|---|---|---|
| Com. Ex. C-5 | 39 | 21 | — | 0.26 | 100 | A | 0.27 | 85 | *5 | 2.6 |
| Com. Ex. C-6 | 39 | 19 | Com.*2 1 | 0.25 | 180 | A | 0.27 | 270 | *6 | 2.9 |
| Com. Ex. C-7 | 39 | 20 | Com.*2 2 | 0.26 | 200 | A | 0.28 | 330 | *7 | 3.0 |

*1Good
*2Comparative compound
*3: Occurrence of inferior cleaning from about 50,000 th printings
*4: Occurrence of image lags from about 90,000 th printings
*5: Occurrence of image lags from about 20,000 th printings
*6: Occurrence of haze in narrow lines from about 70,000 th printings
*7: Occurrence of haze in narrow lines from about 60,000 th printings The results shown in Tables C-2-1 and C-2-2 demonstrate that that the inclusions of the fine particles of fluorine-contained resin in the range of 20 to 60% by volume as well as certain compound into the outermost surface layer of the photoconductor make possible to maintain the lower skin-friction coefficient stably, even when a toner having substantially spherical shape is employed. Further, it is confirmed that the abrasion wear is reduced and the abrasion resistance is remarkably improved. Further, the increase of the potential at the illuminated part was not significant even after the 100,000 th printing, the lag occurrence was not apparent in the photoconductors that were added specific amine compounds, as such it is confirmed that high quality images may be obtained stably.

On the other hand, cleaning failures and/or lag occurrences were induced in the photoconductors that did not satisfy the range of 20 to 60% by volume of fine particles of fluorine-contained resin or that did not contain a specific compound.

TABLE C-3-1

| Example | F-Resin Volume % *a) | F-Resin Covering Ratio *b) | Exemp. Comp. *c) | Durability Test C: Initial Skin-Friction *d) | Initial Potential Illumi. (−V) *e) | Initial Image Quality | Durability C: 100,0000 Sheets Printing Skin-Friction *d) | Durability C: 100,0000 Sheets Printing Potential Illumi. (−V) *e) | Durability C: 100,0000 Sheets Printing Image Quality | Durability C: 100,0000 Sheets Printing Abrasion Wear μm |
|---|---|---|---|---|---|---|---|---|---|---|
| Ex. C-1 | 39 | 20 | C-1-1 | 0.24 | 130 | A*1 | 0.30 | 135 | A*1 | 3.1 |
| Ex. C-2 | 21 | 14 | C-1-1 | 0.30 | 125 | A | 0.37 | 140 | *2 | 3.8 |
| Ex. C-3 | 60 | 31 | C-1-1 | 0.21 | 135 | A | 0.26 | 125 | A | 4.6 |
| Com. Ex. C-1 | 18 | 10 | C-1-1 | 0.32 | 120 | A | 0.62 | 150 | *3 | 6.4 |
| Com. Ex. C-2 | 65 | 35 | C-1-1 | 0.22 | 145 | A | 0.26 | 120 | *4 | 5.4 |
| Ex. C-4 | 39 | 19 | C-1-1 | 0.21 | 135 | A | 0.23 | 165 | A | 2.7 |
| Ex. C-5 | 39 | 20 | C-1-4 | 0.24 | 135 | A | 0.28 | 130 | A | 3.2 |
| Ex. C-6 | 39 | 21 | C-1-8 | 0.25 | 130 | A | 0.29 | 135 | A | 3.1 |
| Ex. C-7 | 39 | 19 | C-1-10 | 0.25 | 135 | A | 0.29 | 135 | A | 3.0 |
| Ex. C-8 | 39 | 21 | C-2-1 | 0.25 | 125 | A | 0.29 | 130 | A | 3.0 |
| Ex. C-9 | 21 | 13 | C-2-1 | 0.30 | 120 | A | 0.35 | 135 | *2 | 3.7 |

*1Good
*2: Occurrence of inferior cleaning from about 40,000 th printings
*3: Occurrence of inferior cleaning from about 20,000 th printings
*4: Occurrence of image lags from about 40,000 th printings

TABLE C-3-2

| Example | F-Resin Volume % *a) | F-Resin Covering Ratio *b) | Exemp. Comp. *c) | Durability Test C: Initial Skin-Friction *d) | Initial Potential Illumi. (−V) *e) | Initial Image Quality | Durability C: 100,0000 Sheets Printing Skin-Friction *d) | Durability C: 100,0000 Sheets Printing Potential Illumi. (−V) *e) | Durability C: 100,0000 Sheets Printing Image Quality | Durability C: 100,0000 Sheets Printing Abrasion Wear μm |
|---|---|---|---|---|---|---|---|---|---|---|
| Ex. C-10 | 60 | 30 | C-2-1 | 0.20 | 130 | A*1 | 0.25 | 120 | A*1 | 4.5 |
| Com. Ex. C-3 | 18 | 9 | C-2-1 | 0.33 | 115 | A | 0.61 | 140 | *3 | 6.3 |
| Com. Ex. C-4 | 65 | 35 | C-2-1 | 0.21 | 140 | A | 0.24 | 110 | *4 | 5.3 |
| Ex. C-11 | 39 | 19 | C-2-1 | 0.21 | 130 | A | 0.22 | 160 | A | 2.6 |
| Ex. C-12 | 39 | 19 | C-2-2 | 0.25 | 130 | A | 0.28 | 130 | A | 3.2 |

TABLE C-3-2-continued

| | | | | Durability Test C | | | | | | |
|---|---|---|---|---|---|---|---|---|---|---|
| | | | | Initial | | | Durability C: 100,0000 Sheets Printing | | | |
| Example | F-Resin Volume % *a) | F-Resin Covering Ratio *b) | Exemp. Comp. *c) | Skin-Friction *d) | Potential Illumi. (−V) *e) | Image Quality | Skin-Friction *d) | Potential Illumi. (−V) *e) | Image Quality | Abrasion Wear μm |
| Ex. C-13 | 39 | 20 | C-2-6 | 0.25 | 135 | A | 0.29 | 135 | A | 3.1 |
| Ex. C-14 | 39 | 19 | C-2-11 | 0.25 | 130 | A | 0.28 | 135 | A | 3.0 |
| Com. Ex. C-5 | 39 | 21 | — | 0.26 | 120 | A | 0.28 | 80 | *5 | 3.0 |
| Com. Ex. C-6 | 39 | 19 | Com.*2 1 | 0.25 | 190 | A | 0.29 | 280 | *6 | 3.3 |
| Com. Ex. C-7 | 39 | 20 | Com.*2 2 | 0.26 | 210 | A | 0.30 | 350 | *6 | 3.2 |

*1 Good
*2 Comparative compound
*3: Occurrence of inferior cleaning from about 20,000 th printings
*4: Occurrence of image lags from about 40,000 th printings
*5: Occurrence of image lags from about 10,000 th printings
*6: Occurrence of haze in narrow lines from about 40,000 th printings The results shown in Tables C-3-1 and C-3-2 demonstrate that that the inclusions of the fine particles of fluorine-contained resin in the range of 20 to 60% by volume as well as a specific compound into the outermost surface layer of the photoconductor make possible to maintain the lower skin-friction coefficient stably, even when a toner having substantially spherical shape is employed. Further, it is confirmed that the abrasion wear is reduced i.e. the abrasion resistance is remarkably improved. Further, the increase of the potential at the illuminated part is not significant even after the 100,000 th printing, the lag occurrence is not apparent in the photoconductors that were added specific amine compounds, as such it is confirmed that high quality images may be obtained stably.

On the other hand, cleaning failures and/or lag occurrences were induced in the photoconductors that did not satisfy the range of 20 to 60% by volume of fine particles of fluorine-contained resin or that did not contain a specific compound.

Example D

The present invention will be further explained based on examples and comparative examples, being exemplary and explanatory only, with respect to photoconductors containing the compounds expressed by general formulas (101) to (112) in the protective layer. All percentages and parts are by weight unless indicated otherwise.

The exemplified compounds incorporated into the protective layers in Example D correspond to the exemplified compounds in terms of each reference No. listed earlier as the specific examples of general formulas (101) to (112).

Example D-1

Coating liquids for under-coating layer, charge-generating layer, and charge-transporting layer having the following compositions respectively, were coated individually by immersion coating and drying in turn on an aluminum cylinder, thereby an under-coating layer of 3.5 μm thick, charge-generating layer of 0.2 μm thick, and charge-transporting layer of 22 μm thick were formed.

-Coating Liquid for Under-Coating Layer-

| | |
|---|---|
| Titanium dioxide powder *1) | 400 parts |
| Melamine resin *2) | 65 parts |
| Alkyd resin *3) | 120 parts |
| 2-butanone | 400 parts |

*1) Tie Pail CR-EL, by Ishihara Sangyo Co. Ltd.
*2) Super Beckamine G-821-60, by Dainippon and Chemicals, Co.
*3) Becolite M6401-50, by Dainippon and Chemicals, Co.

-Coating Liquid for Charge-Generating Layer-

| | |
|---|---|
| Bisazo pigment shown below | 12 parts |
| Polyvinylbutyral | 5 parts |
| 2-butanone | 200 parts |
| Cyclohexanone | 400 parts |

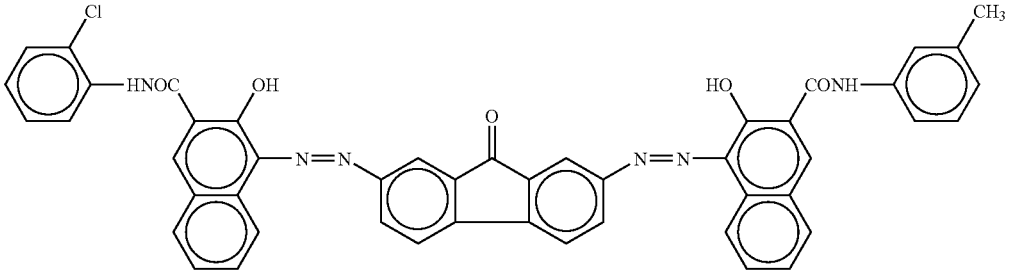

-Coating Liquid for Charge-Transporting Layer-

| | |
|---|---|
| Polycarbonate*1) | 8 parts |
| Charge-transferring substance shown below | 10 parts |
| Tetrahydrofuran | 100 parts |

*1)Z-polyca, by Teijinkasei Co.

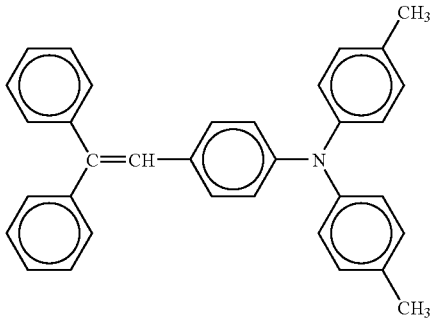

Further, a coating liquid for protective layer was prepared in the following composition; the coating liquid was readied for coating by circulating for 30 minutes at 100 MPa pressure using a high-speed collision dispersion apparatus (Ultimaizer HJP-25005, by Sugino Machine Limited) followed by ultrasonic dispersion for 10 minutes. Then, the coating liquid for protective layer was coated through spray coating by means of a spray gun (Peacecon PC308, by Olinpos Co., 2 kgf/cm$^2$ of air pressure) and drying at 30° C. for 60 minutes to form a protective layer of about 5 μm thick, thereby electrographic photoconductor 1 was prepared.

-Coating Liquid for Protective Layer-

| | |
|---|---|
| Particles of perfluoroalkoxy resin *1) | 5.5 parts |
| Dispersion Aid *2) | 1.0 part |
| Hydroxy aromatic compound *3) | 0.2 part |
| Polycarbonate *4) | 4.2 parts |
| Tetrahydrofuran | 200 parts |
| Cyclohexanone | 60 parts |

*1) MPE-056, by Mitsui Fluorochemical Co.
*2) Modiper F210, by NOF Corporation
*3) Exemplified compound D-2-20
*4) Z-polyca, by Teijinkasei Co.

Example D-2

Electrophotographic photoconductor 2 was prepared in the same manner as Example D-1, except for changing the coating liquid for the protective layer as follows.

-Coating Liquid for Protective Layer-

| | |
|---|---|
| Particles of perfluoroalkoxy resin *1) | 3.3 parts |
| Dispersion Aid *2) | 1.0 part |
| Hydroxy aromatic compound *3) | 0.2 part |
| Polycarbonate *4) | 6.4 parts |
| Tetrahydrofuran | 200 parts |
| Cyclohexanone | 60 parts |

*1) MPE-056, by Mitsui Fluorochemical Co.
*2) Modiper F210, by NOF Corporation
*3) Exemplified compound D-2-20
*4) Z-polyca, by Teijinkasei Co.

Example D-3

Electrophotographic photoconductor 3 was prepared in the same manner as Example D-1, except for changing the coating liquid for the protective layer as follows.

-Coating Liquid for Protective Layer-

| | |
|---|---|
| Particles of perfluoroalkoxy resin *1) | 7.4 parts |
| Dispersion Aid *2) | 1.0 part |
| Hydroxy aromatic compound *3) | 0.2 part |
| Polycarbonate *4) | 2.3 parts |
| Tetrahydrofuran | 200 parts |
| Cyclohexanone | 60 parts |

*1) MPE-056, by Mitsui Fluorochemical Co.
*2) Modiper F210, by NOF Corporation
*3) Exemplified compound D-2-20
*4) Z-polyca, by Teijinkasei Co.

Comparative Example D-1

Comparative electrophotographic photoconductor 1 was prepared in the same manner as Example D-1, except for changing the coating liquid for the protective layer as follows.

-Coating Liquid for Protective Layer-

| | |
|---|---|
| Particles of perfluoroalkoxy resin *1) | 3.0 parts |
| Dispersion Aid *2) | 1.0 part |
| Hydroxy aromatic compound *3) | 0.2 part |
| Polycarbonate *4) | 6.7 parts |
| Tetrahydrofuran | 200 parts |
| Cyclohexanone | 60 parts |

*1) MPE-056, by Mitsui Fluorochemical Co.
*2) Modiper F210, by NOF Corporation
*3) Exemplified compound D-2-20
*4) Z-polyca, by Teijinkasei Co.

Comparative Example D-2

Comparative electrophotographic photoconductor 2 was prepared in the same manner as Example D-1, except for changing the coating liquid for the protective layer as follows.

-Coating Liquid for Protective Layer-

| | |
|---|---|
| Particles of perfluoroalkoxy resin *1) | 7.8 parts |
| Dispersion Aid *2) | 1.0 part |
| Hydroxy aromatic compound *3) | 0.2 part |
| Polycarbonate *4) | 1.9 parts |
| Tetrahydrofuran | 200 parts |
| Cyclohexanone | 60 parts |

*1) MPE-056, by Mitsui Fluorochemical Co.
*2) Modiper F210, by NOF Corporation
*3) Exemplified compound D-2-20
*4) Z-polyca, by Teijinkasei Co.

Comparative Example D-3

Comparative electrophotographic photoconductor 3 was prepared in the same manner as Example D-1, except for changing the coating liquid for the protective layer as follows.

-Coating Liquid for Protective Layer-

| | |
|---|---|
| Particles of perfluoroalkoxy resin *1) | 5.5 parts |
| Dispersion Aid *2) | 1.0 part |
| Polycarbonate *3) | 4.2 parts |
| Tetrahydrofuran | 200 parts |
| Cyclohexanone | 60 parts |

*1) MPE-056, by Mitsui Fluorochemical Co.
*2) Modiper F210, by NOF Corporation
*3) Z-polyca, by Teijinkasei Co.

Example D-4

Electrophotographic photoconductor 4 was prepared in the same manner as Example D-1, except for changing the hydroxy aromatic compound into the exemplified compound D-1-13.

Example D-5

Electrophotographic photoconductor 5 was prepared in the same manner as Example D-1, except for changing the hydroxy aromatic compound into the exemplified compound D-2-2.

Example D-6

Electrophotographic photoconductor 6 was prepared in the same manner as Example D-1, except for changing the hydroxy aromatic compound into the exemplified compound D-3-1.

Example D-7

Electrophotographic photoconductor 7 was prepared in the same manner as Example D-1, except for changing the hydroxy aromatic compound into the exemplified compound D-3-20.

Example D-8

Electrophotographic photoconductor 8 was prepared in the same manner as Example D-1, except for changing the hydroxy aromatic compound into the exemplified compound D-5-49.

Example D-9

Electrophotographic photoconductor 9 was prepared in the same manner as Example D-1, except for changing the hydroxy aromatic compound into the exemplified compound D-5-72.

Example D-10

Electrophotographic photoconductor 10 was prepared in the same manner as Example D-1, except for changing the hydroxy aromatic compound into the exemplified compound D-6-6.

Example D-11

Electrophotographic photoconductor 11 was prepared in the same manner as Example D-1, except for changing the hydroxy aromatic compound into the exemplified compound D-7-18.

Example D-12

Electrophotographic photoconductor 12 was prepared in the same manner as Example D-1, except for changing the hydroxy aromatic compound into the exemplified compound D-8-23.

Example D-13

Electrophotographic photoconductor 13 was prepared in the same manner as Example D-1, except for changing the hydroxy aromatic compound into the exemplified compound D-9-1.

Example D-14

Electrophotographic photoconductor 14 was prepared in the same manner as Example D-1, except for changing the hydroxy aromatic compound into the exemplified compound D-10-6.

Example D-15

Electrophotographic photoconductor 15 was prepared in the same manner as Example D-1, except for changing the hydroxy aromatic compound into the exemplified compound D-10-21.

Example D-16

Electrophotographic photoconductor 16 was prepared in the same manner as Example D-1, except for changing the hydroxy aromatic compound into the exemplified compound D-11-2.

Example D-17

Electrophotographic photoconductor 17 was prepared in the same manner as Example D-1, except for changing the hydroxy aromatic compound into the exemplified compound D-11-20.

Example D-18

Electrophotographic photoconductor 18 was prepared in the same manner as Example D-1, except for changing the hydroxy aromatic compound into the exemplified compound D-12-4.

Reference Example D-1

Comparative electrophotographic photoconductor 4 was prepared in the same manner as Example D-1, except for changing the hydroxy aromatic compound into 3,5-di-t-butyl-4-hydroxytoluene (by Tokyo Kasei Kogyo Co.).

Reference Example D-2

Comparative electrophotographic photoconductor 5 was prepared in the same manner as Example D-1, except for changing the hydroxy aromatic compound into Sumiraizer MDP-S (by Sumitomo Chemical Co.).

Reference Example D-3

Comparative electrophotographic photoconductor 6 was prepared in the same manner as Example D-1, except for changing the hydroxy aromatic compound into Sumiraizer TPM (by Sumitomo Chemical Co.).

Reference Example D-4

Comparative electrophotographic photoconductor 7 was prepared in the same manner as Example D-1, except for changing the hydroxy aromatic compound into Sanol LS-2626 (by Sankyo Co. Ltd.).

Reference Example D-5

Comparative electrophotographic photoconductor 8 was prepared in the same manner as Example D-1, except for changing the hydroxy aromatic compound into MARK PEP-24 (by Asahi Denka Co. Ltd.).

Reference Example D-6

Comparative electrophotographic photoconductor 9 was prepared in the same manner as Example D-1, except for changing the hydroxy aromatic compound into IRGANOX-1330 (by Ciba-Geigy Ltd.).

Example D-19

Electrophotographic photoconductor 19 was prepared in the same manner as Example D-1, except for changing the fine particles of perfluoroalkoxy resin into fine particles of tetrafluoroethylene resin (Lublon L-2, by Daikin Industries, Ltd.).

Toner Production Example 1

-Preparation of Composition Containing Monomer-

| | |
|---|---|
| Styrene Monomer | 70 parts |
| N-butylmethacrylate | 30 parts |
| Polystyrene | 5 parts |
| 3,5-di-tert-butyl zincsalicylate | 2 parts |
| Carbon black | 6 parts |

The above-noted ingredients were blended for 24 hours by means of a ball mill to prepare a polymerizable composition containing monomer.

-Granulation and Polymerization-

To a flask, which was equipped with a mixer, thermometer, inlet pipe of inactive gas, and porous glass tube of 10 mm Φ×50 mm having 110,000 Å of pore size and 0.42 cc/g of pore volume, 400 ml of 2% aqueous solution of polyvinyl alcohol was poured and stirred at ambient temperature while feeding nitrogen gas to replace the oxygen gas in the reaction vessel.

Separately, 1.56 grams of azobis isobutylnitrile was added to 113 grams of the composition containing monomer and was stirred to yield a mixture, then the mixture was passed through the porous glass tube by use of a pump thereby the mixture was added to the aqueous solution of polyvinyl alcohol. Then the mixed solution of the polyvinyl alcohol and the composition containing monomer was circulated for 2 hours at the rate of 120 ml/min while making it pass through the porous glass tube by use of a pump, thereafter the temperature inside the reactor vessel was raised to 70° C. thereby the mixture was allowed to polymerize for 8 hours.

Then, the content of the reaction vessel was cooled to room temperature and allowed to stand overnight, thereafter the supernatant was removed then de-ionized water was poured additionally. After the content was stirred for one hour, was filtered and dried to prepare a toner. From the measurement by Coulter Counter, the toner exhibited 8.5 μm of average particle diameter and a narrow particle size distribution such that the particles in the range of 0 to 5 μm from the average particle diameter occupied 95% of the entire particles.

<Evaluation 1: Average Circularity>

The toner particles obtained in the Toner Production Example 1 were dispersed in water to prepare a suspension, the suspension was directed to pass through a plate-like image detecting region, where the particle images were detected by means of a CCD camera, then the average circularity was evaluated. The "average circularity" means the ratio between the peripheral length of corresponding circle having the same projected area and the peripheral length of the actual particle, i.e. (peripheral length of corresponding circle)÷(peripheral length of actual particle). This value can be measured as the average circularity using a flow-type particle image analyzing apparatus FPIA-2000. Specifically, a surfactant preferably 0.1 to 0.5 ml of alkyl benzene sulfonate is added into 100 to 150 ml of pure water of distilled or de-ionized water as dispersant, and the sample to be evaluated is added about 0.1 to 0.5 gram, the dispersion containing the sample is subjected to ultrasonic dispersing treatment for 1 to 3 minutes, and the dispersion concentration is adjusted in the range of 3000 to 10000 particles/microliter, then the measurement is conducted by the apparatus in the mode of shape and distribution. It has been demonstrated from the investigation until now that the toner having an average circularity of 0.960 or more is effective to provide images with high reproducibility and high precision, more preferably, the average circularity is 0.980 to 1.000. By the way, the average circularity of the toner prepared in the Toner Production Example 1 was 0.98.

<Evaluation 2: Covering Ratio>

The electrophotographic photoconductors of Examples 1 to 18 and Comparative Examples 1 to 9 were respectively sampled from their randomly selected 10 sites, and the surfaces of the sampled coatings were taken pictures with FE-SEM at 5000 times. From the SEM photographs and by means of an image processing software (Image Pro Plus), the fine particle number of fluorine-contained resin, average diameter of each particle, area and covering ratio of the particles was determined, wherein the covering ratio refers to the ratio of surface area where the fine particles of fluorine-contained resin exist within the entire photoconductor surface.

<Evaluation 3: Skin-Friction Coefficient>

As for the resulting inventive electrophotographic photoconductors 1 to 61 and comparative electrophotographic photoconductors 1 to 3, the respective skin-friction coefficients were measured using an Euler-belt system described in JP-A No. 9-166919. The belt referrers to a high quality paper with a moderate thickness that is tensioned on one-forth of photoconductor circular as shown in FIG. 9, wherein the longitudinal direction corresponds the paper-making direction. A balance weight 9*a* of 100 grams was attached to one end of the high quality paper belt 9*b*, and a force gauge (spring balance) 9*c* was attached to the other end of the high quality paper belt; the digital force gauge was slowly pulled, at the moment when the belt begun to move due to sliding of belt 9*b* on sample 9*d*, the weight indicated by the digital force gauge was read, and the coefficient of (static) friction was calculated from the following formula. In the formula, μ represents the friction coefficient, F represents the tensile stress, and W represents the load. In the constitution shown in FIG. 9, a balance (100 grams), belt (Type 6200, long grain, A4 size paper, 30 mm width cut in paper-making direction), and two double clips were equipped.

$$\mu=2/\pi\times\ln(F/W)\quad W=100\text{ grams}$$

<Evaluation 4: Durable Life A>

As for the resulting inventive electrophotographic photoconductors 1 to 18 and comparative electrophotographic photoconductors 1 to 9, the respective photoconductors were mounted on modified-type Imagio Color 5100 (by Ricoh Company, Ltd., light source for image irradiation being changed to a semiconductor laser of wavelength 655 nm, and the unit for coating lubricant being removed), then 100,000 sheets of paper in total were printed sequentially using a ground toner (Imagio Color toner type S, circularity 0.91) which being often employed in evaluation apparatuses; the initial images and 100,000 th printed images were evaluated. Further, the potential voltages at the illuminated parts were measured after the initial printing and the 100,000 th printing. Furthermore, the abrasion wears were evaluated from the difference of layer thicknesses between at the initial and the 100,000 th.

<Evaluation 5: Durable Life B>

As for the resulting inventive electrophotographic photoconductors 1 to 18 and comparative electrophotographic photoconductors 1 to 9, the respective photoconductors were mounted on modified-type Imagio Color 5100 (by Ricoh Company, Ltd., the toner being changed to that of Toner Production Example 1 described earlier, the light source for image irradiation being changed to a semiconductor laser of wavelength 655 nm, and the unit for coating lubricant being removed), then 100,000 sheets of paper in total were printed sequentially, and the initial images and 100,000 th printed images were evaluated. Further, the potential voltages at the illuminated parts were measured after the initial printing and the 100,000 th printing. Furthermore, the abrasion wears were evaluated from the difference of layer thicknesses between at the initial and the 100,000 th.

<Evaluation 6: Durable Life C>

As for the resulting inventive electrophotographic photoconductors 1 to 18 and comparative electrophotographic photoconductors 1 to 9, the respective photoconductors were mounted on Modified Imagio Color 8100 (by Ricoh Company, Ltd., the toner being changed to that of Toner Production Example 1), then 50,000 sheets of paper in total were printed sequentially, and the initial images and 50,000 th printed images were evaluated. Further, the potential voltages at the illuminated parts were measured after the initial printing and the 50,000 th printing. Furthermore, the abrasion wears were evaluated from the difference of layer thicknesses between at the initial and the 50,000 th.

TABLE D-1-1

| | | | | Durability Test A | | | | | | |
|---|---|---|---|---|---|---|---|---|---|---|
| | | | | Initial | | | Durability A: 100,0000 Sheets Printing | | | |
| Example | F-Resin Volume % *a) | F-Resin Covering Ratio *b) | Exemp. Comp. *c) | Skin-Friction *d) | Potential Illumi. (−V) *e) | Image Quality | Skin-Friction *d) | Potential Illumi. (−V) *e) | Image Quality | Abrasion Wear μm |
| Ex. D-1 | 39 | 20 | D-2-20 | 0.25 | 105 | A*1 | 0.26 | 120 | A*1 | 2.5 |
| Ex. D-2 | 21 | 14 | D-2-20 | 0.30 | 100 | A | 0.36 | 125 | A | 3.5 |
| Ex. D-3 | 60 | 31 | D-2-20 | 0.21 | 110 | A | 0.20 | 115 | A | 3.2 |
| Com. Ex. D-1 | 18 | 10 | D-2-20 | 0.33 | 95 | A | 0.50 | 140 | *2 | 4.1 |
| Com. Ex. D-2 | 65 | 35 | D-2-20 | 0.21 | 120 | A | 0.20 | 110 | *3 | 4.3 |
| Com. Ex. D-3 | 39 | 21 | — | 0.26 | 100 | A | 0.27 | 85 | *4 | 2.6 |
| Ex. D-4 | 39 | 19 | D-1-13 | 0.25 | 115 | A | 0.26 | 135 | A | 2.5 |
| Ex. D-5 | 39 | 20 | D-2-2 | 0.25 | 105 | A | 0.27 | 120 | A | 2.4 |
| Ex. D-6 | 39 | 21 | D-3-1 | 0.26 | 110 | A | 0.27 | 125 | A | 2.6 |
| Ex. D-7 | 39 | 19 | D-3-20 | 0.25 | 105 | A | 0.26 | 125 | A | 2.5 |
| Ex. D-8 | 39 | 20 | D-5-49 | 0.24 | 110 | A | 0.25 | 130 | A | 2.5 |
| Ex. D-9 | 39 | 18 | D-5-72 | 0.25 | 110 | A | 0.25 | 125 | A | 2.7 |
| Ex. D-10 | 39 | 20 | D-6-6 | 0.25 | 105 | A | 0.26 | 130 | A | 2.6 |
| Ex. D-11 | 39 | 19 | D-7-18 | 0.26 | 110 | A | 0.25 | 125 | A | 2.8 |
| Ex. D-12 | 39 | 20 | D-8-23 | 0.26 | 105 | A | 0.26 | 130 | A | 2.7 |
| Ex. D-13 | 39 | 21 | D-9-1 | 0.25 | 110 | A | 0.27 | 125 | A | 2.4 |
| Ex. D-14 | 39 | 19 | D-10-6 | 0.24 | 105 | A | 0.25 | 125 | A | 2.5 |

*1Good

*2: Occurrence of inferior cleaning from about 50,000 th printings

*3: Occurrence of image lags from about 80,000 th printings

*4: Occurrence of image lags from about 20,000 th printings

TABLE D-1-2

| | | | | Durability Test A | | | | | | |
|---|---|---|---|---|---|---|---|---|---|---|
| | | | | Initial | | | Durability A: 100,0000 Sheets Printing | | | |
| Example | F-Resin Volume % *a) | F-Resin Covering Ratio *b) | Exemp. Comp. *c) | Skin-Friction *d) | Potential Illumi. (−V) *e) | Image Quality | Skin-Friction *d) | Potential Illumi. (−V) *e) | Image Quality | Abrasion Wear μm |
| Ex. D-15 | 39 | 19 | D-10-21 | 0.25 | 110 | A*1 | 0.25 | 130 | A*1 | 2.7 |
| Ex. D-16 | 39 | 19 | D-11-2 | 0.25 | 110 | A | 0.26 | 135 | A | 2.6 |
| Ex. D-17 | 39 | 20 | D-11-20 | 0.24 | 110 | A | 0.26 | 120 | A | 2.5 |
| Ex. D-18 | 39 | 20 | D-12-4 | 0.26 | 105 | A | 0.26 | 125 | A | 2.7 |
| Ref. Ex. D-1 | 39 | 19 | *6 | 0.25 | 100 | A | 0.25 | 90 | *2 | 2.7 |
| Ref. Ex. D-2 | 39 | 20 | *7 | 0.26 | 100 | A | 0.26 | 90 | *2 | 2.7 |
| Ref. Ex. D-3 | 39 | 21 | *8 | 0.25 | 110 | A | 0.27 | 95 | *3 | 2.5 |
| Ref. Ex. D-4 | 39 | 20 | *9 | 0.27 | 115 | A | 0.30 | 100 | *4 | 2.4 |
| Ref. Ex. D-5 | 39 | 19 | *10 | 0.25 | 100 | A | 0.27 | 85 | *5 | 2.5 |
| Ref. Ex. D-6 | 39 | 19 | *11 | 0.26 | 100 | A | 0.27 | 90 | *3 | 2.5 |
| Ex. D-19 | 39 | 24 | D-2-20 | 0.19 | 120 | A | 0.21 | 140 | A | 2.1 |

*1Good
*2: Occurrence of image lags from about 40,000 th printings
*3: Occurrence of image lags from about 50,000 th printings
*4: Occurrence of image lags from about 60,000 th printings
*5: Occurrence of image lags from about 30,000 th printings
*6: 3,5-di-t-butyl-4-hydroxytoluene
*7: Sumiraizer MDP-S
*8: Sumiraizer TPM
*9: Sanol LS-2626
*10: MARK PEP-24
*11: IRGANOX-1330

The evaluation results shown in Tables D-1-1 and D-1-2 demonstrate that the inclusions of the fine particles of fluorine-contained resin in the range of 20 to 60% by volume as well as specific hydroxy compound into the outermost surface layer of the photoconductor make possible to maintain the lower skin-friction coefficient stably. Further, it is confirmed that the abrasion wear is reduced i.e. the abrasion resistance is remarkably improved. Further, the increase of the potential at the illuminated part is not significant even after the 100,000 th printing, the lag occurrence is not apparent in the photoconductors that were added specific hydroxy compounds, as such it is confirmed that high quality images may be obtained stably.

On the other hand, cleaning failures and/or lag occurrences were induced in the photoconductors that did not satisfy the range of 20 to 60% by volume of fine particles of fluorine-contained resin or that did not contain specific hydroxy compound.

TABLE D-2-1

| | | | | Durability Test B | | | | | | |
|---|---|---|---|---|---|---|---|---|---|---|
| | | | | Initial | | | Durability B: 100,0000 Sheets Printing | | | |
| Example | F-Resin Volume % *a) | F-Resin Covering Ratio *b) | Exemp. Comp. *c) | Skin-Friction *d) | Potential Illumi. (−V) *e) | Image Quality | Skin-Friction *d) | Potential Illumi. (−V) *e) | Image Quality | Abrasion Wear μm |
| Ex. D-1 | 39 | 20 | D-2-20 | 0.25 | 105 | A*1 | 0.25 | 115 | A*1 | 2.7 |
| Ex. D-2 | 21 | 14 | D-2-20 | 0.30 | 100 | A | 0.32 | 125 | *2 | 3.7 |
| Ex. D-3 | 60 | 31 | D-2-20 | 0.21 | 110 | A | 0.20 | 115 | A | 3.4 |
| Com. Ex. D-1 | 18 | 10 | D-2-20 | 0.33 | 95 | A | 0.53 | 140 | *3 | 6.2 |
| Com. Ex. D-2 | 65 | 35 | D-2-20 | 0.21 | 120 | A | 0.20 | 110 | *4 | 4.7 |
| Com. Ex. D-3 | 39 | 21 | — | 0.26 | 100 | A | 0.26 | 85 | *5 | 2.6 |
| Ex. D-4 | 39 | 19 | D-1-13 | 0.25 | 115 | A | 0.25 | 135 | A | 2.6 |
| Ex. D-5 | 39 | 20 | D-2-2 | 0.25 | 105 | A | 0.26 | 120 | A | 2.5 |
| Ex. D-6 | 39 | 21 | D-3-1 | 0.26 | 110 | A | 0.26 | 125 | A | 2.7 |
| Ex. D-7 | 39 | 19 | D-3-20 | 0.25 | 105 | A | 0.25 | 125 | A | 2.6 |
| Ex. D-8 | 39 | 20 | D-5-49 | 0.24 | 110 | A | 0.25 | 130 | A | 2.7 |
| Ex. D-9 | 39 | 18 | D-5-72 | 0.25 | 110 | A | 0.24 | 125 | A | 2.8 |
| Ex. D-10 | 39 | 20 | D-6-6 | 0.25 | 105 | A | 0.25 | 130 | A | 2.8 |
| Ex. D-11 | 39 | 19 | D-7-18 | 0.26 | 110 | A | 0.25 | 125 | A | 2.9 |
| Ex. D-12 | 39 | 20 | D-8-23 | 0.26 | 105 | A | 0.25 | 130 | A | 2.8 |

TABLE D-2-1-continued

| | | | | Durability Test B | | | | | | |
|---|---|---|---|---|---|---|---|---|---|---|
| | | | | Initial | | | Durability B: 100,0000 Sheets Printing | | | |
| Example | F-Resin Volume % *a) | F-Resin Covering Ratio *b) | Exemp. Comp. *c) | Skin-Friction *d) | Potential Illumi. (−V) *e) | Image Quality | Skin-Friction *d) | Potential Illumi. (−V) *e) | Image Quality | Abrasion Wear μm |
| Ex. D-13 | 39 | 21 | D-9-1 | 0.25 | 110 | A | 0.26 | 125 | A | 2.5 |
| Ex. D-14 | 39 | 19 | D-10-6 | 0.24 | 105 | A | 0.25 | 125 | A | 2.7 |

*[1]Good
*2: Occurrence of inferior cleaning from about 80,000 th printings
*3: Occurrence of inferior cleaning from about 30,000 th printings
*4: Occurrence of image lags from about 80,000 th printings
*5: Occurrence of image lags from about 20,000 th printings

TABLE D-2-2

| | | | | Durability Test B | | | | | | |
|---|---|---|---|---|---|---|---|---|---|---|
| | | | | Initial | | | Durability B: 100,0000 Sheets Printing | | | |
| Example | F-Resin Volume % *a) | F-Resin Covering Ratio *b) | Exemp. Comp. *c) | Skin-Friction *d) | Potential Illumi. (−V) *e) | Image Quality | Skin-Friction *d) | Potential Illumi. (−V) *e) | Image Quality | Abrasion Wear μm |
| Ex. D-15 | 39 | 19 | D-10-21 | 0.25 | 110 | A*[1] | 0.25 | 130 | A*[1] | 2.9 |
| Ex. D-16 | 39 | 19 | D-11-2 | 0.25 | 110 | A | 0.25 | 135 | A | 2.7 |
| Ex. D-17 | 39 | 20 | D-11-20 | 0.24 | 110 | A | 0.25 | 120 | A | 2.6 |
| Ex. D-18 | 39 | 20 | D-12-4 | 0.26 | 105 | A | 0.26 | 125 | A | 2.8 |
| Ref. Ex. D-1 | 39 | 19 | *6 | 0.25 | 100 | A | 0.25 | 90 | *2 | 2.9 |
| Ref. Ex. D-2 | 39 | 20 | *7 | 0.26 | 100 | A | 0.26 | 90 | *2 | 2.8 |
| Ref. Ex. D-3 | 39 | 21 | *8 | 0.25 | 110 | A | 0.26 | 95 | *3 | 2.7 |
| Ref. Ex. D-4 | 39 | 20 | *9 | 0.27 | 115 | A | 0.28 | 100 | *4 | 2.6 |
| Ref. Ex. D-5 | 39 | 19 | *10 | 0.25 | 100 | A | 0.26 | 85 | *5 | 2.7 |
| Ref. Ex. D-6 | 39 | 19 | *11 | 0.26 | 100 | A | 0.27 | 90 | *3 | 2.7 |
| Ex. D-19 | 39 | 24 | D-2-20 | 0.19 | 120 | A | 0.20 | 140 | A | 2.3 |

*[1]Good
*2: Occurrence of image lags from about 40,000 th printings
*3: Occurrence of image lags from about 50,000 th printings
*4: Occurrence of image lags from about 60,000 th printings
*5: Occurrence of image lags from about 30,000 th printings
*6: 3,5-di-t-butyl-4-hydroxytoluene
*7: Sumiraizer MDP-S
*8: Sumiraizer TPM
*9: Sanol LS-2626
*10: MARK PEP-24
*11: IRGANOX-1330

The results shown in Tables D-2-1 and D-2-2 demonstrate that that the inclusions of the fine particles of fluorine-contained resin in the range of 20 to 60% by volume as well as specific hydroxy compound into the outermost surface layer of the photoconductor make possible to maintain the lower skin-friction coefficient stably, even when a toner having substantially spherical shape is employed. Further, it is confirmed that the abrasion wear is reduced i.e. the abrasion resistance is remarkably improved. Further, the increase of the potential at the illuminated part is not significant even after the 100,000 th printing, the lag occurrence is not apparent in the photoconductors that were added specific hydroxy compounds, as such it is confirmed that high quality images may be obtained stably.

On the other hand, cleaning failures and/or lag occurrences were induced in the photoconductors that did not satisfy the range of 20 to is 60% by volume of fine particles of fluorine-contained resin or that did not contain a specific compound.

TABLE D-3-1

| Example | F-Resin Volume % *a) | F-Resin Covering Ratio *b) | Exemp. Comp. *c) | Durability Test C: Initial Skin-Friction *d) | Initial Potential Illumi. (−V) *e) | Initial Image Quality | Durability C: 100,0000 Sheets Printing Skin-Friction *d) | Durability C: 100,0000 Sheets Printing Potential Illumi. (−V) *e) | Durability C: 100,0000 Sheets Printing Image Quality | Durability C: 100,0000 Sheets Printing Abrasion Wear μm |
|---|---|---|---|---|---|---|---|---|---|---|
| Ex. D-1 | 39 | 20 | D-2-20 | 0.25 | 125 | A*1 | 0.28 | 135 | A*1 | 2.8 |
| Ex. D-2 | 21 | 14 | D-2-20 | 0.30 | 120 | A | 0.34 | 135 | *2 | 3.5 |
| Ex. D-3 | 60 | 31 | D-2-20 | 0.21 | 130 | A | 0.24 | 125 | A | 4.3 |
| Com. Ex. D-1 | 18 | 10 | D-2-20 | 0.33 | 115 | A | 0.60 | 145 | *3 | 6.0 |
| Com. Ex. D-2 | 65 | 35 | D-2-20 | 0.21 | 140 | A | 0.22 | 115 | *4 | 5.2 |
| Com. Ex. D-3 | 39 | 21 | — | 0.26 | 120 | A | 0.28 | 80 | *5 | 3.0 |
| Ex. D-4 | 39 | 19 | D-1-13 | 0.25 | 135 | A | 0.26 | 145 | A | 3.1 |
| Ex. D-5 | 39 | 20 | D-2-2 | 0.25 | 125 | A | 0.26 | 130 | A | 2.9 |
| Ex. D-6 | 39 | 21 | D-3-1 | 0.26 | 130 | A | 0.27 | 135 | A | 2.8 |
| Ex. D-7 | 39 | 19 | D-3-20 | 0.25 | 125 | A | 0.26 | 145 | A | 2.9 |
| Ex. D-8 | 39 | 20 | D-5-49 | 0.24 | 130 | A | 0.26 | 150 | A | 2.9 |
| Ex. D-9 | 39 | 18 | D-5-72 | 0.25 | 130 | A | 0.27 | 145 | A | 3.0 |
| Ex. D-10 | 39 | 20 | D-6-6 | 0.25 | 125 | A | 0.27 | 140 | A | 3.1 |
| Ex. D-11 | 39 | 19 | D-7-18 | 0.26 | 130 | A | 0.27 | 140 | A | 3.2 |
| Ex. D-12 | 39 | 20 | D-8-23 | 0.26 | 125 | A | 0.28 | 145 | A | 3.2 |
| Ex. D-13 | 39 | 21 | D-9-1 | 0.25 | 130 | A | 0.26 | 140 | A | 2.9 |
| Ex. D-14 | 39 | 19 | D-10-6 | 0.24 | 125 | A | 0.26 | 135 | A | 3.0 |

*1Good
*2: Occurrence of inferior cleaning from about 40,000 th printings
*3: Occurrence of inferior cleaning from about 20,000 th printings
*4: Occurrence of image lags from about 40,000 th printings
*5: Occurrence of image lags from about 10,000 th printings

TABLE D-3-2

| Example | F-Resin Volume % *a) | F-Resin Covering Ratio *b) | Exemp. Comp. *c) | Durability Test C: Initial Skin-Friction *d) | Initial Potential Illumi. (−V) *e) | Initial Image Quality | Durability B: 100,0000 Sheets Printing Skin-Friction *d) | Durability B: 100,0000 Sheets Printing Potential Illumi. (−V) *e) | Durability B: 100,0000 Sheets Printing Image Quality | Durability B: 100,0000 Sheets Printing Abrasion Wear μm |
|---|---|---|---|---|---|---|---|---|---|---|
| Ex. D-15 | 39 | 19 | D-10-21 | 0.25 | 130 | A*1 | 0.26 | 140 | A*1 | 3.4 |
| Ex. D-16 | 39 | 19 | D-11-2 | 0.25 | 130 | A | 0.27 | 145 | A | 3.1 |
| Ex. D-17 | 39 | 20 | D-11-20 | 0.24 | 130 | A | 0.26 | 140 | A | 3.0 |
| Ex. D-18 | 39 | 20 | D-12-4 | 0.26 | 125 | A | 0.28 | 145 | A | 3.2 |
| Ref. Ex. D-1 | 39 | 19 | *6 | 0.25 | 120 | A | 0.26 | 85 | *2 | 3.3 |
| Ref. Ex. D-2 | 39 | 20 | *7 | 0.26 | 120 | A | 0.27 | 85 | *2 | 3.3 |
| Ref. Ex. D-3 | 39 | 21 | *8 | 0.25 | 130 | A | 0.27 | 90 | *3 | 3.1 |
| Ref. Ex. D-4 | 39 | 20 | *9 | 0.27 | 125 | A | 0.28 | 95 | *3 | 3.0 |
| Ref. Ex. D-5 | 39 | 19 | *10 | 0.25 | 120 | A | 0.27 | 80 | *2 | 3.2 |
| Ref. Ex. D-6 | 39 | 19 | *11 | 0.26 | 120 | A | 0.28 | 85 | *4 | 3.1 |
| Ex. D-19 | 39 | 24 | D-2-20 | 0.19 | 140 | A | 0.22 | 150 | A | 2.5 |

*1Good
*2: Occurrence of image lags from about 20,000 th printings
*3: Occurrence of image lags from about 40,000 th printings
*4: Occurrence of image lags from about 30,000 th printings
*6: 3,5-di-t-butyl-4-hydroxytoluene
*7: Sumiraizer MDP-S
*8: Sumiraizer TPM
*9: Sanol LS-2626
*10: MARK PEP-24
*11: IRGANOX-1330

The results shown in Tables D-3-1 to D-3-2 demonstrate that that the inclusions of the fine particles of fluorine-contained resin in the range of 20 to 60% by volume as well as specific hydroxy compound into the outermost surface layer of the photoconductor make possible to maintain the lower skin-friction coefficient stably, even when a toner having substantially spherical shape is employed. Further, it is confirmed that the abrasion wear is reduced i.e. the abrasion resistance is remarkably improved. Further, the increase of the potential at the illuminated part was not significant even after the 50,000 th printing, the lag occurrence was not apparent in the photoconductors that were added specific hydroxy compounds, as such it is confirmed that high quality images may be obtained stably.

On the other hand, cleaning failures and/or lag occurrences were induced in the photoconductors that did not satisfy the range of 20 to 60% by volume of fine particles of fluorine-contained resin or that did not contain a specific compound.

What is claimed is:

1. An electrophotographic photoconductor, comprising:

a photoconductive layer, a protective layer, and a conductive support, wherein the protective layer is disposed as the outermost layer of the photoconductive layer, and 20% by volume to 60% by volume of fine particles of fluorine-contained resin and at least one compound selected from the group consisting of amine aromatic compounds and hydroxy aromatic compounds are incorporated into the protective layer;

wherein said fine particles of fluorine-contained resin having 0.3 to 0.4 μm of secondary particle diameter cover an area of the photoconductor in the range of 10 to 60%.

2. The electrophotographic photoconductor according to claim 1, wherein the amine aromatic compounds are the compounds expressed by the general formulas (1) to (22), and (25) to (8):

General Formula (1)

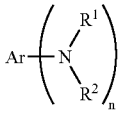

in the general formula (1), $R^1$ and $R^2$ are each an alkyl group having 1 to 4 carbon atoms, may be unsubstituted or substituted by an aromatic hydrocarbon group, and may be identical or different; or $R^1$ and $R^2$ may combine each other to form a heterocyclic ring group containing a nitrogen atom; n is an integer of 1 to 4; Ar is a substituted or unsubstituted aromatic ring group;

General Formula (2)

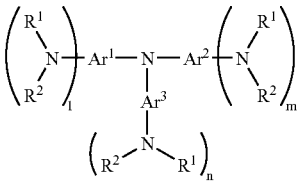

in the general formula (2), $R^1$ and $R^2$ are each an alkyl group having 1 to 4 carbon atoms, may be unsubstituted or substituted by an aromatic hydrocarbon group, and may be identical or different; or $R^1$ and $R^2$ may combine each other to form a heterocyclic ring group containing a nitrogen atom; l, m, n are each an integer of 0 to 3, wherein all of l, m, n being not 0 together with; $Ar^1$, $Ar^2$, and $Ar^3$ are each a substituted or unsubstituted aromatic ring group and may be identical or different; the respective $Ar^1$ and $Ar^2$, $Ar^2$ and $Ar^3$, $Ar^3$ and $Ar^1$ may combine each other to form a heterocyclic ring group containing a nitrogen atom;

General Formula (3)

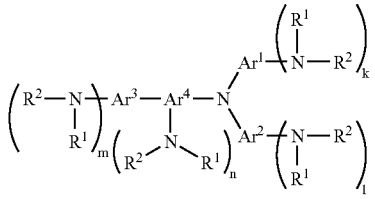

in the general formula (3), $R^1$ and $R^2$ are each an alkyl group having 1 to 4 carbon atoms, may be unsubstituted or substituted by an aromatic hydrocarbon group, and may be identical or different; or $R^1$ and $R^2$ may combine each other to form a heterocyclic ring group containing a nitrogen atom; k, l, m, n are each an integer of 0 to 3, wherein all of k, l, m, n being not 0 together with; $Ar^1$, $Ar^2$, $Ar^3$ and $Ar^4$ are each a substituted or unsubstituted aromatic ring group and may be identical or different; the respective $Ar^1$ and $Ar^2$, $Ar^1$ and $Ar^4$, $Ar^3$ and $Ar^4$ may combine each other to form a ring;

General Formula (4)

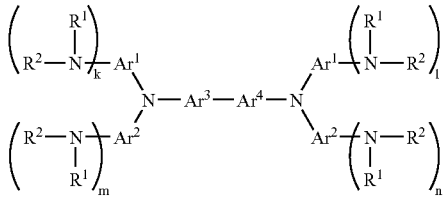

in the general formula (4), $R^1$ and $R^2$ are each an alkyl group having 1 to 4 carbon atoms, may be unsubstituted or substituted by an aromatic hydrocarbon group, and may be identical or different; or $R^1$ and $R^2$ may combine each other to form a heterocyclic ring group containing a nitrogen atom; k, l, m, n are each an integer of 0 to 3, wherein all of k, l, m, n being not 0 together with; $Ar^1$, $Ar^2$, $Ar^3$ and $Ar^4$ are each a substituted or unsubstituted aromatic ring group and may be identical or different; the respective $Ar^1$ and $Ar^2$, $Ar^1$ and $Ar^4$, $Ar^3$ and $Ar^4$ may combine each other to form a ring;

General Formula (5)

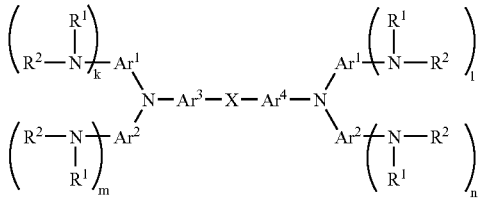

in the general formula (5), $R^1$ and $R^2$ are each an alkyl group having 1 to 4 carbon atoms, may be unsubstituted or substituted by an aromatic hydrocarbon group, and may be identical or different; or $R^1$ and $R^2$ may combine each other to form a heterocyclic ring group containing a nitrogen atom; k, l, m, n are each an integer of 0 to 3, wherein all of k, l, m, n being not 0 together with; $Ar^1$, $Ar^2$, $Ar^3$ and $Ar^4$ are each a substituted or unsubstituted aromatic ring group and may be identical or different; the respective $Ar^1$ and $Ar^2$, $Ar^1$ and $Ar^3$, $Ar^1$ and $Ar^4$ may combine each other to form a ring; X is one of divalent group or atom of methylene group, cyclohexylidene group, oxygen and sulfur;

General Formula (6)

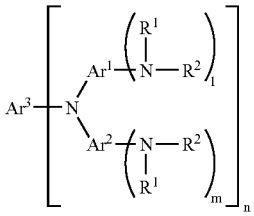

in the general formula (6), $R^1$ and $R^2$ are each an alkyl group having 1 to 4 carbon atoms, may be unsubstituted or substituted by an aromatic hydrocarbon group, and may be identical or different; or $R^1$ and $R^2$ may combine each other to form a heterocyclic ring group containing a nitrogen atom; l and m are each an integer of 0 to 3, wherein both of l and m being not 0 together with; $Ar^1$, $A^2$, and $Ar^3$ are each a substituted or unsubstituted aromatic ring group and may be identical or different; the respective $Ar^1$ and $Ar^2$, $Ar^1$ and $Ar^3$ may combine each other to form a ring:; n is an integer of 1 to 4;

General Formula (7)

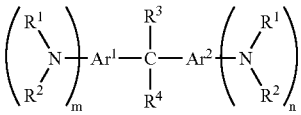

in the general formula (7), $R^1$ and $R^2$ are each an alkyl group having 1 to 4 carbon atoms, may be unsubstituted or substituted by an aromatic hydrocarbon group, and may be identical or different; or $R^1$ and $R^2$ may combine each other to form a heterocyclic ring group containing a nitrogen atom; m and n are each an integer of 0 to 3, wherein both of m and n being not 0 together with; $R^3$ and $R^4$ are each a hydrogen atom, substituted or unsubstituted alkyl group having 1 to 11 carbon atoms, substituted or unsubstituted aromatic ring group or heterocyclic ring group, and may be identical or different; $Ar^1$ and $Ar^2$ are each a substituted or unsubstituted aromatic ring group and may be identical or different; at least one of $Ar^1$, $Ar^2$, $R^3$ and $R^4$ is an aromatic ring group or heterocyclic ring group;

General Formula (8)

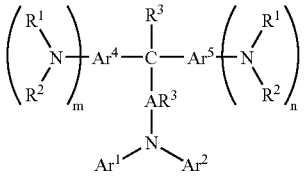

in the general formula (8), $R^1$ and $R^2$ are each an alkyl group having 1 to 4 carbon atoms, may be unsubstituted or substituted by an aromatic hydrocarbon group, and may be identical or different; or $R^1$ and $R^2$ may combine each other to form a heterocyclic ring group containing a nitrogen atom; m and n are each an integer of 0 to 3, wherein both of m and n being not 0 together with; $R^3$ is a hydrogen atom, substituted or unsubstituted alkyl group having 1 to 11 carbon atoms, or substituted or unsubstituted aromatic ring group; $Ar^1$, $Ar^2$, $Ar^3$, $Ar^4$ and $Ar^5$ are each a substituted or unsubstituted aromatic ring group and may be identical or different; the respective $Ar^1$ and $Ar^2$, $Ar^1$ and $Ar^3$ may combine each other to form a heterocyclic ring containing a nitrogen atom;

General Formula (9)

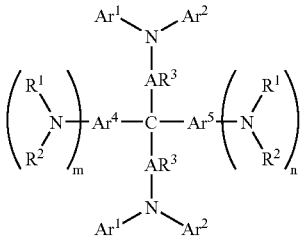

in the general formula (9), $R^1$ and $R^2$ are each an alkyl group having 1 to 4 carbon atoms, may be unsubstituted or substituted by an aromatic hydrocarbon group, and may be identical or different; or $R^1$ and $R^2$ may combine each other to form a heterocyclic ring group containing a nitrogen atom; m and n are each an integer of 0 to 3, wherein both of m and n being not 0 together with; $Ar^1$, $Ar^2$, $Ar^3$, $Ar^4$ and $Ar^5$ are each a substituted or unsubstituted aromatic ring group and may be identical or different; the respective $Ar^1$ and $Ar^2$, $Ar^1$ and $Ar^3$ may combine each other to form a heterocyclic ring containing a nitrogen atom;

General Formula (10)

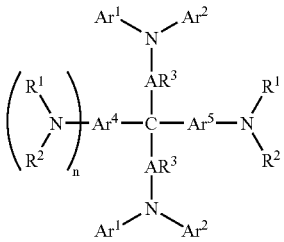

in the general formula (10), $R^1$ and $R^2$ are each an alkyl group having 1 to 4 carbon atoms, may be unsubstituted or substituted by an aromatic hydrocarbon group, and may be identical or different; or $R^1$ and $R^2$ may combine each other to form a heterocyclic ring group containing a nitrogen atom; n is an integer of 1 to 3; $Ar^1$, $Ar^2$, $Ar^3$ and $Ar^4$ are each a substituted or unsubstituted aromatic ring group and may be identical or different; the respective $Ar^1$ and $Ar^2$, $Ar^1$ and $Ar^3$ may combine each other to form a heterocyclic ring containing a nitrogen atom;

General Formula (11)

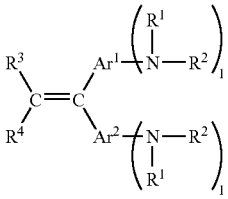

in the general formula (11), $R^1$ and $R^2$ are each an alkyl group having 1 to 4 carbon atoms, may be unsubstituted or substituted by an aromatic hydrocarbon group, and may be identical or different; or $R^1$ and $R^2$ may combine each other to form a heterocyclic ring group containing a nitrogen atom; l is an integer of 1 to 3; $Ar^1$ and $Ar^2$ are each a substituted or unsubstituted aromatic ring group and may be identical or different; $R^3$ and $R^4$ are each a hydrogen atom, unsubstituted or substituted alkyl group having 1 to 4 carbon atoms, unsubstituted or substituted aromatic ring group, or the group expressed by the following general formula (23), General Formula (23)

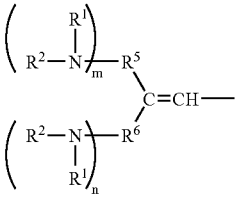

in the general formula (23), $R^1$ and $R^2$ are each an alkyl group having 1 to 4 carbon atoms, may be unsubstituted or substituted by an aromatic hydrocarbon group, and may be identical or different; or $R^1$ and $R^2$ may combine each other to form a heterocyclic ring group containing a nitrogen atom; m and n are each an integer of 0 to 3; $R^5$ and $R^6$ are each a hydrogen atom, unsubstituted or substituted alkyl or alkylene group having 1 to 4 carbon atoms, or unsubstituted or substituted aromatic ring group, and may be identical or different; the respective $R^3$ and $R^4$, $R^5$ and $R^6$, $Ar^1$ and $Ar^2$ may combine each other to form a ring;

General Formula (12)

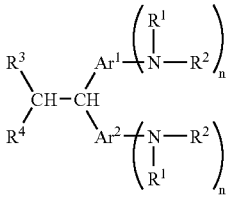

in the general formula (12), $R^1$ and $R^2$ are each an alkyl group having 1 to 4 carbon atoms, may be unsubstituted or substituted by an aromatic hydrocarbon group, and may be identical or different; or $R^1$ and $R^2$ may combine each other to form a heterocyclic ring group containing a nitrogen atom; n is an integer of 1 to 3; $Ar^1$ and $Ar^2$ are each a substituted or unsubstituted aromatic ring group and may be identical or different; $R^3$ and $R^4$ are each a hydrogen atom, unsubstituted or substituted alkyl group having 1 to 4 carbon atoms, unsubstituted or substituted aromatic ring group, or the group expressed by the following general formula (24), and may be identical or different, wherein $R^3$ and $R^4$ are not each a hydrogen atom together with; the respective $R^3$, $R^4$, $Ar^1$, and $Ar^2$ may combine each other to form a ring;

General Formula (24)

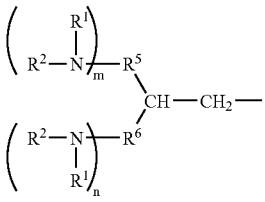

in the general formula (24), $R^1$ and $R^2$ are each an alkyl group having 1 to 4 carbon atoms, may be unsubstituted or substituted by an aromatic hydrocarbon group, and may be identical or different; or $R^1$ and $R^2$ may combine each other to form a heterocyclic ring group containing a nitrogen atom; m and n are each an integer of 0 to 3; $R^5$ and $R^6$ are each a hydrogen atom, substituted or unsubstituted alkyl or alkylene group having 1 to 4 carbon atoms, or substituted or unsubstituted aromatic ring group, and may be identical or different, the respective $R^5$ and $R^6$ may combine each other to form a ring;

General Formula (13)

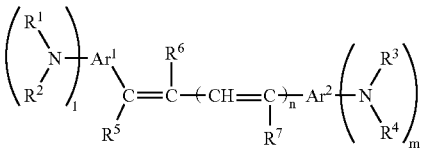

in the general formula (13), $R^1$ and $R^2$ are each an alkyl group having 1 to 4 carbon atoms, may be unsubstituted or substituted by an aromatic hydrocarbon group, and may be identical or different; or $R^1$ and $R^2$ may com bine each other to form a heterocyclic ring group containing a nitrogen atom; $R^3$ and $R^4$ are each a substituted or unsubstituted alkyl group having 1 to 4 carbon atoms or a substituted or unsubstituted aromatic ring group, and may be identical or different; $R^5$, $R^6$ and $R^7$ are each a hydrogen atom, substituted or unsubstituted alkyl group having 1 to 4 carbon atoms, or substituted or unsubstituted aromatic ring group, and may be identical or different; the respective $R^3$ and $R^4$, $Ar^2$ and $R^4$ may combine each other to form a ring containing a nitrogen atom; $Ar^1$ and $R^5$ may combine each other to form a ring; l is an integer of 1 to 3, m is an integer of 0 to 3, n is an integer of 0 or 1;

General Formula (14)

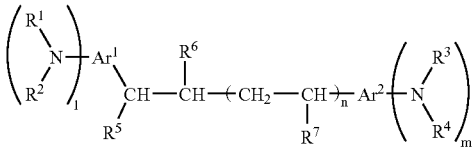

in the general formula (14), $R^1$ and $R^2$ are each an alkyl group having 1 to 4 carbon atoms, may be unsubstituted or substituted by an aromatic hydrocarbon group, and may be identical or different; or $R^1$ and $R^2$ may combine each other to form a heterocyclic ring group containing a nitrogen atom; $R^3$ and $R^4$ are each a substituted or unsubstituted alkyl group having 1 to 4 carbon atoms or a substituted or unsubstituted aromatic ring group, and may be identical or different; $R^5$, $R^6$ and $R^7$ are each a hydrogen atom, substituted or unsubstituted alkyl group having 1 to 4 carbon atoms, or substituted or unsubstituted aromatic ring group; $Ar^1$ and $Ar^2$ are each a substituted or unsubstituted aromatic ring group, and may be identical or different; the respective $R^3$ and $R^4$, $Ar^2$ and $R^4$ may combine each other to form a ring containing a nitrogen atom; $Ar^1$ and $R^5$ may combine each other to form a ring; l is an integer of 1 to 3, m is an integer of 0 to 3, n is an integer of 0 or 1;

General Formula (15)

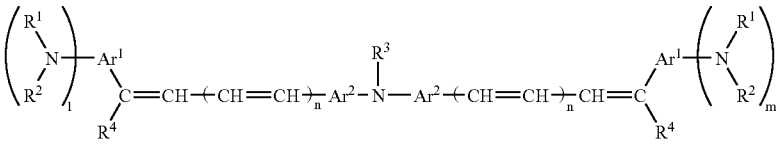

in the general formula (15), $R^1$ and $R^2$ are each an alkyl group having 1 to 4 carbon atoms, may be unsubstituted or substituted by an aromatic hydrocarbon group, and may be identical or different; or $R^1$ and $R^2$ may combine each other to form a heterocyclic ring group containing a nitrogen atom; l and m are each an integer of 0 to 3, wherein both of l and m being not 0 together with; $R^3$ is a substituted or unsubstituted alkyl group having 1 to 4 carbon atoms or a substituted or usubstituted aromatic ring group; $R^4$ is a hydrogen atom, a substituted or unsubstituted alkyl group having 1 to 4 carbon atoms, or a substituted or unsubstituted aromatic ring group; $Ar^1$ and $Ar^2$ are each a substituted or unsubstituted aromatic ring group; the respective $Ar^1$ and $R^4$, $Ar^2$ and $R^3$, $Ar^2$ and $Ar^2$ may combine each other to form a ring; n is an integer of 0 or 1;

General Formula (16)

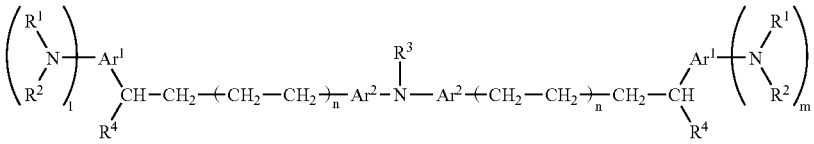

in the general formula (16), $R^1$ and $R^2$ are each an alkyl group having 1 to 4 carbon atoms, may be unsubstituted or substituted by an aromatic hydrocarbon group, and may be identical or different; or $R^1$ and $R^2$ may combine each other to form a heterocyclic ring group containing a nitrogen atom; l and m are each an integer of 0 to 3, wherein both of l and m being not 0 together with; $R^3$ is a substituted or unsubstituted alkyl group having 1 to 4 carbon atoms or a substituted or unsubstituted aromatic ring group; $R^4$ is a hydrogen atom, a substituted or unsubstituted alkyl group having 1 to 4 carbon atoms, or a substituted or unsubstituted aromatic ring group; $Ar^1$ and $Ar^2$ are each a substituted or unsubstituted aromatic ring group; the respective $Ar^1$ and $R^4$, $Ar^2$ and $R^3$, $Ar^2$ and $Ar^2$ may combine each other to form a ring; n is an integer of 0 or General Formula (17)

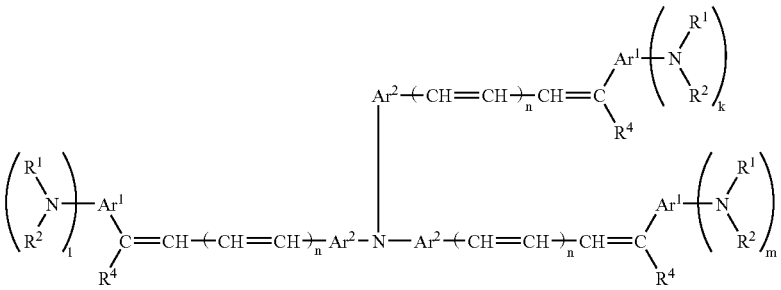

in the general formula (17), $R^1$ and $R^2$ are each an alkyl group having 1 to 4 carbon atoms, may be unsubstituted or substituted by an aromatic hydrocarbon group, and may be identical or different; or $R^1$ and $R^2$ may combine each other to form a heterocyclic ring group containing a nitrogen atom; k, l, m are each an integer of 0 to 3, wherein all of k, l, m being not 0 together with; $R^4$ is a hydrogen atom, a substituted or unsubstituted alkyl group having 1 to 4 carbon atoms, or a substituted or unsubstituted aromatic ring group; $Ar^1$ and $Ar^2$ are each a substituted or unsubstituted aromatic ring group; the respective $Ar^1$ and $R^4$, $Ar^2$ and $Ar^2$ may combine each other to form a ring; n is an integer of 0 or 1;

General Formula (18)

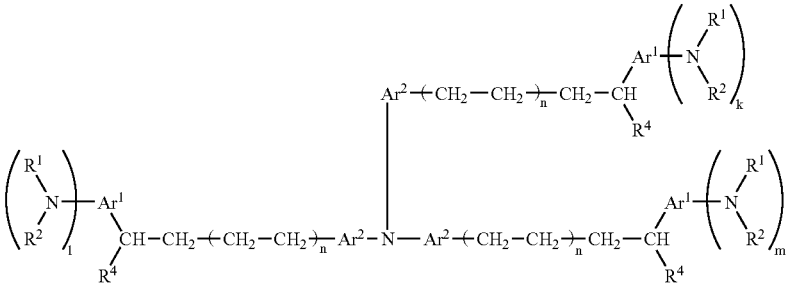

in the general formula (18), $R^1$ and $R^2$ are each an alkyl group having 1 to 4 carbon atoms, may be unsubstituted or substituted by an aromatic hydrocarbon group, and may be identical or different; or $R^1$ and $R^2$ may combine each other to form a heterocyclic ring group containing a nitrogen atom; k, l, m are each an integer of 0 to 3, wherein all of k, l, m being not 0 together with; $R^4$ is a hydrogen atom, a substituted or unsubstituted alkyl group having 1 to 4 carbon atoms, or a substituted or unsubstituted aromatic ring group; $Ar^1$ and $Ar^2$ are each a substituted or unsubstituted aromatic ring group; the respective $Ar^1$ and $R^4$, $Ar^2$ and $Ar^2$ may combine each other to form a ring; n is an integer of 0 or 1;

General Formula (19)

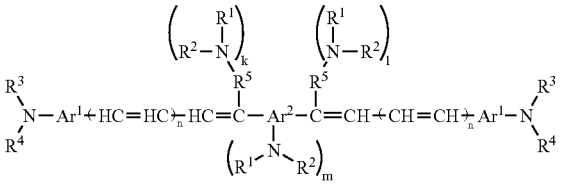

in the general formula (19), $R^1$ and $R^2$ are each an alkyl group having 1 to 4 carbon atoms, may be unsubstituted or substituted by an aromatic hydrocarbon group, and may be identical or different; or $R^1$ and $R^2$ may combine each other to form a heterocyclic ring group containing a nitrogen atom; $R^3$ and $R^4$ are each a substituted or unsubstituted alkyl group having 1 to 4 carbon atoms or a substituted or unsubstituted aromatic ring group, and may be identical or different; $R^5$ is a hydrogen atom, a substituted or unsubstituted alkyl group having 1 to 4 carbon atoms, or a substituted or unsubstituted aromatic ring group; $Ar^1$ and $Ar^2$ are each a substituted or unsubstituted aromatic ring group; the respective $R^3$ and $R^4$, $Ar^1$ and $R^4$ may combine each other to form a heterocyclic ring group containing a nitrogen atom; k, l, m are each an integer of 0 to 3, n is an integer of 1 or 2; when all of k, l, m are 0 together with, $R^3$ and $R^4$ are each an alkyl group having 1 to 4 carbon atoms, and may be identical or different, and $R^3$ and $R^4$ may combine each other to form a heterocyclic ring containing a nitrogen atom;

General Formula (20)

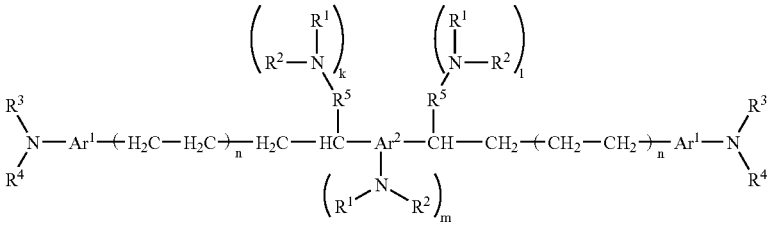

in the general formula (20), $R^1$ and $R^2$ are each an alkyl group having 1 to 4 carbon atoms, may be unsubstituted or substituted by an aromatic hydrocarbon group, and may be identical or different; or $R^1$ and $R^2$ may combine each other to form a heterocyclic ring group containing a nitrogen atom; $R^3$ and $R^4$ are each a substituted or unsubstituted alkyl group having 1 to 4 carbon atoms or a substituted or unsubstituted aromatic ring group, and may be identical or different; $R^5$ is a hydrogen atom, a substituted or unsubstituted alkyl group having 1 to 4 carbon atoms, or a substituted or unsubstituted aromatic ring group; $Ar^1$ and $Ar^2$ are each a substituted or unsubstituted aromatic ring group; the respective $R^3$ and $R^4$, $Ar^1$ and $R^4$ may combine each other to form a heterocyclic ring group containing a nitrogen atom; m is an integer of 0 to 4, n is an integer of 1 or 2; when m is 0, $R^3$ and $R^4$ are each an alkyl group having 1 to 4 carbon atoms, and may be identical or different, and $R^3$ and $R^4$ may combine each other to form a heterocyclic ring containing a nitrogen atom;

General Formula (21)

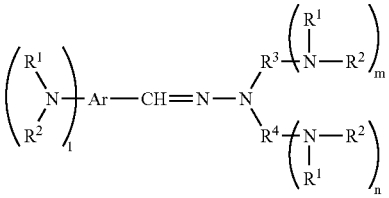

in the general formula (21), $R^1$ and $R^2$ are each an alkyl group having 1 to 4 carbon atoms, may be unsubstituted or substituted by an aromatic hydrocarbon group, and may be identical or different; or $R^1$ and $R^2$ may combine each other to form a heterocyclic ring group containing a nitrogen atom; Ar is a substituted or unsubstituted aromatic ring group;

$R^3$ and $R^4$ are each a hydrogen atom, a substituted or unsubstituted alkyl or alkylene group having 1 to 4 carbon atoms, or a substituted or unsubstituted aromatic ring group; l, m, n are each an integer of 0 to 3, wherein all of l, m, n are not 0 together with;

General Formula (22)

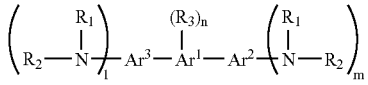

in the general formula (22), $R^1$ and $R^2$ are each an alkyl group having 1 to 4 carbon atoms, may be unsubstituted or substituted by an aromatic hydrocarbon group, and may be identical or different; or $R^1$ and $R^2$ may combine each other to form a heterocyclic ring group containing a nitrogen atom; $Ar^1$ is a substituted or unsubstituted aromatic ring group or heterocyclic ring group; $Ar^2$ and $Ar^3$ are each a substituted or unsubstituted aromatic ring group; $R^3$ is a hydrogen atom, a substituted or unsubstituted alkyl having 1 to 4 carbon atoms, or a substituted or unsubstituted aromatic ring group; l, m are each an integer of 0 to 3, wherein both of l and m are not 0 together with; n is an integer of 1 to 3;

General Formula (25)

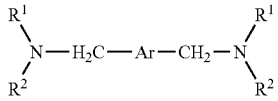

in the general formula (25), $R^1$ and $R^2$ are each a substituted or unsubstituted alkyl group, or a substituted or unsubstituted aromatic hydrocarbon group, may be identical or different, wherein at least one of $R_1$ and $R^2$ is a substituted or unsubstituted aromatic hydrocarbon group; $R^1$ and $R^2$ may combine each other to form a substituted or unsubstituted heterocyclic ring group containing a nitrogen atom; Ar is substituted or unsubstituted aromatic hydrocarbon group;

General Formula (26)

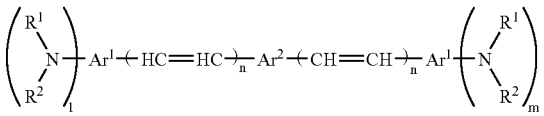

in the general formula (26), $R^1$ and $R^2$ are each an alkyl group having 1 to 4 carbon atoms, may be substituted by an aromatic hydrocarbon group, and may be identical or different; $R^1$ and $R^2$ may combine each other to form a heterocyclic ring group containing a nitrogen atom; $Ar^1$ and $Ar^2$ are each a substituted or unsubstituted aromatic ring group; l and m are each an integer of 0 to 3, wherein both of l and m are not 0 together with; n is an integer of 1 or 2;

General Formula (27)

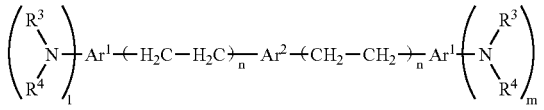

in the general formula (27), $R^1$ and $R^2$ are each an alkyl group having 1 to 4 carbon atoms, may be substituted by an aromatic hydrocarbon group, and may be identical or different; $R^1$ and $R^2$ may combine each other to form a substituted or unsubstituted heterocyclic ring group containing a nitrogen atom; $Ar^1$ and $Ar^2$ are each a substituted or unsubstituted aromatic ring group; l and m are each an integer of 0 to 3, wherein both of l and m are not 0 together with; n is an integer of 1 or 2;

General Formula (28)

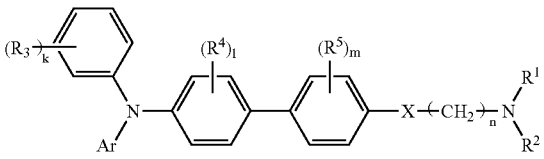

in the general formula (28), $R^1$ and $R^2$ are each a substituted or unsubstituted alkyl group, or a substituted or unsubstituted aromatic hydrocarbon group, may be identical or different; or $R^1$ and $R^2$ may combine each other to form a substituted or unsubstituted heterocyclic ring group containing a nitrogen atom; $R^3$, $R^4$, and $R^5$ are each a substituted or unsubstituted alkyl group, alkoxy group, or halogen atom; Ar is substituted or unsubstituted aromatic hydrocarbon group, or aromatic heterocyclic ring group; X is an oxygen atom, sulfur atom, or bond thereof, n is an integer of 2 to 4, k, l, m are each an integer of 0 to 3.

3. The electrophotographic photoconductor according to claim 1, wherein the hydroxy aromatic compounds are the compounds expressed by the general formulas (101) to (112):

General Formula (101)

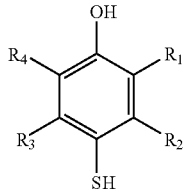

in the general formula (101), $R^1$, $R^2$, $R^3$ and $R^4$ are each a hydrogen atom, halogen atom, hydroxy group, substituted or unsubstituted alkyl group, substituted or unsubstituted alkenyl group, substituted or unsubstituted aryl group, substituted or unsubstituted cycloalkyl group, substituted or unsubstituted alkoxy group, substituted or unsubstituted aryloxy group, substituted or unsubstituted alkylthio group, substituted or unsubstituted arylthio group, substituted amino group, imino group, heterocyclic group, sulfoxide group, sulfonyl group, acyl group, or azo group;

General Formula (102)

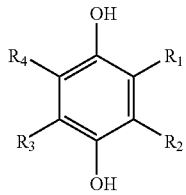

in the general formula (102), $R^1$, $R^2$, $R^3$ and $R^4$ are each a hydrogen atom, halogen atom, substituted or unsubstituted alkyl group, substituted or unsubstituted alkenyl group, substituted or unsubstituted cycloalkyl group, substituted or unsubstituted alkoxy group, substituted or unsubstituted aryloxy group, alkylthio group, arylthio group, alkylamino group, arylamino group, acyl group, alkylacylamino group, arylacylamino group, alkylcarbamoyl group, arylcarbamoyl group, alkylsulfonamido group, arylsulfonamido group, alkylsulfamoyl group, arylsulfamoyl group, alkylsulfonyl group, arylsulfonyl group, alkyloxycarbonyl group, aryloxycarbonyl group, alkylacyloxy group, arylacyloxy group, silyl group, or heterocyclic group, wherein at least one of $R^1$, $R^2$, $R^3$ and $R^4$ is a group having 4 or more carbon atoms in total;

General Formula (103)

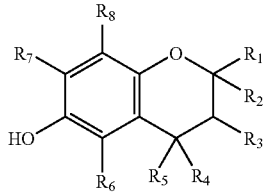

in the general formula (103), $R^1$, $R^2$, $R^3$, $R^4$, $R^5$, $R^6$, $R^7$ and $R^8$ are each a hydrogen atom, hydroxy group, halogen atom, substituted or unsubstituted alkyl group, substituted or unsubstituted alkenyl group, substituted or unsubstituted aryl group, substituted or unsubstituted cycloalkyl group, substituted or unsubstituted alkoxy group, substituted or unsubstituted aryloxy group, substituted or unsubstituted amino group, substituted or unsubstituted imino group, substituted or unsubstituted heterocyclic ring group, substituted or unsubstituted alkylthio group, substituted or unsubstituted arylthio group, substituted or unsubstituted acyl group, substituted or unsubstituted sulfonyl group, substituted or unsubstituted phosphonyl group, or substituted or unsubstituted carbamoyl group;

General Formula (104)

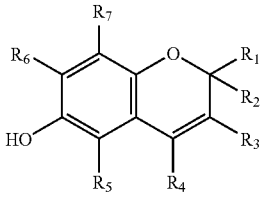

in the general formula (104), $R^1$, $R^2$, $R^3$, $R^4$, $R^5$, $R^6$ and $R^7$ are each a hydrogen atom, hydroxy group, halogen atom, substituted or unsubstituted alkyl group, substituted or unsubstituted alkenyl group, substituted or unsubstituted aryl group, substituted or unsubstituted cycloalkyl group, substituted or unsubstituted alkoxy group, substituted or unsubstituted aryloxy group, substituted or unsubstituted amino group, substituted or unsubstituted imino group, substituted or unsubstituted heterocyclic ring group, substituted or unsubstituted alkylthio group, substituted or unsubstituted arylthio group, substituted or unsubstituted acyl group, substituted or unsubstituted sulfonyl group, substituted or unsubstituted phosphonyl group, or substituted or unsubstituted carbamoyl group;

General Formula (105)

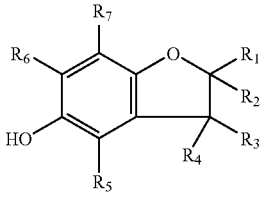

in the general formula (105), $R^1$, $R^2$, $R^3$, $R^4$, $R^5$, $R^6$, and $R^7$ are each a hydrogen atom, hydroxy group, halogen atom, substituted or unsubstituted alkyl group, substituted or unsubstituted alkenyl group, substituted or unsubstituted aryl group, substituted or unsubstituted cycloalkyl group, substituted or unsubstituted alkoxy group, substituted or unsubstituted aryloxy group, substituted or unsubstituted amino group, substituted or unsubstituted imino group, substituted or unsubstituted heterocyclic ring group, substituted or unsubstituted alkylthio group, substituted or unsubstituted arylthio group, substituted or unsubstituted acyl group, substituted or unsubstituted sulfonyl group, substituted or unsubstituted phosphonyl group, or substituted or unsubstituted carbamoyl group;

General Formula (106)

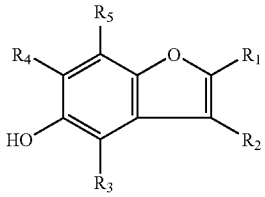

in the general formula (106), $R^1$, $R^2$, $R^3$, $R^4$ and $R^5$ are each a hydrogen atom, hydroxy group, halogen atom, substituted or unsubstituted alkyl group, substituted or unsubstituted alkenyl group, substituted or unsubstituted aryl group, substituted or unsubstituted cycloalkyl group, substituted or unsubstituted alkoxy group, substituted or unsubstituted aryloxy group, substituted or unsubstituted amino group, substituted or unsubstituted imino group, substituted or unsubstituted heterocyclic ring group, substituted or unsubstituted alkylthio group, substituted or unsubstituted arylthio group, substituted or unsubstituted acyl group, substituted or unsubstituted sulfonyl group, substituted or unsubstituted phosphonyl group, or substituted or unsubstituted carbamoyl group;

General Formula (107)

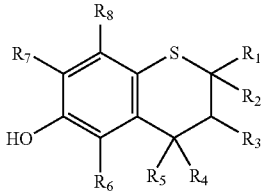

in the general formula (107), $R^1$, $R^2$, $R^3$, $R^4$, $R^5$, $R^6$, $R^7$ and $R^8$ are each a hydrogen atom, hydroxy group, halogen atom, substituted or unsubstituted alkyl group, substituted or unsubstituted alkenyl group, substituted or unsubstituted aryl group, substituted or unsubstituted cycloalkyl group, substituted or unsubstituted alkoxy group, substituted or unsubstituted aryloxy group, substituted amino group, imino group, heterocyclic ring group, substituted or unsubstituted alkylthio group or arylthio group, acyl group, sulfonyl group, phosphonyl group, or carbamoyl group;

General Formula (108)

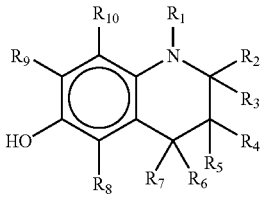

General Formula (109)

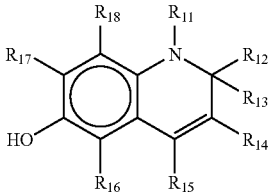

in the general formulas (108) and (109), $R^1$, $R^2$, $R^3$, $R^4$, $R^5$, $R^6$, $R^7$, $R^8$, $R^9$ and $R^{10}$, and $R^{11}$, $R^{12}$, $R^{13}$, $R^{14}$, $R^{15}$, $R^{16}$, $R^{17}$ and $R^{18}$ are each a hydrogen atom, halogen atom, hydroxy group, substituted or unsubstituted alkyl group, substituted or unsubstituted alkenyl group, substituted or unsubstituted aryl group, substituted or unsubstituted cycloalkyl group, substituted or unsubstituted alkoxy group, substituted or unsubstituted aryloxy group, substituted amino group, imino group, heterocyclic ring group, substituted or unsubstituted alkylthio group or arylthio group, sulfoxide group, sulfonyl group, acyl group, or azo group;

General Formula (110)

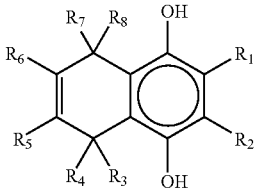

General Formula (111)

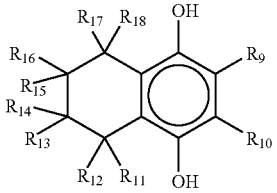

in the general formulas (110) and (111), $R^1$, $R^2$, $R^3$, $R^4$, $R^5$, $R^6$, $R^7$ and $R^8$, and $R^9$, $R^{10}$, $R^{11}$, $R^{12}$, $R^{13}$, $R^{14}$, $R^{15}$, $R^{16}$, $R^{17}$ and $R^{18}$ are each a hydrogen atom, halogen atom, hydroxy group, substituted or unsubstituted alkyl group, substituted or unsubstituted alkenyl group, substituted or unsubstituted aryl group, substituted or unsubstituted cycloalkyl group, substituted or unsubstituted alkoxy group, substituted or unsubstituted aryloxy group, substituted amino group, imino group, heterocyclic ring group, substituted or unsubstituted alkylthio group or arylthio group, sulfoxide group, sulfonyl group, acyl group, or azo group;

General Formula (112)

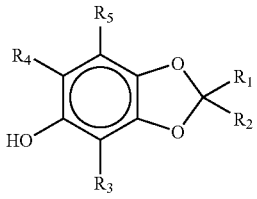

in the general formula (112), $R^1$, $R^2$, $R^3$, $R^4$ and $R^5$ are each a hydrogen atom, halogen atom, hydroxy group, substituted or unsubstituted alkyl group, substituted or unsubstituted alkenyl group, substituted or unsubstituted aryl group, substituted or unsubstituted cycloalkyl group, substituted or unsubstituted alkoxy group, substituted or unsubstituted aryloxy group, substituted amino group, imino group, heterocyclic ring group, substituted or unsubstituted alkylthio group or arylthio group, sulfoxide group, sulfonyl group, acyl group, or azo group.

4. An electrophotographic process, comprising:

charging an electrophotographic photoconductor, exposing the charged electrophotographic photoconductor to a recording light to form an electrostatic latent image, developing the electrostatic latent image by means of a developing agent to form a toner image, and transferring the toner image onto a transfer material, wherein the electrophotographic photoconductor comprises a photoconductive layer, a protective layer, and a conductive support, wherein the protective layer is disposed as the outermost layer of the photoconductive layer, and 20% by volume to 60% by volume of fine particles of fluorine-contained resin and at least one compound selected from the group consisting of amine aromatic compounds and hydroxy aromatic compounds are incorporated into the protective layer;

wherein said fine particles of fluorine-contained resin having 0.3 to 0.4 μm of secondary particle diameter cover an area of the photoconductor in the range of 10 to 60%.

5. The electrophotographic process according to claim 4, wherein the exposing is carried out through recording the electrostatic latent image on the electrophotographic photoconductor by one of light emitting diode and semiconductor laser.

6. The electrophotographic process according to claim 4, wherein at least one of charging roller, cleaning blade, cleaning brush, intermediate transferring belt, and the other members adapted to deform or elongate the fine particles of fluorine-contained resin on the surface of the electrophotographic photoconductor is brought into contact with the surface of the electrophotographic photoconductor.

7. The electrophotographic process according to claim 4, wherein the transferring is carried out through forming a primary color image by duplicating plural images having respective colors on an intermediate-transferring body, then transferring entirely the primary color image onto a recording material.

8. The electrophotographic process according to claim 4, wherein the toner has substantially a spherical shape.

9. An electrophotographic apparatus, comprising:

a charging unit configured to charge an electrophotographic photoconductor, an exposing unit configured to expose the charged electrophotographic photoconductor to a recording light to form an electrostatic latent image, a developing unit configured to develop the electrostatic latent image by means of a developing agent to form a toner image, and a transferring unit configured to transfer the toner image onto a transfer material, wherein the electrophotographic photoconductor comprises a photoconductive layer, and a conductive support, and 20% by volume to 60% by volume of fine particles of fluorine-contained resin and at least one compound selected from the group consisting of amine aromatic compounds and hydroxy aromatic compounds are incorporated into the outermost layer of the photoconductive layer;

wherein said fine particles of fluorine-contained resin having 0.3 to 0.4 μm of secondary particle diameter cover an area of the photoconductor in the range of 10 to 60%.

10. The electrophotographic apparatus according to claim 9, wherein the exposing unit comprises one of light emitting diode and semiconductor laser, and the image forming is carried out in digital manner.

11. The electrophotographic apparatus according to claim 9, wherein the electrophotographic apparatus is equipped with plural electrophotographic photoconductors, charging units, developing units, and transferring units in a tandem-type construction.

12. The electrophotographic apparatus according to claim 9, wherein the electrophotographic apparatus is equipped with at least one member selected from charging roller, cleaning blade, cleaning brush, intermediate transferring belt, and the other members, and wherein the member is adapted to deform or elongate the fine particles of fluorine-contained resin on the surface of the electrophotographic photoconductor, and the member is brought into contact with the surface of the electrophotographic photoconductor.

13. The electrophotographic apparatus according to claim 9, wherein the transferring unit involves an intermediate transferring unit where a primary color image is formed by duplicating plural images having respective colors on an intermediate-transferring body, then the primary color image is transferred entirely onto a recording material.

14. A process cartridge for an electrophotographic apparatus, comprising:

one or more of a charging unit configured to charge an electrophotographic photoconductor, an exposing unit configured to expose the charged electrophotographic photoconductor to a recording light, a developing unit configured to develop the electrostatic latent image by means of a developing agent, a cleaning unit configured to clean the residual toner on the electrophotographic photoconductor, and a transferring unit configured to transfer the toner image onto a transfer material, and an electrophotographic photoconductor comprising a photoconductive layer, a protective layer, and a conductive support, wherein the protective layer is disposed as the outermost layer of the photoconductive layer, and 20% by volume to 60% by volume of fine particles of fluorine-contained resin and at least one compound selected from the group consisting of amine aromatic compounds and hydroxy aromatic compounds are incorporated into the protective layer;

wherein said fine particles of fluorine-contained resin having 0.3 to 0.4 μm of secondary particle diameter cover an area of the photoconductor in the range of 10 to 60%.

15. The electrophotographic photoconductor according to claim 1, wherein a thickness of the protective layer is 0.1 to 10 μm.

16. The electrophotographic process according to claim 4, wherein a thickness of the protective layer of said photoconductor is 0.1 to 10 μm.

17. The electrophotographic apparatus according to claim 9, wherein a thickness of the protective layer of said photoconductor is 0.1 to 10 μm.

18. The process cartrdge according to claim 14, wherein a thickness of the protective layer of said photoconductor is 0.1 to 10 μm.

19. The electrophotographic photoconductor according to claim 1, wherein the photoconductive layer comprises a charge generating and a charge transport layer.

20. The electrophotographic process according to claim 4, wherein the photoconductive layer of said photoconductor comprises a charge generating and a charge transport layer.

21. The electrophotographic apparatus according to claim 9, wherein the photoconductive layer of said photoconductor comprises a charge generating and a charge transport layer.

22. The process cartrdge according to claim 14, wherein the photoconductive layer of said photoconductor comprises a charge generating and a charge transport layer.

* * * * *